US011016438B2

(12) United States Patent
Kamoshida et al.

(10) Patent No.: US 11,016,438 B2
(45) Date of Patent: May 25, 2021

(54) CARTRIDGE, PHOTOSENSITIVE MEMBER UNIT AND ELECTROPHOTOGRAPHIC IMAGE FORMING APPARATUS

(71) Applicant: CANON KABUSHIKI KAISHA, Tokyo (JP)

(72) Inventors: Shigemi Kamoshida, Tokyo (JP); Takuya Kawakami, Tokyo (JP); Hiroki Ogino, Mishima (JP); Kazuhiko Kanno, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/931,481

(22) Filed: Jul. 17, 2020

(65) Prior Publication Data

US 2020/0401079 A1 Dec. 24, 2020

Related U.S. Application Data

(60) Division of application No. 15/659,034, filed on Jul. 25, 2017, now Pat. No. 10,795,311, which is a (Continued)

(30) Foreign Application Priority Data

Feb. 5, 2015 (JP) ..... 2015-021649
Feb. 4, 2016 (JP) ..... 2016-020213

(51) Int. Cl.
*G03G 21/18* (2006.01)
*G03G 21/16* (2006.01)
*G03G 15/00* (2006.01)

(52) U.S. Cl.
CPC ..... *G03G 21/1842* (2013.01); *G03G 21/186* (2013.01); *G03G 21/1853* (2013.01); (Continued)

(58) Field of Classification Search
CPC ..... G03G 15/757; G03G 21/1642; G03G 21/1647; G03G 21/1857; G03G 21/186; (Continued)

(56) References Cited

U.S. PATENT DOCUMENTS 5,729,796 A 3/1998 Miura et al.
5,768,658 A 6/1998 Watanabe et al.
(Continued)

FOREIGN PATENT DOCUMENTS

CN 101916055 A 12/2010
CN 203573085 U 4/2014
(Continued)

OTHER PUBLICATIONS

Feb. 18, 2017 Taiwanese Official Action in Taiwanese Patent Appln. No. 105104161.
(Continued)

*Primary Examiner* — Erika J Villaluna
(74) *Attorney, Agent, or Firm* — Venable LLP

(57) ABSTRACT

A cartridge is detachably mountable to a main assembly of an electrophotographic image forming apparatus. The cartridge includes a rotatable member capable of carrying developer, the rotatable member being rotatable about a rotational axis thereof. The cartridge also includes a coupling member provided at one end portion of the cartridge with respect to a rotational axis direction of the rotatable member, the coupling member including at least one projection and being configured to transmit a rotational force to the rotatable member. A holding member holds the coupling member, and two pins support the holding member, with each of the two pins including a shaft portion elongated in a direction substantially perpendicular to the rotational axis of the rotatable member and the two pins being disposed substantially parallel to each other.

88 Claims, 99 Drawing Sheets

Related U.S. Application Data continuation of application No. PCT/JP2016/054209, filed on Feb. 5, 2016.

(52) U.S. Cl.
CPC ..... *G03G 21/1857* (2013.01); *G03G 21/1864* (2013.01); *G03G 15/757* (2013.01); *G03G 21/1647* (2013.01); *G03G 2221/1657* (2013.01)

(58) Field of Classification Search
CPC ..... G03G 21/1864; G03G 21/1842; G03G 21/1853
See application file for complete search history.

(56) References Cited

U.S. PATENT DOCUMENTS

| | | | |
|---|---|---|---|
| 5,815,644 | A | 9/1998 | Nishiuwatoko et al. |
| 5,870,655 | A | 2/1999 | Nishiuwatoko et al. |
| 5,893,006 | A | 4/1999 | Kanno et al. |
| 5,926,666 | A | 7/1999 | Miura et al. |
| 5,937,240 | A | 8/1999 | Kanno et al. |
| 5,940,657 | A | 8/1999 | Yokomori et al. |
| 5,950,049 | A | 9/1999 | Yokomori et al. |
| 6,070,029 | A | 5/2000 | Nishiuwatoko et al. |
| 6,072,969 | A | 6/2000 | Yokomori et al. |
| 6,345,164 | B1 | 2/2002 | Yokomori et al. |
| 6,381,430 | B1 | 4/2002 | Yokomori et al. |
| 6,496,667 | B2 | 12/2002 | Shiratori et al. |
| 6,516,168 | B2 | 2/2003 | Shiratori et al. |
| 6,560,422 | B2 | 5/2003 | Kanno et al. |
| 6,681,088 | B2 | 1/2004 | Kanno et al. |
| 6,735,403 | B2 | 5/2004 | Kanno et al. |
| 6,834,173 | B2 | 12/2004 | Yamaguchi et al. |
| 6,937,834 | B2 | 8/2005 | Kanno et al. |
| 6,947,687 | B2 | 9/2005 | Yamaguchi et al. |
| 6,961,528 | B2 | 11/2005 | Yamaguchi et al. |
| 6,980,759 | B2 | 12/2005 | Kanno et al. |
| 7,058,337 | B2 | 6/2006 | Hashimoto et al. |
| 7,079,787 | B2 | 7/2006 | Ogino et al. |
| 7,127,192 | B2 | 10/2006 | Batori et al. |
| 7,184,686 | B2 | 2/2007 | Kanno et al. |
| 7,418,225 | B2 | 8/2008 | Morioka et al. |
| 7,463,844 | B2 | 12/2008 | Hashimoto et al. |
| 7,756,441 | B2 | 7/2010 | Kanno et al. |
| 7,929,881 | B2 | 4/2011 | Yoshino et al. |
| 7,933,534 | B2 | 4/2011 | Hoshi et al. |
| 8,059,988 | B2 | 11/2011 | Kanno et al. |
| 8,090,292 | B2 | 1/2012 | Kanno et al. |
| 8,155,557 | B2 | 4/2012 | Kanno et al. |
| 8,170,444 | B2 | 5/2012 | Kanno et al. |
| 8,170,445 | B2 | 5/2012 | Kanno et al. |
| 8,208,830 | B2 | 6/2012 | Uratani et al. |
| 8,385,775 | B2 | 2/2013 | Kanno et al. |
| 8,437,661 | B2 | 5/2013 | Kanno et al. |
| 8,494,410 | B2 | 7/2013 | Kanno et al. |
| 8,577,252 | B2 | 11/2013 | Anan et al. |
| 8,682,211 | B2 | 3/2014 | Hoshi et al. |
| 8,805,237 | B2 | 8/2014 | Kanno et al. |
| 9,025,998 | B2 | 5/2015 | Morioka et al. |
| 9,213,267 | B2 | 12/2015 | Hoshi et al. |
| 9,274,499 | B2 | 3/2016 | Morioka et al. |
| 9,291,994 | B2 | 3/2016 | Kanno et al. |
| 9,310,762 | B2 | 4/2016 | Kanno et al. |
| 9,395,679 | B2 | 7/2016 | Kawakai et al. |
| 9,429,877 | B2 | 8/2016 | Sato et al. |
| 9,715,191 | B2 | 7/2017 | Ogino et al. |
| 9,720,374 | B2 | 8/2017 | Kanno et al. |
| 9,727,021 | B2 | 8/2017 | Fukui et al. |
| 9,804,560 | B2 | 10/2017 | Sato et al. |
| 2007/0059038 | A1 | 3/2007 | Shiraki |
| 2010/0054823 | A1 | 3/2010 | Takasaka et al. |
| 2010/0135692 | A1 | 6/2010 | Abe et al. |
| 2010/0189462 | A1 | 7/2010 | Kawashima et al. |
| 2010/0278559 | A1* | 11/2010 | Komatsu ..... G03G 21/1647 399/167 |
| 2011/0038649 | A1 | 2/2011 | Miyabe et al. |
| 2011/0159970 | A1 | 6/2011 | Okabe |
| 2012/0243905 | A1 | 9/2012 | Uratani et al. |
| 2013/0287448 | A1 | 10/2013 | Baker et al. |
| 2015/0050048 | A1* | 2/2015 | Huang ..... G03G 15/757 399/167 |
| 2015/0220020 | A1 | 8/2015 | Hayashi et al. |
| 2016/0154376 | A1 | 6/2016 | Xiao et al. |
| 2016/0246250 | A1 | 8/2016 | Kamoshida et al. |
| 2016/0306320 | A1 | 10/2016 | Kawakami et al. |
| 2016/0370757 | A1 | 12/2016 | Sato et al. |
| 2017/0003645 | A1 | 1/2017 | Kawakami et al. |
| 2017/0146952 | A1* | 5/2017 | Ikeda ..... G03G 21/1864 |

FOREIGN PATENT DOCUMENTS

| | | | |
|---|---|---|---|
| JP | H10-171304 | A | 6/1998 |
| JP | 2007-079139 | A | 3/2007 |
| JP | 2009-134284 | A | 6/2009 |
| JP | 2011-133682 | A | 7/2011 |
| JP | 2011-145670 | A | 7/2011 |
| JP | 2013-238815 | A | 11/2013 |
| JP | 2014-112265 | A | 6/2014 |
| KR | 20110015451 | A | 2/2011 |
| RU | 2 540 091 | C1 | 1/2015 |

OTHER PUBLICATIONS

Communication in European Patent Application No. 17189323.3, dated Feb. 16, 2018.
Decision to Grant in Russian Patent Application No. 2018136246, dated May 15, 2019 (with English translation).
Notice of Allowance in Korean Patent Application No. 10-2017-7021411, dated Aug. 12, 2019.
Oct. 15, 2019 Office Action in Chilean Patent Application No. 201701970.
Notice of Allowance in Korean Patent Application No. 10-2019-7033289, dated Feb. 7, 2020.
Dec. 17, 2019 Decision to Grant in Russian Patent Application No. 2019122169.
Feb. 7, 2020 Notice of Allowance in Korean Patent Application No. 10-2019-7033289.
Mar. 17, 2020 Examination Report in Indian Patent Application No. 201747030853.
Apr. 30, 2020 Office Action in Taiwanese Patent Application No. 107140810.
Jun. 30, 2020 Office Action in Brazilian Patent Application No. BR112017016420-5 (with partial English translation).
International Search Report and Written Opinion for International Patent Application No. PCT/JP2016/054209.
Extended Search Report dated Oct. 1, 2018 in European Patent Application No. 18 179 267.2.
Decision to Grant in Russian Patent Application No. 2017131060, dated Aug. 1, 2018 (with English translation).
Extended Search Report in European Patent Application No. 16 746 742.2, dated Oct. 17, 2018.
Notice of Allowance in Taiwanese Patent Application No. 10613435, dated Oct. 19, 2018.
Sep. 29, 2019 Office Action in Chinese Patent Application No. 201680014245.7 (with English translation).
Communication in European Patent Application No. 17 189 323.3, dated Mar. 26, 2019.
Jul. 14, 2020 Notice of Acceptance in Australian Patent Application No. 2019200100.
Jul. 27, 2020 Notice of Allowance in Korean Patent Application No. 10-2020-7012838.
Notice of Acceptance dated Dec. 4, 2020 in counterpart Russian Application No. 2020108224/28, together with English translation thereof.
Feb. 22, 2021 Search and Examination Report in United Arab Emirates Patent Application No. P6000963/2017.

(56) References Cited

OTHER PUBLICATIONS

Apr. 7, 2021 Notice of Allowance in European Patent Application No. 16 746 742.2

* cited by examiner (a)

(b)

(a)

(b)

(a)

(b)

(a)

(b)

(a)

(b)

(a)

(b)

(a)

(b)

(a)

(b)

(a)

(b)

(a)

(b)

(a)

(b)

(c)

(a)

(b)

(a)

(b)

(a)

(b)

(a)

(b)

(a)

(b)

(a)

(b)

CARTRIDGE, PHOTOSENSITIVE MEMBER UNIT AND ELECTROPHOTOGRAPHIC IMAGE FORMING APPARATUS

FIELD OF THE INVENTION

The present invention relates to a cartridge, a photosensitive member unit and an electrophotographic image forming apparatus to which said cartridge and/or said photosensitive member unit are dismountably mountable.

The electrophotographic image forming apparatus includes an electrophotographic copying machine, an electrophotographic printer (laser beam printer, LED printer or the like) and so on, for example.

The process cartridge is a unit which includes an image bearing member (photosensitive member) and at least one of process means actable on the image bearing member which are unified into a cartridge detachably mountable to a main assembly of the electrophotographic image forming apparatus. The process means includes developing means, charging means, cleaning means or the like. An example of the process cartridge may be a unit which includes the image bearing member and the charging means as the process means which are unified into a cartridge. Another example may be a unit which includes the image bearing member and the charging means and the cleaning means as the process means which are unified into a cartridge. Further example may be a unit which includes the image bearing member and the developing means, the charging means and the cleaning means as the process means which are unified into a cartridge.

The cartridge and the photosensitive member unit can be mounted to and dismounted from the main assembly of the electrophotographic image forming apparatus by the user. Therefore, maintenance of the apparatus can be carried out in effect by the user without relying on a service person. Thus, the maintenance operation for the electrophotographic image forming apparatus is improved.

BACKGROUND ART

A conventional main assembly of the electrophotographic image forming apparatus is not provided with a mechanism for moving a main assembly side engaging portion for transmitting the rotational force to a rotatable member such as the image bearing member in a direction of a rotational axis direction thereof by opening and closing operation of a main assembly cover. A process cartridge is known which is dismountable from the main assembly in a predetermined direction substantially perpendicular to a rotational axis of the rotatable member. As a rotational force transmission means engageable with the main assembly side engaging portion to transmit the rotational force to the rotatable member, a cartridge side engaging portion (coupling member) provided in the process cartridge is known. For example, in a non-structure (JP 2009-134284), the coupling member is made movably in the rotational axis direction thereof, so that upon the mounting and demounting operation of the process cartridge relative to the main assembly, the engagement and disengagement of the coupling member is accomplished.

SUMMARY OF THE INVENTION

Problem to be Solved

The present invention provides a further development, and provides a cartridge or photosensitive member unit which is dismountable from the main assembly without deteriorating usability performance in a predetermined direction substantially perpendicular to the rotational axis of the rotatable member, the main assembly being not provided with the mechanism for moving the main assembly side engaging portion in the rotational axis direction in response to the opening and closing operation of the main assembly cover of the main assembly. In addition, the present invention provides an electrophotographic image forming apparatus from which the cartridge and/or the photosensitive member unit is dismountable.

Means for Solving the Problem

According to an aspect of the present invention, there is provided, as a first invention, a cartridge dismountable from a main assembly of the electrophotographic image forming apparatus including a rotatable main assembly side engaging portion, said cartridge comprising:

i) a rotatable member capable of carrying a developer and having a rotational axis extending in a direction substantially perpendicular to a dismounting direction of said cartridge; and ii) a coupling member provided at one end portion of said cartridge with respect to the rotational axis to transmit a rotational force from the main assembly engaging portion to said rotatable member, said coupling member being movable between a first position in which the rotational axis of said coupling member is substantially parallel with the rotational axis of said rotatable member, and a second position in which the rotational axis of said coupling member is substantially parallel with the rotational axis of said rotatable member and in which said coupling member is displaced from the first position in a direction perpendicular to the rotational axis of said rotatable member and is displaced from the first position in a direction of the rotational axis of said rotatable member toward the other end portion of said cartridge.

According to another aspect of the present invention, there is provided a photosensitive member unit dismountable from a main assembly of the electrophotographic image forming apparatus including a rotatable main assembly side engaging portion, said photosensitive member unit comprising:

i) a photosensitive member having a rotational axis extending in a direction substantially perpendicular to the dismounting direction of said photosensitive member unit; and ii) a coupling member provided at one end portion of said photosensitive member to transmit a rotational force to said photosensitive member from the main assembly engaging portion, said coupling member being movable between a first position in which a rotational axis of said coupling member is substantially aligned with the rotational axis of said photosensitive member, and a second position in which the rotational axis of said coupling member is substantially parallel with the rotational axis of said photosensitive member and in which said coupling member is displaced from the first position toward the other end portion of said photosensitive member in a direction of the rotational axis of said photosensitive member.

According to a further aspect of the present invention, there is provided a cartridge detachably mountable to a main assembly of a electrophotographic image forming apparatus, said cartridge comprising:

i) a rotatable member capable of carrying a developer; and ii) a coupling member provided at one end of said cartridge with respect to a rotational axis direction of said rotatable member to transmit a rotational force to said rotatable member, said coupling member and being movable between a first position in which a rotational axis of said coupling member is substantially parallel with the rotational axis of said rotatable member, and a second position in which the rotational axis of said coupling member is substantially parallel with the rotational axis of said rotatable member and in which said coupling member is displaced from the first position in a direction substantially perpendicular to the rotational axis of said rotatable member and is displaced from the first position in a direction of the rotational axis of said rotatable member toward the other end portion of said cartridge.

According to a further aspect of the present invention, there is provided a cartridge detachably mountable to a main assembly of a electrophotographic image forming apparatus, said cartridge comprising:

i) a rotatable member capable of carrying a developer; and ii) a rotational force transmission member, provided at another end of said rotatable member with respect to a longitudinal direction thereof, for transmitting a rotational force to said rotatable member; and iii) a coupling member, provided on said rotational force transmission member, for transmitting the rotational force to said rotational force transmission member, said coupling member being movable toward the other end portion in the longitudinal direction of said rotatable member with movement of a rotational axis of said coupling member away from the rotational axis of said rotational force transmission member while maintaining substantial parallelism with the rotational axis of said rotational force transmission member.

According to a further aspect of the present invention, there is provided a photosensitive member unit usable with a process cartridge detachably mountable to a main assembly of the electrophotographic image forming apparatus, said photosensitive member unit comprising:

i) a photosensitive member; and ii) a coupling member provided at one longitudinal end of said photosensitive member to transmit a rotational force to said photosensitive member, said coupling member and being movable between a first position in which a rotational axis of said photosensitive member is substantially aligned with a rotational axis of said coupling member and a second position in which the rotational axis of said photosensitive member and the rotational axis of said coupling member are spaced from each other and substantially parallel with each other and in which said coupling member is displaced from the first position toward the other longitudinal end of said photosensitive member.

According to a further aspect of the present invention, there is provided a photosensitive member unit usable with a process cartridge detachably mountable to a main assembly of the electrophotographic image forming apparatus, said photosensitive member unit comprising:

i) a photosensitive member; and ii) a flange provided at one longitudinal end of said photosensitive member to transmit a rotational force to said photosensitive member;

iii) a coupling member which is mounted on said flange so as to be movable while maintaining substantial parallelism between a rotational axis of said flange and a rotational axis of said coupling member to transmit the rotational force to said flange, wherein said coupling member receives a force from said flange to move toward the other longitudinal end of said photosensitive member with such movement of said coupling member that the rotational axis of said coupling member is away from the rotational axis of said flange from the state in which they are substantially aligned with each other.

According to a further aspect of the present invention, there is provided a cartridge mountable to a main assembly of the electrophotographic image forming apparatus including a rotatable main assembly side engaging portion, said cartridge comprising:

i) a rotatable member capable of carrying a developer and having a rotational axis extending in a direction substantially perpendicular to a mounting direction of said cartridge; and ii) a coupling member provided at one end portion of said cartridge with respect to the rotational axis to transmit a rotational force from the main assembly engaging portion to said rotatable member, said coupling member being movable between a first position in which the rotational axis of said coupling member is substantially parallel with the rotational axis of said rotatable member, and a second position in which the rotational axis of said coupling member is substantially parallel with the rotational axis of said rotatable member and in which said coupling member is displaced from the first position in a direction perpendicular to the rotational axis of said rotatable member and is displaced from the first position in a direction of the rotational axis of said rotatable member toward the other end portion of said cartridge.

According to a further aspect of the present invention, there is provided a photosensitive member unit mountable to a main assembly of the electrophotographic image forming apparatus including a rotatable main assembly side engaging portion, said photosensitive member unit comprising:

i) a photosensitive member having a rotational axis substantially perpendicular to a mounting direction of said photosensitive member unit;

ii) a coupling member provided at one end portion of said photosensitive member to transmit a rotational force to said photosensitive member from the main assembly engaging portion, said coupling member being movable between a first position in which a rotational axis of said coupling member is substantially aligned with the rotational axis of said photosensitive member, and a second position in which the rotational axis of said coupling member is substantially parallel with the rotational axis of said photosensitive member and in which said coupling member is displaced from the first position toward the other end portion of said photosensitive member in a direction of the rotational axis of said photosensitive member.

Effect of the Invention

According to the present invention, there is provided an cartridge or photosensitive member unit which is dismountable (or mountable) from the main assembly without deteriorating usability performance in a predetermined direction substantially perpendicular to the rotational axis of the rotatable member, the main assembly being not provided with the mechanism for moving the main assembly side engaging portion in the rotational axis direction in response to the opening and closing operation of the main assembly cover of the main assembly. In addition, the present invention provides an electrophotographic image forming apparatus from which the cartridge and/or the photosensitive member unit is dismountable or to which the cartridge and/or the photosensitive member unit is mountable.

DESCRIPTION OF THE EMBODIMENTS

Figure 1:
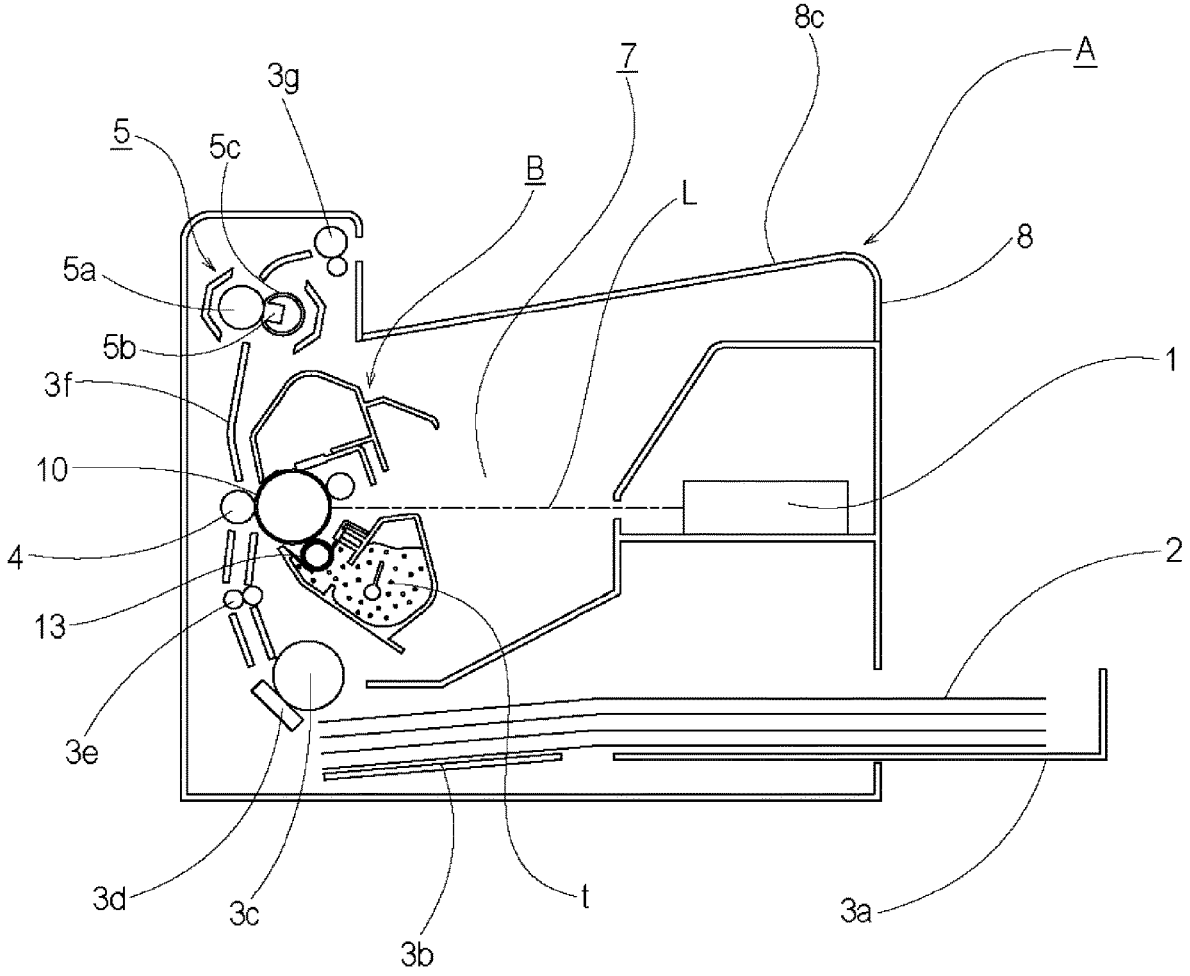
FIG. 1 is a schematic sectional side view of an electrophotographic image forming apparatus according to a first embodiment of the present invention.

Referring to the accompanying drawings, a cartridge and an electrophotographic image forming apparatus according to the present invention will be described. As the electrophotographic image forming apparatus, a laser beam printer is taken, and as the cartridge, a process cartridge for the laser beam printer will be taken. In following description, a widthwise direction of the process cartridge is a direction in which the process cartridge is mounted to and dismounted from a process cartridge and is a feeding direction of a recording material. A longitudinal direction of the process cartridge is substantially perpendicular to the mounting and dismounting direction of the process cartridge relative to the main assembly of the electrophotographic image forming apparatus, is parallel with the rotational axis of an image bearing member and is crossing with the feeding direction of the recording material. Reference numerals in the following description are to refer to the accompanying drawings and do not limit the present invention.

Embodiment 1

Figure 2:
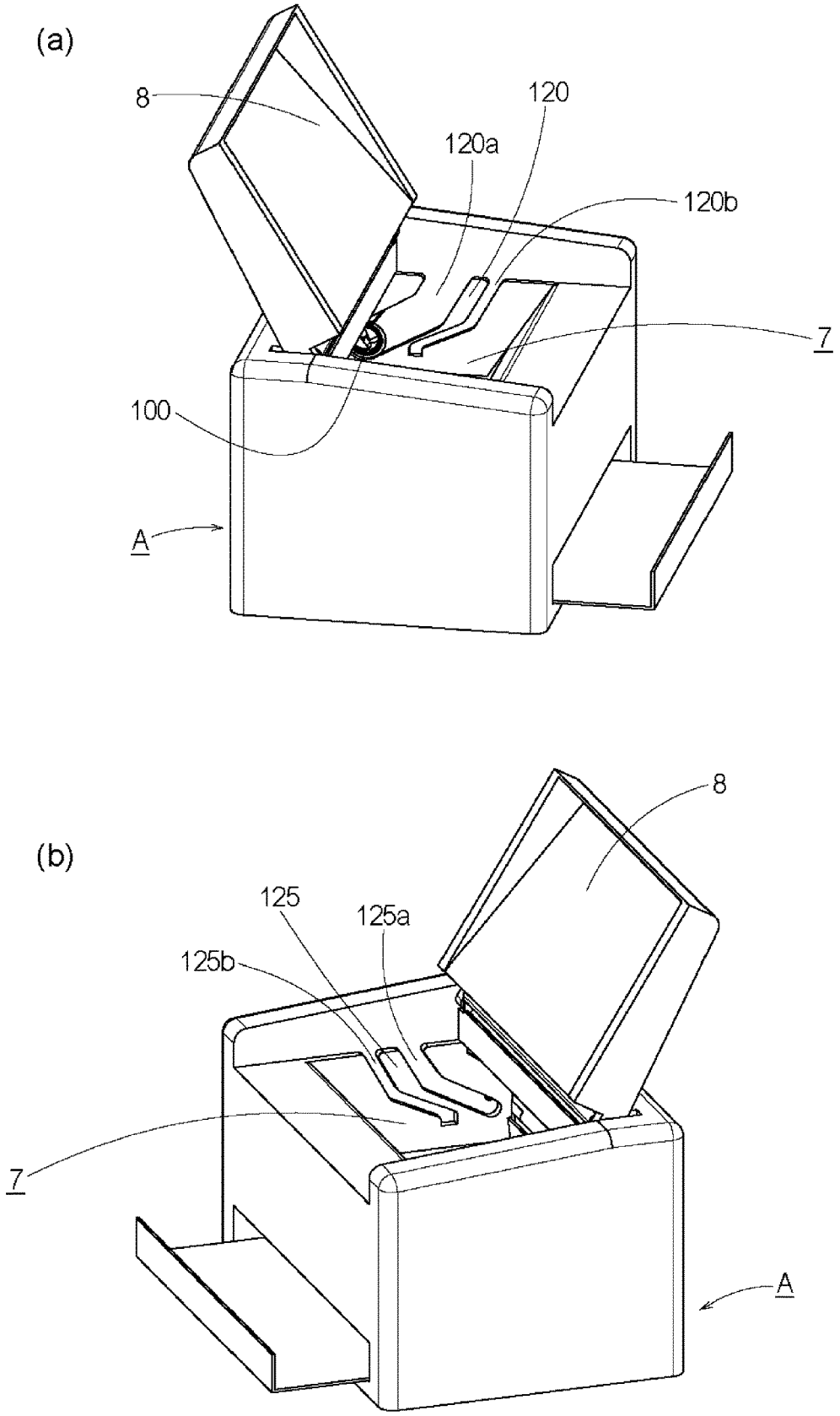
FIG. 2 is a schematic perspective view of a main assembly of the electrophotographic image forming apparatus according to the first embodiment of the present invention.
Figure 3:
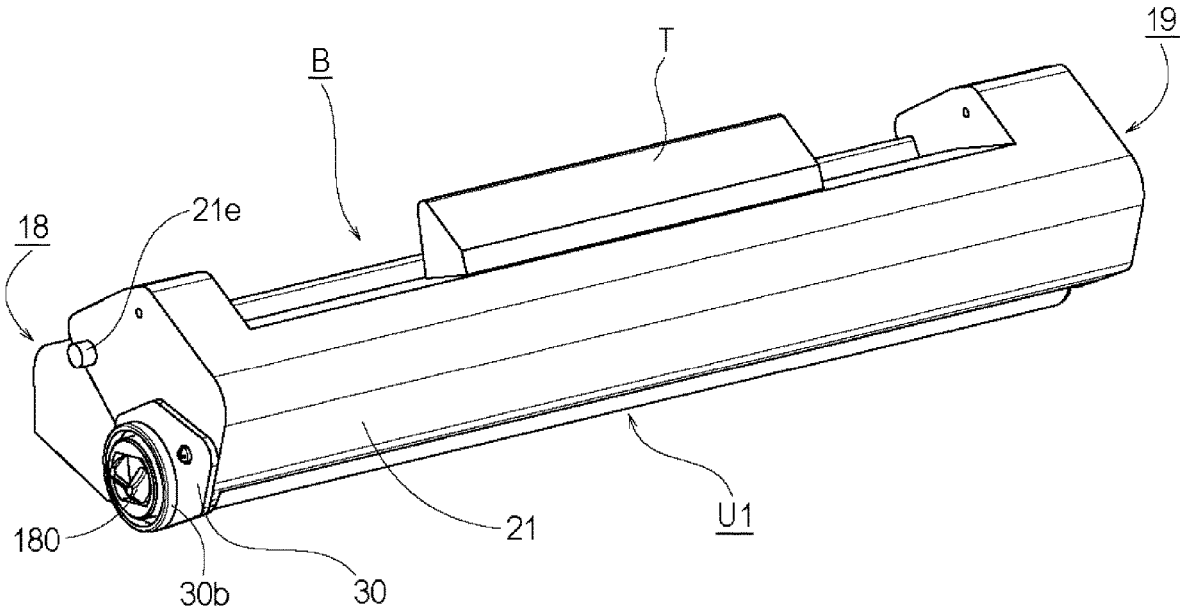
FIG. 3 is a schematic perspective view of a schematic perspective view according to the first embodiment of the present invention.
Figure 3:
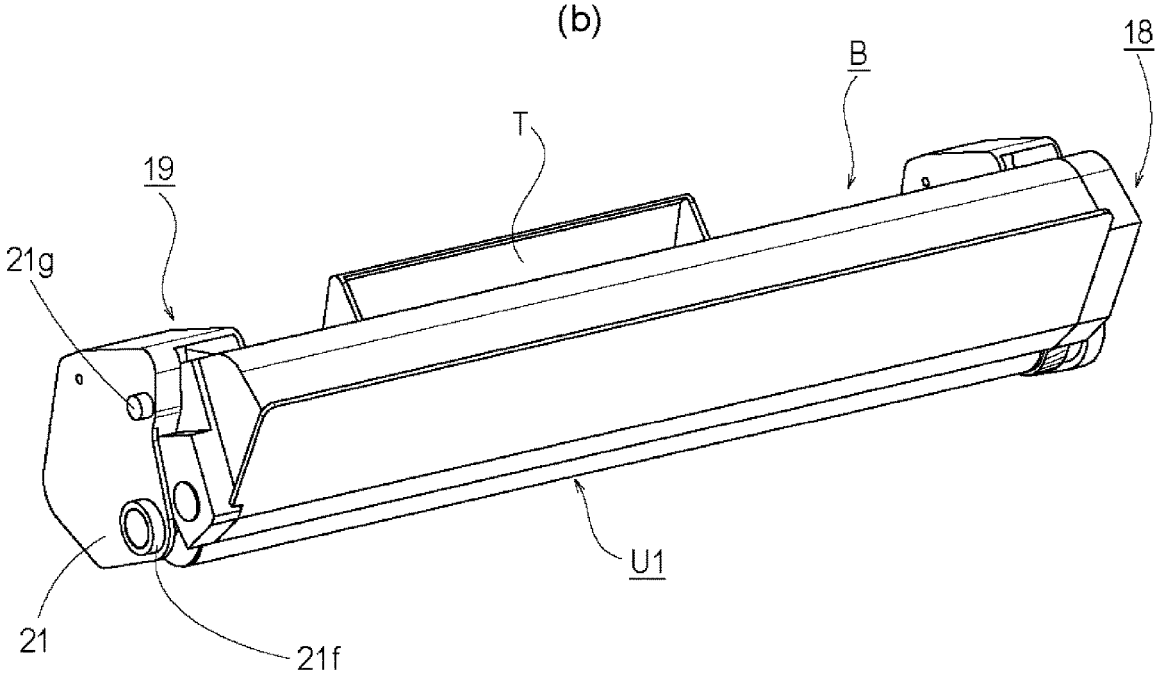
Figure 4:
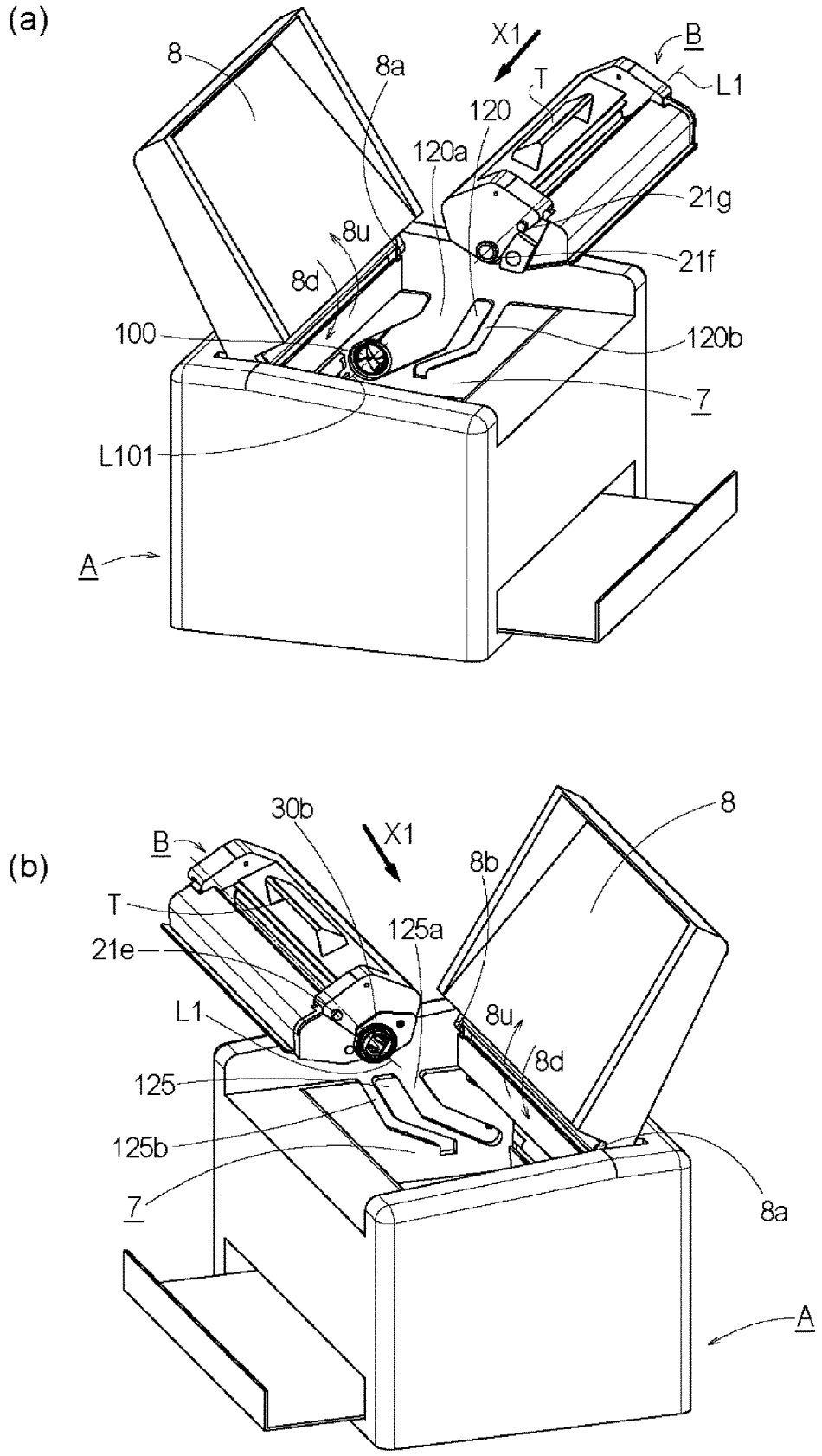
FIG. 4 is a schematic perspective view illustrating a mounting operation of the process cartridge to the main assembly of the electrophotographic image forming apparatus in the first embodiment of the present invention.

(1) Electrophotographic Image Forming Apparatus:

Referring first to FIG. 1 through FIG. 4, an electrophotographic image forming apparatus with which a process cartridge according to the embodiment of the present invention is usable will be described. In the following description, a main assembly of the electrophotographic image forming apparatus the main assembly A of the apparatus) is the portion except for the process cartridge (cartridge B) of the electrophotographic image forming apparatus. The cartridge B is detachably mountable (mountable and dismountable) relative to the main assembly A. FIG. 1 is a schematic side sectional view of the electrophotographic image forming apparatus. FIG. 2 is a schematic perspective view of the main assembly A. FIG. 3 is a schematic perspective view of the cartridge B. FIG. 4 is a schematic perspective view illustrating a mounting operation of the cartridge B to the main assembly A.

As shown in FIG. 1, in the image forming operation in the main assembly A, a laser beam L modulated in accordance with image information is projected from optical means 1 onto the surface of the electrophotographic photosensitive member 10 in the form of a drum (photosensitive drum 10) which is an image bearing member (rotatable member). By this, an electrostatic latent image can be formed on the photosensitive drum 10 in accordance with the image information. The electrostatic latent image is and developed by a developing roller 13 which will be described hereinafter, with the developer t. As a result, a developer image is formed on the photosensitive drum 10.

In synchronism with the formation of the developer image, a lift-up plate 3*b* provided at the free end portion of the sheet feeding tray 3*a* accommodating recording materials 2 is raised to feed the recording material 2 by the sheet feeding roller 3*c*, a separation pad 3*d* and a pair of registration rollers 3*e* or the like.

In a transfer position, a transfer roller 4 is provided as transferring means. The transfer roller 4 it is supplied with a voltage having the polarity opposite to that of the developer image. By this, the developer image formed on the surface of the photosensitive drum 10 is transferred onto the recording material 2. The recording material 2 is the material on which the image is formed with the developer, and it may be recording paper, a label sheet, OHP sheet.

The recording material 2 having the transferred developer image is fed to fixing means 5 through a feeding guide 3*f*. The fixing means 5 includes a driving roller 5*a* and a fixing roller 5*c* which contains a heater 5*b*. The fixing means 5 applies heat and pressure to the passing recording material 2 to fix the developer image transferred onto recording material 2, on the recording material 2. By this, the image is formed on the recording material 2.

Thereafter, recording material 2 is fed by a pair of discharging rollers 3 *g* to be discharged onto a discharging portion 8*c* of a main assembly cover 8. The sheet feeding roller 3*c*, the separation pad 3*d*, the registration roller pair 3*e*, the feeding guide 3*f* and the discharging roller pair 3 *g* and so on constitute feeding means for the recording material 2.

Referring to FIG. 2 through FIG. 4, the description will be made as to the mounting and dismounting of the cartridge B relative to the main assembly A. In the following description, the side at which the rotational force is transmitted from the main assembly A to the photosensitive drum 10 is called driving side. The opposite side with respect to the rotational axis direction of the photosensitive drum 10 is called non-driving side.

As shown in FIG. 2, the main assembly A is provided with a setting portion 7 which is a space for accommodating the cartridge B. In the state that the cartridge B is placed in the space, a coupling member 180 of the cartridge B is engaged with (connected with) a main assembly side engaging portion 100 of the main assembly A. The rotational force is transmitted from the main assembly side engaging portion 100 to the photosensitive drum 10 through the coupling member 180 (detailed description will be made hereinafter).

As shown in part (a) of FIG. 2, the driving side of the main assembly A is provided with the main assembly side engaging portion 100 and a driving side guiding member 120. The driving side guide portion 120 includes a first guide portion 120*a* and a second guide portion 120*b* for guiding the cartridge B in the mounting and dismounting operations. As shown in part (b) of FIG. 2, the non-driving side of the main assembly A is provided with a non-driving side guiding member 125. The non-driving side guide portion 125 includes a first guide portion 125*a* and a second guide portion 125*b* for guiding the cartridge B in the mounting and dismounting operations thereof. The driving side guiding member 120 and the non-driving side guiding member 125 are provided opposed to each other at driving and non-driving sides of the setting portion 7 in the main assembly A.

On the other hand, as shown in part (a) of FIG. 3, the driving side of the cartridge B is provided with a drum bearing 30 for rotatably supporting a photosensitive drum unit U1. The drum bearing 30 is provided with a driving side supported portion 30*b*. In the driving side of the cartridge B, a cleaning frame 21 is provided with a driving side rotation preventing portion 21*e*. As shown in part (b) of FIG. 3, in the non-driving side of the cartridge B, the cleaning frame 21 is provided with a non-driving side supported portion 21*f* and a non-driving side guide portion 21*g*.

Referring to FIG. 4, the mounting of the cartridge B to the main assembly A will be described. The main assembly cover 8 capable of opening and closing the main assembly A is opened by rotation in a direction of arrow 8*u* about the hinge portion 8*a* and a hinge portion 8*b*. By this, the setting portion 7 in the main assembly A is uncovered. The cartridge B is moved in the direction substantially perpendicular to a rotational axis L1 of the photosensitive drum 10 (arrow X1 direction in FIG. 4) in the cartridge B so as to be set in the main assembly A (setting portion 7). In this mounting process, in the driving side of the cartridge B, the driving side supported portion 30*b* and the driving side rotation preventing portion 21*e* are guided by the first guide portion 120*a* and the second guide portion 120*b* of the driving side guide portion 120, respectively. Similarly, in the non-driving side of the cartridge B, the non-driving side supported portion 21*f* and the non-driving side guide portion 21 *g* are guided by the first guide portion 125*a* and the second guide portion 125*b* of the non-driving side guide portion 125, respectively. As a result, the cartridge B is set in the setting portion 7. Thereafter, the main assembly cover 8 is rotated in a direction of an arrow 8*d*, so that the mounting of the cartridge B to the main assembly A is completed. When the cartridge B is removed from the main assembly A, the main assembly cover 8 is opened, and a dismounting operation is carried out. These operations are carried out by the user, in which the user grips a grip T of the cartridge B in moving the cartridge B.

In this embodiment, the setting of the cartridge B in the setting portion 7 is expressed as mounting of the cartridge B to the main assembly A. In addition, the dismounting of the cartridge B from the setting portion 7 is expressed as dismounting the cartridge B from the main assembly A. In addition, the position of the cartridge B set in the setting portion 7 relative to the main assembly A is called complete mounted position.

In the foregoing description of the mounting of the cartridge B, the cartridge B is inserted by the user as far as the setting portion 7, but this is not limiting to the present invention. For example, in an alternative structure, the user inserts the cartridge B partway, and then lets the cartridge to fall to the setting portion 7, that is, the final mounting operation may be carried out using another means.

The description will be made as to "substantially perpendicular".

For the purpose of the smooth mounting and dismounting of the cartridge B, a small gap is extended in the longitudinal direction between the cartridge B and the main assembly A of the apparatus. Therefore, when the cartridge B is mounted to or dismounted from the main assembly A of the apparatus, the entirety of the cartridge B may be slightly inclined within the range of the gap. The L4, the directions of the mounting and dismounting may not be perpendicular, strictly speaking. However, the present invention is effective in such a case, and therefore, "substantially perpendicular" covers such a case.

Figure 5:
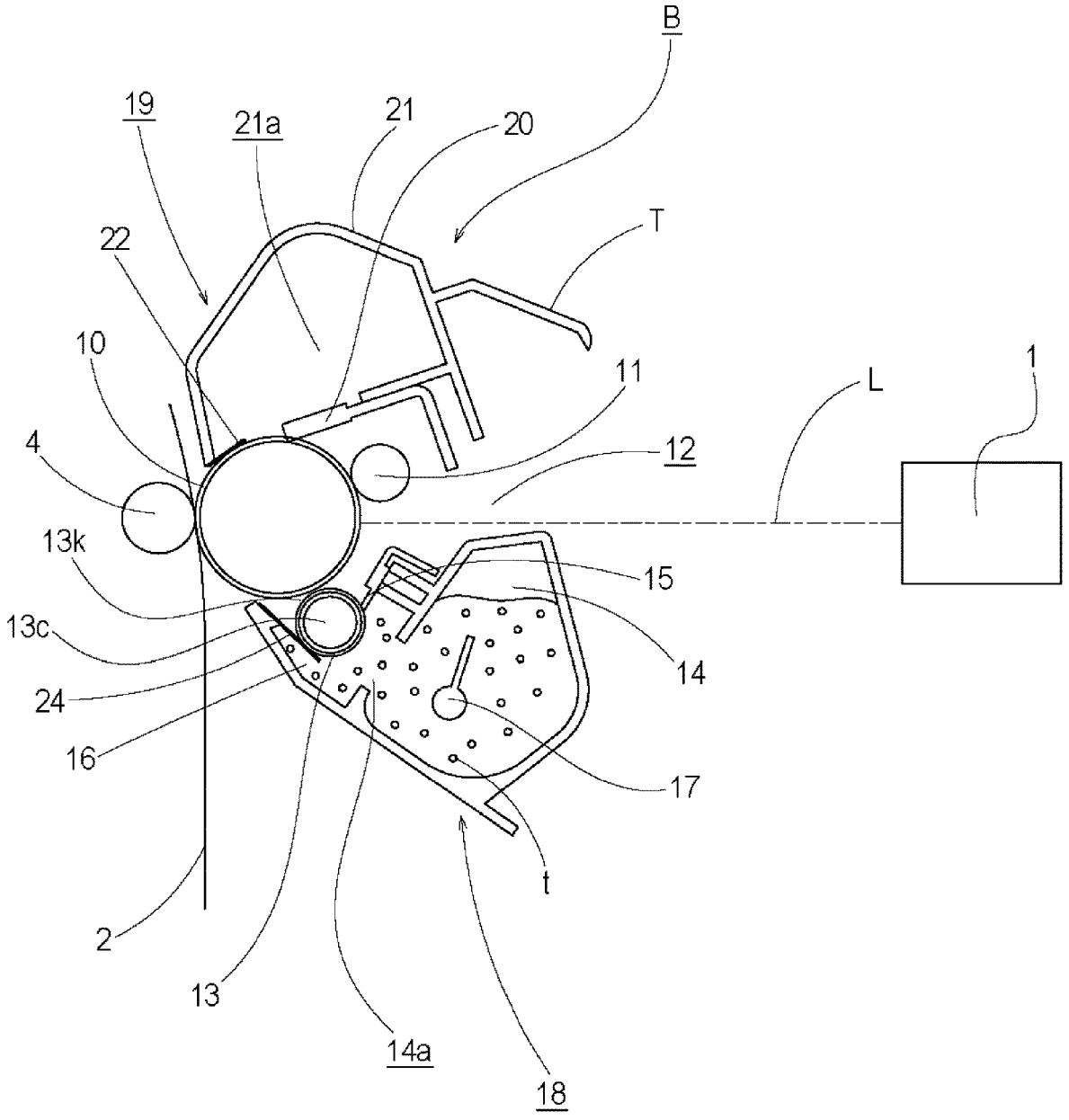
FIG. 5 is a sectional side view of the process cartridge according to the first embodiment of the present invention.
Figure 6:
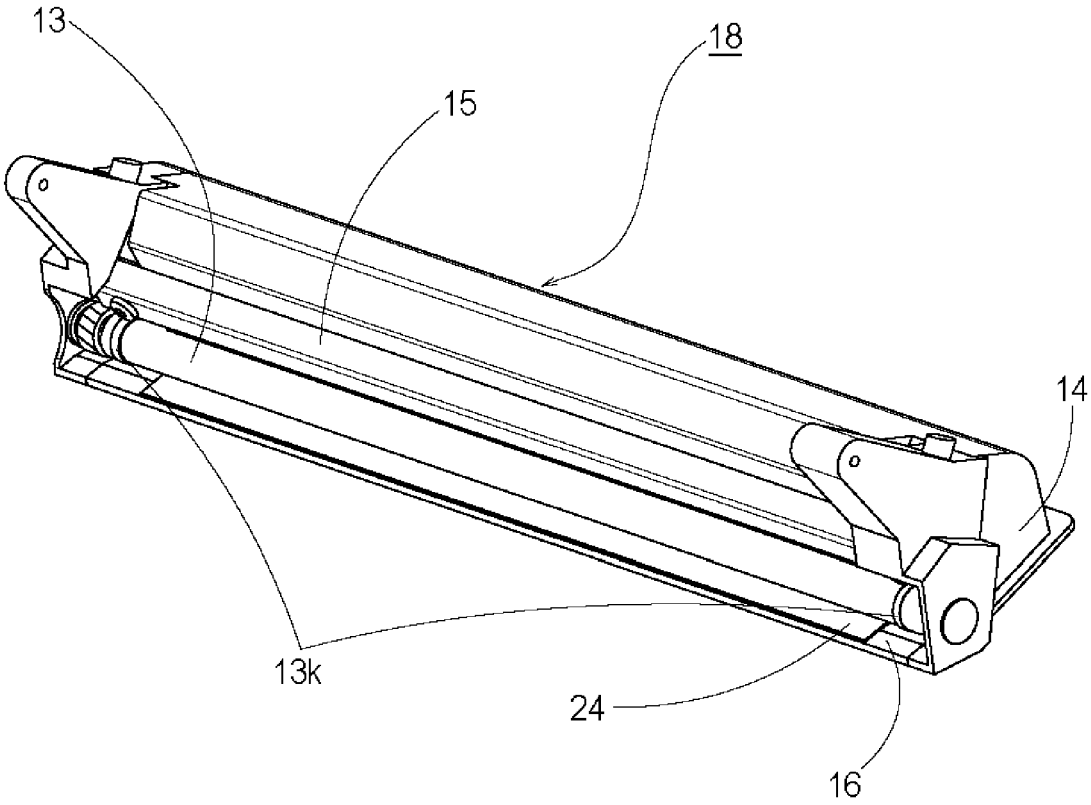
FIG. 6 is a schematic perspective view of a first frame unit in the first embodiment of the present invention.
Figure 7:
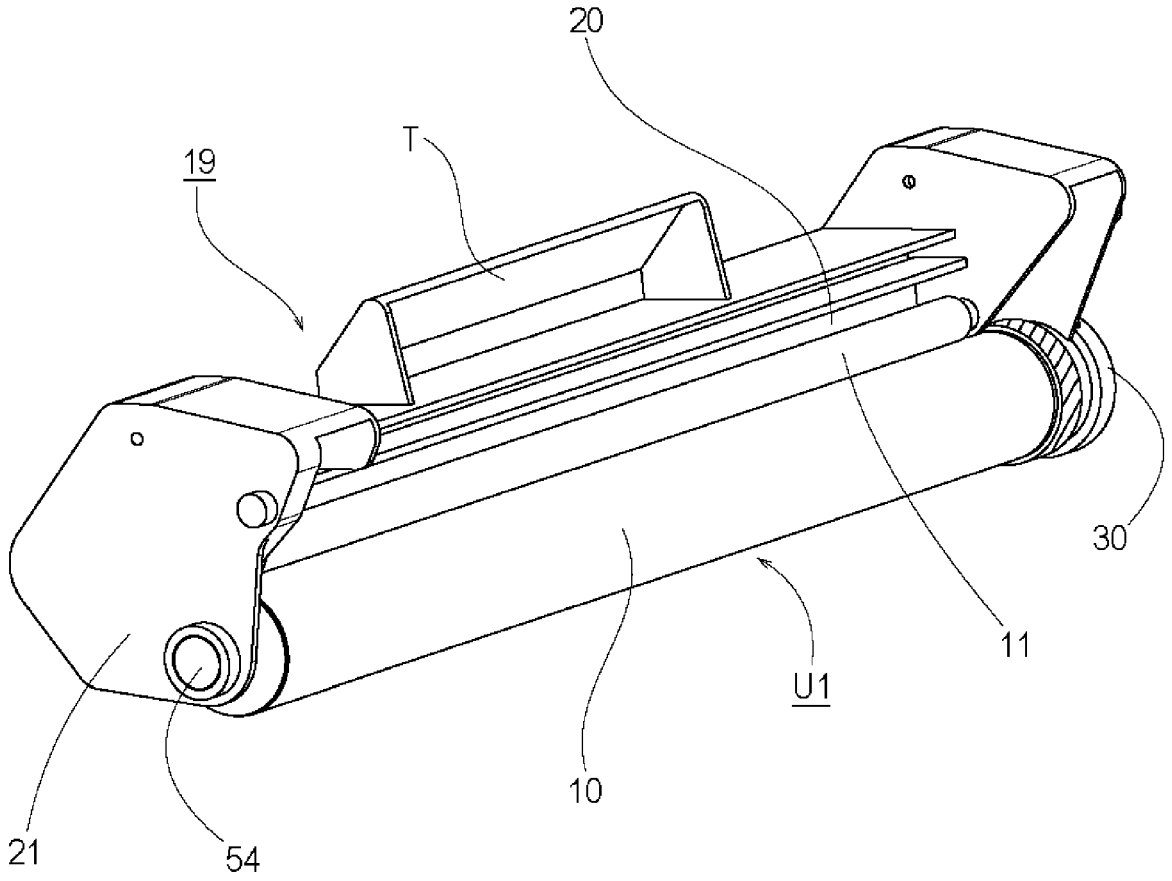
FIG. 7 is a schematic perspective view of a second frame unit in the first embodiment of the present invention.
Figure 8:
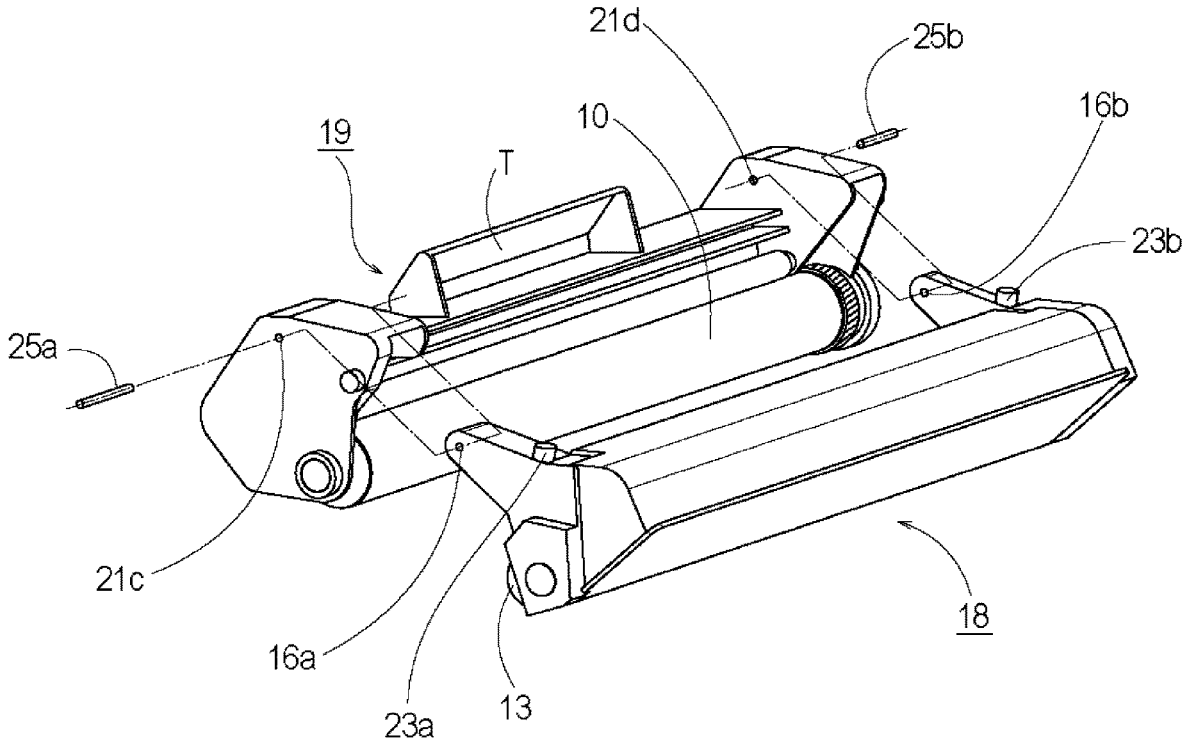
FIG. 8 illustrates connection of the first frame unit and the second frame unit in the first embodiment of the present invention.
Figure 8:
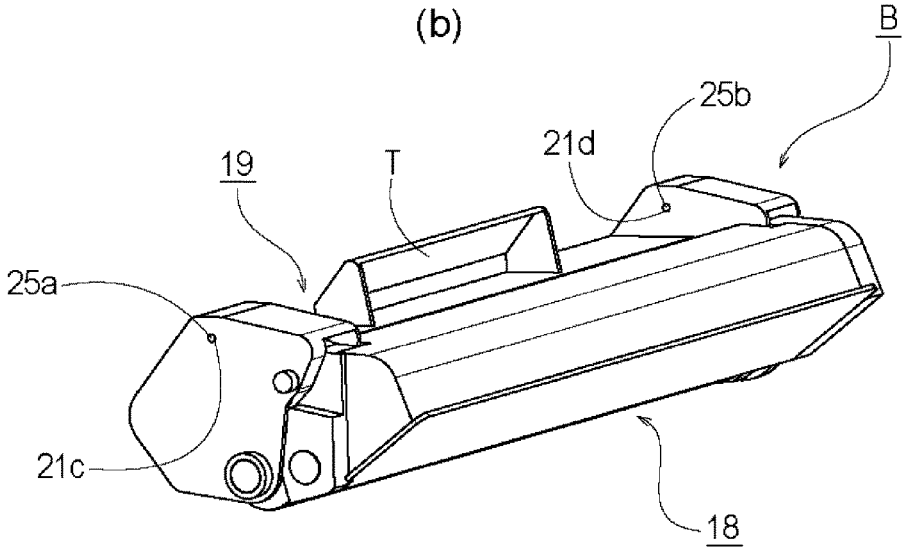

(2) Brief Description of Process Cartridge:

Referring to FIG. 5 through FIG. 8, the cartridge B according to an embodiment of the present invention will be described. FIG. 5 is a schematic sectional view of the cartridge B. FIG. 6 is a schematic perspective view of a first frame unit 18. FIG. 7 is a schematic perspective view of a second frame unit 19. FIG. 8 illustrates combination of the first frame unit 18 and the second frame unit 19.

As shown in FIG. 5, the cartridge B includes the photosensitive drum 10 having a photosensitive layer. A charging roller 11 as charging means (process means) is provided in contact with the surface of the photosensitive drum 10. The charging roller 11 uniformly charges surface of the photosensitive drum 10 apply the voltage applied from the main assembly A of the apparatus. The charging roller 11 is driven by the photosensitive drum 10. The thus charged photosensitive drum 10 is exposed to the laser beam L supplied from the optical means 1 through the exposure opening 12, so that the electrostatic latent image is formed. The electrostatic latent image is developed by developing means which will be described hereinafter.

The developer t contained in a developer accommodating container 14 is supplied into a developing container 16 through the opening 14*a* of the developer accommodating container 14 by a rotatable developer feeding member 17. The developing container 16 includes the developer carrying member (developing roller) 13 as the developing means (process means). The developing roller 13 functions as a rotatable member capable of carrying the developer t. The developing roller 13 contains the magnet roller (fixed magnet) 13*c*. A developing blade 15 is provided in contact with a peripheral surface of the developing roller 13. The developing blade 15 regulates an amount of the developer t deposited on the peripheral surface of the developing roller 13 and triboelectrically charges the developer t. By this, a developer layer is formed on the surface of the developing roller 13. A blow-out preventing sheet 24 is provided to prevent leakage of the developer t from the developing container 16.

The developing roller 13 is urged toward the photosensitive drum 10 by an urging spring 23*a* and an urging spring 23*b* (FIG. 8) while keeping a predetermined clearance relative to the photosensitive drum 10 by spacer roller 13*k* (FIG. 6) provided at the opposite longitudinal end portions of the developing roller 13, respectively. The developing roller 13 supplied with a voltage is rotated to carry the developer t into a developing zone for the photosensitive drum 10. The developing roller 13 visualizes the electrostatic latent image on the photosensitive drum 10 by transferring the developer t in accordance with the electrostatic latent image into a developer image on the photosensitive drum 10. That is, the photosensitive drum 10 functions as a rotatable member capable of carrying the developer image (developer).

Thereafter, the developer image formed on the photosensitive drum 10 is transferred onto the recording material 2 by the transfer roller 4.

The cleaning frame 21 is provided with a cleaning blade 20 as cleaning means (process means) in contact with the outer peripheral surface of the photosensitive drum 10. The cleaning blade 20 elastically contacts the photosensitive drum 10 at the free end. The cleaning blade 20 functions to scrape off the developer t remaining on the photosensitive drum 10 after transferring the developer image onto the recording material 2. The developer t scraped off the surface of the photosensitive drum 10 by the cleaning blade 20 is collected into a removed developer accommodating portion 21*a*. A receptor sheet 22 is provided to prevent leakage of the developer t from the removed developer accommodating portion 21*a*.

The cartridge B is constituted by the first frame unit 18 and the second frame unit 19 which are combined into an integral structure. The first frame unit 18 and the second frame unit 19 will be described.

As shown in FIG. 6, the first frame unit 18 comprises the developer accommodating container 14 and the developing container 16. The developer accommodating container 14 is provided with the developer feeding member 17 (unshown) and so on. The developing container 16 is provided with the developing roller 13, the developing blade 15, the developing roller 13, the spacer rollers 13*k* at the respective end portions, the blow-out preventing sheet 24 and so on.

As shown in FIG. 7, the second frame unit 19 is provided with the cleaning frame 21, the cleaning blade 20, the charging roller 11 and so on. The photosensitive drum unit U1 as a photosensitive member unit including the photosensitive drum 10 is rotatably supported using the drum bearing 30 and a drum shaft 54.

As shown in FIG. 8, a rotation hole 16*a* and a rotation hole 16*b* at the opposite end portions of the first frame unit 18 and a fixing hole 21*c* and a fixing hole 21*d* at the opposite end portions of the second frame unit 19 are connected by a unit connecting pin 25*a* and a unit connecting pin 25*b*. By this, the first frame unit 18 and the second frame unit 19 are rotatably connected with each other. By the urging spring 23*a* and the urging spring 23*b* provided between the first frame unit 18 and the second frame unit 19, the developing roller 13 is urged toward the photosensitive drum 10 with the predetermined clearance kept therebetween by the spacer rollers 13*k* (FIG. 6).

Figure 9:
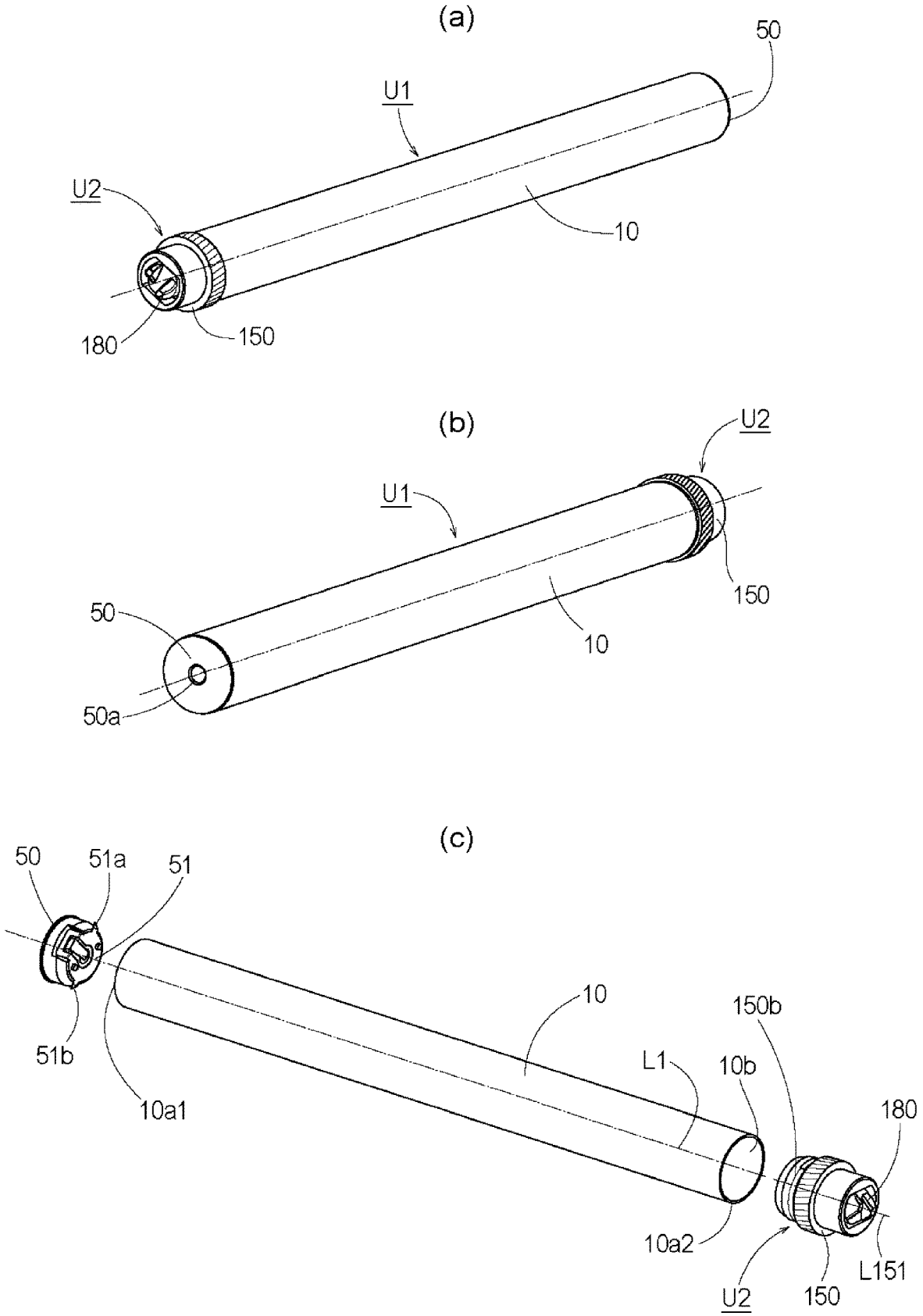
FIG. 9 is a schematic perspective view of a photosensitive member unit according to the first embodiment of the present invention.
Figure 10:
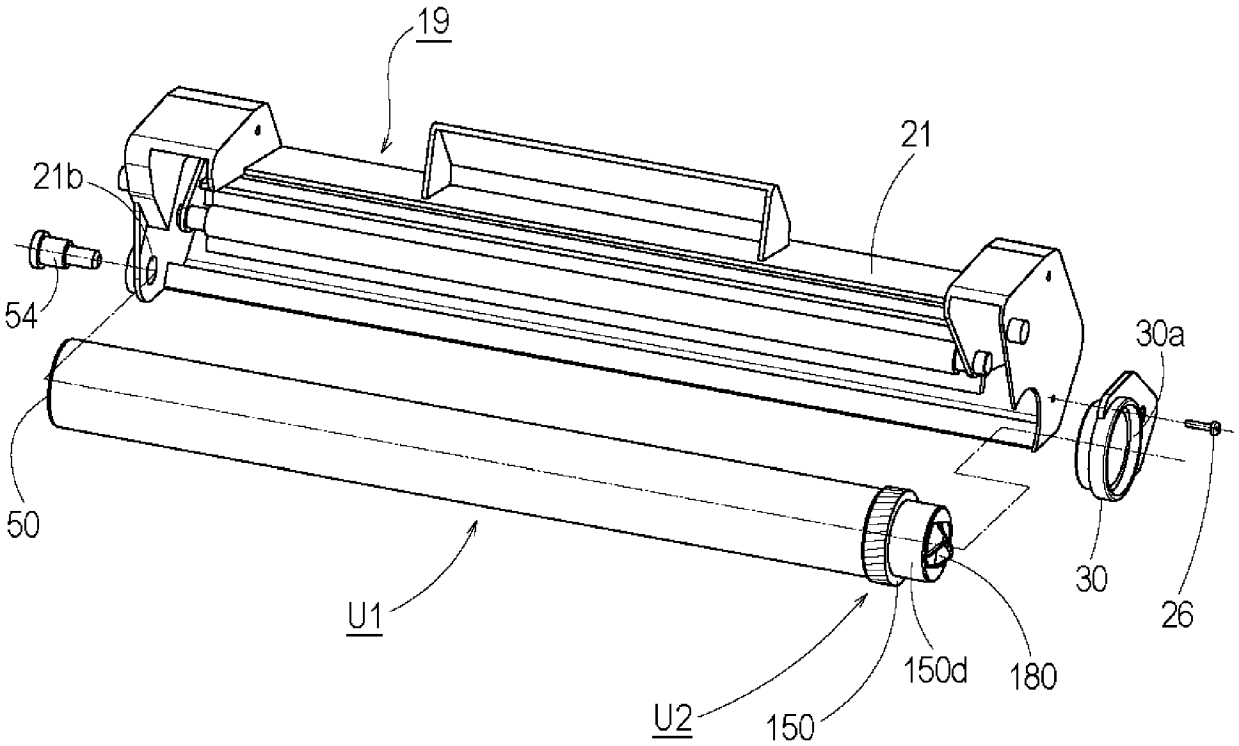
FIG. 10 is a schematic perspective view illustrating assembling of the photosensitive member unit on the second frame unit in the first embodiment of the present invention.

(3) Structure of Photosensitive Member Unit:

Referring to FIGS. 9 and 10, the structure of the photosensitive drum unit U1 will be described. Part (a) of FIG. 9 is a schematic perspective view of the photosensitive drum unit U1 as seen from the driving side, and part (b) of FIG. 9 is a schematic perspective view thereof as seen from the non-driving side. Part (c) of FIG. 9 is an exploded schematic perspective view of the photosensitive drum unit U1. FIG. 10 is an illustration of a state in which the photosensitive drum unit U1 is being assembled into the second frame unit 19.

As shown in FIG. 9, the photosensitive drum unit U1 as the photosensitive member unit comprises the photosensitive drum 10, a driving side flange unit U2 and a non-driving side flange 50 and so on.

The photosensitive drum 10 is an electroconductive member of aluminum or the like coated with the photosensitive layer at the surface. The inside of the photosensitive drum 10 may be hollow or solid.

The driving side flange unit U2 is provided at the driving side end portion with respect to the longitudinal direction of the photosensitive drum 10 (rotational axis direction along the rotational axis L1). More particularly, as shown in part (c) of FIG. 9, in the driving side flange unit U2, an engagement supporting portion 150*b* of the driving side flange (rotational force receiving member (rotational force transmission member)) 150 engages with an opening 10*a*2 provided at the end portion of the photosensitive drum 10, and is fixed to the photosensitive drum 10 by bonding and/or clamp or the like. When the driving side flange 150 rotates, the photosensitive drum 10 rotates integrally therewith. The driving side flange 150 is fixed to the photosensitive drum 10 such that a rotational axis L151 of the driving side flange 150 and a rotational axis L1 of the photosensitive drum 10 are substantially coaxial (on the same line) with each other.

In the following description, the mounting and dismounting direction (mounting direction and dismounting direction) of the cartridge B to the main assembly A of the apparatus is substantially perpendicular to the rotational axis L1 of the photosensitive drum 10 and the rotational axis L151 of the driving side flange 150 and also perpendicular to the rotational axis L101 of the main assembly side engaging portion which will be described hereinafter. Here, "substantially coaxial (substantially on the same axis)" means completely coaxial (on the same line) case and a slightly deviated case from the completely coaxial case due to the variation or the like of the dimensions of the parts The same applies to the other cases in the following descriptions.

The non-driving side flange 50 is provided at the end portion 10*a*1 in the non-driving side of the photosensitive drum 10, substantially coaxial with the photosensitive drum 10. The non-driving side flange 50 is made of resin material, and as shown in part (c) of FIG. 9, it is fixed to the photosensitive drum 10 at the non-driving side end portion 10*a*1 of the photosensitive drum 10 by bonding and/or clamp or the like. The non-driving side flange 50 is provided with an electroconductive grounding plate 51 for electrical grounding of the photosensitive drum 10. The grounding plate 51 includes a projection 51*a* and a projection 51*b* larger than the inner surface 10*b* of the photosensitive drum 10. By the projection 51*a* and projection 51*b* contacting the inner surface 10*b* of the photosensitive drum 10, the grounding plate 51 is electrically connected with the projection 51*b*.

The photosensitive drum unit U1 is rotatably supported on the second frame unit 19. As shown in FIG. 10, in the driving side of the photosensitive drum unit U1, a supported portion 150*d* of the driving side flange 150 is rotatably supported by a supporting portion 30*a* of the drum bearing 30. The drum bearing 30 is fixed to the cleaning frame 21 by a screw 26. On the other hand, in the non-driving side of the photosensitive drum unit U1, the shaft receiving portion 50*a* of the non-driving side flange 50 (part (b) of FIG. 9) is rotatably supported by the electroconductive drum shaft 54. Because of the drum shaft 54 contacts the contact portion (unshown) of the grounding plate 51, the drum shaft 54 is electrically connected with the photosensitive drum 10 through the grounding plate 51. When the cartridge B is mounted to the main assembly A of the apparatus, the drum shaft 54 contacts a main assembly contact portion (unshown) provided in the main assembly A of the apparatus, by which the photosensitive drum 10 is electrically connected with the main assembly A of the apparatus. The drum shaft 54 is press-fitted in a supporting portion 21*b* provided on the non-driving side of the cleaning frame 21.

Figure 11:
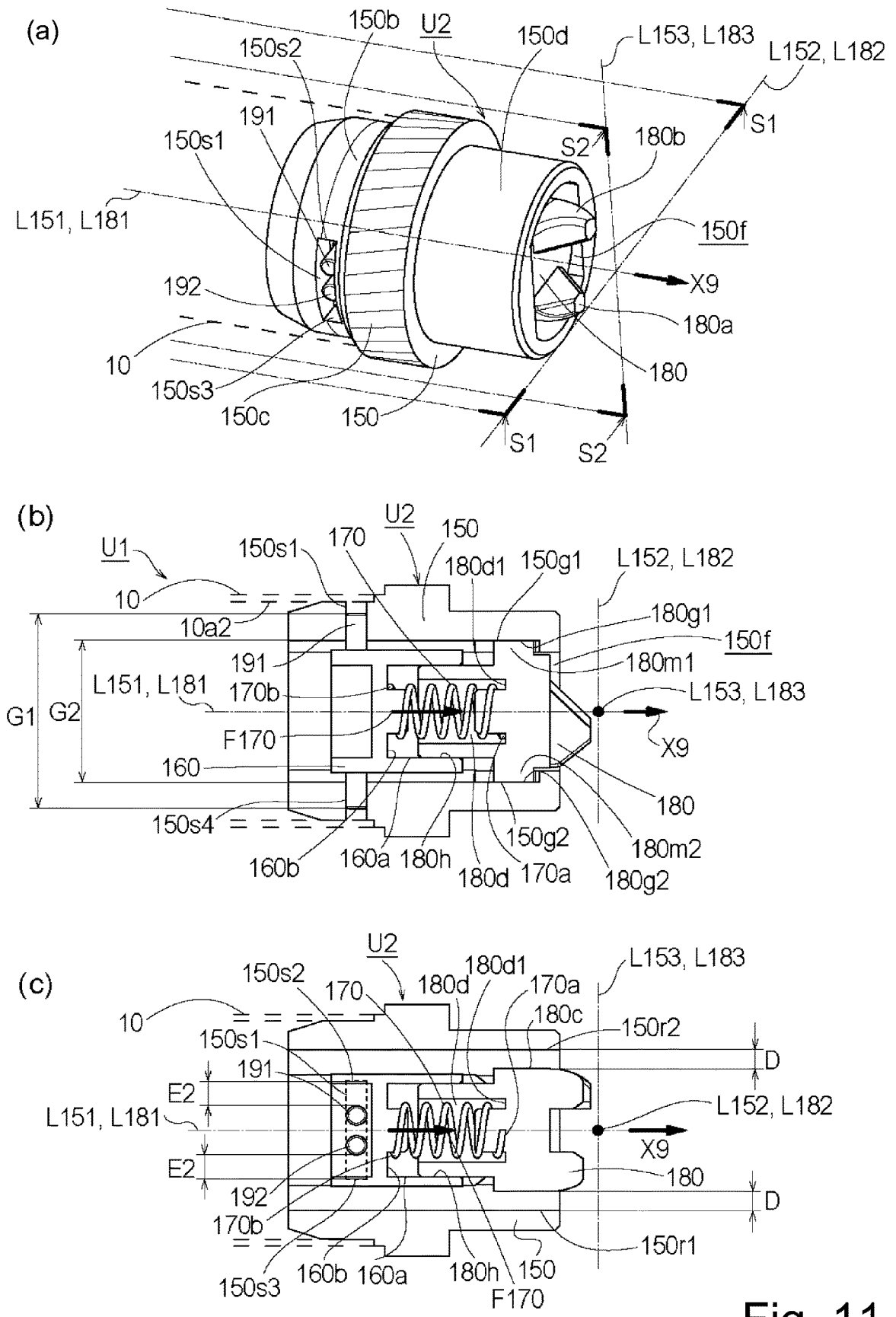
FIG. 11 is a schematic perspective view and a schematic sectional view of the photosensitive member unit the first embodiment of the present invention.
Figure 12:
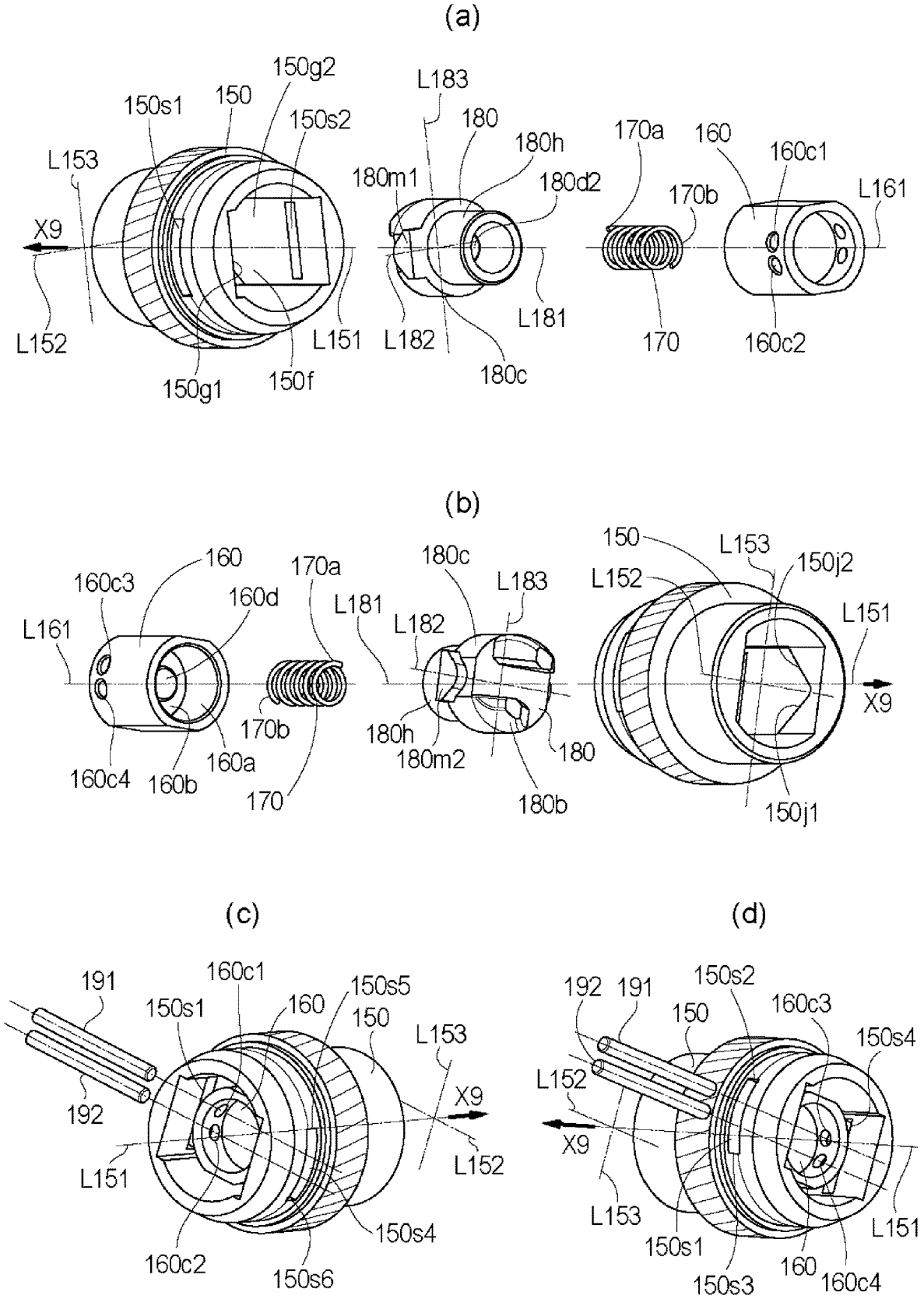
FIG. 12 is an exploded schematic perspective view of a driving side flange unit in the first embodiment of the present invention.
Figure 13:
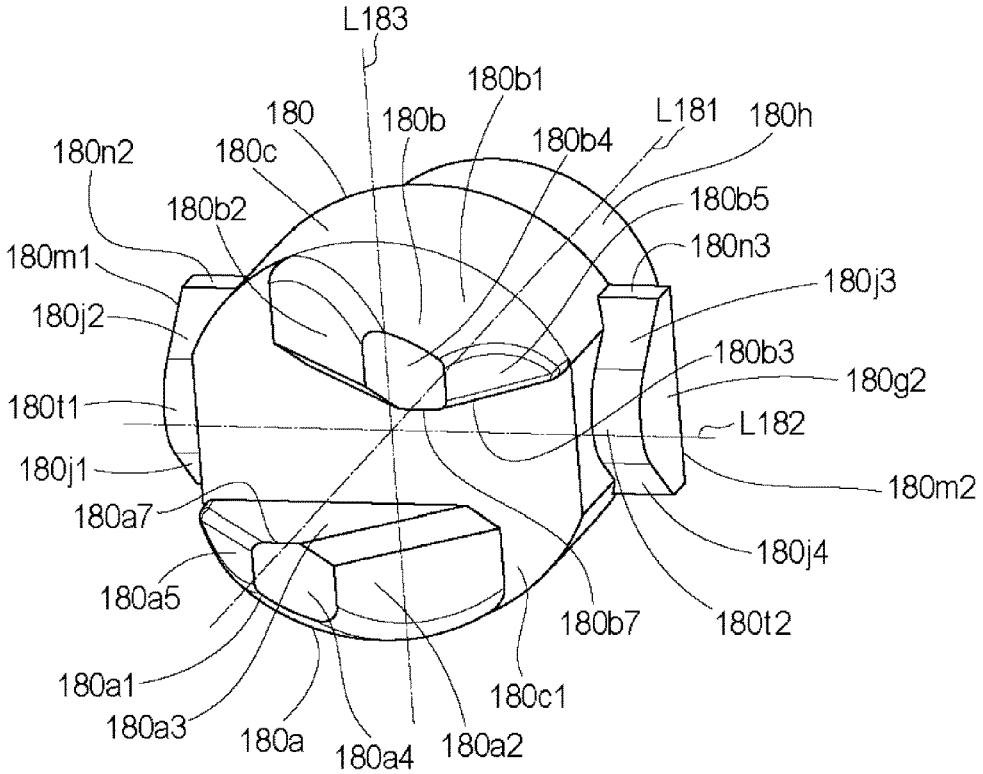
FIG. 13 is a schematic perspective view of a coupling member in the first embodiment of the present invention.
Figure 13:
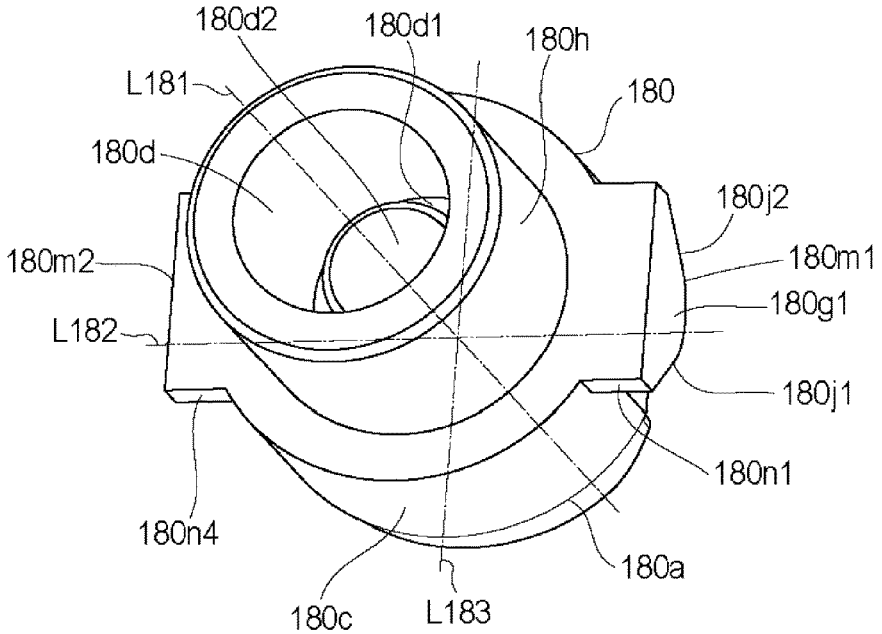
Figure 14:
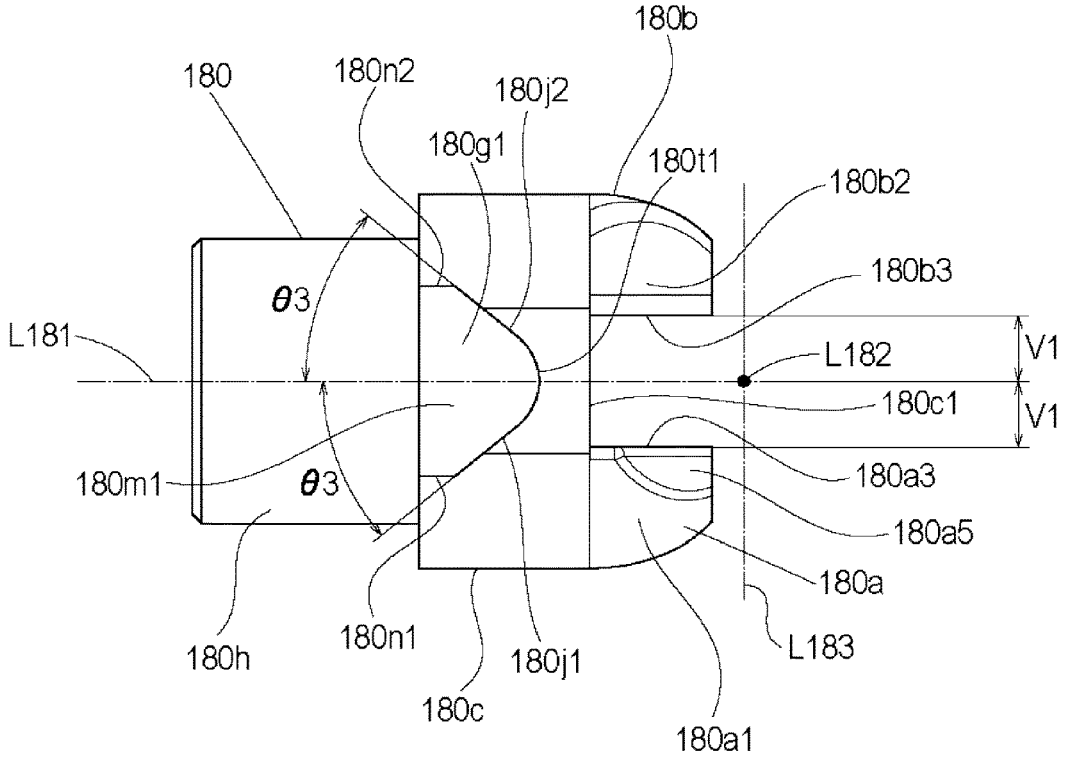
FIG. 14 is a schematic side view of the coupling member according to the first embodiment of the present invention.
Figure 14:
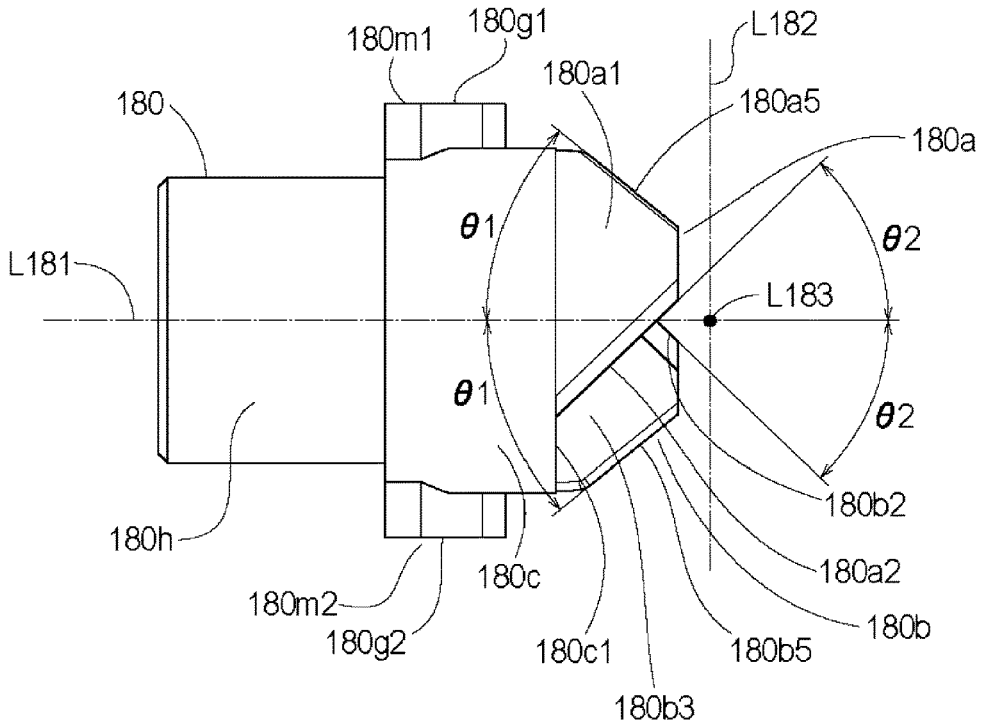
Figure 15:
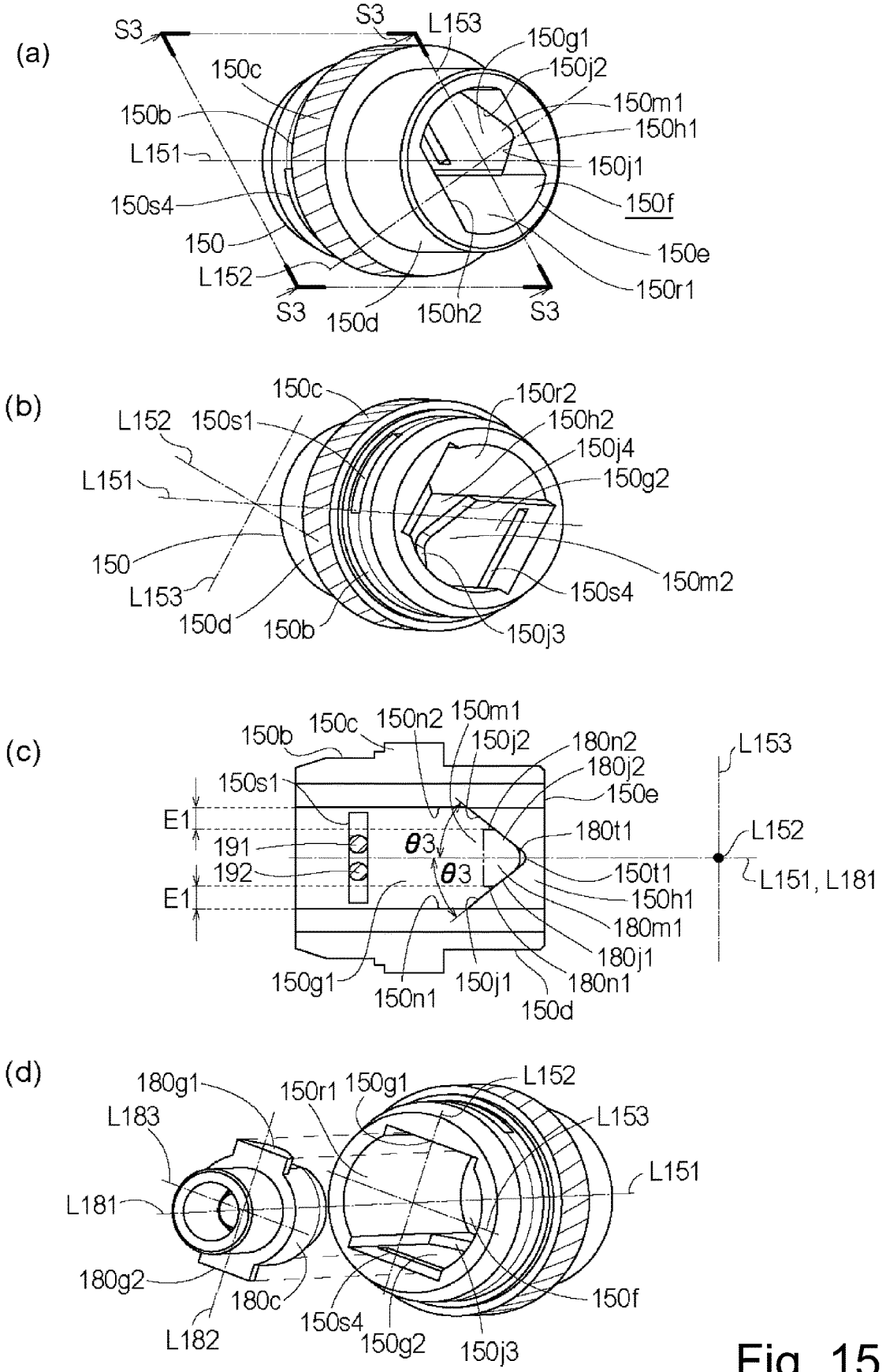
FIG. 15 is a schematic perspective view and a schematic sectional view of a driving side flange according to the first embodiment of the present invention.
Figure 16:
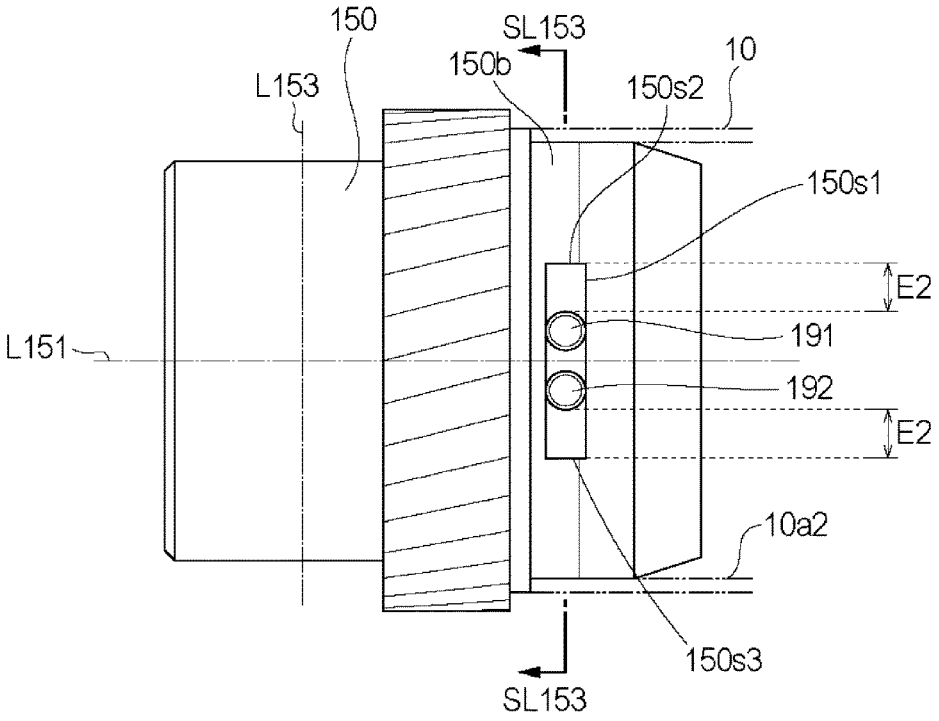
FIG. 16 is an illustration of the driving side flange, a slider and a retention pin in the first embodiment of the present invention.
Figure 16:
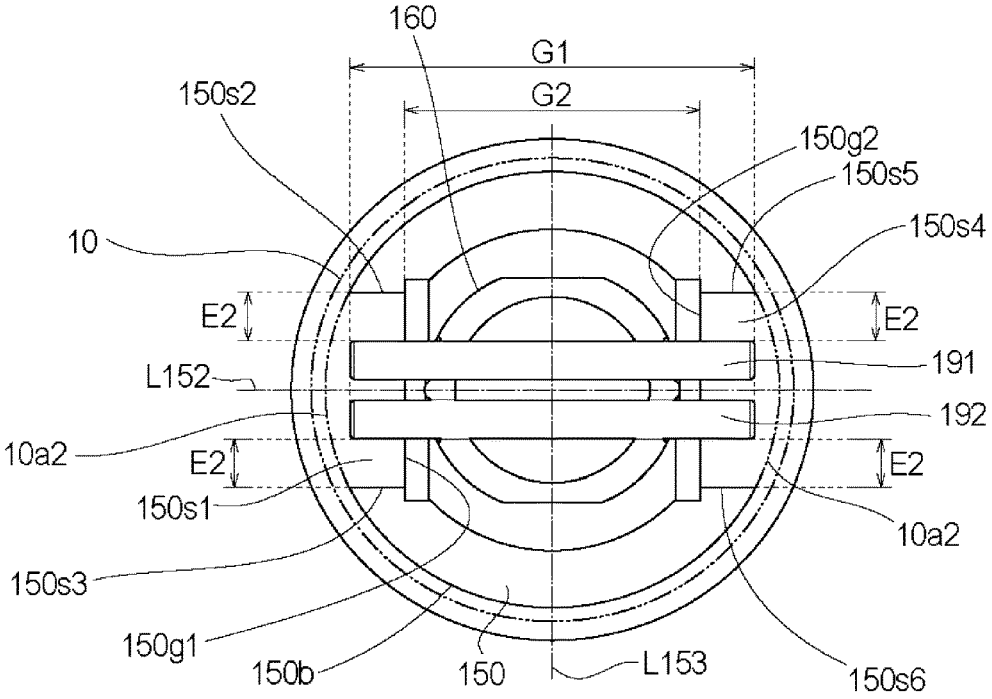

(4) Driving Side Flange Unit:

Referring to FIG. 11 through FIG. 15, the structure of the driving side flange unit U2 will be described. Part (a) of FIG. 11 is a schematic perspective view of the state in which the driving side flange unit U2 is mounted to the photosensitive drum 10, as seen from the driving side. In the part (a) of FIG. 11, the photosensitive drum 10 and the parts therein are depicted by broken lines. Part (b) of FIG. 11 is a schematic sectional view taken along a line S1 in part (a) of FIG. 11, and part (c) of FIG. 11 is a schematic sectional view taken along a line S2 in part (a) of FIG. 11. In part (c) of FIG. 11, a slide groove 150*s*1 of the driving side flange 150 is depicted by broken lines for the convenience of illustration. FIG. 12 is an exploded schematic perspective view of the driving side flange unit U2. FIG. 13 is a schematic perspective view of the coupling member 180. FIG. 14 is an illustration of the coupling member 180. Part (a) of FIG. 15 and part (b) of FIG. 15 are schematic perspective views of the driving side flange 150. Part (c) of FIG. 15 is a schematic sectional view taken along a line S3 in part (a) of FIG. 15, in which a projection 180*m*1 of the coupling member 180, a retention pin 191 and a retention pin 192 are shown for illustration. Part (d) of FIG. 15 is a schematic perspective view of the coupling member 180 and the driving side flange 150. FIG. 16 illustrates the driving side flange 150, a slider 160, the retention pin 191 and the retention pin 192, and part (b) of FIG. 16 is a sectional view taken along a line SL153 in part (a) of FIG. 16. In FIG. 16, the photosensitive drum 10 is depicted by chain lines with double dots.

As shown in FIGS. 11 and 12, the driving side flange unit U2 comprises the driving side flange 150, the coupling member 180, an urging member 170, the slider 160, the retention pin 191 and the retention pin 192, as the rotational force transmission member.

Here, in FIG. 11, "L151" is the rotational axis when the driving side flange 150 is rotated, and in the following description, the rotational axis L151 is simply called axis L151. Similarly, "L181" is the rotational axis when the coupling member 180 is rotated, and in the following description, the rotational axis L181 is simply called axis L181.

The coupling member 180 is provided inside the driving side flange 150 together with the urging member 170 and the slider 160. By the structure which will be described hereinafter, the slider 160 does not move in the direction of the axis L151 relative to the driving side flange 150, the retention pin 191 and retention pin 192.

In this embodiment, the urging member 170 includes a compression coil spring. As shown in part (b) of FIG. 11 and part (c) of FIG. 11, one end portion of the 170*a* of the urging member 170 contacts a spring contact portion 180*d*1 of the coupling member 180, and the other end portion 170*b* contacts a spring contact portion 160*b* of the slider 160. The urging member 170 is compressed between the coupling member 180 and the slider 160, and the urging force F170 thereof urges the coupling member 180 toward the driving side (arrow X9 direction (outwardly of the cartridge B)). The urging member may be an elastic member (capable of producing an elastic force) such as a spring, a leaf spring, a torsion spring, rubber, sponge or the like. However, as will be described hereinafter, the coupling member 180 is movable in the direction parallel with the axis L151 of the driving side flange 150, and therefore, a kind of the urging member 170 is required to have a certain degree of stroke. Therefore, the coil spring or the like capable of having a stroke is preferable.

Referring to FIGS. 13 and 14, the configuration of the coupling member 180 will be described.

As shown in FIG. 13, the coupling member 180 mainly comprises the projection 180*m*1, a projection 180*m*2, a first projected portion 180*a*, a second projected portion 180*b*, a round body 180*c*, an engaging portion 180*h* and a spring mounting portion 180*d*.

An axis extending in a direction perpendicular to axis L181 is an axis L182, and an axis extending in a direction perpendicular to the axis L181 and to the axis L182 is an axis L183.

As shown in FIGS. 13 and 14, the projection 180*m*1 and the projection 180*m*2 are projected from the round body 180*c* along the axis direction L182, and the projection 180*m*1 and the projection 180*m*2 are disposed at positions diametrically opposite with respect to the axis L181. The projection 180*m*1 and the projection 180*m*2 have the same configurations, and therefore, the description will be made only as to the projection 180*m*1.

As shown in part (a) of FIG. 14, the projection 180*m*1 has a symmetrical configuration with respect to the axis L181 as seen in the direction of the axis L182, more particularly it has a pentagonal configuration. The portion of the projection 180*m*1 having two surfaces inclined by an angle θ3 relative to the axis L181 as seen in the direction of the axis L182 is called a portion-to-be-guided 180*j*1 and a portion-to-be-guided 180*j*2 as an inclined portion or contact portion. The portion-to-be-guided 180*j*1 and the portion-to-be-guided 180*j*2 are inclined relative to the axis L181. The portion connecting the portion-to-be-guided 180*j*1 and the portion-to-be-guided 180*j*2 are called round (R) configuration portion 180*t*1. In addition, the surfaces of the projection 180*m*1 perpendicular to the axis L183 are called a projection end portion 180*n*1 and a projection end portion 180*n*2. The surface of the projection 180*m*1 perpendicular to the axis L182 is called a rotational force transmitting portion 180*g*1.

The projection 180*m*2 also has a portion-to-be-guided 180*j*3, a portion-to-be-guided 180*j*4, a R configuration portion 180*t*2, a projection end portion 180*n*3, a projection end portion 180*n*4 and a rotational force transmitting portion 180*g*2, similarly.

As shown in part (b) of FIG. 14, the first projected portion 180*a* and the second projected portion 180*b* have portions which are projected from the driving side end portion 180*c*1 of the cylindrical round body 180*c* toward the driving side and which have spherical surfaces, and they are point symmetrical with respect to the axis L181. The first projected portion 180*a* and the second projected portion 180*b* are provided inside the round body 180*c* with respect to the rotation radius direction of the coupling member 180.

As shown in part (a) of FIG. 13, the first projected portion 180*a* and the second projected portion 180*b* each comprise a main assembly contact portion 180*a*1, a main assembly contact portion 180*b*1, a second main assembly contact portion 180*a*2, a second main assembly contact portion 180*b*2, a rotational force receiving portion 180*a*3, a rotational force receiving portion 180*b*3, a third main assembly contact portion 180*a*5, a third main assembly contact portion 180*b*5, a leading side surface 180*a*4 and a leading side surface 180*b*4. Driving side free end portions of the rotational force receiving portion 180*a*3 and the rotational force receiving portion 18*b*3 are a free end corner portion 180*a*7 and a free end corner portion 180*b*7, respectively. The main assembly contact portion 180*a*1 and the main assembly contact portion 180*b*1 are provided outside the first projected portion 180*a* and the second projected portion 180*b*, respectively. The first projected portion 180*a* and the second projected portion 180*b* contact the main assembly side engaging portion 100 when the coupling member 180 engages with the main assembly side engaging portion 100 and when the coupling member 180 is disengaged from the main assembly side engaging portion, as will be described in detail hereinafter.

The rotational force receiving portion 180*a*3 and the rotational force receiving portion 180*b*3 have flat surfaces parallel with the axis L181 of the coupling member 180 (part (a) of FIG. 14). In this embodiment, the rotational force receiving portion 180*a*3 and the rotational force receiving portion 180*b*3 have flat surfaces perpendicular to the axis L183. A distance between the axis L181 and the rotational force receiving portion 180*a*3 or the rotational force receiving portion 180*b*3 is offset V1. As shown in part (b) of FIG. 14, the second main assembly contact portion 180*a*2 and the second main assembly contact portion 180*b*2 are inclined surfaces inclined relative to the axis L181 of the coupling member 180 by an angle θ2, as seen in the direction of the axis L183. The third main assembly contact portion 180*a*5 and the third main assembly contact portion 180*b*5 are inclined surfaces inclined relative to the axis L181 of the coupling member 180 by an angle θ1, as seen in the direction of the axis L183.

The main assembly contact portion 180*a*1 and the main assembly contact portion 180*b*1 approach to the axis L181 as the distance from the driving side of the axis L181 decreases. In this embodiment, the main assembly contact portion 180*a*1 and the main assembly contact portion 180*b*1 are parts of spherical surfaces having substantially the same radius as that of the cylindrical shape of the round body 180*c*, and therefore, the outer diameters thereof in a plane perpendicular to the axis L181 decrease toward the driving side of the axis L181.

The engaging portion 180*h* has a cylindrical shape having a center axis which is common with the axis L181, and is supported by a cylindrical portion 160*a* of the slider 160 as a holding member (movable member) with almost no gap (part (b) of FIG. 11, part (c) of FIG. 11), as will be described in detail hereinafter. The cylindrical portion 160*a* functions as a holding portion for holding the coupling member 180. As shown in FIG. 13, the spring mounting portion 180*d* is provided on a non-driving side end portion of the engaging portion 180*h*. The spring mounting portion 180*d* is provided with a spring contact portion 180*d*1 contacting one end portion 170*a* of the urging member 170, and the spring contact portion 180*d*1 is substantially perpendicular to the axis L181 of the coupling member 180.

Referring to FIG. 15, the configuration of the driving side flange 150 will be described.

As shown in FIG. 15, the driving side flange 150 is provided with the engagement supporting portion 150*b* engaging with the inner surface 10*b* of the photosensitive drum 10, a gear portion 150*c*, a supporting portion 150*d* rotatably supported by the drum bearing 30 and so on.

An axis extending in a direction perpendicular to axis L151 is an axis L152, and an axis extending in a direction perpendicular to the axis L151 and to the axis L152 is an axis L153.

The inside of the driving side flange 150 is hollow, and is called hollow portion 150*f*. The hollow portion 150*f* includes a flat surface inner wall portion 150*h*1, a flat surface inner wall portion 150*h*2, a cylindrical inner wall portion 150*r*1, a cylindrical inner wall portion 150*r*2, a recess 150*m*1 and a recess 150*m*2.

The flat surface inner wall portion 150*h*1 and the flat surface inner wall portion 150*h*2 have surfaces perpendicular to the axis L152 and are diametrically opposite (180 degrees) from each other axis L151. The cylindrical inner wall portion 150*r*1 and the cylindrical inner wall portion 150*r*2 have cylindrical configurations having a central axis which is common with the axis L151, and a disposed at positions diametrically opposite from each other with respect to the axis L151. The recess 150*m*1 and the recess 150*m*2 are formed with the flat surface inner wall portion 150*h*1 and the flat surface inner wall portion 150*h*2, respectively, and are farther from the axis L151 along the axis L152. The recess 150*m*1 and the recess 150*m*2 have the same configuration and are provided at the positions diametrically opposite with respect to the axis L151, and therefore, the following description will be made with respect to the recess 150*m*1 only.

The recess 150*m* is symmetrical with respect to the axis L151 as seen in the direction of the axis L152. As shown in part (c) of FIG. 15, the portion having the surfaces inclined by the angle θ3 relative to the axis L151 as seen in the direction of the axis L152 is a guide portion 150*j*1 and a guide portion 150*j*2, similarly to the portion-to-be-guided 180*j*1—the portion-to-be-guided 180*j*4. The guide portion 150*j*1 and the guide portion 150*j*2 are inclined relative to the axis L151. In this embodiment, the inclined surface of the guide portion 150*j*1 corresponds to the portion-to-be-guided 180*j*1, and the inclined surface of the guide portion 150*j*2 corresponds to the portion-to-be-guided 180*j*2. The portion connecting the guide portion 150*j*1 and the guide portion 150*j*2 with each other is a round configuration portion 150*t*1. Surfaces of the recess 150*m*1 perpendicular to the axis L153 are a recess end portion 150*n*1 and a recess end portion 150*n*2. A rotational force receiving portion 150*g*1 having a flat surface perpendicular to the axis L152 is provided, with a step relative to the flat surface inner wall portion 150*h*1. In addition, the rotational force receiving portion 150*gi* is provided with the slide groove 150*s*1. As will be described hereinafter, the slide groove 150*s*1 includes a through hole supporting the retention pin 191 and the retention pin 192, and has a rectangular-shape with the long side thereof being along the axis L153, as seen in the direction of the axis L152.

The parts constituting the recess 150*m*2 include a rotational force receiving portion 150*g*2, a guide portion 150*j*3, a guide portion 150*j*4, R, a guide portion 150*j*4, a R configuration portion 150*t*2, a slide groove 150*s*4, a recess end portion 150*n*3 and a recess end portion 150*n*4.

A driving side end portion of the hollow portion 150*f* is an opening 150*e*.

As shown in FIGS. 11, 12 and part (d) of FIG. 15, the coupling member 180 is provided in the hollow portion 150*f* of the driving side flange 150 such that the axis L182 is parallel with the axis L152. The rotational force transmitting portion 180*g*1 and the rotational force transmitting portion 180*g*2, and the rotational force receiving portion 150*g*1 and the rotational force receiving portion 150*g*2 are engaged with each other with almost no gap in the direction of the axis L182, respectively. By this, the movement of the coupling member 180 relative to the driving side flange 150 in the direction of the axis L182 is limited (part (b) of FIG. 11, part (d) of FIG. 15). As shown in part (c) of FIG. 11, when the coupling member 180 is placed in the hollow portion 150*f* such that the axis L181 is substantially coaxial with the axis L151, gaps D are provided between the round body 180*c* and the cylindrical inner wall portion 150*r*1 and the cylindrical inner wall portion 150*r*2, respectively. In addition, as shown in part (c) of FIG. 15, gaps E1 are provided between the projection end portion 180*n*1 and the recess end portion 150*n*1 and between the projection end portion 180*n*2 and the recess end portion 150*n*1, respectively, in the direction of the axis L153. By this, coupling member 180 is movable in the direction of the axis L183 relative to the driving side flange 150. Here, the projection 180*m*1 and the recess 150*m* are so shaped that the gap E1 is larger than the gap D. In this embodiment, the coupling member 180 is provided with the projection 180*m*1, and the flange 150 is provided with the recess 150*m*1, but the recess-projection relationship may be reversed. The above-described inclined portion may be provided only one or both of the coupling member 180 and the flange 150. That is, the inclined portion may be provided at least one of the coupling member 180 and the flange 150.

Referring to FIGS. 11 and 12, the configurations of the slider 160, the retention pin 191 and the retention pin 192 will be described.

As shown in FIGS. 11 and 12, the slider 160 is provided with the cylindrical portion 160*a*, a contact portion 160*b* contacted by the other end portion 170*b* of the urging member 170, a through hole 160*c*1—a through hole 160*c*4. The central axis of the cylindrical portion 160*a* is an axis L161.

The cylindrical portion 160*a* is engaged with the engaging portion 180*h* of the coupling member 180 with almost no gap to support the engaging portion 180*h*. By this, the coupling member 180 is movable in the direction of the axis L181 while keeping the substantial coaxiality between the axis L181 and the axis L161.

On the other hand, as shown in part (b) of FIG. 11, part (c) of FIG. 12 and part (c) of FIG. 15, the cylindrical retention pin 191 and the retention pin 192 are inserted into the through hole 160*c*1—the through hole 160*c*4 of the slider 160 such that the central axes are parallel with the axis L152. The retention pin 191 and the retention pin 192 are supported by the slide groove 150*s*1 and the slide groove 150*s*4 of the driving side flange 150, so that the slider 160 and the driving side flange 150 are connected with each other.

As shown in part (c) of FIG. 11 and part (a) of FIG. 16, the retention pin 191 and the retention pin 192 are juxtaposed along the axis L153. The diameters of the retention pin 191 and the retention pin 192 are slightly smaller than the width of the slide groove 150*s*1 and the slide groove 150*s*4 measured in the direction of the axis L151. By this, the slider 160 keeps the parallelism between the axis L161 and the axis L151. In addition, the slider 160 is prevented from the movement relative to the driving side flange 150 in the direction of the axis L151. In other words, the slider 160 is movable in the direction substantially perpendicular to the axis L151.

As shown in part (b) of FIG. 11 and part (b) of FIG. 16, by the fixing engagement between the engagement supporting portion 150*b* of the driving side flange 150 (part (a) of FIG. 16) and the opening 10*a*2 of the photosensitive drum 10, the retention pin 191 and the retention pin 192 are prevented from disengaging in the direction of the axis L152. In addition, a length G1 of the retention pin 191 and the retention pin 192 is selected to be sufficiently larger than a distance G2 between the rotational force transmitting portion 150*g*1 and the rotational force transmitting portion 150*g*2. By doing so, the retention pin 191 and the retention pin 192 are prevented from disengaging from the slide groove 150*s* Iand the slide groove 150*s*4.

Furthermore, between the retention pin 191 and the one end portion 150*s*2 of the slide groove 150*s*1 and between the retention pin 192 and the other end portion 150*s*3 of the slide groove 150*s*1, a gap E2 larger than the gap D is provided (part (c) of FIG. 11 and part (a) of FIG. 16). Similar gaps E2 are provided between the retention pin 191 and one end portion 150*s*5 of the slide groove 150*s*4 and between the retention pin 192 and in the other end portion 150*s*6 of the slide groove 150*s*4 (part (a) of FIG. 16). In addition, lubricant (unshown) is applied to the through hole 160*c*1—the through hole 160*c*4, the slide groove 150*s*1 and the slide groove 150*s*4. By this, the slider 160 is smoothly movable relative to the driving side flange 150 in the direction of the axis L153.

As shown in part (c) of FIG. 15, the guide portion 150*j*1 and the guide portion 150*j*2 as the inclined portions or the contact portions are contactable to the portion-to-be-guided 180*j*1 and the portion-to-be-guided 180*j*2 as the inclined portions or the contact portions (here, it is unnecessary that both of the guide portion 150*j*1 (150*j*2) and the portion-to-be-guided 180*j*1 (180*j*2) are inclined, but it will suffice if one of them is inclined). By the contact therebetween, the coupling member 180 is prevented from disengaging from the opening 150*e* of the driving side flange 150. By the urging member 170, the coupling member 180 is urged toward the driving side such that the portion-to-be-guided 180*j*1 and the portion-to-be-guided 180*j*2 contact the guide portion 150*j*1 and the guide portion 150*j*2. The same applies to the relationship between the guide portion 150*j*3 the guide portion 150*j*4 and the portion-to-be-guided 180*j*3, the portion-to-be-guided 180*j*4.

As described hereinbefore, the projection 180*m*1 and the projection 180*m*2 are symmetrical with respect to the axis L181, as seen in the direction of the axis L182. In addition, the recess 150*m*1 and the recess 150*m*2 are symmetrical with respect to the axis L151 as seen in the direction of the axis L152. Therefore, the coupling member 180 is urged toward the driving side by the urging member 170, so that the portion-to-be-guided 180*j*1—the portion-to-be-guided 180*j*4 contact the guide portion 150*j*1 and the guide portion 150*j*4, and therefore, the axis L181 and the axis L151 are substantially coaxial with each other.

With the above-described structures, the coupling member 180 keeps the state relative to the driving side flange 150 through the slider 160 such that the axis L181 and the axis L151 are parallel with each other. The coupling member 180 is movable relative to the driving side flange 150 in the directions of the axis L181 and the axis L183. The coupling member 180 is prevented from moving relative to the driving side flange 150 in the direction of the axis L182. The coupling member 180 is urged toward the driving side (arrow X9 direction in FIG. 11) relative to the driving side flange 150 by the urging force F170 of the urging member 170 such that the axis L181 and the axis L151 are substantially coaxial with each other.

In this embodiment, the driving side flange 150, the coupling member 180 and the slider 160 are made of resin material such as polyacetal, polycarbonate or the like. The retention pin 190 is made of metal such as carbon steel, stainless steel or the like. However, depending on the load torque for rotating the photosensitive drum 10, the materials of the parts may be made of metal four resin material.

In this embodiment, the gear portion 150*c* functions to transmit the rotational force received by the coupling member 180 from the main assembly side engaging portion 100 to the developing roller 13, and it is a helical gear or spur gear integrally molded with the driving side flange 150. The developing roller 13 may be rotated not through the driving side flange 150. In such a case, the gear portion 150*c* may be omitted.

Referring to FIG. 12 and part (d) FIG. 15, an assembling process of the driving side flange unit U2 will be described. As shown in part (d) of FIG. 15, the coupling member 180 is inserted into the space portion 150*f* of the driving side flange 150. At this time, as described hereinbefore, the phases of the coupling member 180 and the driving side flange 150 are adjusted such that the axis L182 and the axis L152 are parallel with each other. Next, as shown in FIG. 12, the urging member 170 is mounted. The urging member 170 is limited in the position in the radial direction a shaft portion 180*d*2 of the coupling member 180 and a shaft portion 160*d* of the slider 160. The urging member 170 may be mounted beforehand to any one of or both of the shaft portion 180*d*2 and the shaft portion 160*d*. At this time, the urging member 170 is press-fitted relative to the shaft portion 180*d*2 (or shaft portion 160*d*) such that the urging member 170 does not dislodge, by which the assembling operativity is improved. Thereafter, the slider 160 is inserted into the space portion 150*f* so that the engaging portion 180*h* is fitted into the cylindrical portion 160*a*. As shown in part (c) of FIG. 12 and part (d) of FIG. 12, the retention pin 191 and the retention pin 192 are inserted from the slide groove 150*s*1 through the through hole 160*c*1—the through hole 160*c*4 into the slide groove 150*s*4.

Figure 17:
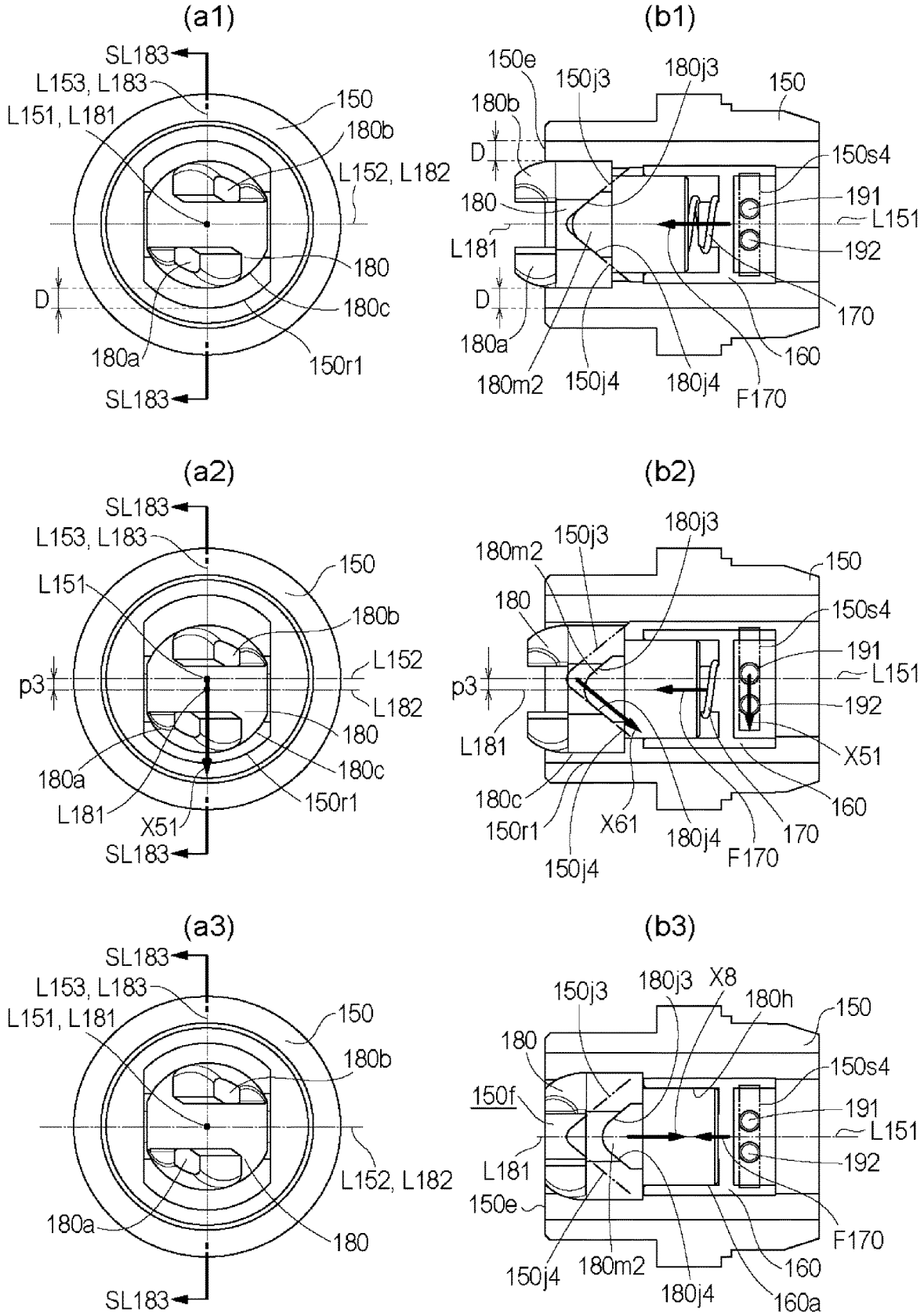
FIG. 17 is an illustration of the operation of the coupling member according to the first embodiment of the present invention.

(6) Operation of the Coupling Member:

Referring to FIG. 17, the coupling member 180 will be described. Part (a1) of FIG. 17 is an illustration of the state in which the axis L181 of the coupling member 180 and the axis L151 of the driving side flange 150 are aligned with each other, and the guide portion 150*j*1—the guide portion 150*j*4 contact the portion-to-be-guided 180*j*1 and the portion-to-be-guided 180*j*4, respectively. Part (a2) of FIG. 17 is an illustration of the state in which the coupling member 180 has moved relative to the driving side flange 150 in the direction indicated by an arrow X51, that is, the direction parallel with the axis L183. Part (a3) of FIG. 17 is a illustration of the state in which the coupling member 180 has moved along the axis L151 toward the non-driving side (arrow X8 direction) from the state in which the guide portion 150*j*1—the guide portion 150*j*4 and the portion-to-be-guided 180*j*1 and the portion-to-be-guided 180*j*4 contact to each other, respectively. Part (b1) of FIG. 17-part (b3) of FIG. 17 are schematic sectional views taken along lines SL183 parallel with the axis L183 in part (a1) of FIG. 17 and part (a3) of FIG. 17. In part (b1) of FIG. 17-part (b3) of FIG. 17, the coupling member 180 is depicted in the unsectioned state for better illustration, and the guide portion 150*j*3 and the guide portion 150*j*4 of the driving side flange 150 and the slide groove 150*s*4 are depicted by broken lines.

First, as shown in part (b1) of FIG. 17, as for the coupling member 180, the guide portion 150*j*3 and the guide portion 150*j*4 contact the portion-to-be-guided 180*j*3 and the portion-to-be-guided 180*j*4, by the urging force F170 of the urging member 170, so that the axis L181 and the axis L151 are substantially coaxial with each other. At this time, the first projected portion 180*a* and the second projected portion 180*b* of the coupling member 180 this is projected toward the driving side through the opening 150*e* of the driving side flange 150. The urging member 170 is a spring as the elastic member.

As shown in part (a2) of FIG. 17, the coupling member 180 is moved relative to the driving side flange 150 in the direction of the arrow X51 parallel with the axis L183 by a distance p3. Then, as shown in part (b2) of FIG. 17, the coupling member 180 moves along the guide portion 150*j*4 (arrow X61) against the urging force F170 of the urging member 170 while keeping the contact between the portion-to-be-guided 180*j*4 and the guide portion 150*j*4 of the driving side flange 150. At this time, the coupling member 180 is such that the parallelism are maintained between the axis L181 and the axis L151. Therefore, the coupling member 180 is movable in the direction of the arrow X61 to the extent that the round body 180*c* contacts the cylindrical inner wall portion 150*r*1, that is, to the extent that the movement distance p3 of the coupling member 180 in the direction of the axis L183 becomes equal to the gap D. On the hand, the slider 160 is movable only in the direction of the axis L183 by the function of the retention pin 191 and the retention pin 192. Therefore, the slider 160 moves in the direction of the arrow X51 integrally with the retention pin 191 and the retention pin 192 in interrelation with the movement of the coupling member 180 in the direction of the arrow X61.

When the coupling member 180 is moved in the direction opposite to that of the arrow X51, the coupling member 180 moves along the guide portion 150*j*3, similarly.

On the other hand, as shown in part (b3) of FIG. 17, when the coupling member 180 is moved in the direction of the arrow X8, the coupling member 180 moves in the direction of the arrow X8 against the urging force F170 of the urging member 170 in the state that the engaging portion 180*h* is supported by the cylindrical portion 160*a* of the slider 160. At this time, the gaps provided between the portion-to-be-guided 180*j*3, the portion-to-be-guided 180*j*4 of the coupling member 180 and the guide portion 150*j*3, the guide portion 150*j*4 of the driving side flange 150, respectively. The coupling member 180 can move to the state that it is completely accommodated in the inside space portion 150*f* of the driving side flange 150 through the opening 150*e* of the driving side flange 150.

As described in the foregoing, the coupling member 180 is movable relative to the driving side flange 150 in the directions of the axis L181 and the axis L183. In addition, by the contact between the guide portion 150*j*1—the and the portion-to-be-guided 180*j*1 and the contact between the guide portion 150*j*4 and the portion-to-be-guided 180*j*4, the coupling member 180 is movable relative to the driving side flange 150 in the direction of the axis L181 in interrelation with the movement in the direction of the axis L183.

Figure 18:
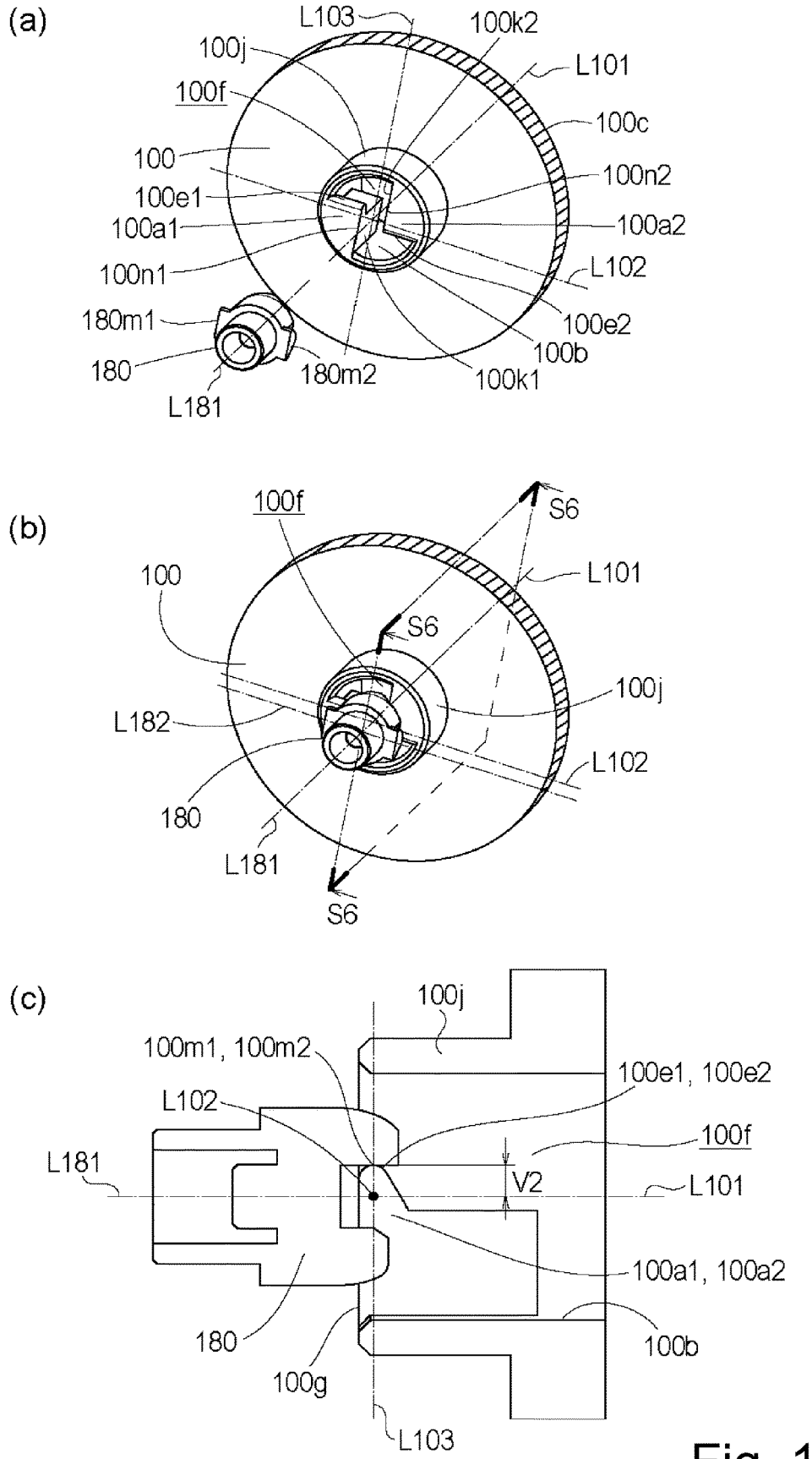
FIG. 18 is a schematic perspective view and a schematic sectional view showing a main assembly side engaging portion in the first embodiment of the present invention.
Figure 19:
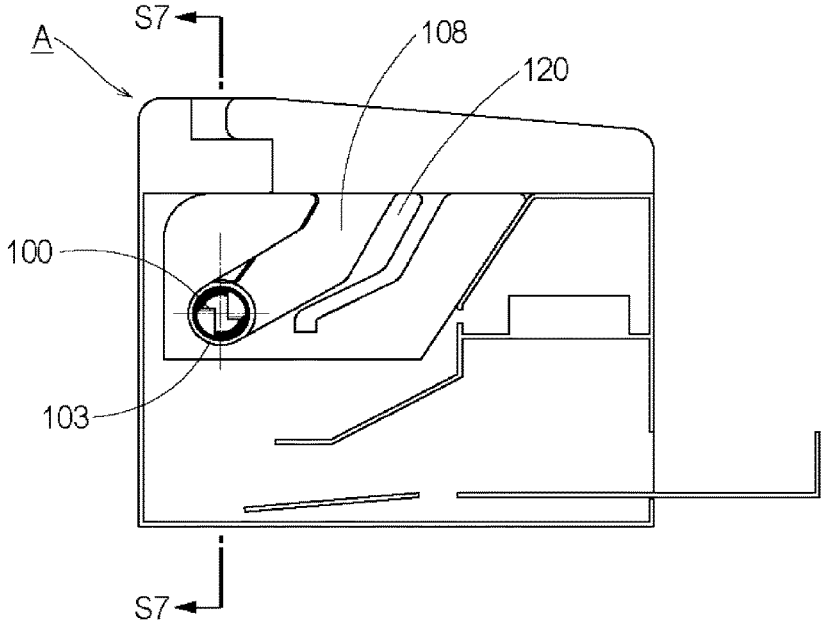
FIG. 19 is an illustration of a supporting structure of the main assembly side engaging portion in the first embodiment of the present invention.
Figure 19:
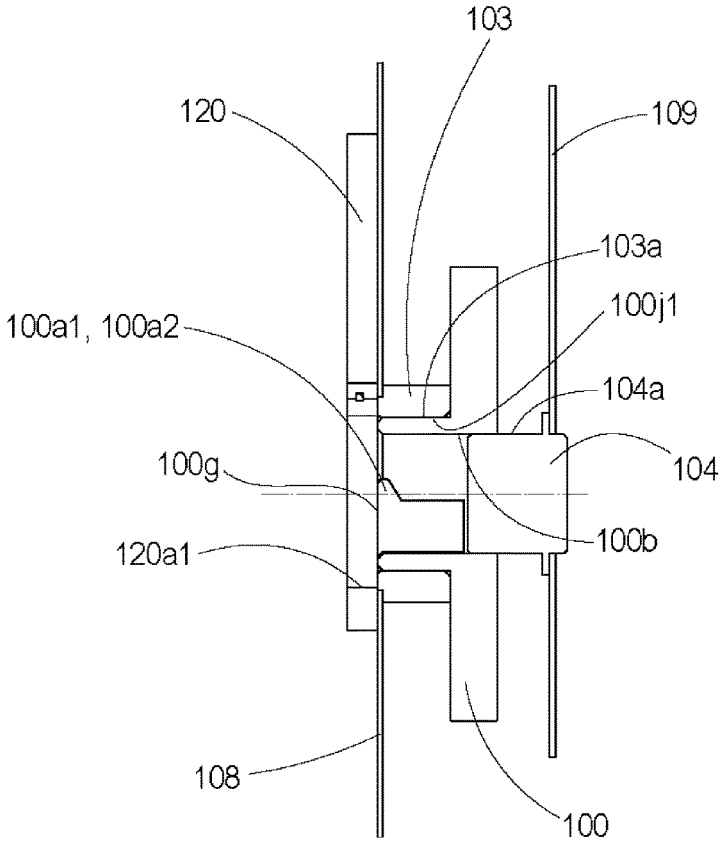

(7) Main Assembly Side Engaging Portion and Driving Structure of the Main Assembly:

Referring to FIGS. 18 and 19, the structures in the main assembly A of the apparatus for rotating the photosensitive drum 10 will be described. FIG. 18 is an illustration of the configuration of the main assembly side engaging portion 100.

In FIG. 17, L101 is a rotational axis when the main assembly side engaging portion 100 rotates, and the rotational axis L101 is called axis L101 in the following description. In addition, the direction perpendicular to the axis L101 is called axis L102, and the direction perpendicular to both of the axis L101 and the axis L102 is called axis L103.

Part (a) of FIG. 18 and part (b) of FIG. 18 are schematic perspective views of the main assembly side engaging portion 100 of the main assembly A of the apparatus. Part (c) of FIG. 18 is a schematic sectional view taken along a line S6 of part (b) of FIG. 18 (plane perpendicular to the axis L102 and including the axis 101). FIG. 19 is an illustration of a supporting method for the main assembly side engaging portion 100. Part (a) of FIG. 19 is a side view of the driving side of the main assembly A of the apparatus, and part (b) of FIG. 19 is a schematic sectional view illustrating a supporting structure of the main assembly side engaging portion 100, taken along a line S7 of part (a) of FIG. 19.

As shown in part (a) of FIG. 18, the main assembly side engaging portion 100 is provided with a cylindrical driving shaft 100*j* and a drive gear portion 100*c*. Inside the driving shaft 100*j*, there are provided a cylindrical inner wall 100*b*, a rotational force applying portion 100*a*1 and a rotational force applying portion 100*a*2. A space in the driving shaft 100*j* defined by the inner wall 100*b*, the rotational force applying portion 100*a*1, the rotational force applying portion 100*a*2 is called space portion 100*f*. As shown in part (b) of FIG. 18 and part (c) of FIG. 18, the coupling member 180 enters the space portion 100*f* and receives the rotational force, in the rotational force transmission operation. A cartridge B side end portion of the space portion 100*f* with respect to the axis L101 is called an opening end portion 100*g*.

The rotational force applying portion 100*a*1 and the rotational force applying portion 100*a*2 have the configurations of a point symmetry with respect to the axis L101 of the main assembly side engaging portion 100 and are provided with a cylindrical surface 100*e*1 and a cylindrical surface 100*e*2 extending along the axis L102, respectively. The portions of the rotational force applying portion 100*a*1 and the rotational force applying portion 100*a*2 most projected in the direction of the axis L103 are a most projected portion 100*m*1 and a most projected portion 100*m*2, respectively. The rotational force applying portion 100*a*1 and the rotational force applying portion 100*a*2 contact the rotational force receiving portion 180*a*3 and the rotational force receiving portion 180*b*3 of the coupling member 180 at the most projected portion 100*m*1 and the most projected portion 100*m*2 to transmit the rotational force to the coupling member 180. The distance is between the axis L101 and the most projected portion 100*m*1 and between the axis 101 and the most projected portion 100*m*2 measured along the axis L103 is called offset V2. As shown in part (a) of FIG. 18, the rotational force applying portion 100*a*1 and the rotational force applying portion 100*a*2 have a flat surface wall portion 100*k*1 and the flat surface wall portion 100*k*2 which are perpendicular to the axis L103. Ridge portions of the flat surface wall portion 100*k*1 and the flat surface wall portion 100*k*2 adjacent to the opening end portion 100 *g* are a retraction force applying portion 100*n*1 and a retraction force applying portion 100*n*2, respectively.

The rotational force applying portion 100*a*1 and the rotational force applying portion 100*a*2 are connected with each other by the inner wall 100*b*, so that the strength thereof is enhanced. Thus, the main assembly side engaging portion 100 can smoothly transmit the rotational force to the coupling member 180.

A drive gear portion 100*c* having a center aligned with the axis L101 is provided in the side opposite from the cartridge B with respect to the direction of the axis L101 of the main assembly side engaging portion 100. The drive gear portion 100*c* is integral or non-rotatably fixed with the main assembly side engaging portion 100, and when the drive gear portion 100*c* rotates about the axis L101, the main assembly side engaging portion 100 also rotates about the axis L101.

As shown in part (a) of FIG. 19 and part (b) of FIG. 19, an inside circumference 103*a* of the bearing member 103 supports an outer configuration portion 100*j*1 of the driving shaft 100*j* of the main assembly side engaging portion 100. An outer configuration portion 104*a* of the bearing member 104 supports an inner wall portion 100*b* of the main assembly side engaging portion 100. The bearing member 103 and the bearing member 104 are fixed on aside plate 108 and a side plate 109 constituting the casing of the main assembly A of the apparatus such that the axes thereof are coaxial with the axis L101, respectively. Therefore, the main assembly side engaging portion 100 is correctly placed at a predetermined position in the main assembly A of the apparatus with respect to the diametrical direction.

Figure 20:
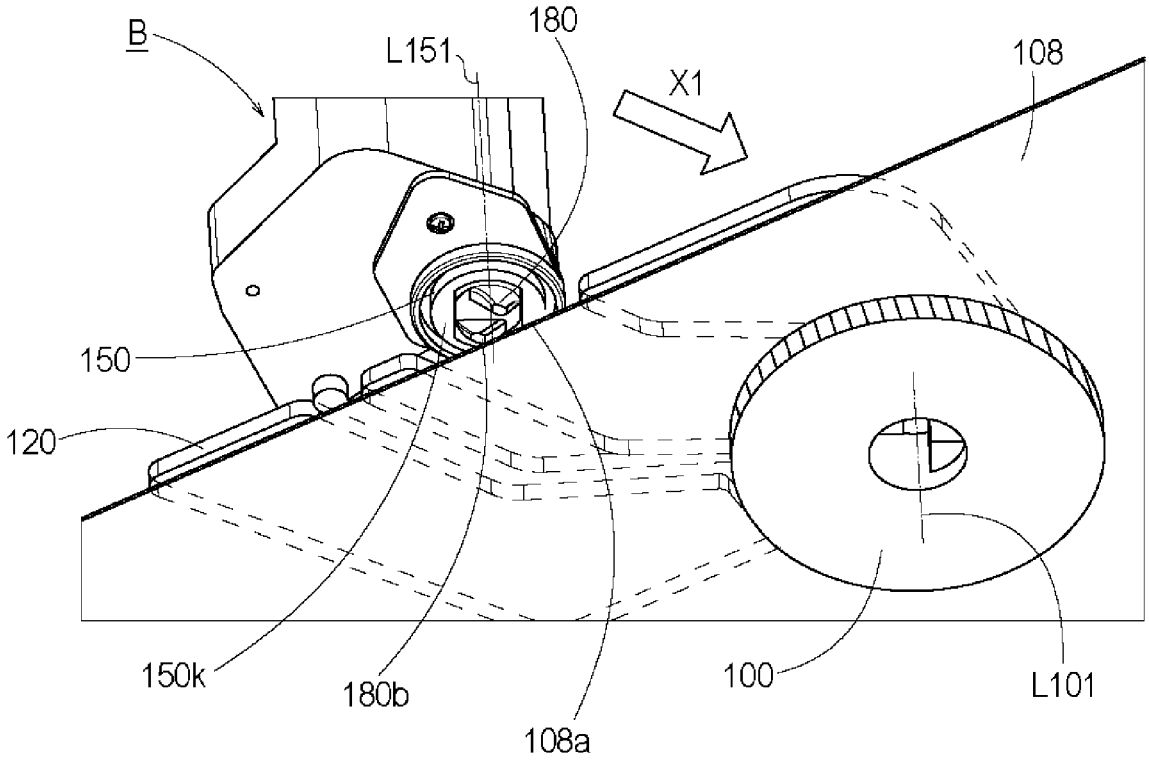
FIG. 20 is a schematic perspective view illustrating a state in the partway of the process cartridge mounting as seen from the driving side in the first embodiment of the present invention.
Figure 21:
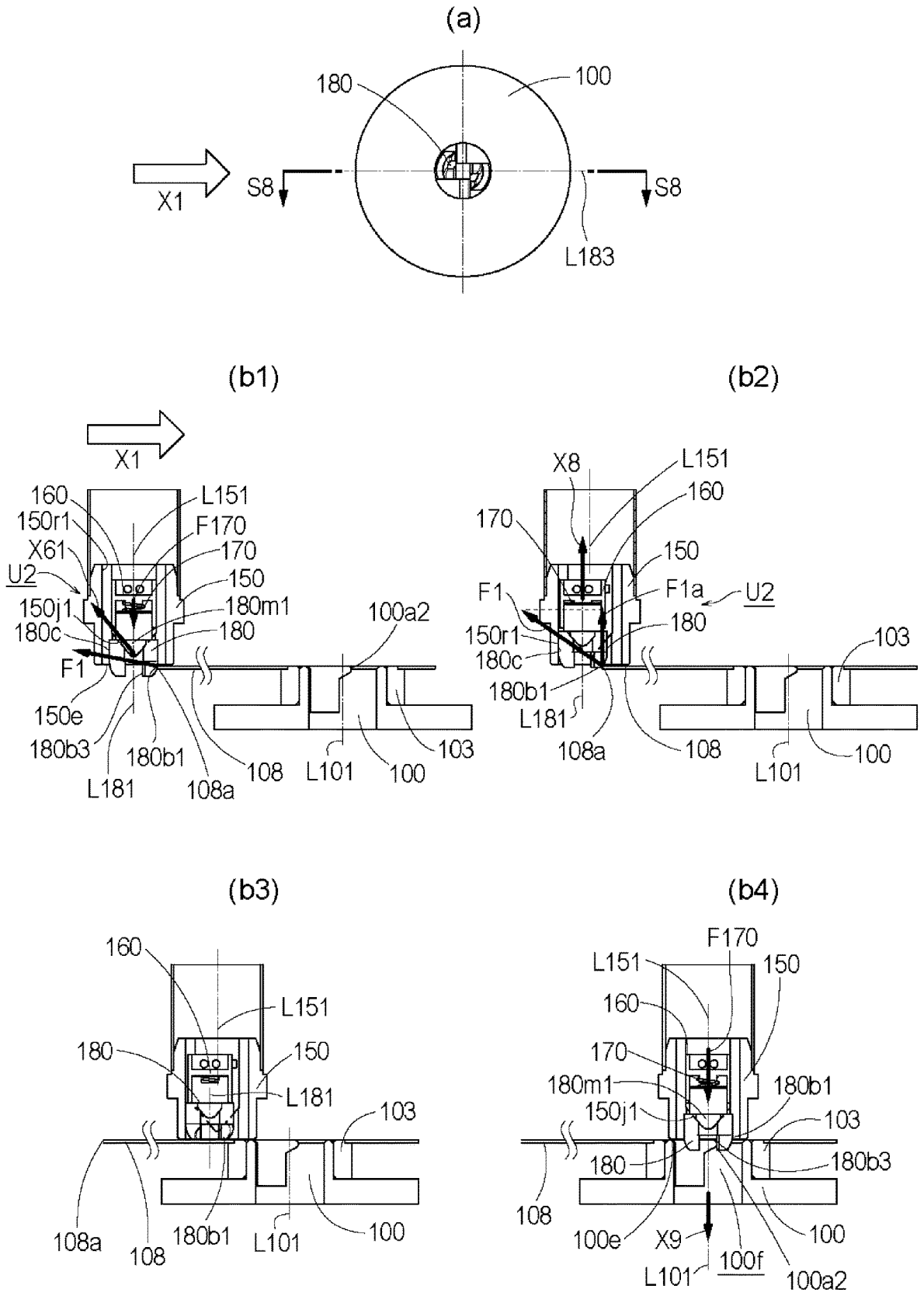
FIG. 21 is an illustration of the operation at the time when the coupling member is engaged with the main assembly side engaging portion in the first embodiment of the present invention.
Figure 22:
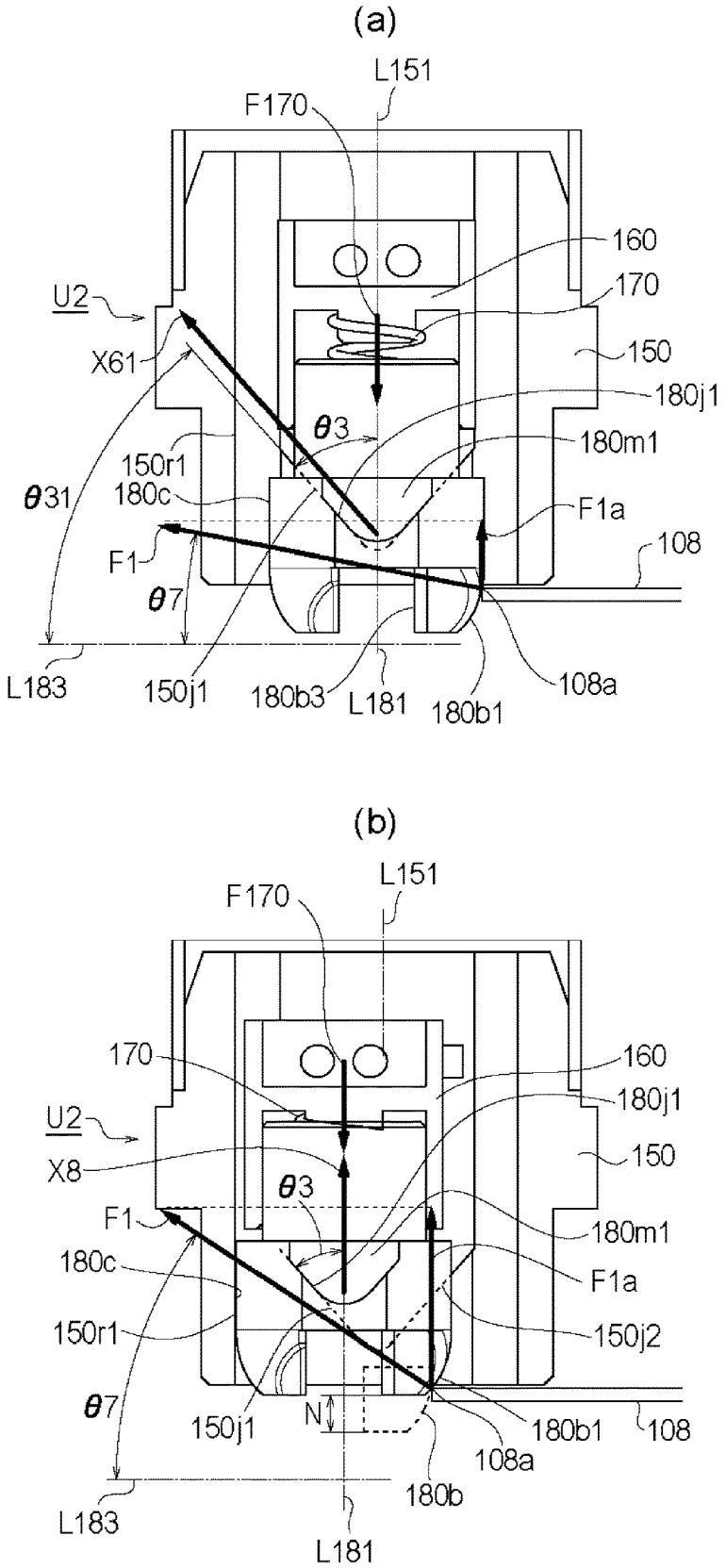
FIG. 22 is an enlarged illustration of the operation at the time when the coupling member is engaged with the main assembly side engaging portion in the first embodiment of the present invention.
Figure 23:
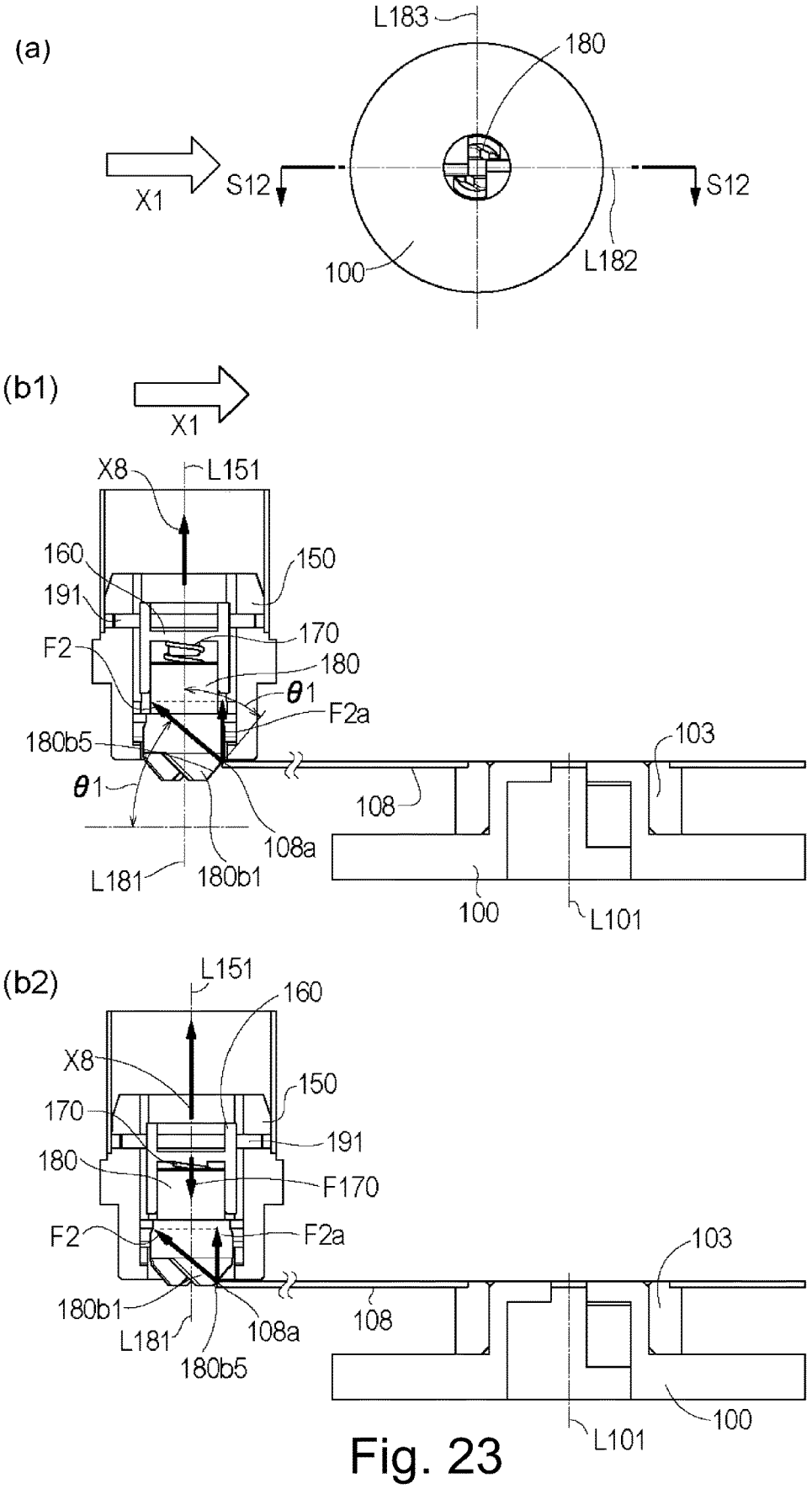
FIG. 23 is an illustration of the operation at the time when the coupling member is engaged with the main assembly side engaging portion in the first embodiment of the present invention.

(8) Engaging Operation of the Coupling Member:

Referring to FIG. 20 to FIG. 23, the engaging operation of the coupling member 180 will be described. FIG. 20 is a perspective view of major parts of the cartridge B in the driving side, in the mounting state of the cartridge B to the main assembly A of the apparatus. FIGS. 21 and 23 are schematic sectional views at the time when the coupling member 180 is brought into engagement with the main assembly side engaging portion 100. Part (a) of FIG. 21 and part (a) of FIG. 23 are an S8 sectional view, and an illustration of the sectional direction of the S12 sectional view. Parts (b1) to (b4) of FIG. 21 shows S8 section of part (a) of FIG. 21, and are schematic sectional views illustrating engagement of the moving coupling member 180 with the main assembly side engaging portion 100. Part (a) of FIG. 22 and part (b) of FIG. 22 are enlarged views of the neighborhood of the driving side flange unit U2 and the contact portion 108*a* as a fixed member shown in part (b1) of FIG. 21 and part (b2) of FIG. 21. In part (b2) of FIG. 21, a first projected portion 180*b* in an initial state of the mounting which will be described hereinafter is shown by broken lines. Part (b1) of FIG. 23 and part (b2) of FIG. 23 show sections taken along lines S12 of part (a) of FIG. 23 and illustrate a process of mounting of the cartridge B. In the following description, "engagement" means the state in which the axis L151 and the axis L101 are substantially coaxial with each other, and the drive transmission is possible from the main assembly side engaging portion 100 to the coupling member 180. The description will be made as to the process of the rotational force receiving portion 180*b*3 contacting the rotational force applying portion 100*a*2 until the engagement between the coupling member 180 in the main assembly side engaging portion 100 is completed, referring to the Figures.

As shown in part (a) of FIG. 21, the description will be made as to the case that the axis L183 of the coupling member 180 and the mounting direction of the cartridge B (arrow X1) are parallel with each other. As shown in FIG. 20, cartridge B moves in the direction (arrow X1) substantially perpendicular to the rotational axis L1 of the photosensitive drum 10 and substantially perpendicular to the axis L151 of the driving side flange 150 to be mounted to the main assembly A of the apparatus. As shown in part (b1) of FIG. 21 and part (a) of FIG. 22, and the time when the cartridge B starts to be mounted to the main assembly A of the apparatus, the coupling member 180 is most projected toward the driving side beyond the opening 150*e* of the driving side flange 150 by the urging force F170 of the urging member 170. This state is the initial state of the mounting. At this time, the coupling member 180 is in the first position (projected position). At this time, the rotational axis L181 of the coupling member 180 is substantially parallel with the rotational axis L1 of the photosensitive drum 10. More particularly, the rotational axis L181 and the rotational axis L1 are substantially aligned with each other. The rotational axis L181 of the coupling member 180 is substantially parallel with the axis L151 of the driving side flange 150. More particularly, the rotational axis L181 and the rotational axis L151 are substantially aligned with each other.

When the cartridge B is moved in the direction of the arrow X1 from the initial state of the mounting, the main assembly contact portion 180*b*1 of the coupling member 180 contacts the contact portion 108*a* of the side plate 108 of the main assembly A of the apparatus. As shown in part (b1) of FIG. 21 and part (a) of FIG. 22, the main assembly contact portion 180*b*1 receives the force F1 (retraction force) from the contact portion 108*a* as the fixed member. The force F1 is directed substantially toward the center of the substantially spherical surface constituting the main assembly contact portion 180*b*1, and therefore, it is inclined by an angle θ7 which is smaller than a complementary angle θ31 of the angle θ3 relative to the axis L183. Therefore, when the coupling member 180 receives the force F1, moves in the direction of the arrow X61 along the guide portion 150*j*1 against the urging force F170 of the urging member 170 while keeping the contact between the portion-to-be-guided 180*j*1 and the guide portion 150*j*1 of the driving side flange 150.

As shown in part (b2) of FIG. 21 and part (b) of FIG. 22, the cartridge B is further moved in the direction of the arrow X1. Then, the round body 180*c* of the coupling is brought into contact to the cylindrical inner wall portion 150*r*1 of the driving side flange 150, so that the movement of the coupling member 180 relative to the driving side flange 150 in the direction of the arrow X61 is limited. At this time, an amount the movement of the coupling member 180 from the initial state of the mounting in the direction of the axis L181 is movement distance N (part (b) of FIG. 22). The movement distance N is determined by the gap D (part (c) of FIG. 11) and the angle θ3 (FIG. 15) of the guide portion 150*j*1—guide portion 150*j*4 relative to the axis L181.

In the state shown in part (b) of FIG. 22, the coupling member 180 has moved by the movement distance N in the direction of the arrow X8 from the initial state of the mounting. Because the force F1 is directed toward the center of the substantially spherical surface constituting the main assembly contact portion 180*b*1, the angle θ7 Between the direction of the force F1 and in the axis L183 is larger than that at the initial state of the mounting. With this, a component force F a of the force F1 in the direction of the arrow X8 increases the as compared with that of the initial state of the mounting. By the component force F1*a*, the coupling member 180 moves further in the direction of the arrow X8 against the urging force F170 of the urging member 170, so that the coupling member 180 can pass by the contact portion 108*a* of the side plate 108.

Thereafter, as shown in part (b3) of FIG. 21, the cartridge B move in the direction of the arrow X1 while keeping the coupling member 180 in the space portion 150*f* of the driving side flange 150. The position of the coupling member 180 shown in part (b3) of FIG. 21 is a second position (retracted position). At this time, the rotational axis L181 of the coupling member 180 is substantially parallel with the rotational axis L1 of the photosensitive drum 10. More specifically, there is a gap between the rotational axis L181 and the rotational axis L1 (the rotational axis L181 and the rotational axis L1 are substantially out of alignment). The rotational axis L181 of the coupling member 180 is substantially parallel with the axis L151 of the driving side flange 150. More specifically, at this time, there is a gap between the rotational axis L181 and the rotational axis L151 (the rotational axis L181 and the rotational axis L1 are substantially out of alignment). In the second position (retracted position), the coupling member 180 is displaced (moved/retracted) toward the photosensitive drum 10 (the other end portion side of the photosensitive drum 10 in the longitudinal direction), as compared with that in the first position (projected position).

As shown in part (b4) of FIG. 21, when the cartridge B is moved to the complete mounted position, the axis L101 of the main assembly side engaging portion 100 and the axis L151 of the driving side flange 150 are made substantially coaxial with each other by positioning means for determining the position of the cartridge B relative to the main assembly A of the apparatus. At this time, the coupling member 180 is moved in the direction indicated by the arrow X9 by the urging force F170 of the urging member 170. Simultaneously, the coupling member 180 is moved along the guide portion 150*j*1, so that the axis 1*o* L181 is aligned with the axis L151 of the driving side flange 150.

The coupling member 180 enters the space portion 100*f* of the main assembly side engaging portion 100. At this time, the coupling member 180 is overlapped with the main assembly side engaging portion 100 in the direction of the axis L101. Simultaneously, the rotational force receiving portion 180*b*3 is opposed to the rotational force applying portion 100*a*2, so that the rotational force receiving portion 180*a*3 is opposed to the rotational force applying portion 100*a*1. In this manner, the coupling member 180 is engaged with the main assembly side engaging portion 100 to enable the rotation of the coupling member 180. The position of the coupling member 180 at this time is substantially the same as the above-described first position (projected position).

When the cartridge B is moved to the complete mounted position, the first projected portion 180*a* and the second projected portion 180*b* may be overlapped with the rotational force applying portion 100*a*1 and the rotational force applying portion 100*a*2 as seen in the direction of the axis L101, depending on the rotational phase of the main assembly side engaging portion 100. In such a case, the coupling member 180 cannot enter the space portion 100*f* In such a case, by the main assembly side engaging portion 100 being rotated by a driving source which will be described hereinafter, the first projected portion 180*a*, the second projected portion 180*b* and the rotational force applying portion 100*a*1, the rotational force applying portion 100*a*2 become not overlapping with each other as seen in the direction of the axis L101. Then, the coupling member 180 becomes capable of entering the space portion 100*f* by the urging force F170 of the urging member 170. That is, main assembly side engaging portion 100 is capable of engaging, while being rotated by the driving source, with the coupling member 180, which then starts to rotate.

As shown in part (a) of FIG. 23, the description will be made as to the case that the axis L183 of the coupling member 180 is perpendicular to the mounting direction of the cartridge B (arrow X1).

As shown in part (b1) of FIG. 23, the cartridge B is moved in the direction of the arrow X1. Then, the third main assembly contact portion 180*b*5 contacts and the contact portion 108*a*. At this time, the third main assembly contact portion 180*b*5 receives a force F2 from the contact portion 108*a* because of the mounting movement of the cartridge B. The third main assembly contact portion 180*b*5 is inclined relative to the axis L181 by the angle θ1 (part (b) of FIG. 14) as described hereinbefore, and therefore, the forcing F2 is inclined relative to the axis L182 by the angle θ1, and a component force F2*a* of the force F2 in the direction of the arrow X8 is produced. Therefore, when the cartridge B is moved further in the direction of the arrow X1, the coupling member 180 is moved by the component force F2*a* In the direction of the arrow X8 against the urging force F170 of the urging member 170 to pass by the contact portion 108*a* as shown in part (b2) of FIG. 23. Here, the angle θ1 formed between the third main assembly contact portion 180*b*5 and the axis L181 is selected such that the coupling member 180 can move in the direction of the arrow X8 by the component force F2*a* against the urging force F170 of the urging member 170. Thereafter, similarly to the case of the part (b3) of FIG. 21 and part (b4) of FIG. 21, the cartridge B can be moved to the complete mounted position while keeping the coupling member 180 in the space portion 150*f* of the driving side flange 150.

The foregoing description has been made with respect to the case in which the mounting direction X1 of the cartridge B is parallel with or perpendicular to the axis L183. However, when the direction of the axis L183 is different from the mounting direction in an and the angle, the coupling member 180 moves in the direction of the arrow X8, similarly, and therefore, the coupling member 180 can pass the contact portion 108*a*. The coupling member 180 is moved by the force F1 along the guide portion 150*j*1—the guide portion 150*j*4 in the direction indicated by the arrow X8, or by the component force F1*a* or the component force F2*a* of the force F1 or the force F2 in the arrow X8 direction.

Therefore, with the above-described structure, the cartridge B can be mounted to the main assembly A of the apparatus irrespective of the rotational phases of the coupling member 180 and the main assembly side engaging portion 100 relative to the mounting direction of the cartridge B to the main assembly A of the apparatus.

As described above, according to the structure of the present invention, the coupling member 180 can be engaged with the main assembly side engaging portion 100 with a simple structure, without using a complicated structure for the main assembly A of the apparatus or the cartridge B.

In this embodiment, the contact portion 108*a* of the side plate 108 shown in FIG. 20 is in the form of an edge, but the contact portion 108*a* may be beveled or rounded. By doing so, in the movement of the cartridge B in the direction of the arrow X1, the coupling member 180 easily moves in the direction of the arrow X8, and therefore, the load in the mounting of the cartridge B to the main assembly A of the apparatus can be reduced. In addition, the occurrences of the damage and/or dent attributable to the contact between the main assembly contact portion 180*b*1 and the contact portion 108*a* can be reduced.

In addition, in this embodiment, as shown in part (b) of FIG. 14, the third main assembly contact portion 180*a*5 and the third main assembly contact portion 180*b*5 are inclined relative to the axis L181 by the angle θ1. However, the third main assembly contact portion 180*a*5 and the third main assembly contact portion 180*b*5 may be provided by a spherical surface into with the main assembly contact portion 180*a*1 and the main assembly contact portion 180*b*1.

Figure 24:
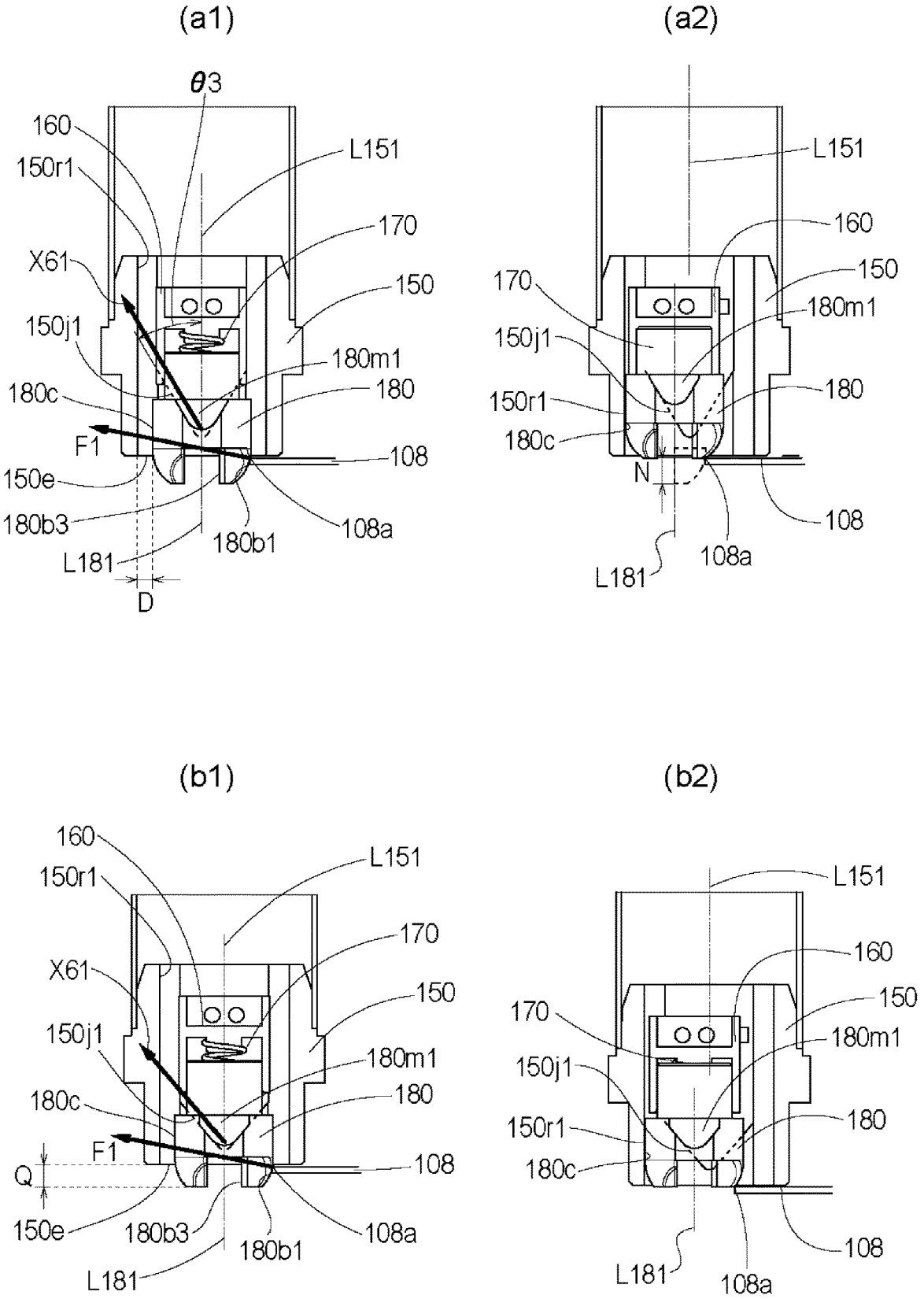
FIG. 24 is an illustration of the operation at the time when the coupling member is engaged with the main assembly side engaging portion in the first embodiment of the present invention.

Furthermore, in this embodiment, as shown in part (b2) of FIG. 21, the coupling member 180 moves in the direction of the arrow X8 after the round body 180*c* contacts the cylindrical inner wall portion 150*r*1. However, it is a possible alternative that at the time of the contact of the round body 180*c* to the cylindrical inner wall portion 150*r*1, the coupling member 180 passes the contact portion 108*a*. To provide such a structure, as shown in part (a1) of FIG. 24 and part (a2) of FIG. 24, for example, the inclination θ3 is reduced, or the gap D is increased, by which the movement distance N is increased. Or, as shown in part (b1) of FIG. 24 and part (b2) of FIG. 24, projection amounts Q of the first projected portion 180*a* and the second projected portion 180*b* from the opening 150*e* of the driving side flange 150 toward the driving side may be reduced. In such a case, the leading side surface 180*a*4 and the leading side surface 180*b*4 of the coupling member 180 are moved toward the arrow X8 beyond the contact portion 108*a* to pass the contact portion 108*a*, only by the movement along the guide portion 150*j*1—the guide portion 150*j*4. Therefore, it is unnecessary to produce the component force F1*a* of the force F1 in the direction of the arrow X8. Therefore, it is unnecessary that the configurations of the main assembly contact portion 180*a*1 and the main assembly contact portion 180*b*1 are substantially spherical (that is, the angle θ7 in FIG. 22 is 0°). By doing so, the design latitude for the first projected portion 180*a* and the second projected portion 180*b* is enhanced.

Figure 25:
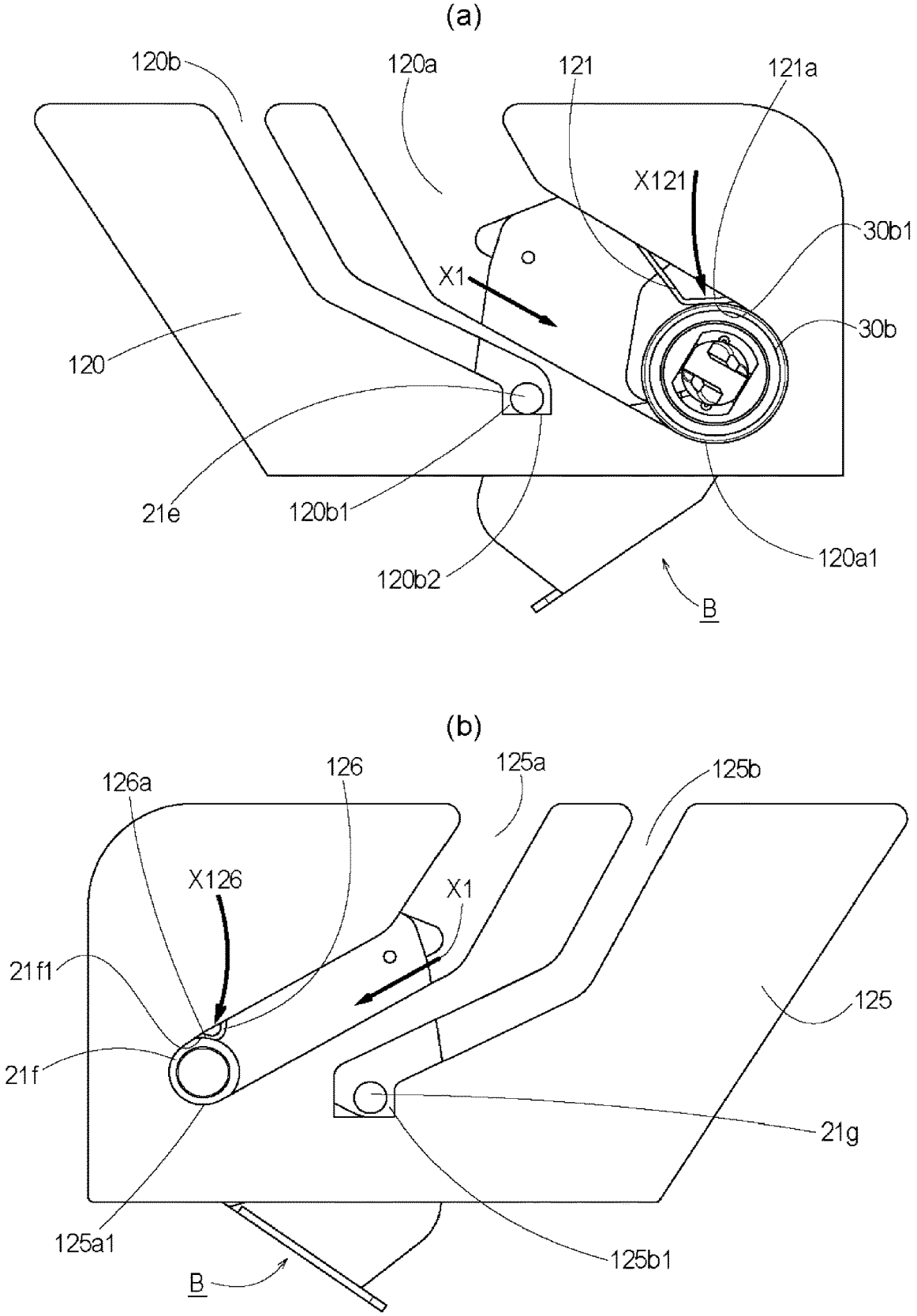
FIG. 25 is an illustration of a state in which the process cartridge mounting is completed in the first embodiment of the present invention.
Figure 26:
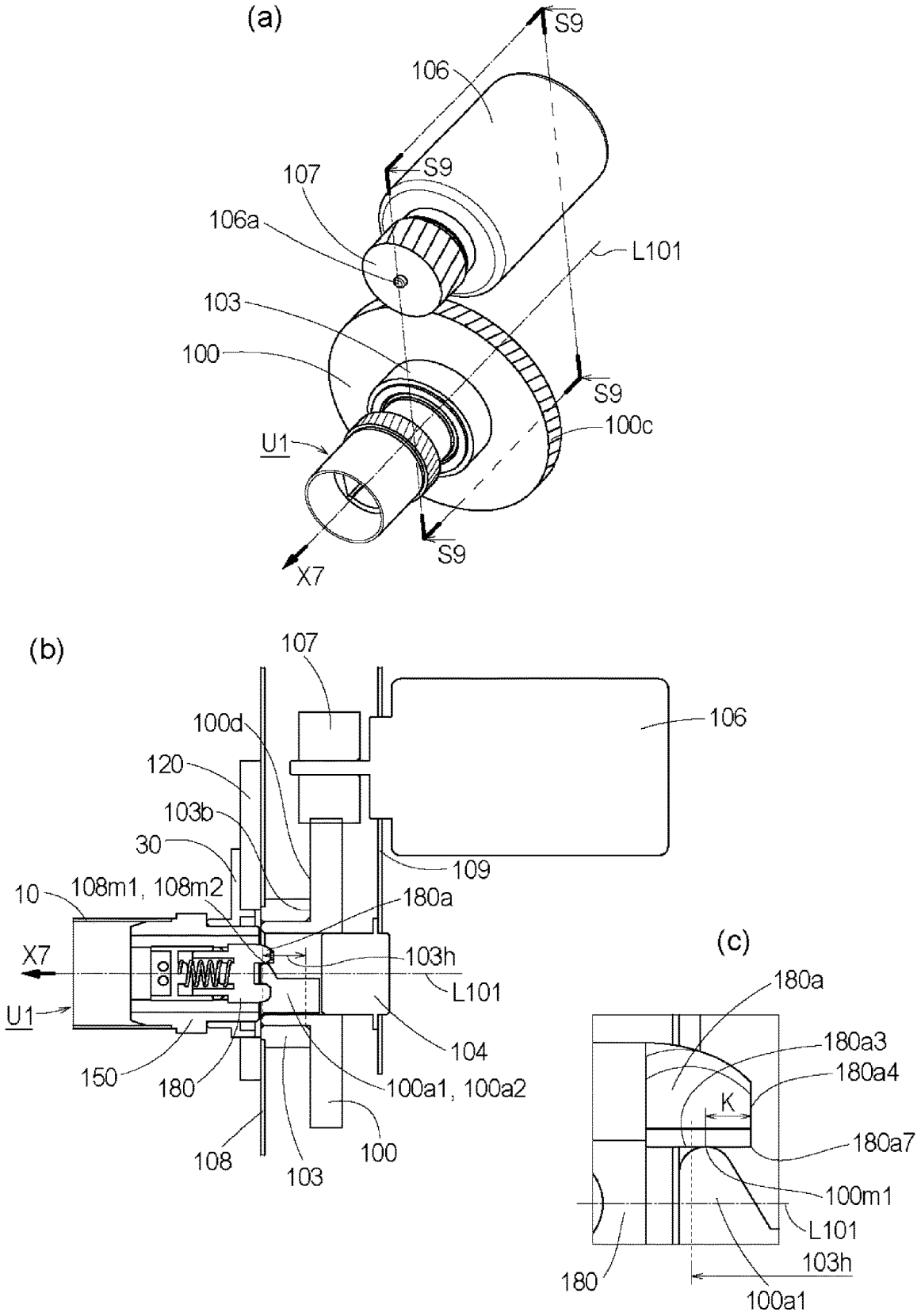
FIG. 26 is a schematic perspective view and a schematic sectional view illustrating a driving structure for the main assembly of the electrophotographic image forming apparatus and the photosensitive member unit in the first embodiment of the present invention.
Figure 27:
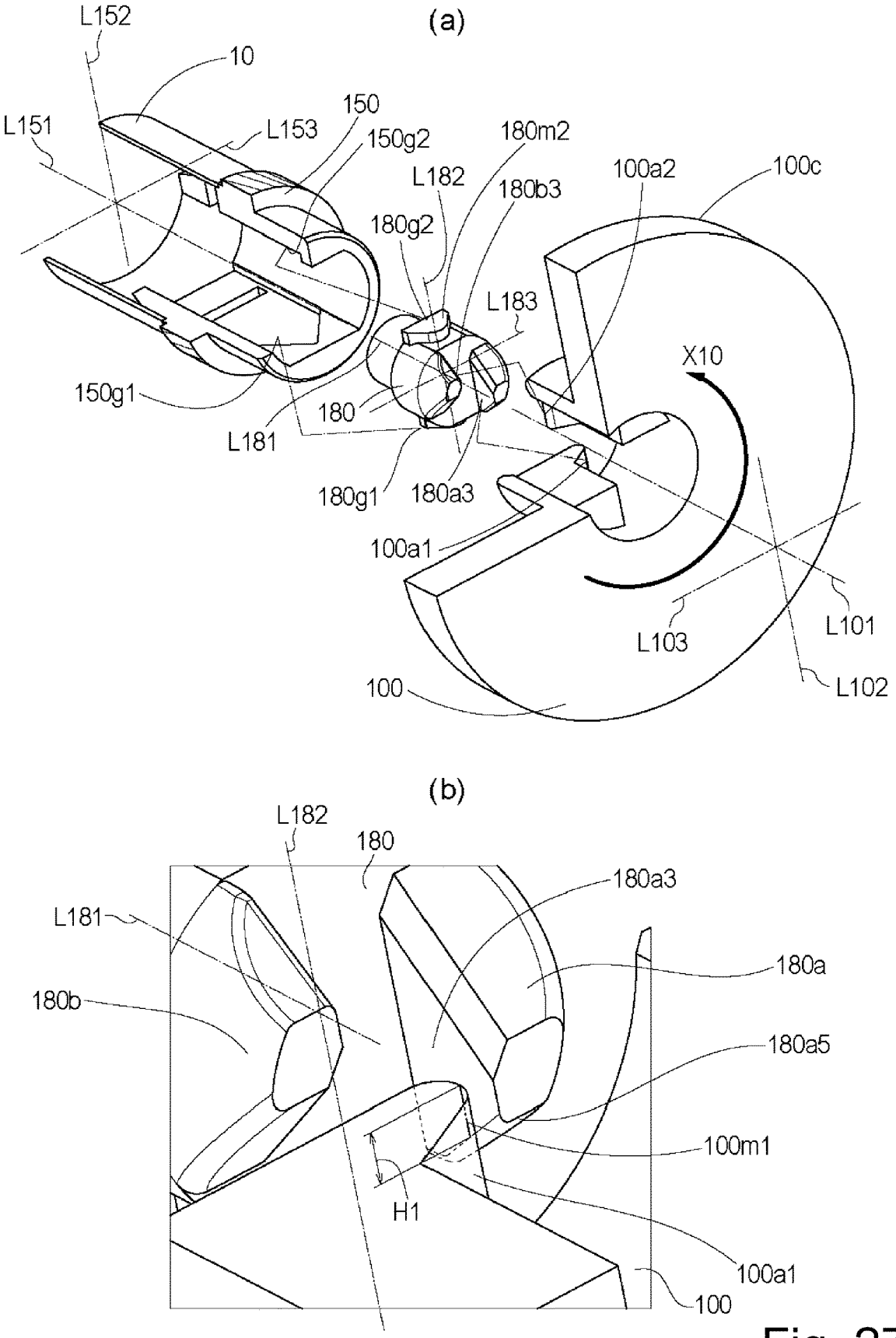
FIG. 27 is a perspective sectional view showing a rotational force transmission path in the first embodiment of the present invention.

(9) Rotational Force Transmitting Operation to the Coupling:

Referring to FIG. 25 through FIG. 27, the rotational force transmitting operation when the photosensitive drum 10 is rotated will be described. FIG. illustrates the complete mounted position of the cartridge B. Part (a) of FIG. 25 is a view as seen from the driving side, and part (b) of FIG. 25 is a view as seen from the non-driving side. FIG. 26 is a schematic perspective view illustrating the driving structure of the main assembly A of the apparatus. Part (a) of FIG. 26 is a schematic perspective view of a drive transmission path, and part (b) of FIG. 26 is a schematic sectional view taken along a line S9 of part (a) of FIG. 26. Part (c) of FIG. 26 is an enlarged view of the neighborhood of the first projected portion 180*a* of part (b) of FIG. 26. Part (a) of FIG. 27 is a perspective sectional view illustrating a rotational force transmission path. Part (b) of FIG. 27 is an enlarged schematic perspective view illustrating the contact between the rotational force applying portion 100*a*1 and the rotational force receiving portion 180*b*3, and which parts behind the rotational force applying portion 100*a*1 are indicated by broken lines.

Referring first to FIG. 25, the positioning of the cartridge B in the main assembly A of the apparatus at the time of rotational force transmission will be described. When the cartridge B is mounted in the complete mounted position, the driving side supported portion 30*b* is received by a positioning portion 120*a*1 provided in a downstream side of the first guide portion 120*a* with respect to the cartridge mounting direction X1. Simultaneously, the non-driving side supported portion 21*f* is received by a positioning portion 125*a*1*p* rovided in a downstream side of a second guide portion 125*a* with respect to the cartridge mounting direction X1. In the driving side of the main assembly A of the apparatus, a driving side urging spring 121 is provided which urges an urging portion 121*a* toward the cartridge positioning portion 120*a*1 (arrow X121 direction). When the cartridge B is mounted in the complete mounted position, the urging portion 121*a* of the driving side urging spring 121 contacts an urged portion (portion-to-be-urged) 30*b*1 of the driving side supported portion 30*b*, and the driving side supported portion 30*b* is urged so as to contact to the cartridge positioning portion 120*a*1. Similarly, in the non-driving side of the main assembly A of the apparatus, there is provided a non-driving side urging spring 126 which urges an urging portion 126*a* toward the cartridge positioning portion 125*a*1 (arrow X125 direction). When the cartridge B is mounted in the complete mounted position, the urging portion 126*a* of the non-driving side urging spring 126 contacts the urged portion 21*f*1 of the non-driving side supported portion 21*f*, and the non-driving side supported portion 21*f* is urged to contact to the cartridge positioning portion 125*a*1. By this, the position of the cartridge B relative to the main assembly A of the apparatus is determined. At this time, a rotation preventing portion 21*e* is accommodated in a rotational position regulating portion 120*b*1 provided in the downstream side of the lower guide portion 120*b* with respect to the mounting direction X1 so as to contact to a rotational position regulation surface 120*b*2. On the other hand, the non-driving side guide portion 21 *g* is accommodated in an accommodating portion 125*b*1 provided in a downstream side of a lower guide portion 125*b* with respect to the mounting direction X1.

In this manner, the cartridge B is correctly positioned in the cartridge positioning portion 120*a*1 and the cartridge positioning portion 125*a*1 of the main assembly A of the apparatus.

The rotational force transmitting operation at the time of rotating the photosensitive drum 10 will be described.

As shown in part (a) of FIG. 26 and part (b) of FIG. 26, a motor 106 as the driving source of the main assembly A of the apparatus is fixed on the side plate 109 constituting in the casing of the main assembly A of the apparatus and is provided with a coaxial pinion gear 107 integrally rotatable with the motor 106. As described in hereinbefore, the main assembly side engaging portion 100 is correctly positioned in the diametrical direction in the main assembly A of the apparatus such that the driving gear portion 100*c* and the pinion gear 107 are in meshing engagement with each other. Therefore, when the motor 106 rotates, the main assembly side engaging portion 100 rotates through the driving gear portion 100*c*.

In addition, as shown in part (b) of FIG. 26 and part (c) of FIG. 26, the main assembly side engaging portion 100 is positioned such that in the rotational force transmission operation, the most projected portion 100*m*1 and the most projected portion 100*m*2 are within the supporting range 103*h* with respect to the direction of the axis L101. Here, the supporting range 103*h* is the range in which the bearing member 103 and the main assembly side engaging portion 100 contact each other when the bearing member 103 rotatably supports the main assembly side engaging portion 100. By this, axis tilting of the main assembly side engaging portion 100 which may be caused by the load in the rotational force transmission for the main assembly side engaging portion 100 during the rotational force transmission can be suppressed. Therefore, unevenness of the rotation of the main assembly side engaging portion 100 attributable to the axis tilting can be suppressed, and the rotational force is smoothly transmitted to the coupling member 180 from the main assembly side engaging portion 100, and therefore, the photosensitive drum 10 can be rotated precisely.

The driving gear portion 100*c* and the pinion gear 107 are helical gears. The twist angles of the helical gear are selected such that the main assembly side engaging portion 100 is urged in the direction of the arrow X7 which is parallel with the axis L101, by the rotational force provided by the motor 106. By the contact between the contact portion 100*d* of the main assembly side engaging portion 100 and the contact portion 103*b* of the bearing member 103, the movement of the main assembly side engaging portion 100 in the direction of the arrow X7 is limited. By this, the position of the main assembly side engaging portion 100 in the axis L101 direction relative to the main assembly A of the apparatus is determined. In addition, a variation of the engagement amount K between the main assembly side engaging portion 100 and the coupling member 180 which will be described hereinafter can be reduced. Here, the engagement amount K is a length from the most projected portion 100*m*1 of the rotational force applying portion 100*a*2 to the free end corner portion 180*a*7 of the rotational force receiving portion 180*a*3, measured in the direction of the axis 181, as shown in part (c) of FIG. 26.

As shown in part (a) of FIG. 27, the main assembly side engaging portion 100 is rotated in the direction indicated by X10, by the rotational force received from the motor 106 as the driving source. The rotational force applying portion 100*a*1 and the rotational force applying portion 100*a*2 provided on the main assembly side engaging portion 100 contact the rotational force receiving portion 180*a*3 and the rotational force receiving portion 180*b*3 of the coupling member 180, respectively. By this, the rotational force is transmitted from the main assembly side engaging portion 100 to the coupling member 180. In the following, the state in which the rotational force applying portion 100*a*1 and the rotational force applying portion 100*a*2 contact the rotational force receiving portion 180*a*3 and the rotational force receiving portion 180*b*3 of the coupling member 180 is called "two-point-contact".

In this embodiment, the offset V1 (part (c) of FIG. 18) which is the distance between the axis L101 and the most projected portion 100*m*1 is the same as the offset V2 (part (b) of FIG. 14) which is the distance between the axis L181 and the rotational force receiving portion 180*a*3. By doing so, when the rotational force applying portion 100*a*1 contacts the rotational force receiving portion 180*a*3, the axis L182 of the coupling member 180 and the axis L102 of the main assembly side engaging portion 100 are parallel with each other. Then, as shown in part (b) of FIG. 27, the rotational force applying portion 100*a*1 contacts the rotational force receiving portion 180*a*3 at the most projected portion 100*m*1, and the contact range has a width in the direction of the axis L182 (contact width H1). Similarly, the rotational force applying portion 100*a*2 and the rotational force receiving portion 180*b*3 contact to each other with a contact width H2 (unshown). In this embodiment, when the rotational force applying portion 100*a*1 and the rotational force receiving portion 180*a*3 contact each other, the axis L182 and the axis L102 are parallel with each other, but the axis L182 may be made inclined relative to the axis L102 by making the offset V1 and the offset V2 different from each other.

On the other hand, as described hereinbefore, the rotational force transmitting portion 180*g*1 and the rotational force transmitting portion 180*g*2 fit the rotational force receiving portion 150*g*1 and the rotational force receiving portion 150*g*2 with almost no gap in the direction of the axis L182 (part (c) of FIG. 15), and therefore, the substantially parallel state is maintained therebetween. By this, the coupling member 180 can transmit the rotation about the axis L181 the driving side flange 150. Therefore, the rotation of the coupling member 180 is transmitted to the driving side flange 150 through the rotational force transmitting portion 180*g*1, the rotational force transmitting portion 180*g*2, the rotational force receiving portion 150*g*1 and the rotational force receiving portion 150*g*2.

As described above, the rotational force is transmitted from the main assembly side engaging portion 100 to the photosensitive drum 10 through the coupling member 180 and the driving side flange 150, thus rotating the photosensitive drum 10.

In this embodiment, in the rotational force transmitting operation, the main assembly side engaging portion 100 is placed in a predetermined position in the main assembly A of the apparatus with respect to the radial direction. In addition, the driving side flange 150 is also placed in a predetermined position in the main assembly A of the apparatus through the cartridge B with respect to the radial direction. The main assembly side engaging portion 100 in the predetermined position and the driving side flange 150 in the predetermined position are connected with each other by the coupling member 180. When the main assembly side engaging portion 100 and the driving side flange 150 are positioned such that the axis L151 and the axis L101 are substantially coaxial with each other, the coupling member 180 rotates with the axis L181 in the axis L101 substantially aligned with each other. Therefore, the main assembly side engaging portion 100 is capable of smooth three transmitting the rotational force to the photosensitive drum 10 through the coupling member 180.

Figure 28:
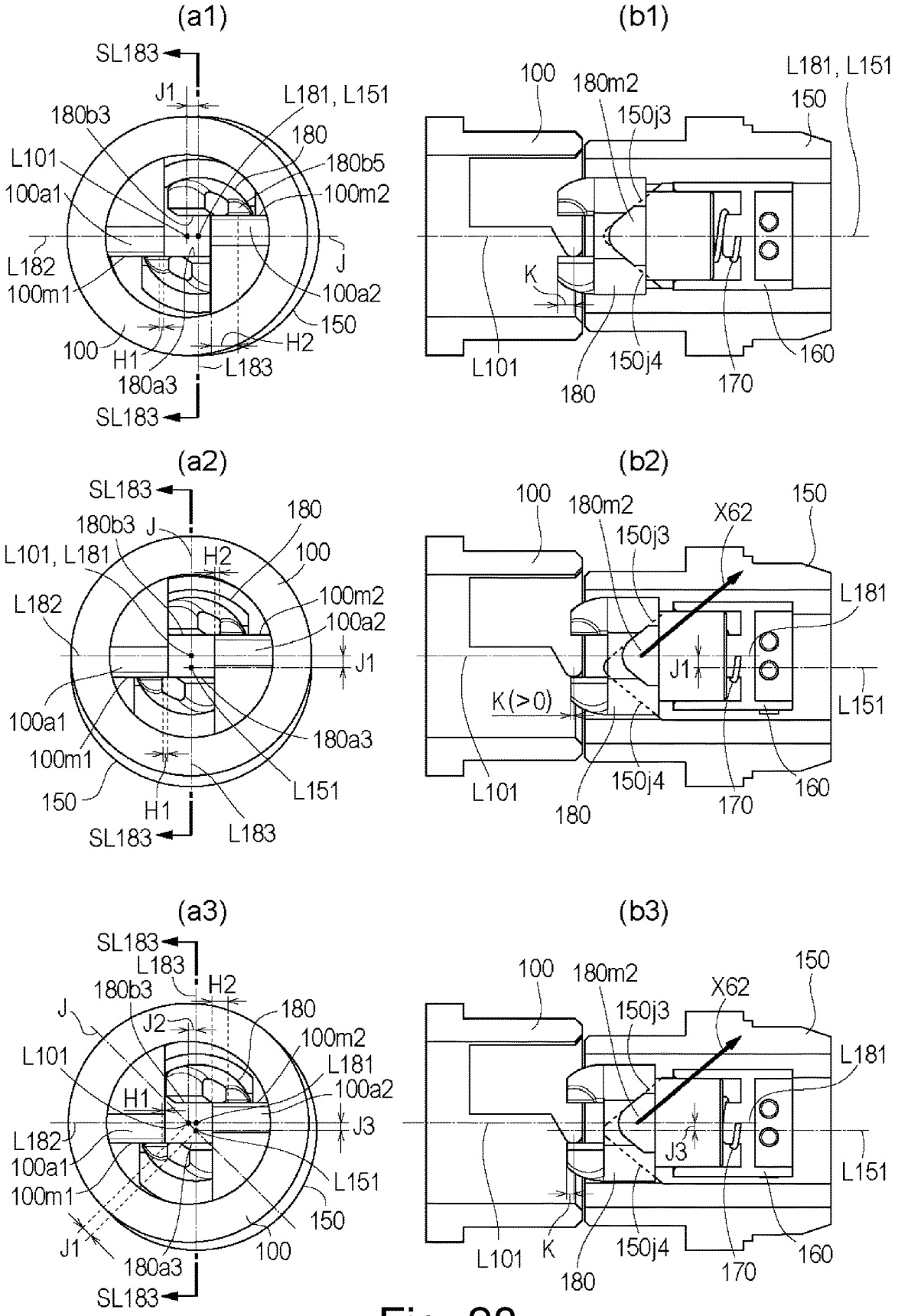
FIG. 28 is a sectional view shown in a state of the time of the rotational force transmission in the first embodiment of the present invention.

On the other hand, as shown in FIG. 28, the axis L151 and the axis L101 may be more or less deviated from the coaxial state due to the variation or the like in the part dimensions. Referring to FIG. 28, the drive transmission when the axis L151 and the axis L101 are deviated will be described. The direction in which the axis L151 and the axis L101 are deviated from each other is called "axis deviating direction J", and the amount of the deviation is called "shaft deviation amount J1". Part (a1) through part (a3) of FIG. 28 shows the state of drive transmission as seen from the driving side. Part (a1) of FIG. 28 shows the state in which the axis deviating direction J and the axis L183 are perpendicular to each other, part (a2) of FIG. 28 shows the state in which the axis deviating direction J and the axis L183 are parallel with each other, and part (a3) of FIG. 28 shows the state in which the axis deviating direction J is inclined relative to the axis L183. Part (b1)-part (b3) of FIG. 28 are sectional schematic sectional view taken along a plane SL183 parallel with the axis L183 in the part (a1)-part (a3) of FIG. 28.

Referring to part (a1) of FIG. 28, the description will be made as to the case that the axis deviating direction J is perpendicular to the axis L183. In this case, the coupling member 180 is unable to move in the direction of the axis L182 relative to the driving side flange 150, and therefore, the coupling member 180 moves by the amount of the shaft deviation amount J1 in the direction of the axis L182 relative to the main assembly side engaging portion 100. Then, corresponding to the shaft deviation amount J1, the engagement width H1 between the rotational force applying portion 100*a*1 and the rotational force receiving portion 180*a*3 becomes small, and to the contrary, the engagement width H2 between the rotational force applying portion 100*a*2 and the rotational force receiving portion 180*b*3 becomes large. That is, the main assembly side engaging portion 100 and the coupling member 180 are brought into the two-point-contact to each other while changing the engagement width H1 and the engagement width H2.

The description will be made as to the case that the axis deviating direction J is parallel with the axis L183 as shown in part (a2) of FIG. 28. In this case, the coupling member 180 is unable to move in the direction of the axis L183 relative to the main assembly side engaging portion 100, and therefore, the coupling member 180 moves by the shaft deviation amount J1 in the direction of the axis L183 relative to the driving side flange 150. As shown in part (b2) of FIG. 28, with the movement of the coupling member 180 toward the axis L183, the coupling member 180 moves in the direction of an arrow X62 on the guide portion 150*j*3. In this state, the main assembly side engaging portion 100 and the coupling member 180 can be brought into the two-point-contact.

Referring to part (a3) of FIG. 28, the description will be made as to the case that the axis deviating direction J is inclined relative to the axis L183. A component of the shaft deviation amount J1 in the axis L182 direction is deviation J2, and a component in the axis L183 direction is deviation J3. Then, the coupling member 180 moves by the amount of the deviation J2 in the axis L182 direction relative to the main assembly side engaging portion 100, and the engagement width H1 and the engagement width H2 change. In addition, the coupling member 180 moves by the shaft deviation amount J3 in the axis L183 direction relative to the driving side flange 150, and moves in the direction of the arrow X62 (part (b3) of FIG. 28). In this state, the main assembly side engaging portion 100 and the coupling member 180 can be brought into the two-point-contact. When the coupling member 180 is driven, the axis L183 becomes perpendicular, parallel and inclined relative to the axis deviating direction J. Therefore, the coupling member 180 takes one of the states shown in FIG. 28 while moving in the direction of the axis L183 relative to the driving side flange 150 and while moving in the direction of the axis L182 relative to the main assembly side engaging portion 100. By this, the coupling member 180 can keep the two-point-contact with the main assembly side engaging portion 100. During one full rotation of the coupling member 180, the axis L181 and the axis L151 are most distant from each other when the axis deviating direction J and the axis L183 are parallel with each other (part (a2) of FIG. 28). Therefore, the engagement amount K between the main assembly engaging portion 100 and the coupling member 180 is minimum in the state shown in part (b2) of FIG. 28. Therefore, the engagement amount K is to be enough to assure the engagement amount K larger than 0 even in the state of the part (b2) of FIG. 28. In addition, the engagement width H1 and the engagement width H2 change with the movement of the coupling member 180 toward the axis L182. The rotational force receiving portion 180*a*3 is convergently tapered by the provision of the third main assembly contact surface 180*b*5 (part (b) of FIG. 27), and therefore, the engagement width H1 and the engagement width H2 change with the movement of the axis L181 of the coupling member 180. Therefore, the engagement width H1 and the engagement width H2 are required to be determined so that the engagement width H1 and the engagement width H2 are always more than 0 during one full rotation of the coupling member 180.

As described in the foregoing, the coupling member 180 is capable of maintaining the two-point-contact with the main assembly side engaging portion 100 by moving in the direction of the axis L183. Therefore, the drive transmission by only one of the rotational force receiving portion 180*a*3 and the rotational force receiving portion 180*b*3 does not occur, and therefore, the load applied to the rotational force receiving portion 180*a*3, the rotational force receiving portion 180*b*3, the rotational force applying portion 100*a*1 and the rotational force applying portion 100*a*2 can be diversified. By this, the coupling member 180 and the main assembly side engaging portion 100 is not subjected to excessive load during the rotation transmission.

Figure 29:
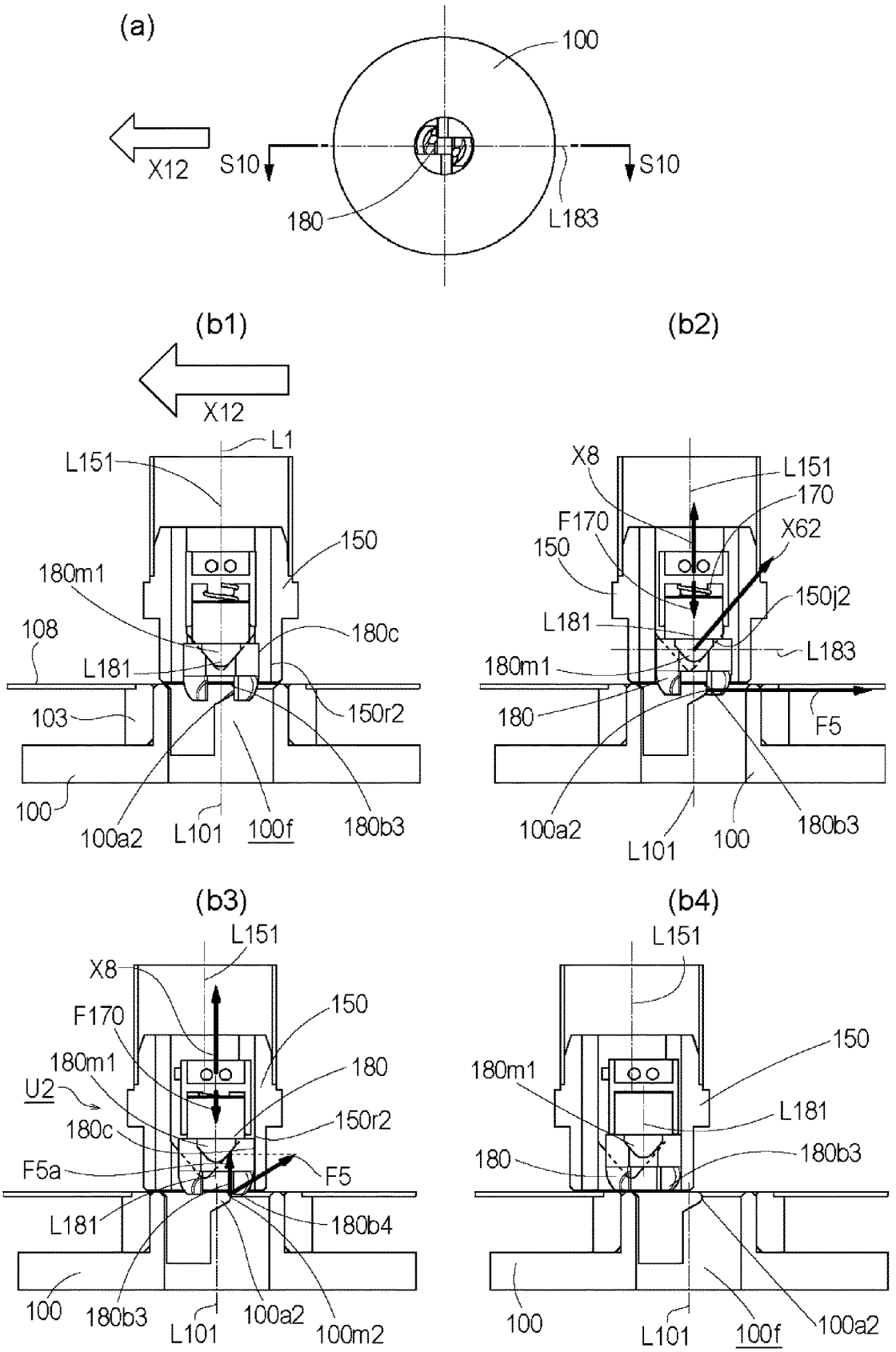
FIG. 29 is an illustration of an operation state at the time when the coupling member is disengaged from the main assembly side engaging portion in the first embodiment of the present invention.
Figure 30:
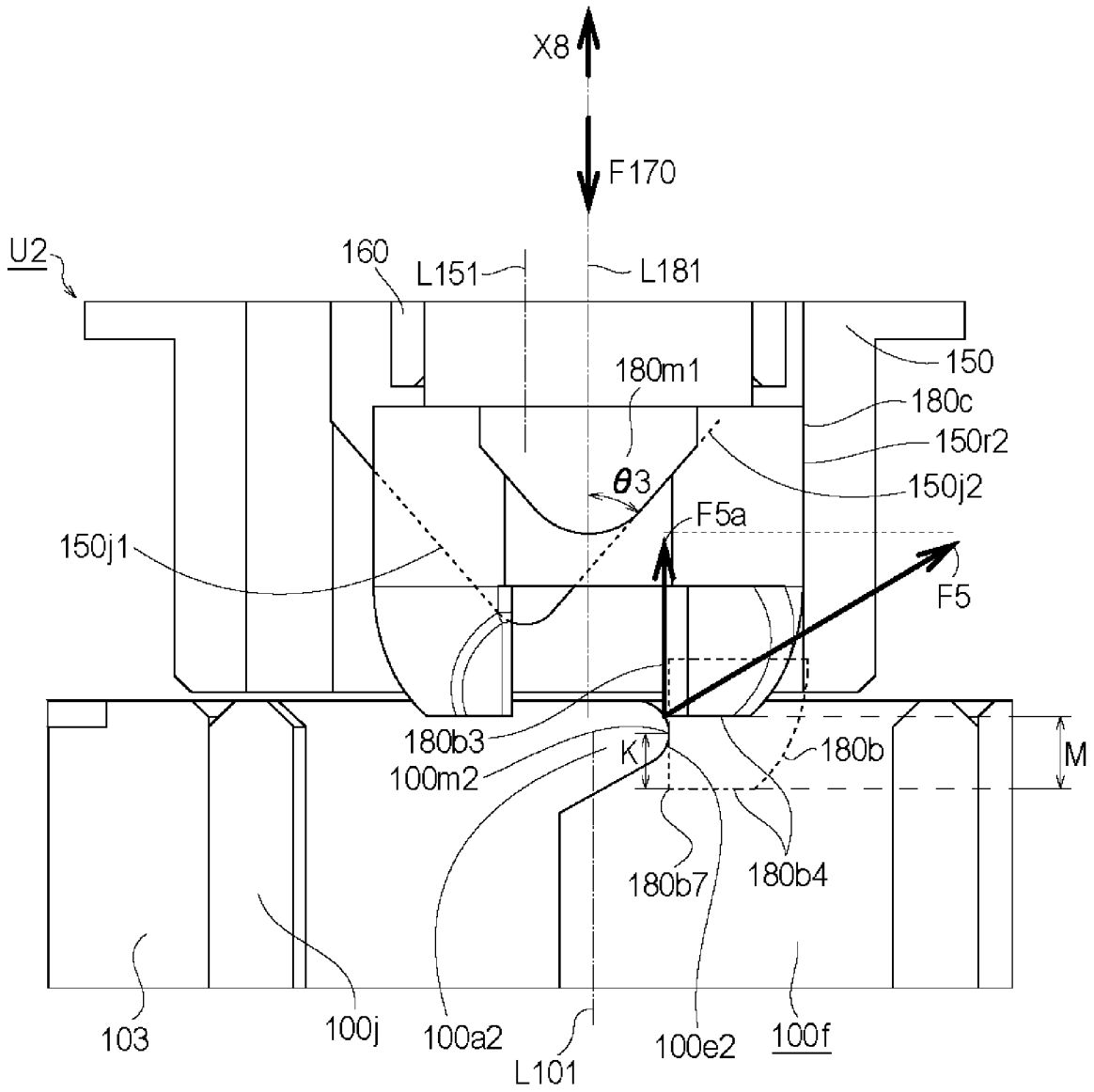
FIG. 30 is an enlarged illustration of the operation state at the time when the coupling member is disengaged from the main assembly side engaging portion in the first embodiment of the present invention.
Figure 31:
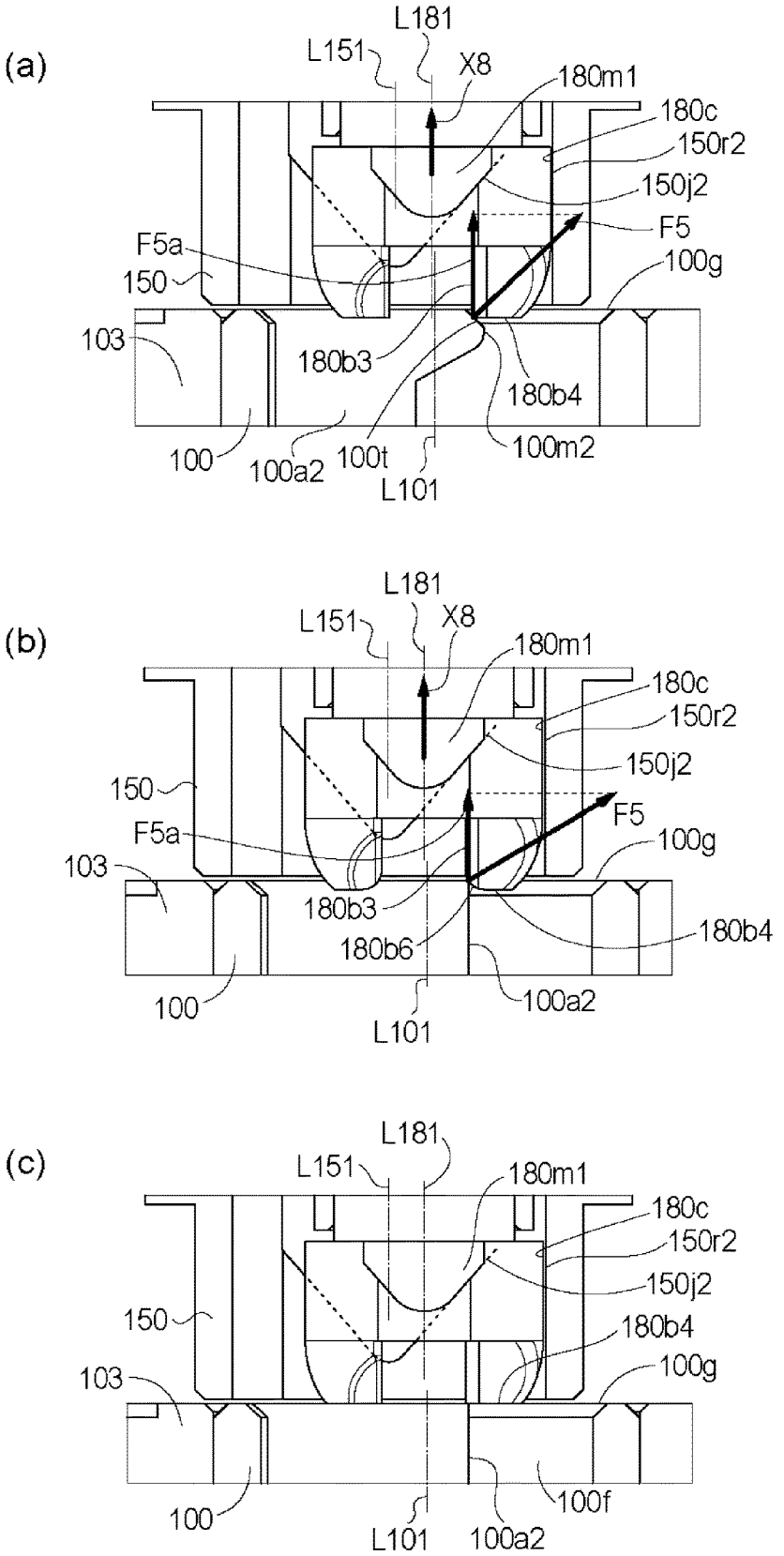
FIG. 31 is an illustration of an operation state at the time when the coupling member is disengaged from the main assembly side engaging portion in the first embodiment of the present invention.
Figure 32:
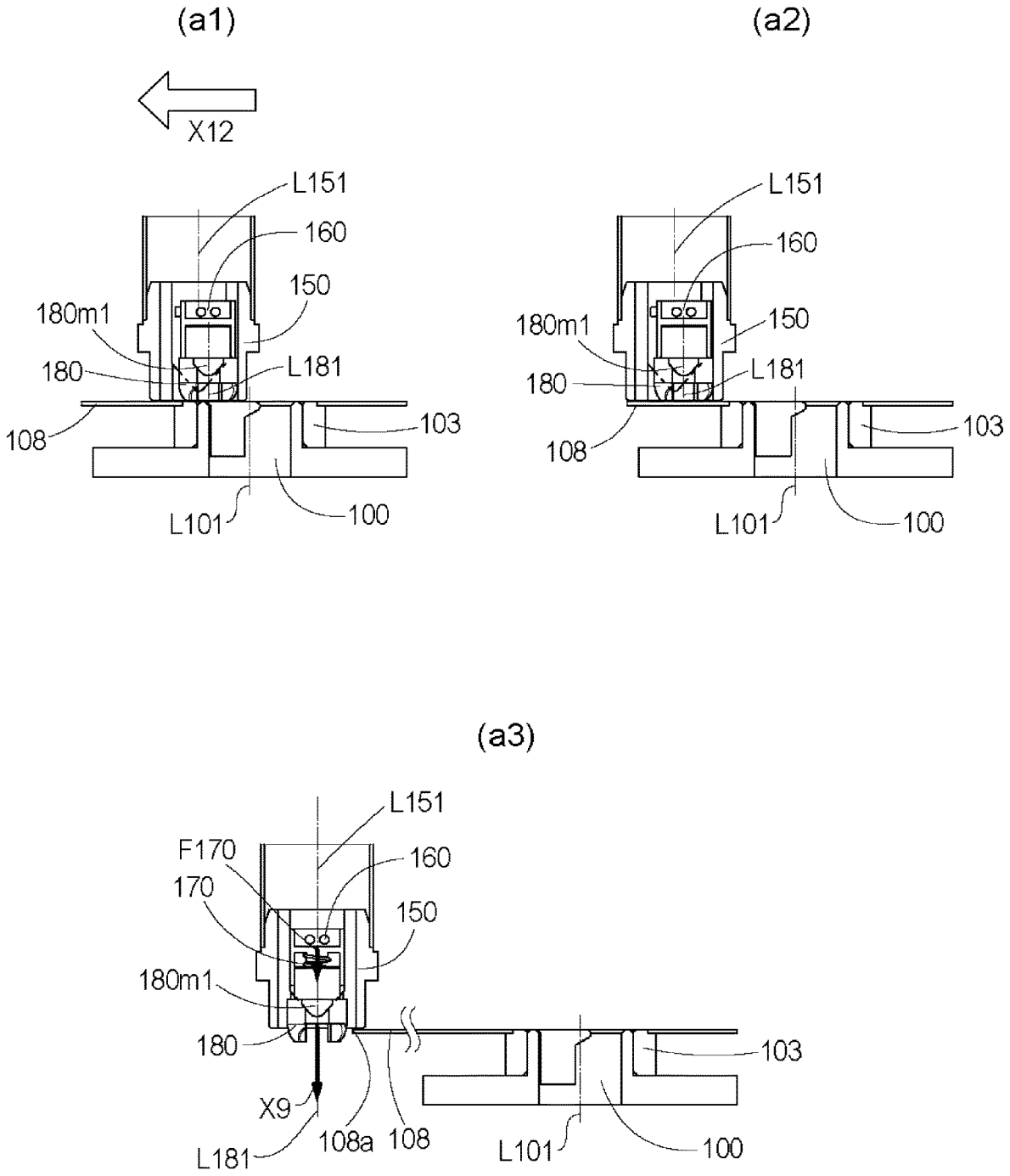
FIG. 32 is an illustration of an operation state at the time when the coupling member is disengaged from the main assembly side engaging portion in the first embodiment of the present invention.
Figure 33:
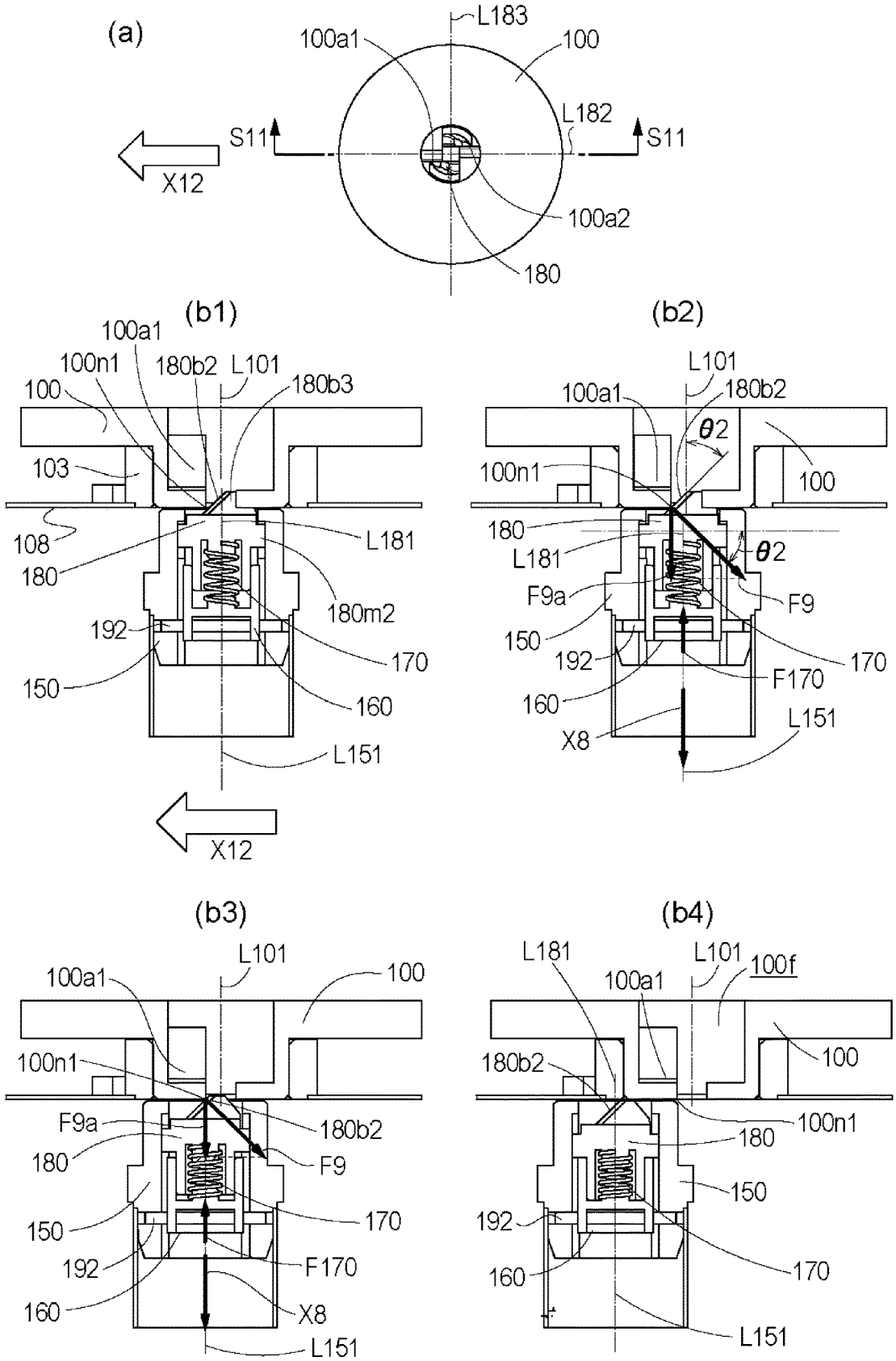
FIG. 33 is an illustration of an operation state at the time when the coupling member is disengaged from the main assembly side engaging portion in the first embodiment of the present invention.

(10) Disengaging Operation of the Coupling in the Cartridge Dismounting Operation:

Referring to FIG. 29 through FIG. 33, the description will be made as to the operation of disengaging the coupling member 180 from the main assembly side engaging portion 100 when the cartridge B is dismounted from the main assembly A of the apparatus. Part (a) of FIG. 29 and part (a) of FIG. 33 show the dismounting direction of the cartridge B and S10 section, and S11 section. Parts (b1)-(b4) of FIG. 29 and part (a1)-part (a3) of FIG. 32 show S section of part (a) of FIG. 29 and are schematic sectional views illustrating disengagement of the coupling member 180 from the main assembly side engaging portion 100. Parts (b1)-(b4) of FIG. 33 is a S11 section of part (a) of FIG. 33, and is a schematic sectional view illustrating the state of the coupling member 180 disengaging from the main assembly side engaging portion 100. FIG. 30 is an enlarged view of the neighborhood of the driving side flange unit U2 and the main assembly side engaging portion 100 of part (b3) of FIG. 29. In FIG. 29 through FIG. 32, the coupling member 180 is not shown in section, and the guide portion 150*j*1 and the guide portion 150*j*2 of the driving side flange 150 are depicted by broken lines, for better illustration. In FIG. 30, the second projected portion 180*b* of the coupling member 180 in the initial state of the dismounting (which will be described hereinafter) is depicted by broken lines. In the following, the rotational force receiving portion 180*b*3 side will be taken for the explanation.

As shown in part (a) of FIG. 29, the description will be made as to the case in which the dismounting direction of the cartridge B (arrow X12) and the axis L183 of the coupling member 180 are parallel with each other.

As shown in part (b1) of FIG. 29, the cartridge B is moved in the dismounting direction X12 which is substantially perpendicular to the rotational axis L1 of the photosensitive drum 10 and which is substantially perpendicular to the axis L151 of the driving side flange 150 to be dismounted from the main assembly A of the apparatus. In the state that the image forming operation has been completed, and the rotation of the main assembly side engaging portion 100 has been stopped, the rotational force applying portion 100*a*1 is in contact with the rotational force receiving portion 180*a*3, and the rotational force applying portion 100*a*2 is in contact with the rotational force receiving portion 180*b*3. With respect to the dismounting direction X12 of the cartridge B, the rotational force applying portion 100*a*2 is in the downstream side of the rotational force receiving portion 180*b*3. In this embodiment, any portions of the coupling member 180 other than the rotational force receiving portion 180*a*3 and the rotational force receiving portion 180*b*3 do not contact the main assembly side engaging portion 100. This is the initial state of the dismounting.

The position of the coupling member 180 in the state of part (b1) of FIG. 29 is the first position (enabled-rotational-force-transmission-position). The first position (enabled-rotational-force-transmission-position) is substantially the same as the above-described first position (projected position). At this time, the rotational axis L181 of the coupling member 180 is substantially parallel with the rotational axis L1 of the photosensitive drum 10. More particularly, the rotational axis L181 and the rotational axis L1 are aligned with each other. The rotational axis L181 of the coupling member 180 is substantially parallel with the axis L151 of the driving side flange 150. More particularly, the rotational axis L181 and the rotational axis L151 are aligned with each other.

Then, the cartridge B is moved in the dismounting direction X12. Then, as shown in part (b2) of FIG. 29, the rotational force receiving portion 180*b*3 in the upstream side of the coupling member 180 with respect to the dismounting direction receives a force F5 from the rotational force applying portion 100*a*2 with the dismounting of the cartridge B. The force F5 is perpendicular to the rotational force receiving portion 180*b*3, and therefore, is parallel with the axis L183 which is a normal line of the rotational force receiving portion 80*b*3. Therefore, when the coupling member 180 receives the force F5, moves in the direction of the arrow X62 along the guide portion 150*j*2 against the urging force F170 of the urging member 170 while keeping the contact between the portion-to-be-guided 180*j*2 and the guide portion 150*j*2 of the driving side flange 150.

Here, the rotational force receiving portion 180*b*3 (and rotational force receiving portion 180*a*3) is set such that the coupling member 180 can be moved by the force F5 in the direction of the axis L183. In this embodiment, the rotational force receiving portion 180*b*3 (and rotational force receiving portion 180*a*3) is the flat surface perpendicular to the axis L183, and therefore, the direction of the force F5 is parallel with the axis L183. Therefore, the user can move the cartridge B in the dismounting direction X12 with a small force, while moving the coupling member 180 in the axis L183 (and axis L181) relative to the driving side flange 150.

When the cartridge B is further moved in the dismounting direction X12, the round body 180*c* abuts to the cylindrical inner wall portion 150*r*2, as shown in part (b3) of FIG. 29 and FIG. 30. By this, the movement of the coupling member 180 relative to the driving side flange 150 in the direction of the axis L183 is limited. An amount of movement of the coupling member 180 from the initial state of dismounting to this state, as measured in the direction of the axis L181, is a movement distance M (FIG. 30). Then, the movement distance M is determined by the inclination θ3 of the guide portions 150*j*1-150*j*4 relative to the axis L181 in the gap D (part (c) of FIG. 11). In this embodiment, as shown in FIG. 30, the setting is such that free end corner portion 180*b*7 of the rotational force receiving portion 180*b*3 is in the arrow X8 side of the most projected portion 100*m*2 of the rotational force applying portion 100*a*2, that is, the movement distance M is larger than the engagement amount K. By this, a component force F5*a* of the force F5 in the direction of the arrow X8 is produced, because the force F5 is perpendicular to the cylindrical surface 100*e*2 of the rotational force applying portion 100*a*2. By the component force F5*a*, the coupling member 180 moves further in the direction of the arrow X8 (toward the photosensitive member (photosensitive drum 10)) against the urging force F170 of the urging member 170, with the movement of the cartridge B in the dismounting direction X12. As shown in part (b4) of FIG. 29, the coupling member 180 is disengaged from the space portion 100*f* of the main assembly side engaging portion 100.

The position of the coupling member 180 in part (b4) of FIG. 29 is the second position (disengageable position). The second position (disengageable position) is substantially the same as the above-described second position (retracted position). At this time, the rotational axis L181 of the coupling member 180 is substantially parallel with the rotational axis L1 of the photosensitive drum 10. More specifically, there is a gap between the rotational axis L181 and the rotational axis L1 (the rotational axis L181 and the rotational axis L1 are substantially out of alignment). The rotational axis L181 of the coupling member 180 is substantially parallel with the axis L151 of the driving side flange 150. More specifically, at this time, there is a gap between the rotational axis L181 and the rotational axis L151 (the rotational axis L181 and the rotational axis L1 are substantially out of alignment). In this second position, the coupling member 180 is displaced (moved/retracted) toward the photosensitive drum 10 (toward the other end portion side of the photosensitive drum 10 in the longitudinal direction) from the position in the first position.

Thereafter, as shown in part (a1) of FIG. 32 and part (a2) of FIG. 32, the cartridge B moves in the direction of the arrow X12 while the coupling member 180 is in the hollow portion 150*f* of the driving side flange 150. As shown in part (a3) of FIG. 32, when the coupling member 180 passes the contact portion 108*a* of the side plate 108, it moves in the direction of the arrow X9 by the urging force F170 of the urging member 170, and the cartridge B is removed from the main assembly A of the apparatus.

In summary, with the dismounting of the cartridge B from the main assembly A of the apparatus, the coupling member 180 is disengaged from the main assembly side engaging portion 100. In other words, with the dismounting of the cartridge B from the main assembly A of the apparatus, the coupling member 180 receives the force from the main assembly side engaging portion 100, so that the coupling member 180 moves from the first position to the second position. Further in other words, with the dismounting of the cartridge B from the main assembly A of the apparatus, the coupling member receives the force from the main assembly side engaging portion 100 and the driving side flange 150 to move (displace) from the first position (enabled-rotational-force-transmission-position) to the second position (disengageable position).

In this embodiment, parts of the rotational force applying portion 100*a*1 and the rotational force applying portion 100*a*2 are cylindrical, but this is not restrictive to the present invention. For example, as shown in part (a) of FIG. 31, the rotational force applying portion 100*a*2 may be provided with a beveling portion 100*t* at the opening end portion 100*g* so that when the round body 180*c* of the coupling member 180 contacts the cylindrical inner wall portion 150*r*2, the component force F5*a* of the force F5 in the direction of the arrow X8 is produced. Or, as shown in part (b) of FIG. 31, a driving side free end of the rotational force receiving portion 180*b*3 of the coupling member 180 may be provided with a rounded portion 180*b*6 so that the rotational force applying portion 100*a*2 is a flat surface parallel with the axis L101. Furthermore, as shown in part (c) of FIG. 31, the structure may be such that when the round body 180*c* of the coupling member 180 contacts the cylindrical inner wall portion 150*r*2, the leading side surface 180*b*4 is disengaged from the space portion 100*f*.

Referring to part (a) of FIG. 33, the description will be made as to the case that the axis L183 of the coupling member 180 is perpendicular to the dismounting direction X12 of the cartridge B.

The cartridge B is moved to the dismounting direction X12 as shown in part (b1) of FIG. 33. Then, the coupling member 180 move together with the driving side flange 150 in the dismounting direction X12 since the movement of the coupling member 180 relative to the driving side flange 150 in the direction of the axis L182 is limited.

As shown in part (b2) of FIG. 33, the second main assembly contact portion 180*b*2 as a retracting force receiving portion in the upstream side of the coupling member 180 with respect to the dismounting direction X12 contacts the retraction force applying portion 100*n*1 in the downstream side of the main assembly side engaging portion 100 with respect to the dismounting direction X12. By this, the second main assembly contact portion 180*b*2 receives a force F9 (retraction force) from the retraction force applying portion 100*n*1 by the dismounting operation of the cartridge B. At this time, the second main assembly contact portion 180*b*2 is inclined by an angle θ2 relative to the axis L181. Therefore, a component force F9*a* in the direction of the arrow X8 is produced since the force F9 is inclined by the angle θ2 relative to the axis L182.

When the cartridge B is file the movement in the dismounting direction X12, as shown in part (b3) of FIG. 33, the coupling member 180 is moved in the direction of the arrow X8 against the urging force F170 of the urging member 170 by the component force F9*a*. As shown in part (b4) of FIG. 33, the coupling member 180 is disengaged from the space portion 100*f* of the main assembly side engaging portion 100.

Thereafter, similarly to the case of the part (a1) through part (a3) of FIG. 32, the cartridge B moves in the direction of the arrow X12 while the coupling member 180 is in the hollow portion 150*f* of the driving side flange 150, and the coupling member 180 is removed from the main assembly A of the apparatus.

In the foregoing description, the dismounting direction X12 of the cartridge B is parallel with or perpendicular to the axis L183 of the coupling member 180. However, the coupling member 180 can be similarly removed from the main assembly side engaging portion 100 even when the dismounting direction is different from those described in the foregoing. In such a case, upon the dismounting of the cartridge B, one of the rotational force receiving portion 180*a*3 and the rotational force receiving portion 180*b*3 contacts one of the rotational force applying portion 100*a*1 and the rotational force applying portion 100*a*2. Or, one of the second main assembly contact portion 180*a*2 and the second main assembly contact portion 180*b*2 contacts one of the retraction force applying portion 100*n*1 and the retraction force applying portion 100*n*2. Then, the coupling member 180 receives one of the force F5 and force F9 to move relative to the driving side flange 150 in the direction of the arrow X8 so that it can be disengaged from the main assembly side engaging portion 100.

Therefore, the cartridge B can be removed from the main assembly A of the apparatus irrespective of the rotational phase relationship between the coupling member 180 and the main assembly side engaging portion 100.

As described in the foregoing, the coupling member 180 placed in the space portion 100*f* of the main assembly side engaging portion 100 can be disengaged to the outside of the space portion 100*f* in response to the dismounting operation of the cartridge B. Therefore, the cartridge B can be dismounted in the direction substantially perpendicular to the rotational axis of the photosensitive drum 10.

According to the embodiment of the present invention, the coupling member 180 is movable relative to the driving side flange 150 in the direction of the axis L181 and in the direction of the axis L183. In addition, the coupling member 180 is movable relative to the driving side flange 150 in the direction of the axis L181 in interrelation with the movement in the axis L183 direction. By this, when the cartridge B is mounted to the main assembly A of the apparatus by moving the cartridge B in the direction substantially perpendicular to the rotational axis L1 of the photosensitive drum 10, the coupling member 180 moves in the direction of the axis L181 to permit engagement with the main assembly side engaging portion 100. When the cartridge B is dismounted from the main assembly A of the apparatus by moving the cartridge B in the direction substantially perpendicular to the rotational axis L1 of the photosensitive drum 10, the coupling member 180 moves in the direction of the axis L181 to permit disengagement from the main assembly side engaging portion 100. In addition, when the cartridge B is dismounted from the main assembly A of the apparatus, it is unnecessary to rotate any of the photosensitive drum 10 and the main assembly side engaging portion 100. Therefore, the dismounting load of the cartridge B is reduced, and the usability performance at the time of dismounting the cartridge B from the main assembly A of the apparatus is improved.

Figure 34:
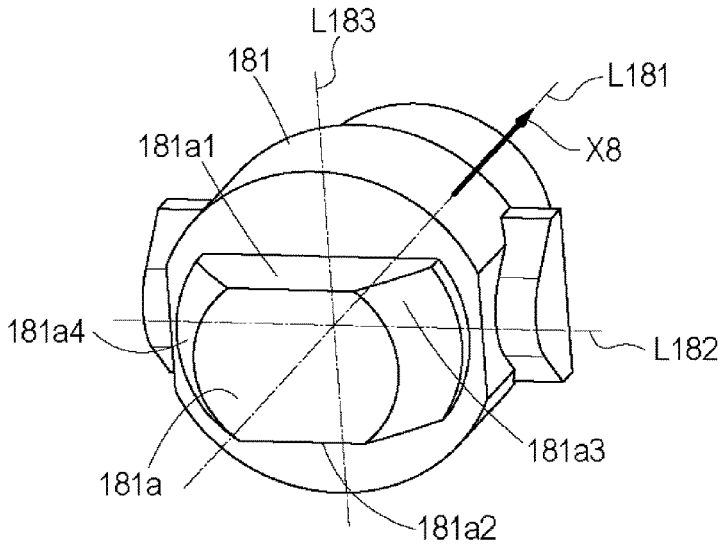
FIG. 34 is a schematic perspective view of the coupling member and the main assembly side engaging portion in the first embodiment of the present invention.
Figure 34:
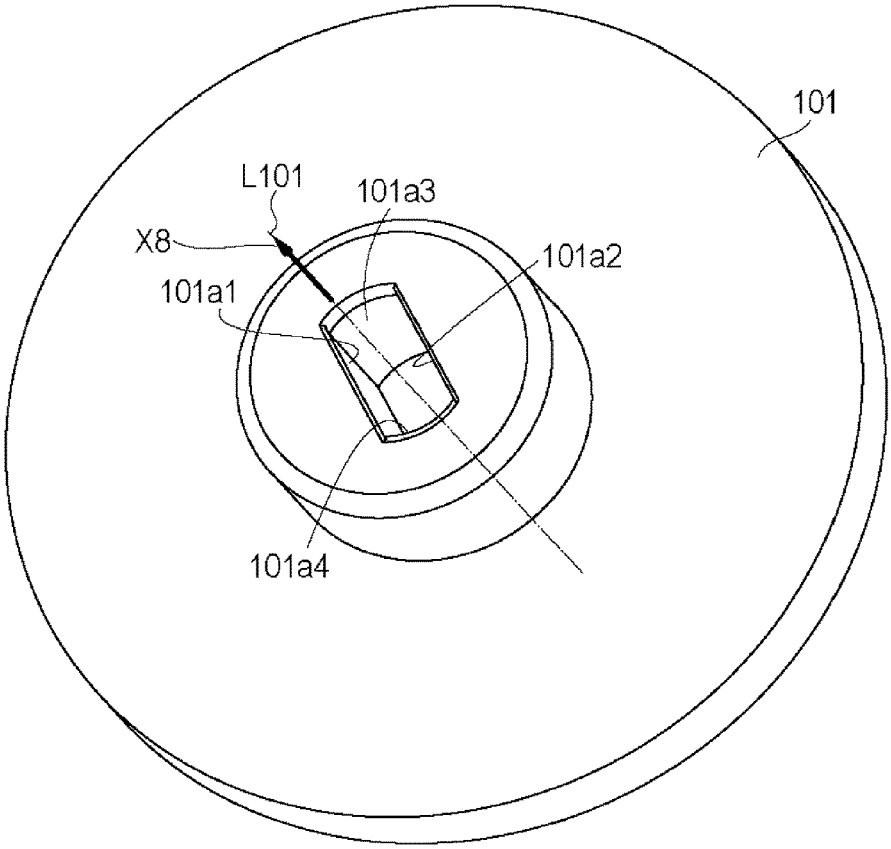

The configurations of the first projected portion 180*a* and the second projected portion 180*b* of the coupling member 180 and the rotational force applying portion 100*a*1 and the rotational force applying portion 100*a*2 of the main assembly side engaging portion 100 are not limited to those described in the foregoing. For example, as shown in part (a) of FIG. 34, a coupling member 181 is provided with a projected portion 181*a*. The projected portion 181*a* is provided with a rotational force receiving portion 181*a*1 and a rotational force receiving portion 181*a*2 perpendicular to the axis L183, and with a tapered portion 181*a*3 and a tapered portion 181*a*4 inclined relative to the axis L181 as seen in the direction of the axis L183. On the other hand, as shown in part (b) of FIG. 34, a main assembly side engaging portion 101 is provided with a rotational force applying portion 101*a*1 and a rotational force applying portion 101*a*2 which are opposed to the rotational force receiving portion 181*a*1 and the rotational force receiving portion 181*a*2 when it is engaged with the coupling member 181. The main assembly side engaging portion 101 is provided with a cylindrical inner wall portion 101*a*3 and a cylindrical inner wall portion 101*a*4 which are opposed to the tapered portion 181*a*3 and the tapered portion 181*a*4. The structures except for the coupling member 181 and the main assembly side engaging portion 101 are the same as those described in the foregoing, and the description are omitted by applying the same reference numerals and characters.

With this arrangement, when the driving force is transmitted from the main assembly side engaging portion 101 to the photosensitive drum 10, the rotational force applying portion 101*a*1 and the rotational force applying portion 101*a*2 contact the rotational force receiving portion 181*a*1 and the rotational force receiving portion 181*a*2 so that the coupling member 181 can receive the rotational force from the main assembly side engaging portion 101.

Figure 35:
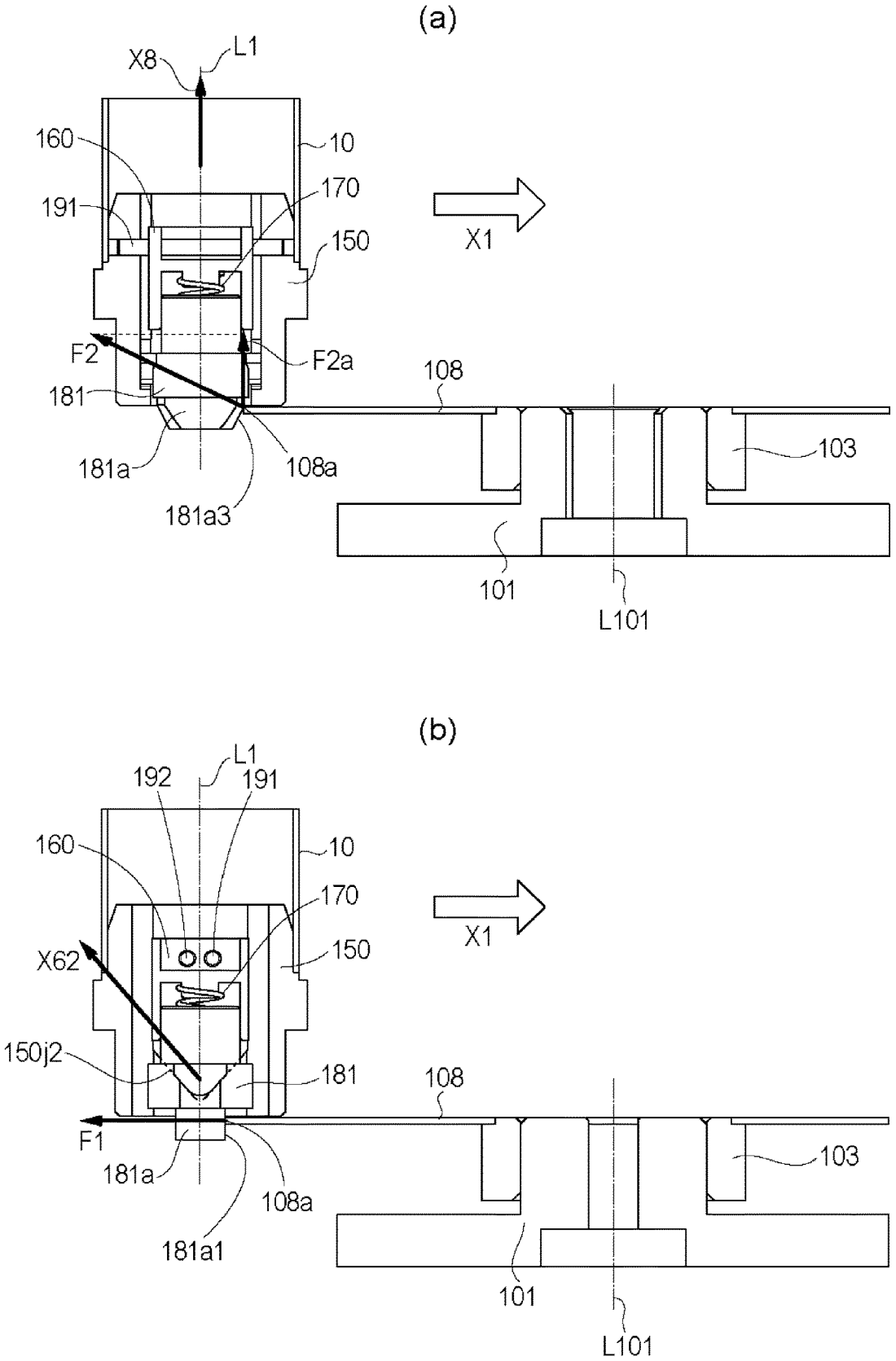
FIG. 35 is an illustration of the operation at the time when the coupling member is engaged with the main assembly side engaging portion in the first embodiment of the present invention.

When the cartridge B is moved in the mounting direction X1 relative to the main assembly A of the apparatus, as shown in part (a) of FIG. 35, the tapered portion 181*a*3 (or tapered portion 181*a*4) contacts the contact portion 108*a* to receive the force F2. By the component force F2*a* of the force F2, the coupling member 181 can move in the direction of the arrow X8. Or, as shown in part (b) of FIG. 35, the rotational force receiving portion 181*a*1 (or rotational force receiving portion 181*a*2) contacts the contact portion 108*a* to receive the force F1. By the force F1, the coupling member 181 can move in the direction of the arrow X62 (or arrow X61) along the guide portion 150*j*1—guide portion 150*j*4.

Figure 36:
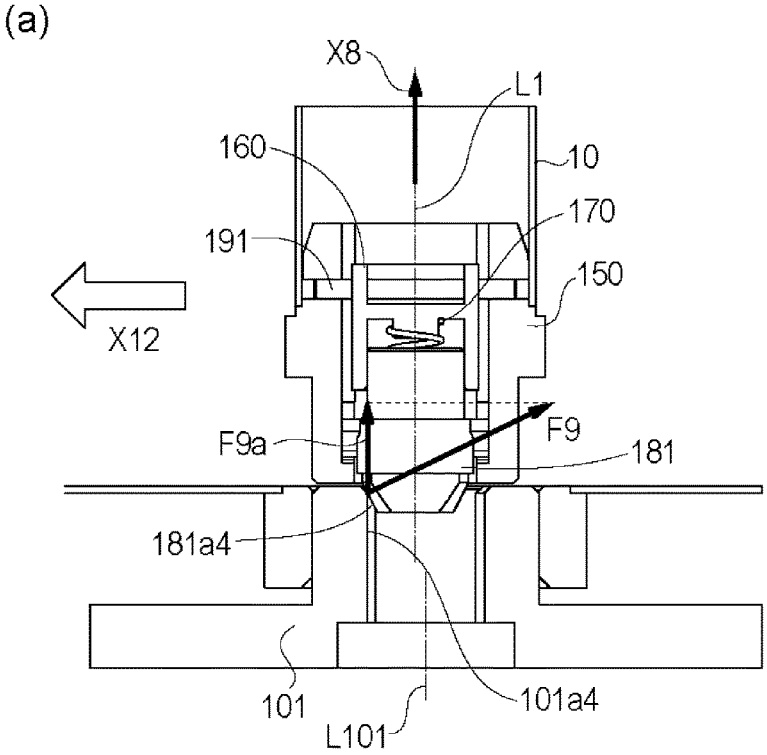
FIG. 36 is an illustration of an operation state at the time when the coupling member is disengaged from the main assembly side engaging portion in the first embodiment of the present invention.
Figure 36:
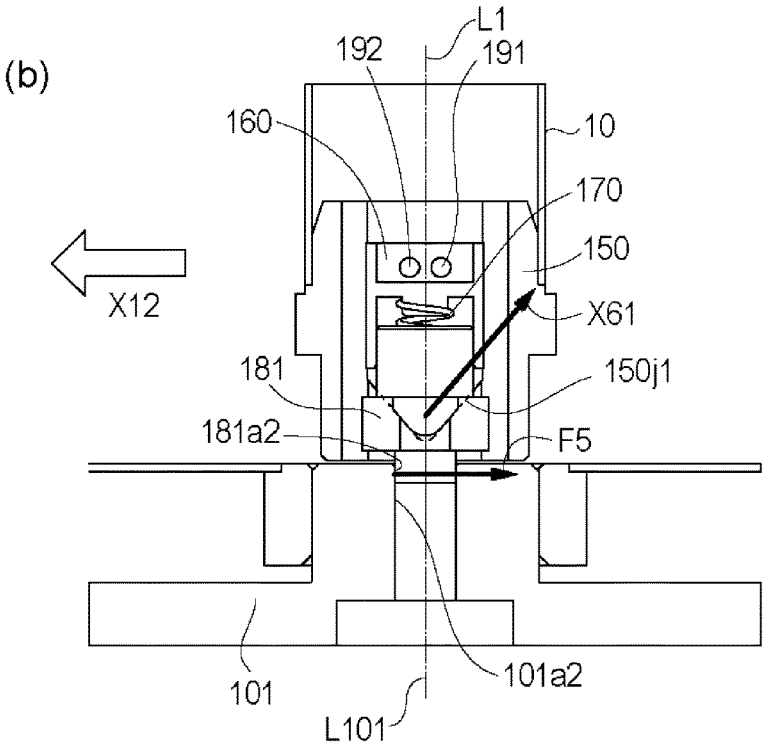

When the cartridge B is moved in the dismounting direction X12 from the main assembly A of the apparatus, as shown in part (a) of FIG. 36, the tapered portion 181*a*4 (or tapered portion 181*a*3) contacts the cylindrical inner wall portion 101*a*4 (or cylindrical inner wall portion 101*a*3) to receive the force F9. By the component force F9*a* of the force F92, the coupling member 181 can move in the direction of the arrow X8. Or, as shown in part (b) of FIG. 36, the rotational force receiving portion 181*a*2 (or rotational force receiving portion 181*a*1) contacts the rotational force applying portion 101*a*2 (or rotational force applying portion 101*a*1) to receive the force F5. By the force F5, the coupling member 181 can move in the direction of the arrow X62 (or arrow X61) along the guide portion 150*j*1—guide portion 150*j*4.

Embodiment 2

Referring to FIG. 37 through FIG. 54, a second embodiment of the present invention will be described.

In the description of this embodiment, the same reference numerals as in Embodiment 1 are assigned to the elements having the corresponding functions in this embodiment, and the detailed description thereof is omitted for simplicity, and the structure and operation which are different from Embodiment 1 will be described. Also, similar parts names will be assigned. These applied to the other embodiments, too.

Similarly to the description of Embodiment 1, rotational axes of a driving side flange 250, of a coupling member 280 and of a main assembly side engaging portion 100 will be called axes. These applied to the other embodiments, too.

The mounting direction of the cartridge B to the main assembly A of the apparatus and the dismounting direction of the cartridge B from the main assembly A of the apparatus in this embodiment are similar to those of Embodiment 1, and this applies to the other embodiments, too.

Figure 37:
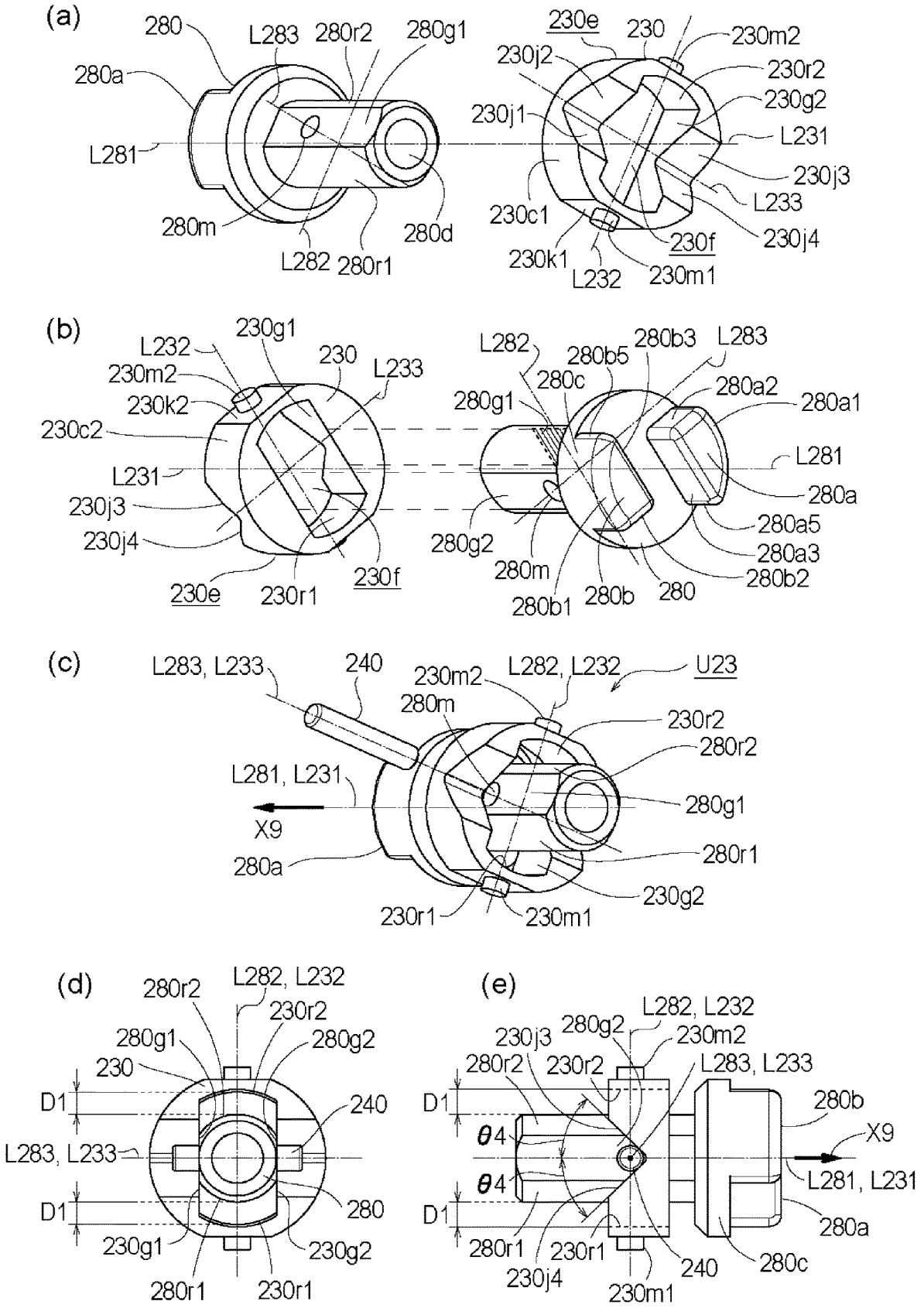
FIG. 37 is an exploded illustration of a coupling unit according to a second embodiment of the present invention.

Referring first to FIG. 37, the structure of a coupling unit U23 used in this embodiment will be described. As shown in FIG. 37, the coupling unit U23 comprises the coupling member 280, an intermediate slider 230 as an intermediate transmission member, and a guided pin (pin to be guided) 240.

The coupling member 280 will be described in detail. The rotational axis of the coupling member 280 is an axis L281, a direction perpendicular to the axis L281 is an axis L282, and a direction perpendicular to both of the axis L281 and the axis L282 is an axis L283.

Part (a)-part (c) of FIG. 37 are exploded perspective views of the coupling unit U23. Part (d)-part (e) of FIG. 37 illustrate the coupling unit U23, and part (d) of FIG. 37 is a view as seen in the direction of the axis L281, and part (e) of FIG. 37 is a view as seen in the direction of the axis L283. In part (e) of FIG. 37, a cylindrical inner wall portion 230*r*1 and a cylindrical inner wall portion 230*r*2 (which will be described hereinafter) of the slider 230 are detected by broken lines.

The coupling member 280 comprises a first projected portion 280*a*, a second projected portion 280*b*, a round body 280*c*, a cylindrical portion 280*r*1, a cylindrical portion 280*r*2, a first rotational force transmitting portion 280*g*1, a first rotational force transmitting portion 280*g*2 and a through hole 280*m*.

The through holes 280*m* are cylindrical and are provided in the first rotational force transmitting portion 280*g*1 and the first rotational force transmitting portion 280*g*2, and the central axes of the through holes 280*m* are parallel with the axis L283.

The first rotational force transmitting portion 280*g*1 and the first rotational force transmitting portion 280*g*2 are flat surfaces perpendicular to the axis L283, and the disposed at positions diametrically opposite from each other with respect to the axis L281, as seen in the direction of the axis L281. The cylindrical portion 280*r*1 and the cylindrical portion 280*r*2 are cylindrical, and the central axis thereof is the axis L281, and they are disposed at positions diametrically opposite from each other with respect to the axis L281, as seen in the direction of the axis L281. The round body 280*c* also has a cylindrical shape having the central axis aligned with the axis L281, and has a radius which is larger than those of the cylindrical portion 280*r*1 and the cylindrical portion 280*r*2.

The first projected portion 280*a* and the second projected portion 280*b* have a rotational force receiving portion 280*a*3, a rotational force receiving portion 280*b*3, a second main assembly contact portion 280*a*2 and a second main assembly contact portion 280*b*2. The connecting portion between the round body 280*c* and the rotational force receiving portion 280*a*3 and the rotational force receiving portion 280*b*3 smoothly connect them by round configuration portion 280*a*5, R configuration portion 280*b*5. Driving side free end portions of the first projected portion 280*a* and the second projected portion 280*b* are provided with a free end round portion 280*a*1 and a free end R portion 280*b*1 extending along the entire circumferences thereof. In this embodiment, the rotational force receiving portion 280*a*3 and the rotational force receiving portion 280*b*3 have flat surfaces perpendicular to the axis L283, and the second main assembly contact portion 280*a*2 and the second main assembly contact portion 280*b*2 have flat surfaces perpendicular to the axis L282.

The intermediate slider 230 will be described in detail. As shown in part (a) of FIG. 37, the rotational axis of the coupling member 230 is an axis L231, and a direction perpendicular to the axis L231 is an axis L232, and a direction perpendicular to both of the axis L231 and the axis L232 is an axis L233.

The intermediate slider 230 mainly comprises a hollow portion 230*f*, an outer peripheral portion 230*e*, and first guide portions 230*j*1-230*j*4.

The outer periphery portion 230*e* is provided with a cylindrical projection 230*m*1 and a cylindrical projection 230*m*2 which extend from a second rotational force transmitting portion 230*k*1 and a second rotational force transmitting portion 230*k*2 (which will be described hereinafter) in the direction of the axis L232.

The second rotational force transmitting portion 230*k*1 and the second rotational force transmitting portion 230*k*2 have flat surfaces perpendicular to the axis L232, and a disposed at positions diametrically opposite from each other with respect to the axis L231. In addition, a round body 230*c*1 and a round body 230*c*2 have cylindrical shapes having the central axes aligned with the axis L231 and a disposed at positions diametrically opposite from each other with respect to the axis L231.

The hollow portion 230*f* is provided with a first rotational force receiving portion 230*g*1 and a first rotational force receiving portion 230*g*2 having flat surfaces perpendicular to the axis L233, and the cylindrical inner wall portion 230*r*1 and the cylindrical inner wall portion 230*r*2 having the cylindrical shape with the central axis thereof aligned with the axis L231. The cylindrical inner wall portion 230*r*1 and the cylindrical inner wall portion 230*r*2 are disposed at positions diametrically opposite from each other with respect to the axis L231, as seen in the direction of the axis L231.

As shown in part (e) of FIG. 37, the first guide portion 230*j*3 and the first guide portion 230*j*4 are inclined by an angle θ4 relative to the axis L231 as seen in the direction of the axis L233. The first guide portion 230*j*3 and the first guide portion 230*j*4 have symmetrical configurations with respect to the axis L231 as seen in the direction of the axis L233. As shown in part (a) of FIG. 37, the first guide portion 230*j*1 and the first guide portion 230*j*2 are disposed at positions diametrically opposite from the first guide portion 230*j*3 and the first guide portion 230*j*4 with respect to the axis L231, respectively.

As shown in as shown in FIG. 37, the cylindrical portion 280*r*1, the cylindrical portion 280*r*2, the first rotational force transmitting portion 280*g*1 and the first rotational force transmitting portion 280*g*2 are provided in the hollow portion 230*f* such that the axis L283 of the coupling member 280 is parallel with the axis L233 of the intermediate slider 230. As shown in part (d) of FIG. 37, the first rotational force transmitting portion 280*g*1 and first rotational force transmitting portion 280*g*2 are engaged with first rotational force receiving portion 230*g*1 and the first rotational force receiving portion 230*g*2, respectively with almost no gap in the direction of the axis L283. By this, the coupling member 280 is prevented from moving relative to the intermediate slider 230 in the direction of the axis L283. The intermediate slider 230 is prevented from rotating relative to the coupling member 280 in the direction of the axis L231. That is, a rotational force is transmitted from the coupling member 280 to the intermediate slider 230 through the engagement between the first rotational force transmitting portion 280*g*1 and the first rotational force transmitting portion 280*g*2 and the first rotational force receiving portion 230*g*1 and the first rotational force receiving portion 230*g*2.

The cylindrical portion 280*r*1, the cylindrical portion 280*r*2, the cylindrical inner wall portion 230*r*1 and the cylindrical inner wall portion 230*r*2 are provided such that when the axis L281 of the coupling member 280 is substantially coaxial with the axis L231 in the hollow portion 230*f*, gaps D1 are provided between the cylindrical portion 280*r*1 and the cylindrical inner wall portion 230*r*1 and between the cylindrical portion 280*r*2 and the cylindrical inner wall portion 230*r*2, respectively. By this, the coupling member 280 is movable relative to the intermediate slider 230 in the direction of the axis L282.

As shown in part (c) of FIG. 37 and part (e) of FIG. 37, the cylindrical guided pin 240 is inserted into a through hole 230*m* of the coupling member 230. As will be described hereinafter, when the coupling member 280 is urged toward the driving side (arrow X9) by the urging member 270, the first guide portion 230*j*1 and the first guide portion 230*j*2 contact the guided pin 240. By this, the coupling member 280 is prevented from disengaging from the intermediate slider 230 toward the driving side, and the axis L281 substantially coaxial with the axis L231.

Figure 38:
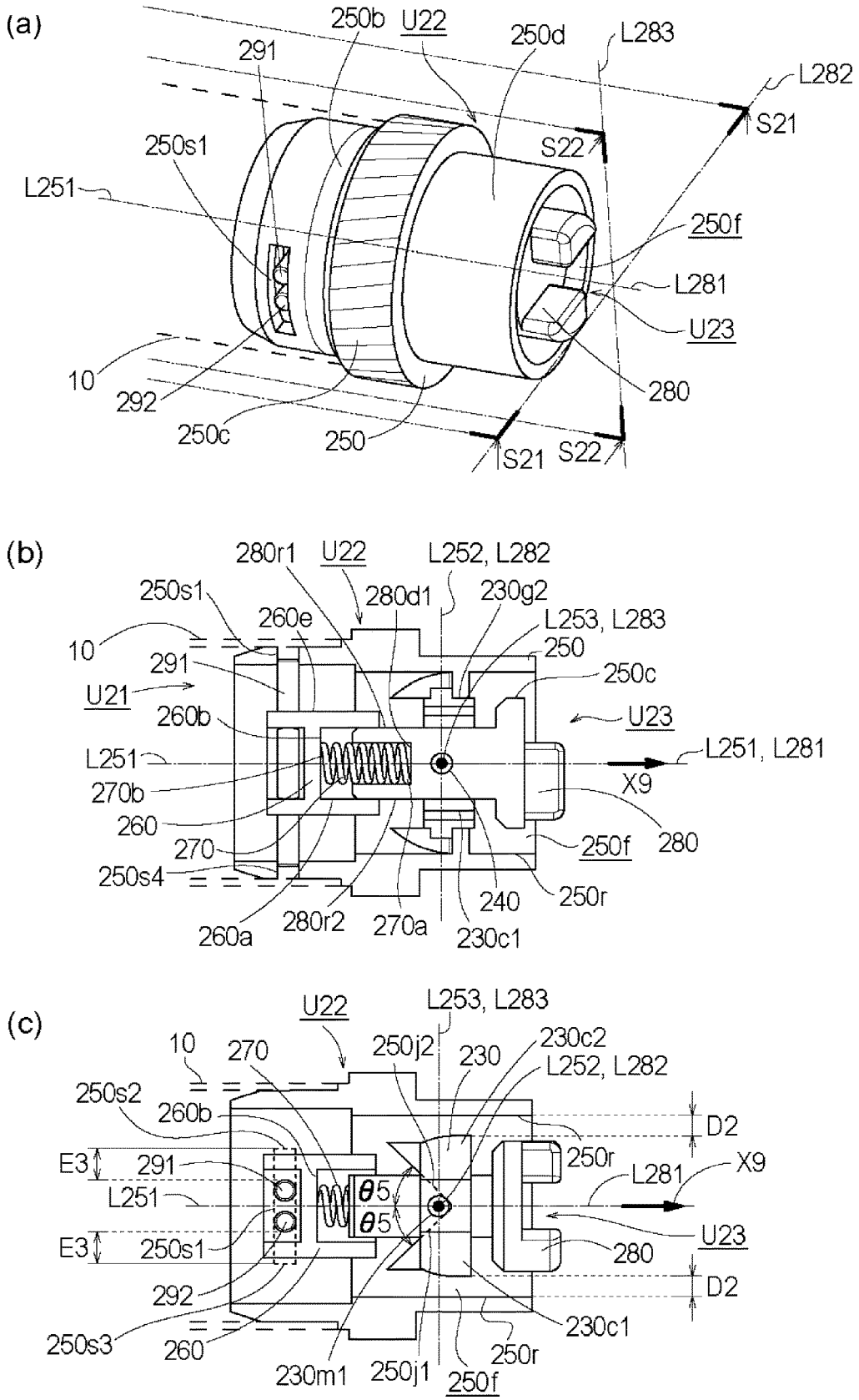
FIG. 38 is a schematic perspective view in a schematic sectional view of the photosensitive member unit according to the second embodiment of the present invention.
Figure 39:
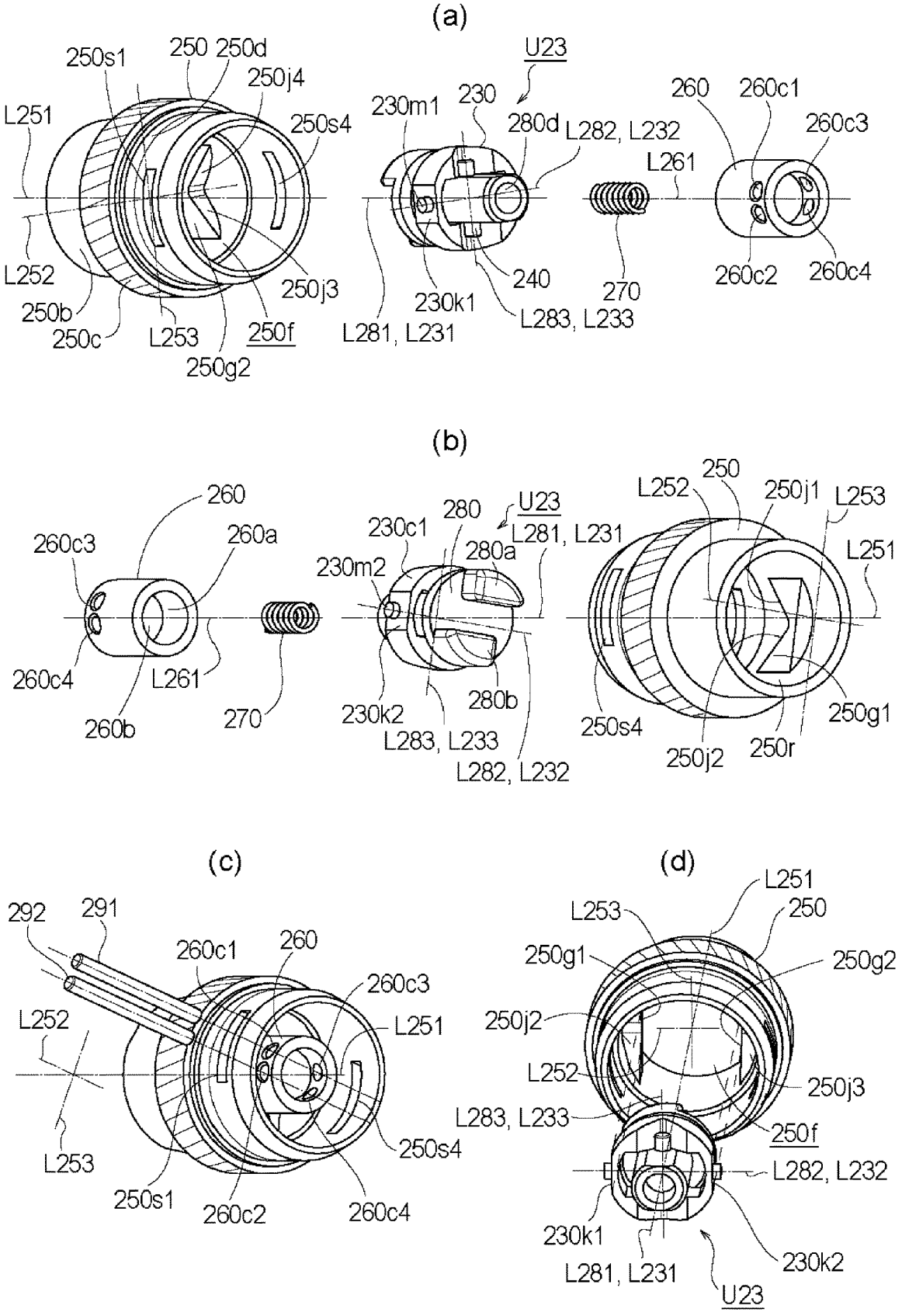
FIG. 39 is exploded schematic perspective view of the driving side flange unit in the second embodiment of the present invention.

FIGS. 38 and 39, the structure of a driving side flange unit U22 used in this embodiment will be described. Part (a) of FIG. 38 is a schematic perspective view of a photosensitive drum unit U21 to which the driving side flange unit U22 is mounted, as seen from the driving side. Part (b) of FIG. 38 is a schematic sectional view taken along a line S21 in part (a) of FIG. 38, and part (c) of FIG. 38 is a schematic sectional view taken along a line S22 in part (a) of FIG. 38. FIG. 39 is an exploded perspective view of the driving side flange unit U22. In part (c) of FIG. 38, the coupling unit U23 is not sectioned, and a second guide portion 250*j*1, a second guide portion 250*j*2 and a slide groove 250*s*1 are depicted by broken lines, for better illustration.

As shown in FIG. 38, the driving side flange unit U22 comprises the driving side flange 250, the coupling unit U23, the retention pin 291, the retention pin 292, the urging member 270 and the slider 260.

Referring first to FIG. 39, the driving side flange 250 will be described in detail. The rotational axis of the driving side flange is an axis L251, a direction perpendicular to the axis L251 is axis L252, and a direction perpendicular to both of the axis L251 and the axis L252 is axis L253.

The driving side flange 250 is provided with an engagement supporting portion 250*b*, a gear portion 250*c* and a supporting portion 250*d* and so on. The inside of the driving side flange 250 is hollow and will be called a hollow portion 250*f*.

In the hollow portion 250*f*, there are provided a second rotational force receiving portion 250*g*1 and a second rotational force receiving portion 250*g*2 which have flat surfaces perpendicular to the axis L252, a cylindrical inner wall portion 250*r* having a cylindrical shape with the central axis thereof aligned with the axis L251, and second guide portions 250*j*1-250*j*4.

As shown in part (c) of FIG. 38, the second guide portion 250*j*1 and the second guide portion 250*j*2 are inclined relative to the axis L251 by an angle θ5, as seen in the direction of the axis L252. The second guide portion 250*j*1 and the second guide portion 250*j*2 are symmetrical with respect to the axis L251, as seen in the direction of the axis L252. The second guide portion 250*j*3 and the second guide portion 250*j*4 are disposed at positions diametrically opposite from the second guide portion 250*j*1 and the second guide portion 250*j*2 with respect to the axis L251, respectively.

The cylindrical inner wall portion 250*r* is provided with the slide groove 250*s*1 and the slide groove 250*s*4. As will be described hereinafter, the slide groove 250*s*1 and the slide groove 250*s*4 are through holes supporting the retention pin 291 and the retention pin 292, and have respective rectangular-shapes having long sides extending in the direction of the axis L253, as seen in the direction of the axis L252.

As shown in FIGS. 38, 39, the coupling unit U23 is disposed in the hollow portion 250*f* of the driving side flange 250 such that the axis L282 is parallel with the axis L252. The second rotational force transmitting portion 230*k*1 and the second rotational force transmitting portion 230*k*2 of the intermediate slider 230 are engaged with the second rotational force receiving portion 250*g*1 and the second rotational force receiving portion 250*g*2 with almost no gap in the direction of the axis L282, respectively. By this, the coupling unit U23 is prevented from moving relative to the driving side flange 250 in the direction of the axis L282 (part (d) of FIG. 39). The intermediate slider 230 is prevented from rotating relative to the driving side flange 250 about the axis L251. That is, the rotational force is transmitted from the intermediate slider 230 to the flange 250 through engagement between the second rotational force transmitting portion 230*k*1 and the second rotational force receiving portion 250*g*1 and between the second rotational force transmitting portion 230*k*2 and the second rotational force receiving portion 250*g*2.

As shown in part (c) of FIG. 38, the round body 230*c*1, the round body 230*c*2 and the cylindrical inner wall portion 250*r* are provided such that when the axis L281 of the coupling unit U23 is substantially coaxial with the axis L251 in the hollow portion 250*f*, gaps D2 are provided between the round body 230*c*1 and the cylindrical inner wall portion 250*r* and between the round body 230*c*2 and the cylindrical inner wall portion 250*r*. By this, the coupling unit U23 is movable relative to the driving side flange 250 in the direction of the axis L283. As will be described hereinafter, when the intermediate slider 230 is urged toward the driving side (arrow X9) by the urging member 270 through the coupling member 280, the cylindrical projection 230*m*1 and the cylindrical projection 230*m*2 contact the second guide portion 250*j*1—the second guide portion 250*j*4. By this, the intermediate slider 230 is prevented from disengaging from the driving side flange 250 toward the driving side, and the axis L231 is substantially coaxial with the axis L251.

As shown in FIG. 38, the slider 260 as the holding member (movable member) is provided with a cylindrical portion 260*a* engaged with the cylindrical portion 280*r*1 and the cylindrical portion 280*r*2 of the coupling member 280, a contact portion 260*b* contacted by one end portion 270*a* of the urging member 270, a through hole 260*c*1—a through hole 260*c*4 penetrated by the retention pin 291 and the retention pin 292. The central axis of the cylindrical portion 260*a* is an axis L261.

The cylindrical portion 260*a* engages with the cylindrical portion 280*r*1 and the cylindrical portion 280*r*2 of the coupling member 280 with almost no gap to support them. By this, the coupling member 280 is movable in the direction of the axis L281 while keeping the axis L281 and the axis L261 is this are coaxial with each other.

On the other hand, as shown in part (c) of FIG. 39, the cylindrical retention pin 291 and the retention pin 292 are inserted into the through hole 260*c*1—through hole 260*c*4 of the slider 260 with almost no gap in the radial direction such that the central axes of the retention pin 291 and the retention pin 292 are parallel with the axis L252 of the driving side flange 250. The retention pin 291 and the retention pin 292 are supported by the slide groove 250*s*1 and the slide groove 250*s*4 of the driving side flange 250, so that the slider 260 and the driving side flange 250 are connected with each other.

As shown in part (c) of FIG. 38, the retention pin 291 and the retention pin 292 are juxtaposed in the axis L253. The diameters of the retention pin 291 and the retention pin 292 are slightly smaller than the width of the slide groove 150*s*1 and the slide groove 150*s*4 measured in the direction of the axis L251. By this, the slider 260 keeps the parallelism between the axis L261 and the axis L251. In addition, the slider 260 is prevented from the movement relative to the driving side flange 250 in the direction of the axis L251. In other words, the slider 260 is movable in the direction substantially perpendicular to the axis L251.

As shown in part (b) of FIG. 38, the retention pin 291 and the retention pin 292 are prevented from disengaging in the direction of the axis L252 by the opening 10*a*2 of the photosensitive drum 10. In addition, the lengths G4 of the retention pin 291 and the retention pin 292 are made larger than a diameter pG5 of the cylindrical inner wall portion 250*r*. By doing so, the retention pin 291 and the retention pin 292 are prevented from disengaging from the slide groove 250*s*1 and the slide groove 250*s*4.

In addition, between the retention pin 291 and one end portion of 250*s*2 of the slide groove 250*s*1 and between the retention pin 292 and the other end portion of 250*s*3 of the slide groove 250*s*1, gaps E3 larger than the gap D2 is provided (part (c) of FIG. 38). Between the retention pin 291 and the one end portion 250*s*5 of the slide groove 250*s*4 and between the retention pin 292 and the other end portion 250*s*6 of the slide groove 250*s*4, the gaps similar to the gap E2 are provided. In addition, lubricant (unshown) is applied to the through hole 260*c*1—the through hole 260*c*4, the slide groove 250*s*1 and the slide groove 250*s*4. By this, the slider 260 is smoothly movable relative to the driving side flange 250 in the direction of the axis L253.

Therefore, the slider 260 is movable relative to the driving side flange 250 in the directions of the axis L252 and the axis L253 and in a direction provided by sum of vectors of these directions (that is, any direction perpendicular to the axis L251), while keeping the parallelism between the axis L261 and the axis L251. In other words, the slider 260 is movable substantially in the direction perpendicular to the axis L251. In addition, the slider 260 is prevented from moving relative to the driving side flange 250 in the direction of the axis L251.

As shown in part (b) of FIG. 38, the one end portion 270*a* of the urging member 270 contacts a spring contact portion 260*b* of the slider 260, and a other end portion 270*b* contacts a spring contact portion 280*d*1 of the coupling member 280. The urging member 270 is compressed between the coupling member 280 and the slider 260 to urge the coupling member 280 toward the driving side (arrow X9). As shown in part (e) of FIG. 37, the urging member 270 also urges the intermediate slider 230 toward the driving side (arrow X9), through the contact between the guided pin 240 mounted on the coupling member 280 and the first guide portion 230*j*1—first guide portion 230*j*4.

With the above-described structures, the coupling member 280 keeps the state relative to the driving side flange 250 through the slider 260 such that the axis L281 and the axis L251 are parallel with each other. The intermediate slider 230 does not rotated relative to the coupling member 280 about the axis L231, and does not rotate relative to the driving side flange 250 about the axis L233. Therefore, the intermediate slider 230 keeps relative to the coupling member 280 and the driving side flange 250 such that the axis L231 is parallel with the axis L281 and the axis L251.

Additionally, the coupling member 280 is movable relative to the intermediate slider 230 in the direction of the axis L282. In addition, the intermediate slider 230 is movable relative to the driving side flange 250 in the direction of the axis L233. In other words, as seen in the direction of the axis L251, the moving direction of the coupling member 280 relative to the intermediate slider 230 and the moving direction of the intermediate slider 230 relative to the driving side flange 250 are substantially crossing with each other (more particularly, substantially perpendicular to each other). Therefore, the coupling member 280 is movable relative to the driving side flange 250 in the direction of the axis L282, the direction of the axis L233 and in a direction provided by sum of vectors of these directions (that is, any direction perpendicular to the axis L281).

Furthermore, by the urging of the urging member 270, the axis L281 of the coupling member 280 is substantially coaxial with the axis L231 of the intermediate slider 230, and the axis L231 is substantially coaxial with the axis L251 of the driving side flange 250. Therefore, the coupling member 280 is urged by the urging member 270 relative to the driving side flange 250 such that the axis L281 and the axis L251 are substantially coaxial with each other.

Figure 40:
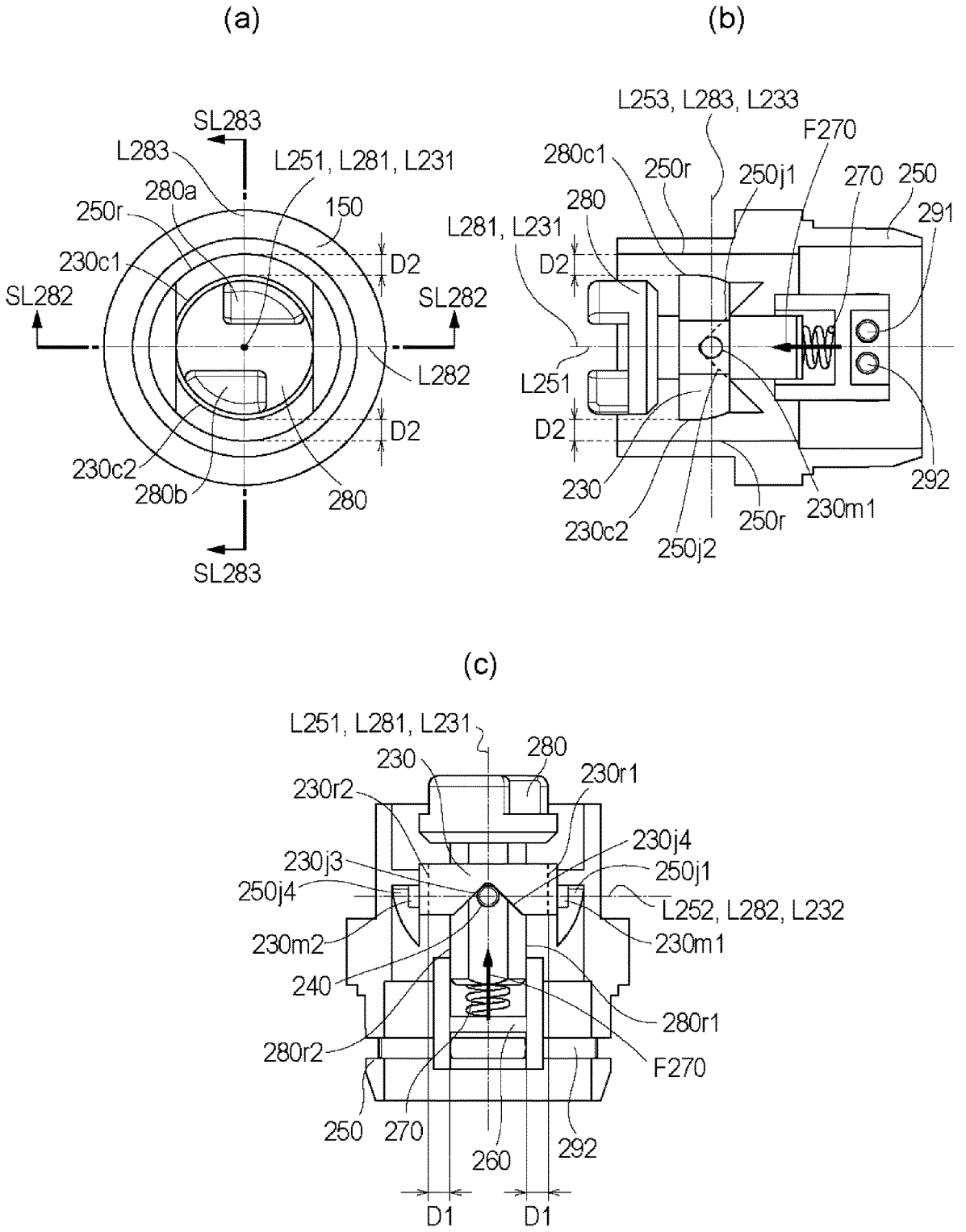
FIG. 40 is an illustration of the operations of the coupling member and the coupling unit according to the second embodiment of the present invention.
Figure 41:
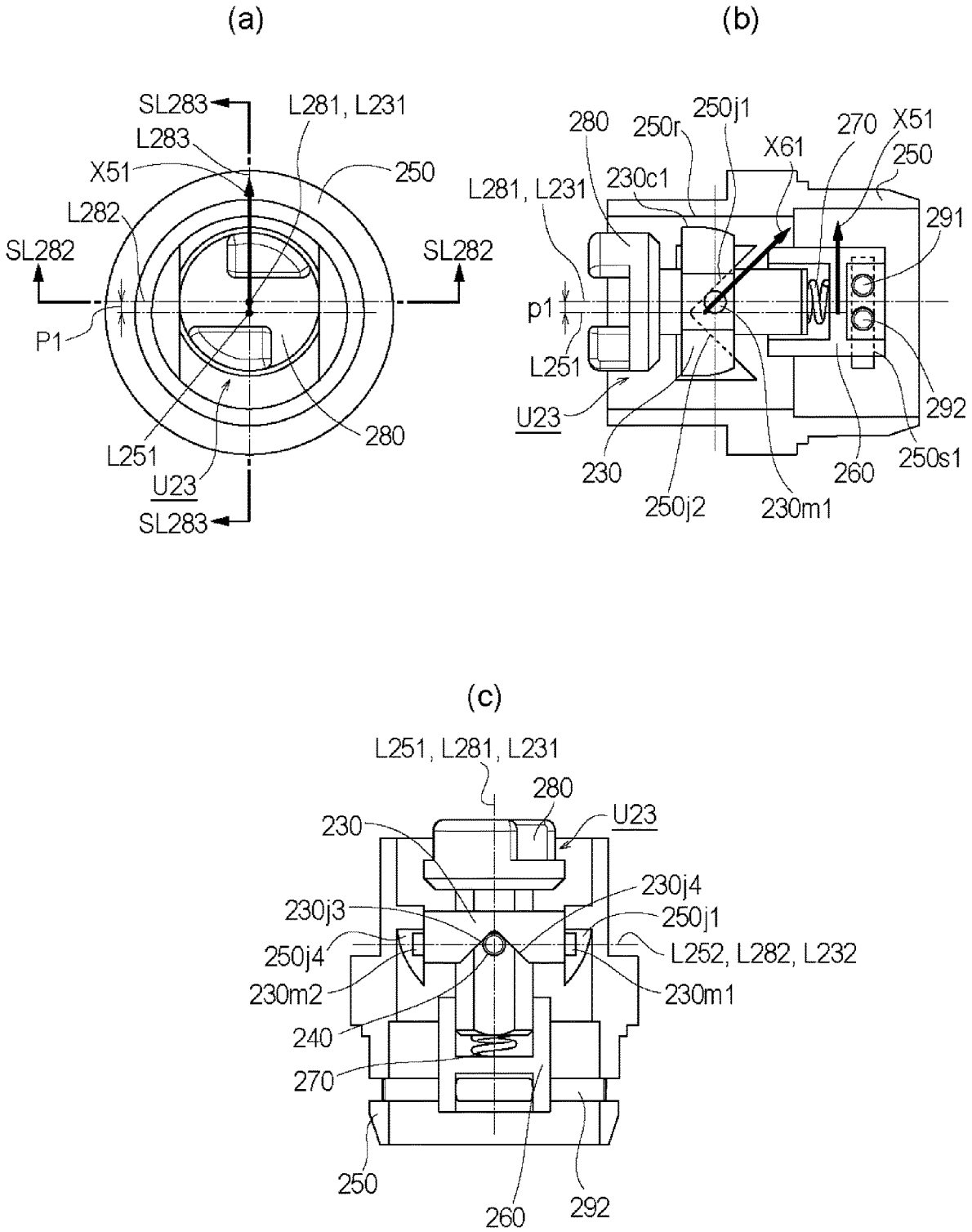
FIG. 41 is an illustration of the operations of the coupling member and the coupling unit according to the second embodiment of the present invention.
Figure 42:
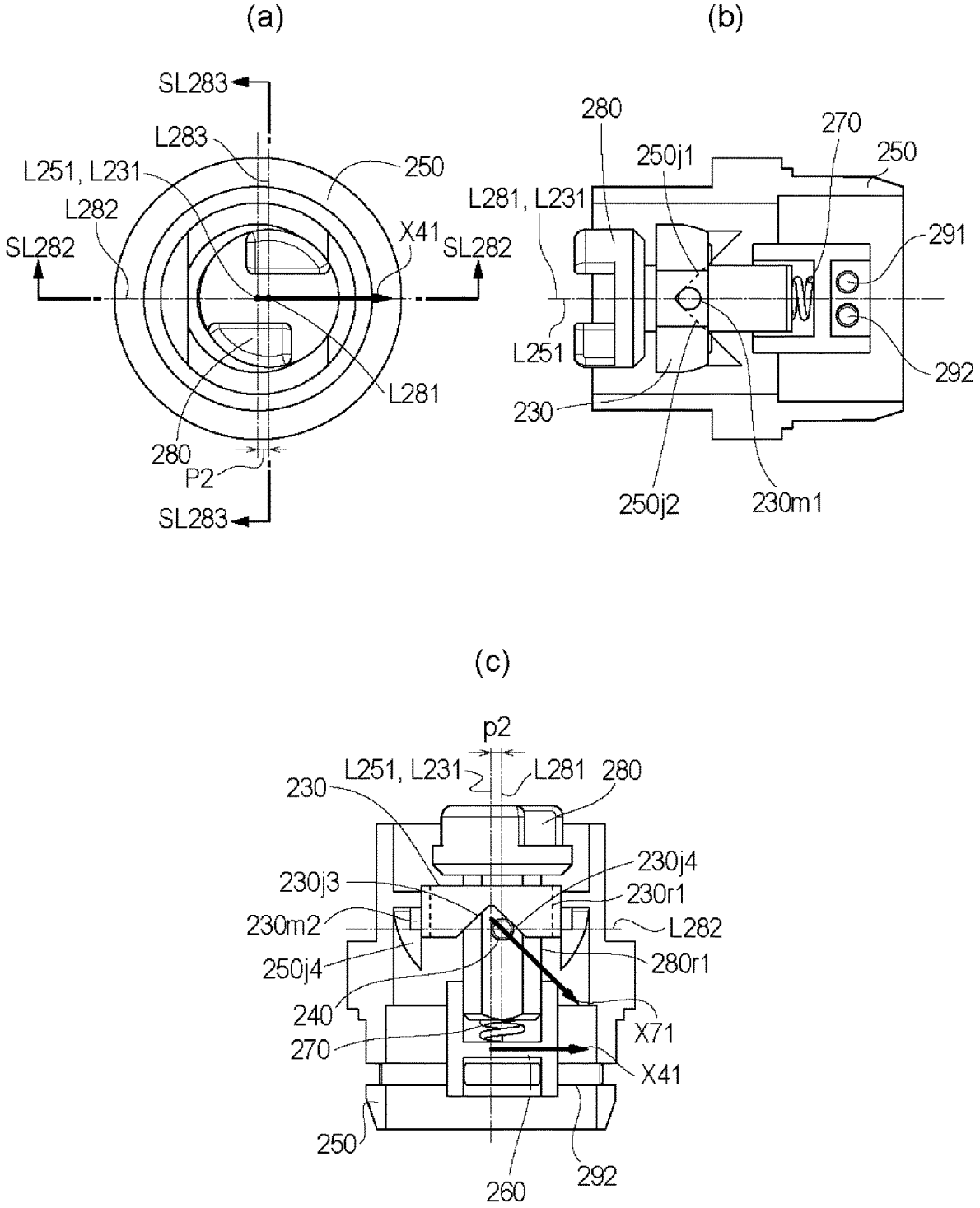
FIG. 42 is an illustration of the operations of the coupling member and the coupling unit according to the second embodiment of the present invention.

Referring to FIG. 40 through FIG. 43, the operation of the coupling member 280 will be described. FIG. 40 shows the state in which the axis L281 of the coupling member 280 is coaxial with the axis L251 of the driving side flange 250. Part (a) of FIG. 40 is a view as seen from the driving side, part (b) of FIG. 40 and part (c) of FIG. 40 are sectional views taken along a line SL283 parallel with the axis L283 and a line SL282 parallel with the axis L282 of part (a) of FIG. 40, respectively. The lines along which the sectional views are taken apply to FIG. 41 through FIG. 43. FIG. 41 shows the state in which the coupling member 280 has been moved relative to the driving side flange 250 in the direction of an arrow X51 parallel with the axis L283. FIG. 42 shows the state in which the coupling member 280 has been moved relative to the driving side flange 250 in the direction of an arrow X41 parallel with the axis L282. FIG. 44 is a view in which the coupling member 280 has been moved by a distance p in a direction of an arrow X45 which is in the direction provided by a sum of the vectors of the arrow X41 and the arrow X51.

First, the coupling member 280 *c* is urged by the urging force F270 of the urging member 270 such that the first guide portion 230*j*3 and the first guide portion 230230*j*4 contact the guided pin 240, and the second guide portion 250*j*1 and the second guide portion 250*j*2 contact the cylindrical projection 230*m*1, as shown in FIG. 40. As shown in part (c) of FIG. 40, by the contact between the first guide portion 230*j*3 and the first guide portion 230*j*4 and the guided pin 240, the axis L281 and the axis L231 become especially coaxial, as seen in the direction of the axis L282. On the other hand, as shown in part (b) of FIG. 40, by the contact between the second guide portion 250*j*1 and the second guide portion 250*j*2 and the cylindrical projection 230*m*1, the axis L231 and the axis L251 become substantially coaxial, as seen in the direction of the axis L283. Therefore, by the urging force F270 of the urging member 270 to the coupling member 280, the axis L281 and the axis L251 become substantially coaxial with each other.

Then, as shown in part (a) of FIG. 41, the coupling member 280 is moved relative to the driving side flange 250 in the direction of the arrow X51 parallel with the axis L283. Then, as shown in part (b) of FIG. 41, the coupling unit U23 is moved in the direction on the second guide portion 250*j*1 (arrow X61) by the contact between the cylindrical projection 230*m*1 as an inclined portion or contact portion of the intermediate slider 230 and the second guide portion 250*j*1 as an inclined portion or contact portion of the driving side flange 250. At this time, the coupling unit U23 keeps the state in which the axis L281 is parallel with the axis L251. Therefore, the coupling unit U23 is movable in the direction of the arrow X61 until the round body 230*c*1 of the intermediate slider 230 abuts to the cylindrical inner wall portion 250*r*, that is, until the movement distance p1 thereof in the direction of the axis L283 becomes equal to the gap D2. On the other hand, the slider 260 is prevented from moving in the direction of the axis L251, by the retention pin 291 and the retention pin 292. Therefore, in interrelation with the movement of the coupling unit U23 in the direction of the arrow X61, the slider 260 moves together with the retention pin 291 and the retention pin 292 in the direction of the arrow X51 along the slide groove 250*s*1 and the slide groove 250*s*4.

When the coupling member 280 is moved in the direction opposite from the arrow X51, the coupling member 280 move along the second guide portion 250*j*2, similarly.

On the hand, as shown in part (a) of FIG. 42, the coupling member 280 is moved relative to the driving side flange 250 in the direction of the arrow X41 parallel with the axis L282. Then, as shown in part (c) of FIG. 42, the coupling member 280 is moved in the direction along the first guide portion 230*j*4 (arrow X71) by the contact between the guided pin 240 as the inclined portion or contact portion and the first guide portion 230*j*4 as the inclined portion or contact portion of the intermediate slider 230. At this time, the coupling member 280 is such that the parallelism is maintained between the axis L281 and the axis L231. Therefore, the coupling member 280 is movable in the direction of the arrow X71 until the cylindrical portion 280*r*1 abuts to the cylindrical inner wall portion 230*r*1 of the intermediate slider 230, that is, the movement distance p2 of the coupling portion 280 in the direction of the axis L282 becomes equal to the gap D1. On the other hand, the slider 260 is prevented from moving in the direction of the axis L251, by the retention pin 291 and the retention pin 292. Therefore, in interrelation with the movement of the coupling member 280 in the direction of the arrow X71, the slider 260 moves in the direction of the arrow X41 along the central axis of the retention pin 291 and the retention pin 292.

When the coupling member 280 is moved in the direction opposite to that of the arrow X41, the coupling member 280 move along the first guide portion 230*j*3, similarly.

Figure 43:
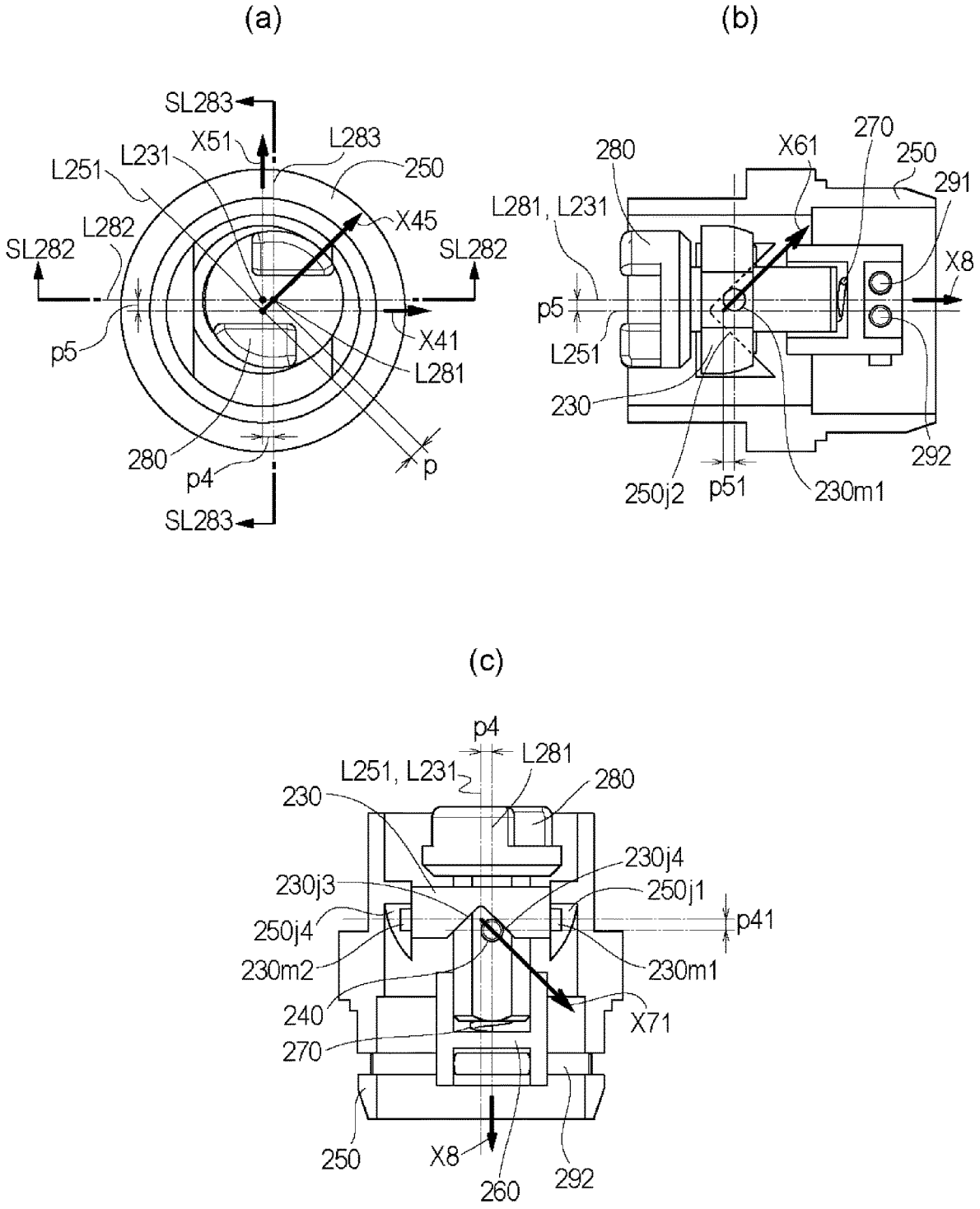
FIG. 43 is an illustration of the operations of the coupling member and the coupling unit according to the second embodiment of the present invention.
Figure 44:
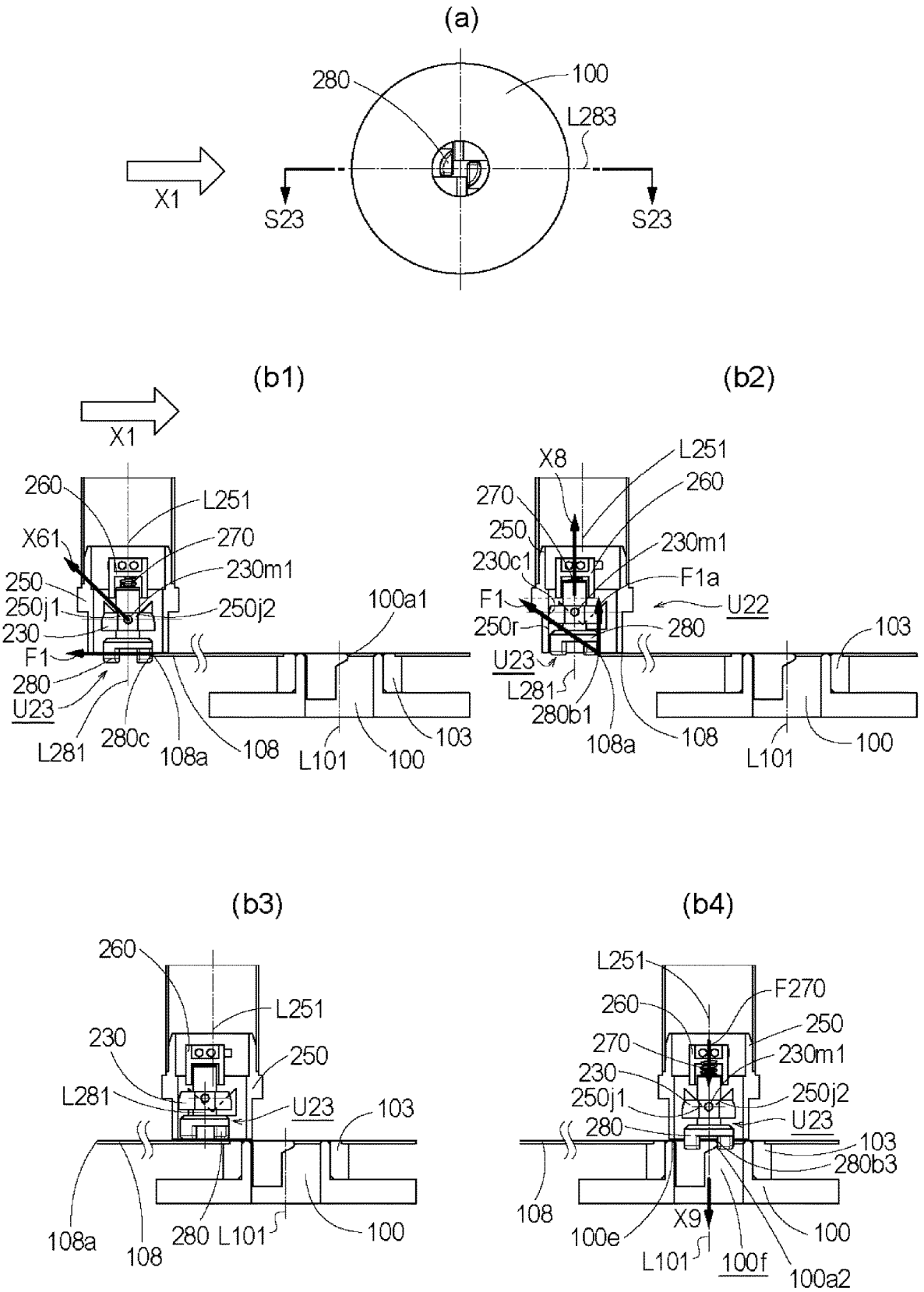
FIG. 44 is an illustration of the operation state at the time when the coupling member is engaged with the main assembly side engaging portion in the second embodiment of the present invention.

Furthermore, as shown in part (a) of FIG. 43, the coupling member 280 is moved relative to the driving side flange 250 in the direction of the arrow X45 by the distance p. A component of the distance pin the direction of the axis L282 is p4, and the component thereof in the direction of the axis L283 is p5. Then, the coupling member 280 moves relative to the intermediate slider 230 in the direction of the axis L282 by the distance p4. Simultaneously, the coupling member 280 and the intermediate slider 230 move relative to the driving side flange in the direction of the axis L283 by the distance p5. With the movement of the coupling member 280 relative to the intermediate slider 230, the coupling member 280 moves along the first guide portion 230*j*4 by the distance p41, and moves relative to the intermediate slider 230 in the direction of the arrow X8 (part (c) of FIG. 43). Simultaneously, with the movement of the intermediate slider 230 relative to the driving side flange 250, the intermediate slider 230 and the coupling member 280 move along the second guide portion 250*j*1 by the distance p51, and moves relative to the driving side flange 250 in the direction of the arrow X8 (part (b) of FIG. 43). Therefore, with movement of the coupling member 280 in the direction of the arrow X45 by the distance p, it moves in the direction of the arrow X8 by the distance p41+p51.

The structure for the movement of the coupling member 280 in the direction of the arrow X8 is similar to that of Embodiment 11, and therefore, the description is omitted.

As described in the foregoing, the coupling member 280 is movable relative to the driving side flange 250 in the direction of the axis L281, the direction of the axis L283 and the direction of the axis L282. In addition, the coupling member 280 is movable relative to the driving side flange 250 in the direction of the axis L281 in interrelation with the movement in the direction of the axis L283, the direction of the axis L282 and the direction provided by sum of the vectors of these directions, that is, any direction perpendicular to the axis L281.

Figure 45:
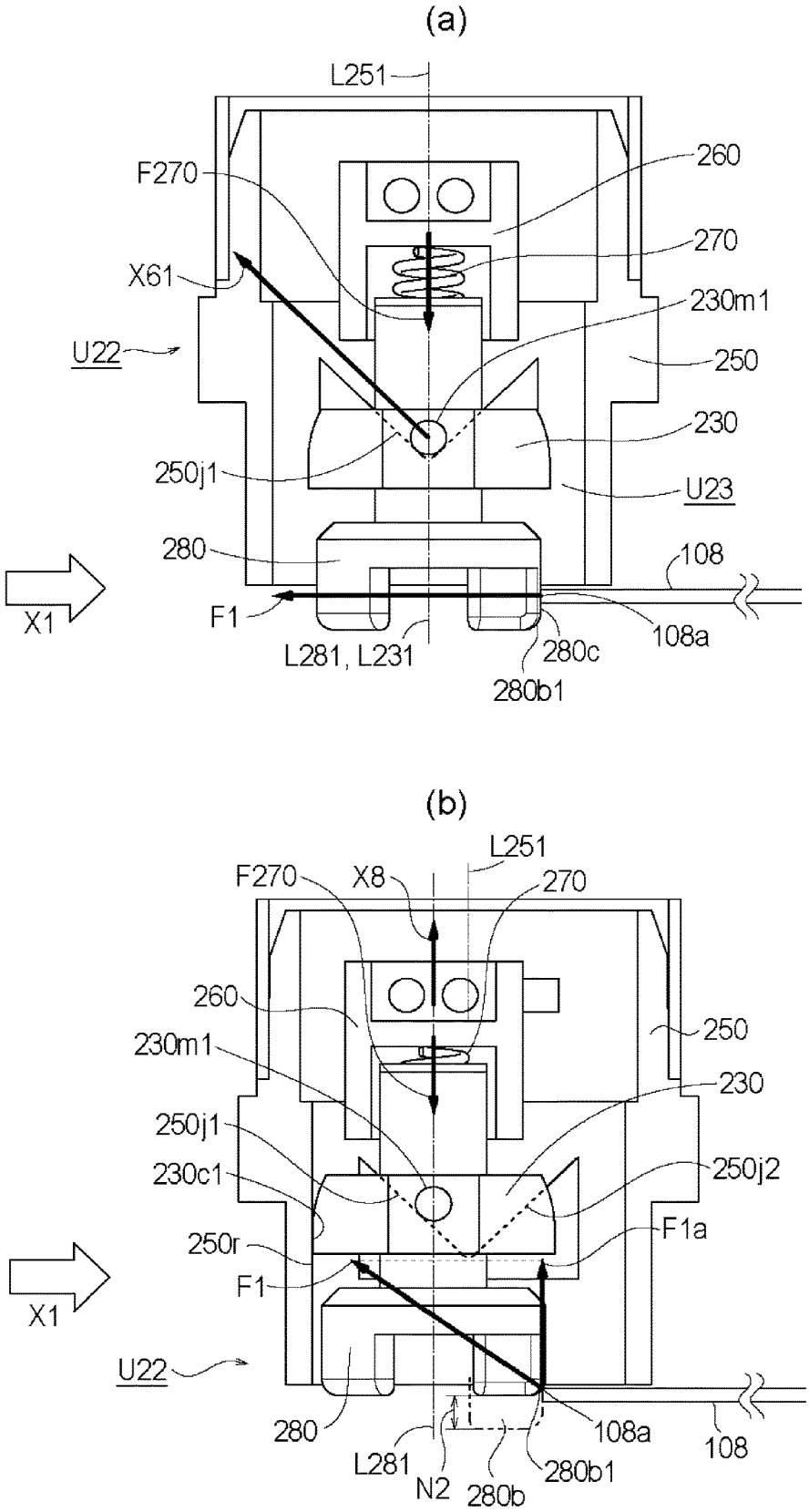
FIG. 45 is an enlarged illustration of the operation state at the time when the coupling member is engaged with the main assembly side engaging portion in the second embodiment of the present invention.
Figure 46:
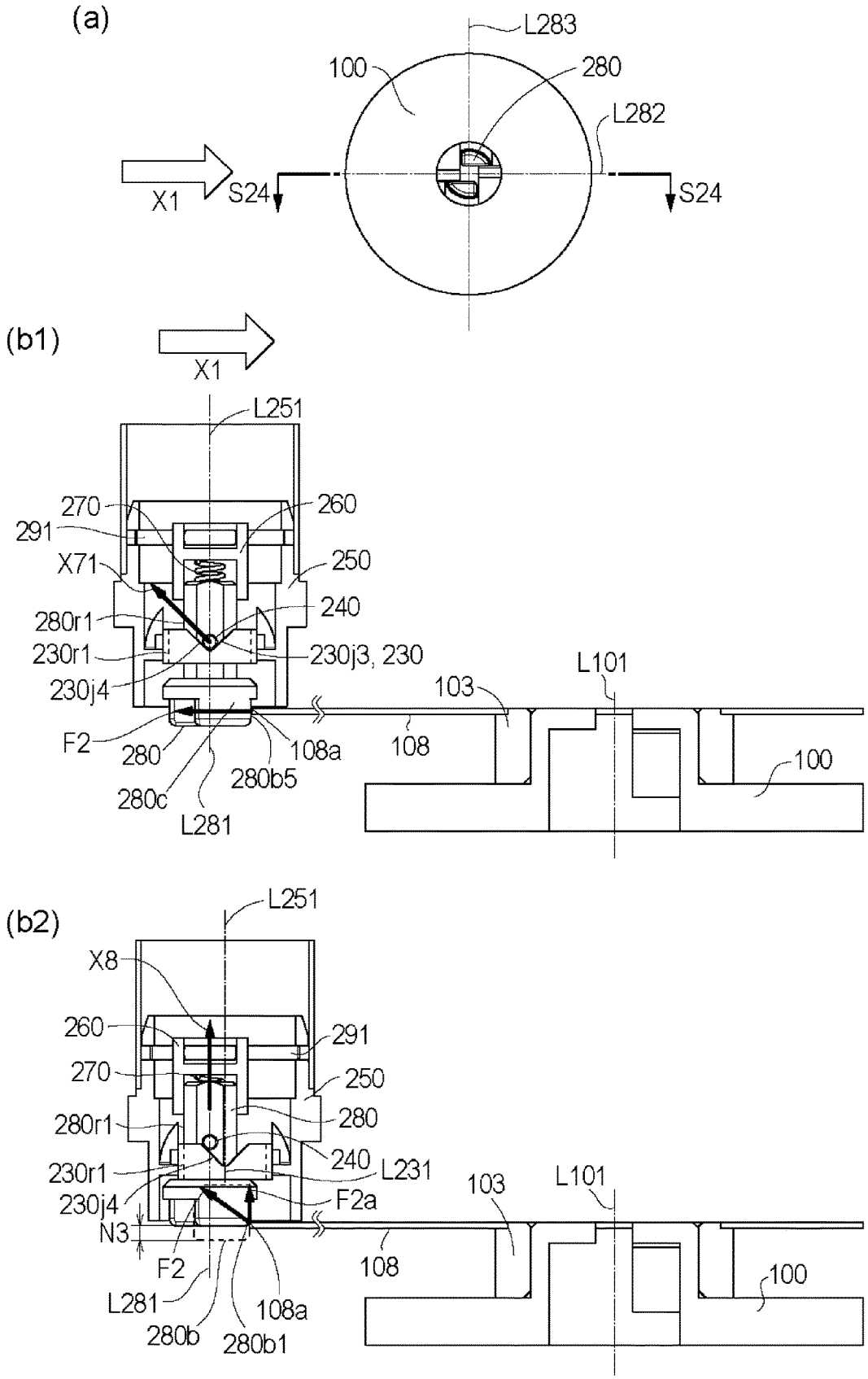
FIG. 46 is an illustration of the operation state at the time when the coupling member is engaged with the main assembly side engaging portion in the second embodiment of the present invention.

Referring to FIG. 44 to FIG. 46, the engaging operation of the coupling member 280 will be described. FIGS. 44 and 46 is a schematic sectional view showing the state in which the coupling member 280 engages with the main assembly side engaging portion 100. Part (a) of FIG. 44 and part (a) of FIG. 46 show the mounting direction and the lines along which a S23 sectional view and S24 sectional view are taken. Part (b1) of FIG. 44 through part (b4) of FIG. 44 are schematic sectional views taken along a line S23-S23 of part (a) of FIG. 44, in which the coupling member 280 moves to engage with the main assembly side engaging portion 100. Part (b1) of FIG. 46 and part (b2) of FIG. 46 are schematic sectional views taken along a line S24 of part (a) of FIG. 46, in which the coupling member 280 moves to engage with the main assembly side engaging portion 100. Part (a) of FIG. 45 and part (b) of FIG. are enlarged views of the neighborhood of the driving side flange unit U22 shown in part (b1) of FIG. 44 and part (b2) of FIG. 44. In part (b) of FIG. and part (b2) of FIG. 46, the first projected portion 280*b* in the initial state (which will be described hereinafter) of the mounting is depicted by broken lines. In the following, the description will be made as to the completion of the engagement between the main assembly side engaging portion 100 and the coupling member 280.

As shown in part (a) of FIG. 44, the description will be made as to the case that the axis L283 of the coupling member 280 and the mounting direction of the cartridge B (arrow X1) are parallel with each other.

As shown in part (b1) of FIG. 44 and part (a) of FIG. 45, when the cartridge B is moved in the direction of the arrow X1, the round body 280*c* of the coupling member 280 contacts the contact portion 108*a*. This state is the initial state of the mounting. The position of the coupling member 280 in the state shown in part (b1) of FIG. 44 this is a first position (projected position). At this time, the rotational axis L281 of the coupling member 280 is substantially parallel with the rotational axis L1 of the photosensitive drum 10. More particularly, the rotational axis L281 and the rotational axis L1 are substantially aligned with each other. The rotational axis L281 of the coupling member 280 is substantially parallel with the axis L251 of the driving side flange 250. More particularly, the rotational axis L281 and the rotational axis L251 are substantially aligned with each other.

With the advancement of the mounting of the cartridge B, the round body 280*c* receives the force F1 from the main assembly side contact portion 108*a* as the fixed member. The force F1 is directed in parallel with the direction of the arrow X1, that is, in parallel with the axis L283, and therefore, the cylindrical projection 230*m*1 of the intermediate slider 230 is contacted to the second guide portion 250*j*1 of the driving side flange 250 by the force F1. The coupling unit U23 moves relative to the driving side flange 250 along the second guide portion 250*j*1 in the direction of the arrow X61.

As shown in part (b2) of FIG. 44 and part (b) of FIG. 45, the round body 230*c*1 of the intermediate slider 230 contacts a cylindrical inner wall portion 250*r*1 of the driving side flange 250 to limit the movement of the coupling unit U23 in the direction of the X61. At this time, in the direction of the axis L281, a movement distance of the coupling unit U23 from the initial state of the mounting is N2. The movement distance N2 is determined by the angle 05 of the second guide portion 250*j*1—the second guide portion 250*j*4 relative to the axis L251 and the gap D2 (part (c) of FIG. 38).

In the state shown in part (b) of FIG. 45, the coupling unit U23 is distance from the position in the initial state of the mounting shown in part (b1) of FIG. 44 and part (a) of FIG. 45 in the direction of the arrow X8 by a movement distance N2. The movement distance N2 is selected such that only the free end R portion 280*b*1 of the coupling member 280 projects beyond the driving side flange 250. Then, the force F1 is directed toward the center of the R configuration of the free end round configuration portion 280*b*1, and therefore the force F1 produces a component force F1*a* in the direction of the arrow X8. With the movement of the cartridge B in the mounting direction X1, the coupling member 280 is moved further in the direction of the arrow X8 against the urging force F270 of the urging member 270 by the component force F1*a*. As shown in part (b3) of FIG. 44, the coupling member 280 can pass the contact portion 108*a*. The position of the coupling member 280 shown in part (b3) of FIG. 44 is a second position (retracted position). At this time, the rotational axis L281 of the coupling member 280 is substantially parallel with the rotational axis L1 of the photosensitive drum 10. More specifically, there is a gap between the rotational axis L281 and the rotational axis L1 (the rotational axis L281 and the rotational axis L1 are substantially out of alignment). The rotational axis L281 of the coupling member 280 is substantially parallel with the axis L251 of the driving side flange 250. More specifically, at this time, there is a gap between the rotational axis L281 and the rotational axis L251 (the rotational axis L281 and the rotational axis L1 are substantially out of alignment). In this second position, the coupling member 280 is displaced (moved/retracted) toward the photosensitive drum 10 (toward the other end portion side of the photosensitive drum 10 in the longitudinal direction) from the position in the first position.

Similarly to Embodiment 1, when the cartridge B is moved to the complete mounted position thereafter, the coupling member 280 is projected in the direction of the arrow X9 by the urging force of the urging force F270 of the urging member 270, so that the coupling member 280 can be brought into engagement with the main assembly side engaging portion (part (b4) of FIG. 44). That is, at this time, the position of the coupling member 280 is substantially the same as the first position (projected position).

On the other hand, as shown in FIG. 46, the description will be made as to the case that the axis L283 of the coupling member 280 and the mounting direction of the cartridge B (arrow X1) are perpendicular to each other.

When the cartridge B is mounted in the direction of the arrow X1, the round body 280*c* of the coupling member 280 contacts to the contact portion 108*a*. With further mounting movement of the cartridge B, the round body 280*c* receives the force F2 from the main assembly side contact portion 108*a*. The force F2 is directed in parallel with the arrow X1, that this, in parallel with the axis L282, and therefore, the guided pin 240 contacts the first guide portion 230*j*4 of the intermediate slider 230 by the force F2. Then, the coupling member 280 moves relative to the intermediate slider 230 along the first guide portion 230*j*4 in the direction of the arrow X71.

As shown in part (b2) of FIG. 46, the cylindrical portion 280*r*1 of the coupling member 280 contacts the cylindrical inner wall portion 230*r*1 of the intermediate slider 230, so that the movement of the coupling member 280 in the direction of the X71 is prevented. At this time, in the direction of the axis L281, the movement distance of the coupling member 280 from the initial state is N3 (part (b2) of FIG. 46). The movement distance N3 is determined by the angle θ4 of the first guide portion 230*j*1—first guide portion 230*j*4 relative to the axis L231 and the gap D1 (part (c) of FIG. 37).

In the state shown in part (b2) of FIG. 46, the coupling member 280 is distant from the position in the initial state of the mounting in the direction of the arrow X8 by the movement distance N3. The movement distance N3 is selected such that only the free end R portion 280*b*1 of the coupling member 280 projects beyond the driving side flange 250. Then, the force F1 is directed toward the center of the round configuration of the free end R portion 280*b*1, and therefore, the force F2 produces a component force F2*a* in the direction of the arrow X8 With the movement of the cartridge B in the mounting direction X1, the coupling member 280 is further moved in the direction of the arrow X8 against the urging force F270 of the urging member 270 by the component force F2*a*, and can pass the contact portion 108*a*. Thereafter, the cartridge B can be moved to the complete mounted position through the process similar to that shown in part (b3) of FIG. 44 and part (b4) of FIG. 44.

Figure 47:
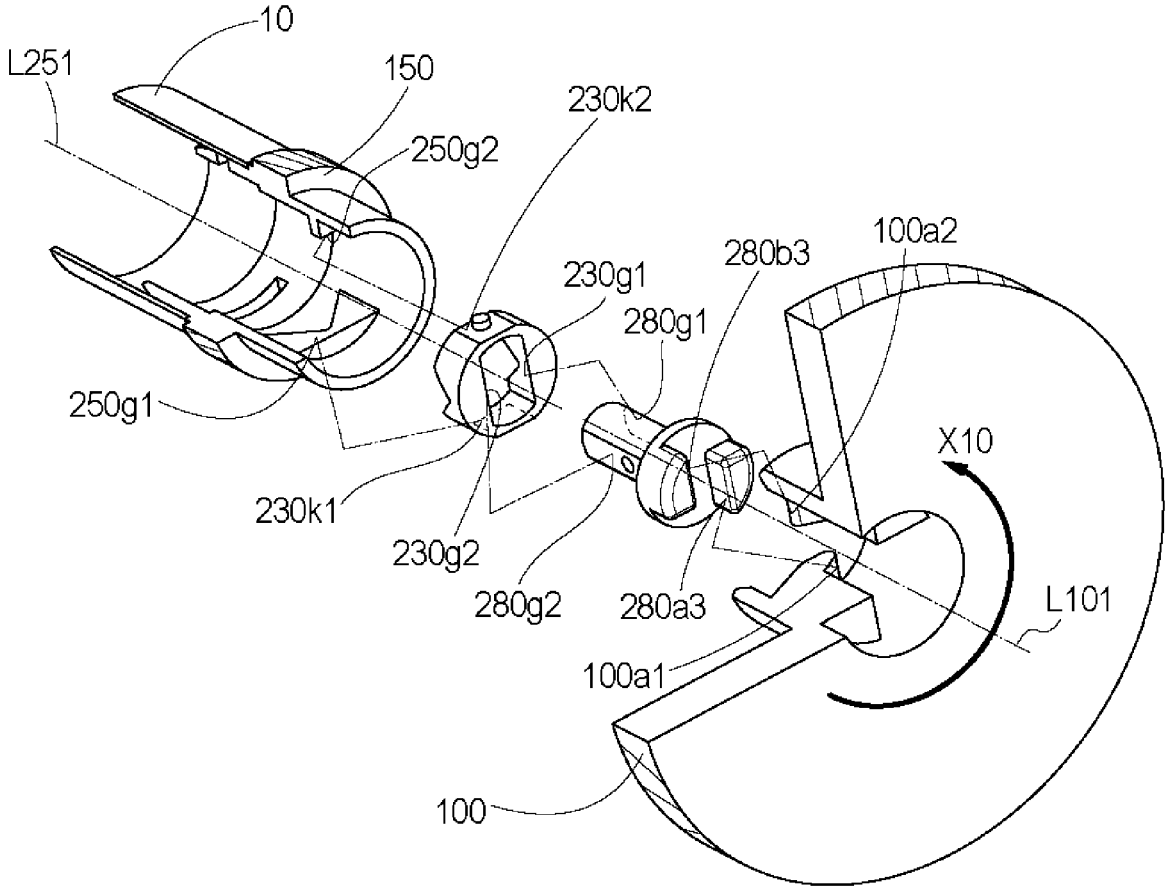
FIG. 47 is a perspective sectional view showing the rotational force transmission path in the second embodiment of the present invention.

Referring to FIG. 47, the description will be made as to a rotational force transmitting operation to the photosensitive drum 10 in this embodiment. FIG. 47 is a perspective sectional view illustrating a rotational force transmission path.

The rotational force transmission path from the main assembly side engaging portion to the coupling member 280 is similar to that of Embodiment 1, and therefore, the detailed description is omitted. The coupling member 280 having received the rotational force transmits the rotational force from the first rotational force transmitting portion 280*g*1 and the first rotational force transmitting portion 280*g*2 to the intermediate slider 230 through the first rotational force receiving portion 230 *g* and the first rotational force receiving portion 230*g*2. Then, the intermediate slider 230 transmits the rotational force to the driving side flange 250 from second rotational force transmitting portion 230*k*1 and the second rotational force transmitting portion 230*k*2 to the second rotational force receiving portion 250*g*1 and the second rotational force receiving portion 250*g*2. Similarly to the member, the rotational force is transmitted from the driving side flange 250 to the photosensitive drum 10.

Referring to FIG. 48 through FIG. 51, the description will be made as to the operation of disengaging the coupling member 280 from the main assembly side engaging portion 100 when the cartridge B is dismounted from the main assembly A of the apparatus.

Figure 48:
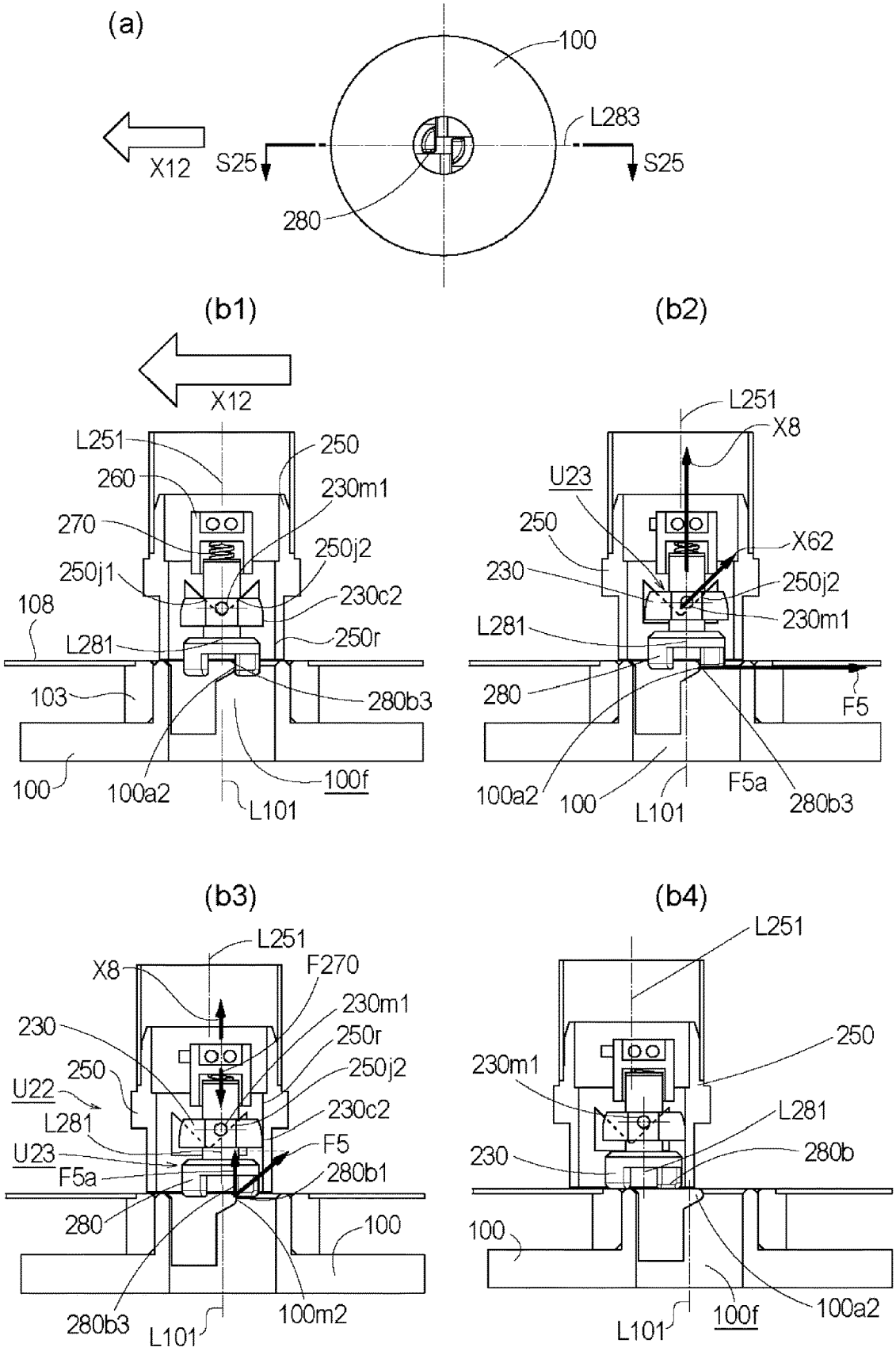
FIG. 48 is an illustration of the operation state of the time when the coupling member is disengaged from the main assembly side engaging portion according to the second embodiment of the present invention.
Figure 49:
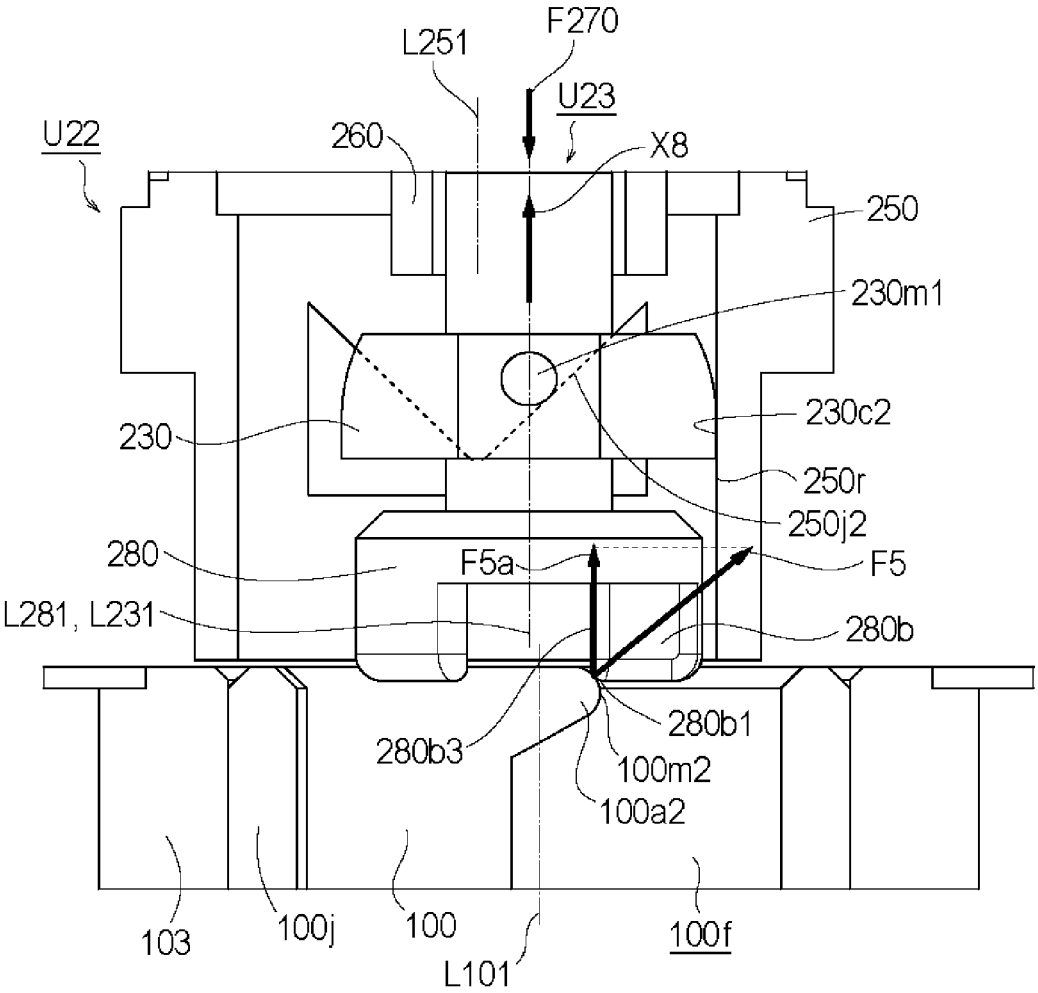
FIG. 49 is an enlarged illustration of the operation state at the time when the coupling member is disengaged from the main assembly side engaging portion in the second embodiment of the present invention.
Figure 50:
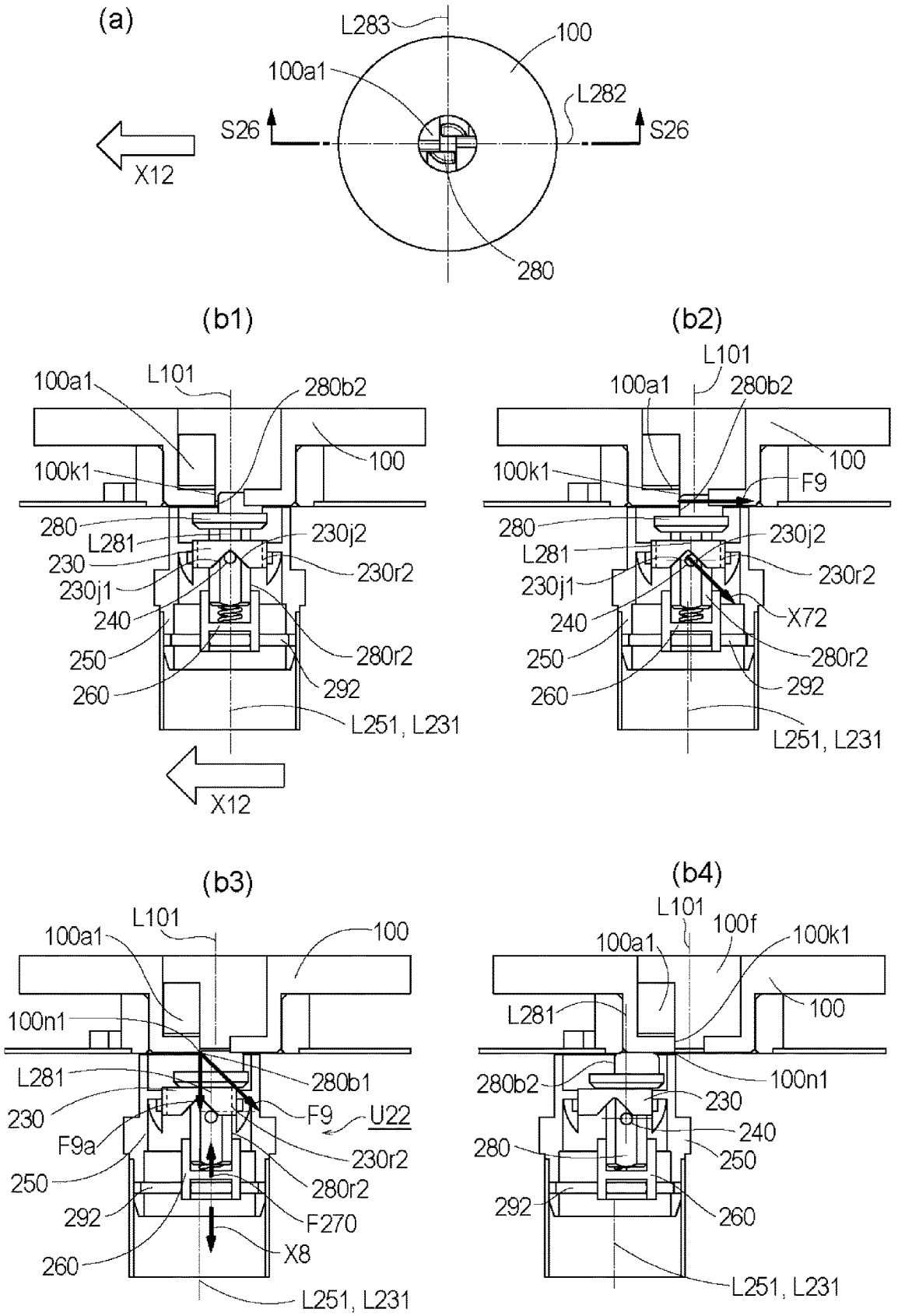
FIG. 50 is an illustration of the operation state of the time when the coupling member is disengaged from the main assembly side engaging portion according to the second embodiment of the present invention.
Figure 51:
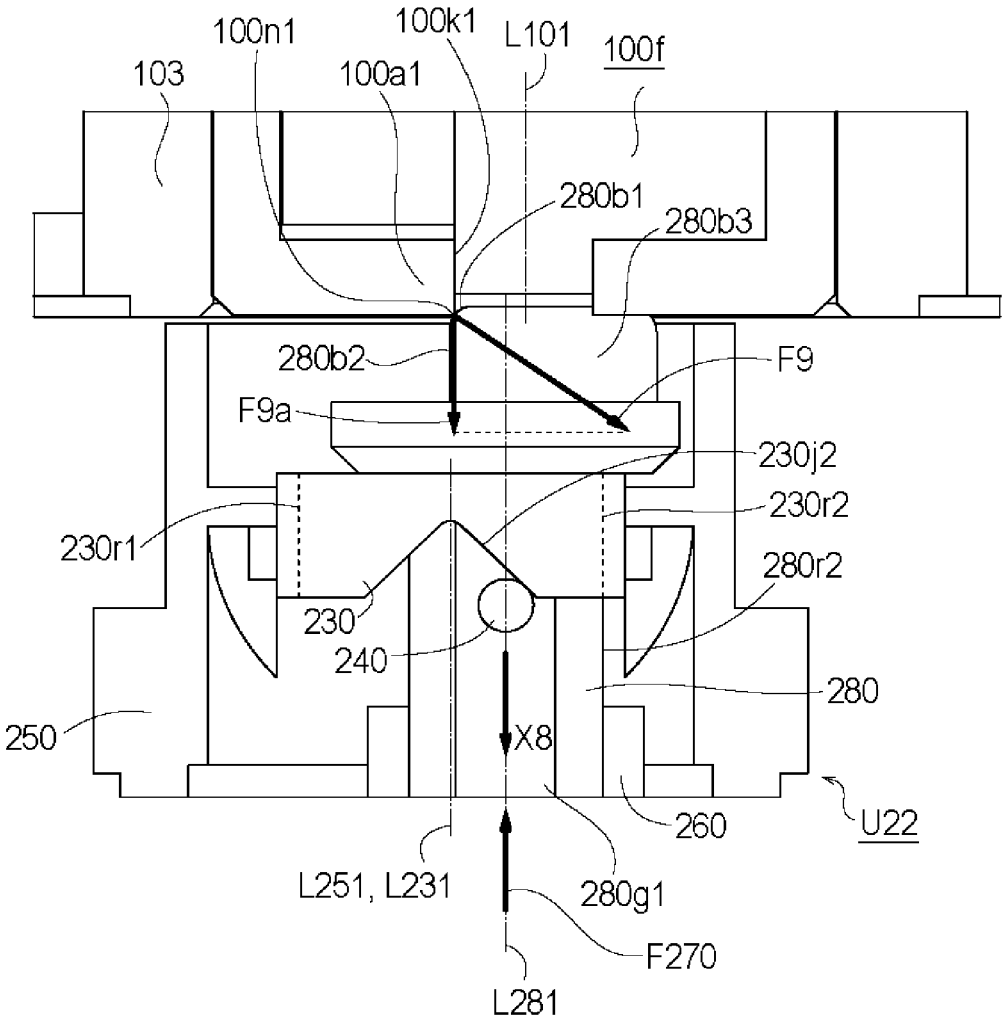
FIG. 51 is an enlarged illustration of the operation state at the time when the coupling member is disengaged from the main assembly side engaging portion in the second embodiment of the present invention.

Part (a) of FIG. 48 and part (a) of FIG. 50 shows the dismounting direction of the cartridge B and the lines along which the S25 sectional view and the S26 sectional view are shown. Parts (b1)-(b4) of FIG. 48 is a S25 section of part (a) of FIG. 48, and is a schematic sectional view illustrating the state of the coupling member 180 disengaging from the main assembly side engaging portion 100. Parts (b1)-(b4) of FIG. 50 is a S26 section of part (a) of FIG. 50, and is a schematic sectional view illustrating the state of the coupling member 180 disengaging from the main assembly side engaging portion 100. FIGS. 49 and 51 are enlarged views of the neighborhood of the driving side flange unit U22 shown in part (b3) of FIG. 48 and part (b3) of FIG. 50. In the sectional view of FIG. 48-FIG. 51, the coupling unit U23 is not sectioned, for better illustration. In part (b1) of FIG. 48-part (b4) of FIG. 48 and FIG. 49, the second guide portion 250*j*1 and the second guide portion 250*j*2 of the driving side flange 250 are indicated by broken lines. In parts (b1)-(b3) of FIG. 50 and FIG. 51, the cylindrical inner wall portion 230*r*1 and the cylindrical inner wall portion 230*r*2 of the intermediate slider 230 are depicted by broken lines. In the following, the rotational force receiving portion 280*b*3 side will be taken for the explanation.

First, as shown in FIG. 48, the description will be made as to the case that the dismounting direction of the cartridge B (arrow X12) and the axis L283 of the coupling member 280 are parallel with each other.

The position of the coupling member 280 in the state shown in part (b1) of FIG. 48 is the first position (enabled-rotational-force-transmission-position). The first position (enabled-rotational-force-transmission-position) is substantially the same as the first position (projected position). At this time, the rotational axis L281 of the coupling member 280 is substantially parallel with the rotational axis L1 of the photosensitive drum 10. More particularly, the rotational axis L281 and the rotational axis L1 are substantially aligned with each other. The rotational axis L281 of the coupling member 280 is substantially parallel with the axis L251 of the driving side flange 250. More particularly, the rotational axis L281 and the rotational axis L251 are substantially aligned with each other.

As shown in part (b2) of FIG. 48, when the cartridge B is moved in the dismounting direction X12, rotational force receiving portion 280*b*3 in the upstream side of the coupling member 280 receives the force F5 from the rotational force applying portion 100*a*2. The force F5 is directed perpendicular to the rotational force receiving portion 280*b*3, that is, in parallel with the axis L283, and therefore, the cylindrical projection 230*m*1 of the intermediate slider 230 and the second guide portion 250*j*2 of the driving side flange 250 contact to each other by the force F5. The coupling unit U23 moves relative to the driving side flange 250 in the direction of the arrow X62 along the second guide portion 250*j*2.

When the cartridge B is moved further in the direction of the dismounting direction X12, the round body 230*c*2 of the intermediate slider 230 contacts to the cylindrical inner wall portion 250*r* of the driving side flange 250, as shown in part (b3) of FIG. 48. By this, the movement of the coupling unit U23 relative to the driving side flange 250 in the direction of the arrow X62 is limited. The above-described movement distance N2 is selected such that the free end R portion 280*b*1 of the second projected portion 280*b* contacts the rotational force applying portion 100*a*2 in the non-driving side of a most projected portion 100*m*2 of the rotational force applying portion 100*a*2 at this time, as shown in FIG. 49. By this, the force F5 is directed toward the center of the round configuration of the free end round portion 280*b*1, and therefore, a component force F5*a* of the force F5 is produced in the direction of the arrow X8. With the movement of the cartridge B in the direction of the dismounting direction X12, the coupling member 280 is moved further in the direction of the arrow X8 against the urging force F270 of the urging member 270 by the component force F5*a*. As shown in part (b4) of FIG. 48, the coupling member 280 is disengaged from the space portion 100*f* of the main assembly side engaging portion 100.

The position of the coupling member 280 in part (b4) of FIG. 48 is the second position (disengageable position). The second position (disengagement enabled position) is substantially the same as the above-described first position (retracted position). At this time, the rotational axis L281 of the coupling member 280 is substantially parallel with the rotational axis L1 of the photosensitive drum 10. More specifically, there is a gap between the rotational axis L281 and the rotational axis L1 (the rotational axis L281 and the rotational axis L1 are substantially out of alignment). The rotational axis L281 of the coupling member 280 is substantially parallel with the axis L251 of the driving side flange 250. More specifically, at this time, there is a gap between the rotational axis L281 and the rotational axis L251 (the rotational axis L281 and the rotational axis L1 are substantially out of alignment). In this second position, the coupling member 280 is displaced (moved/retracted) toward the photosensitive drum 10 (toward the other end portion side of the photosensitive drum 10 in the longitudinal direction) from the position in the first position.

In summary, with the dismounting of the cartridge B from the main assembly A of the apparatus, the coupling member 280 is disengaged from the main assembly side engaging portion 100. In other words, with the dismounting of the cartridge B from the main assembly A of the apparatus, the coupling member 280 receives the force from the main assembly side engaging portion 100, so that the coupling member 280 moves from the first position to the second position. Further in other words, with the dismounting of the cartridge B from the main assembly A of the apparatus, the coupling member 280 receives the force from the main assembly side engaging portion 100 and the driving side flange 250 to move from the first position (enabled-rotational-force-tranmission-position) to the second position (disengagement enabled position).

As shown in part (a) of FIG. 50, the description will be made as to the case that the axis L283 of the coupling member 280 is perpendicular to the dismounting direction X12 of the cartridge B.

The coupling member 280 in part (b) of FIG. 50 is also the first position (enabled-rotational-force-tranmission-position). At this time, the rotational axis L281 of the coupling member 280 is substantially parallel with the rotational axis L1 of the photosensitive drum 10. More particularly, the rotational axis L281 and the rotational axis L are substantially aligned with each other. The rotational axis L281 of the coupling member 280 is substantially parallel with the axis L251 of the driving side flange 250. More particularly, the rotational axis L281 and the rotational axis L251 are substantially aligned with each other.

The position of the intermediate slider 230 in part (b1) of FIG. 50 is a first middle position. At this time, a rotational axis L231 of the intermediate slider 230 is substantially parallel with the rotational axis L1 of the photosensitive drum 10. More particularly, the rotational axis L231 and the rotational axis L1 are substantially aligned with each other. In addition, the rotational axis L231 of the intermediate slider 230 is substantially parallel with the axis L251 of the driving side flange 250. More particularly, the rotational axis L231 and the rotational axis L251 are substantially aligned with each other.

When the cartridge B is moved in the direction of the dismounting direction X12 from the state shown in part (b1) of FIG. 50, the coupling member 280 moves in the direction of the dismounting direction X12 together with the driving side flange 250 and the intermediate slider 230 As shown in part (b2) of FIG. 50, the second main assembly contact portion 280*b*2 in the upstream side of the coupling member 280 with respect to the dismounting direction X12 contacts a flat surface wall portion 100*k*1 in the downstream side with respect to the dismounting direction X12, and the cartridge B receives the force force F9 in the dismounting thereof. The force F9 is directed perpendicular to the second main assembly contact portion 280*b*2, that is, in parallel with the axis L282. Therefore, by the force F9, the coupling member 280 moves in the direction of the arrow X72 along the first guide portion 230*j*2 relative to the intermediate slider 230 and the driving side flange 250, while the guided pin 240 is in contact with the first guide portion 230*j*1 of the intermediate slider 230.

When the cartridge B is moved farther in the dismounting direction X12, the cylindrical portion 280*r*2 of the coupling member 280 is brought into contact to the cylindrical inner wall portion 230*r*2 of the intermediate slider 230, as shown in part (b3) of FIG. 50. By this, the movement of the coupling member 280 relative to the driving side flange 250 and the intermediate slider 230 in the direction of the arrow X72 is regulated. The above-described movement distance N3 is selected such that the free end round portion 280*b*1 of the second projected portion 280*b* contacts a retraction force applying portion 100*n*1, as shown in FIG. 51 at this time. By this, the force F9 is directed toward the center of the round configuration of the free end round portion 280*b*1, and therefore, a component force F9*a* of the force F9 is produced in the direction of the arrow X8. With the movement of the cartridge B in the direction of the dismounting direction X12, the coupling member 280 is moved further in the direction of the arrow X8 against the urging force F270 of the urging member 270 by the component force F9*a*. As shown in part (b4) of FIG. 50, the coupling member 280 is disengaged from the space portion 100*f* of the main assembly side engaging portion 100. The position of the coupling member 180 shown in part (b4) of FIG. 50 is also the second position (disengagement enabled position). At this time, the rotational axis L281 of the coupling member 280 is substantially parallel with the rotational axis L1 of the photosensitive drum 10. More specifically, there is a gap between the rotational axis L281 and the rotational axis L1 (the rotational axis L281 and the rotational axis L1 are substantially out of alignment). The rotational axis L281 of the coupling member 280 is substantially parallel with the axis L251 of the driving side flange 250. More specifically, at this time, there is a gap between the rotational axis L281 and the rotational axis L251 (the rotational axis L281 and the rotational axis L1 are substantially out of alignment). In this second position, the coupling member 280 is displaced (moved/retracted) toward the photosensitive drum 10 (toward the other end portion side of the photosensitive drum 10 in the longitudinal direction) from the position in the first position.

The position of the intermediate slider 230 shown in part (b4) of FIG. 50 is a second middle position. At this time, a rotational axis L231 of the intermediate slider 230 is substantially parallel with the rotational axis L1 of the photosensitive drum 10. More specifically, there is a gap between the rotational axis L231 and the rotational axis L1 (the rotational axis L231 and the rotational axis L1 are substantially out of alignment). In addition, the rotational axis L231 of the intermediate slider 230 is substantially parallel also with the axis L251 of the driving side flange 250. More specifically, at this time, there is a gap between the rotational axis L231 and the rotational axis L251 (the rotational axis L231 and the rotational axis L1 are substantially out of alignment). In the second position, the intermediate slider 230 is displaced (moved/retracted) toward the photosensitive drum 10 (toward the other end portion side of the photosensitive drum 10 with respect to the longitudinal direction), as compared with the first position.

In summary, with the dismounting of the cartridge B from the main assembly A of the apparatus, the coupling member 280 is disengaged from the main assembly side engaging portion 100. In other words, with the dismounting of the cartridge B from the main assembly A of the apparatus, the coupling member 280 receives the force from the main assembly side engaging portion 100, so that the coupling member 280 moves from the first position to the second position. Further in other words, with the dismounting of the cartridge B from the main assembly A of the apparatus, the coupling member 280 receives the force from the main assembly side engaging portion 100 and the driving side flange 250 to move from the first position (enabled-rotational-force-transmission-position) to the second position (disengagement enabled position).

In the foregoing, the description has been made as to the case in which the dismounting direction 12 of the cartridge B is parallel with the axis L283 of the coupling member 280, as an example. However, the coupling member 280 can be similarly removed from the main assembly side engaging portion 100 even when the dismounting direction is different from those described in the foregoing. In such a case, in the dismounting of the cartridge B, any one of the rotational force receiving portion 280*a*3 and the rotational force receiving portion 280*b*3 contacts one rotational force applying portion 100*a*1 and the rotational force applying portion 100*a*2. Or, anyone of the second main assembly contact portion 280*a*2 and the second main assembly contact portion 280*b*2 contacts one of the flat surface wall portion 100*k*1 and the flat surface wall portion 100*k*2. Or, any one of the free end round portion 280*a*1 and the free end round portion 280*b*1 contacts one of the retraction force applying portion 100*n*1 and the retraction force applying portion 100*n*2. Then, the coupling member 280 receives at lease one of the force F5 and the force F9 by the dismounting operation described above to move relative to the driving side flange 250 in the direction perpendicular to the axis L281. In interrelation with the movement in the direction perpendicular to the axis L281, the coupling member 280 moves in the direction of the arrow X8 to disengage from the main assembly side engaging portion 100.

That is, the cartridge B can be dismounted from the main assembly A of the apparatus irrespective of the rotation of phases of the coupling member 280 and the main assembly side engaging portion 100 relative to the dismounting direction of the cartridge B from the main assembly A of the apparatus.

Figure 52:
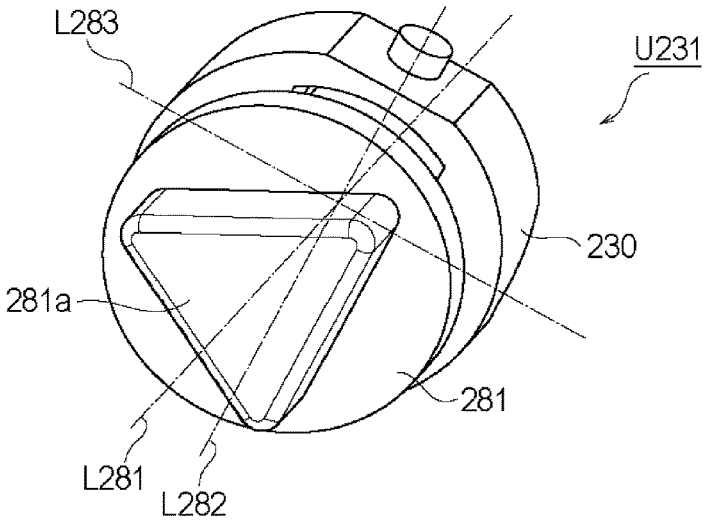
FIG. 52 is a schematic perspective view of the coupling member and the main assembly side engaging portion according to the second embodiment of the present invention.
Figure 52:
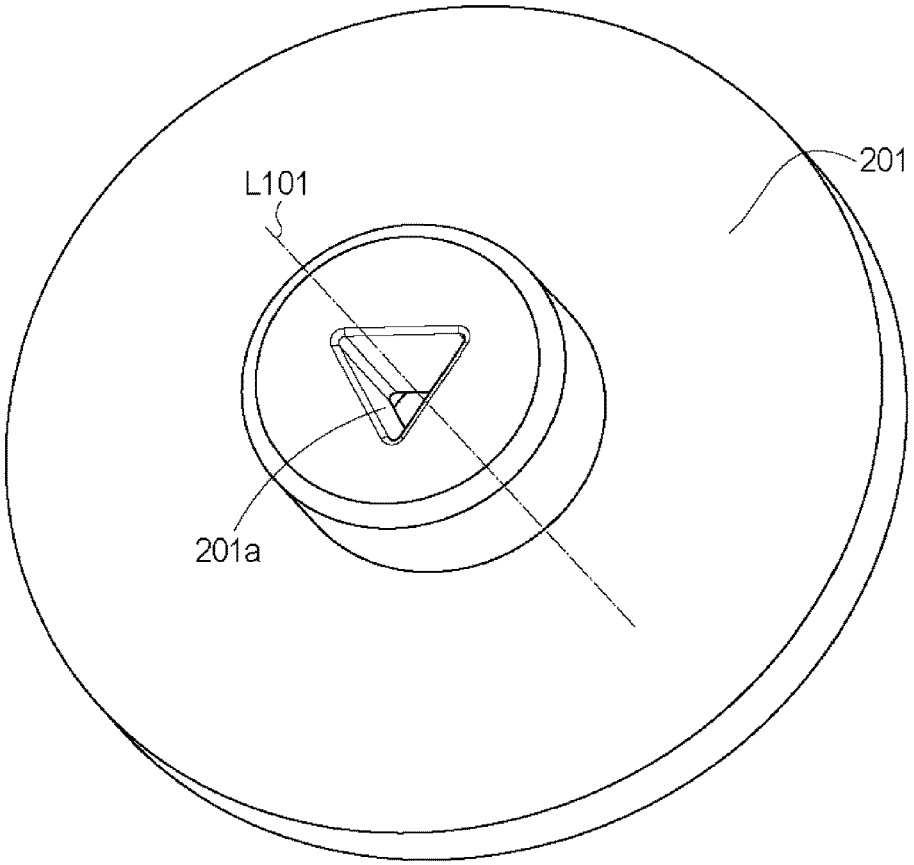
Figure 53:
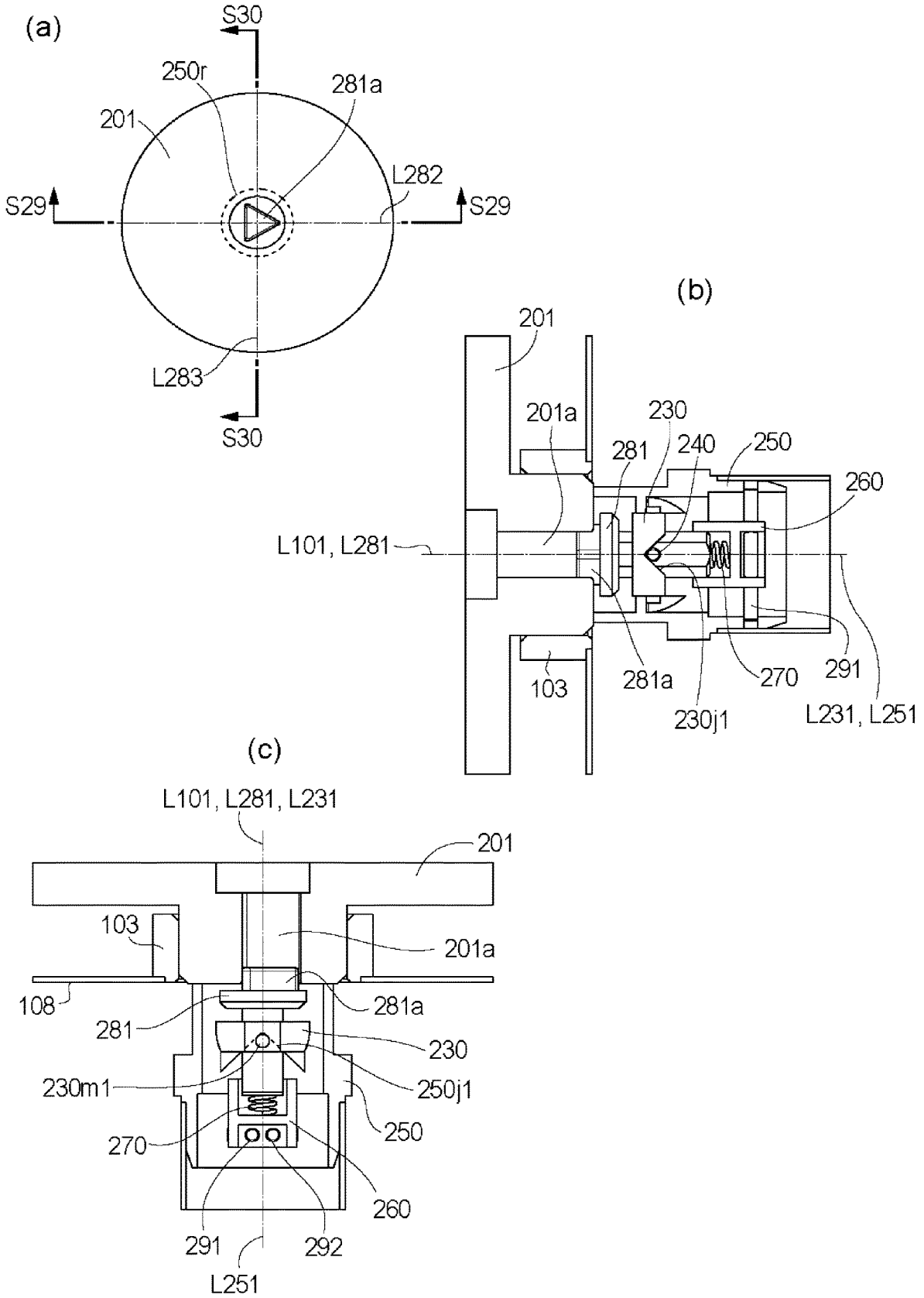
FIG. 53 is an illustration of the operation state of the time when the coupling member is disengaged from the main assembly side engaging portion according to the second embodiment of the present invention.
Figure 54:
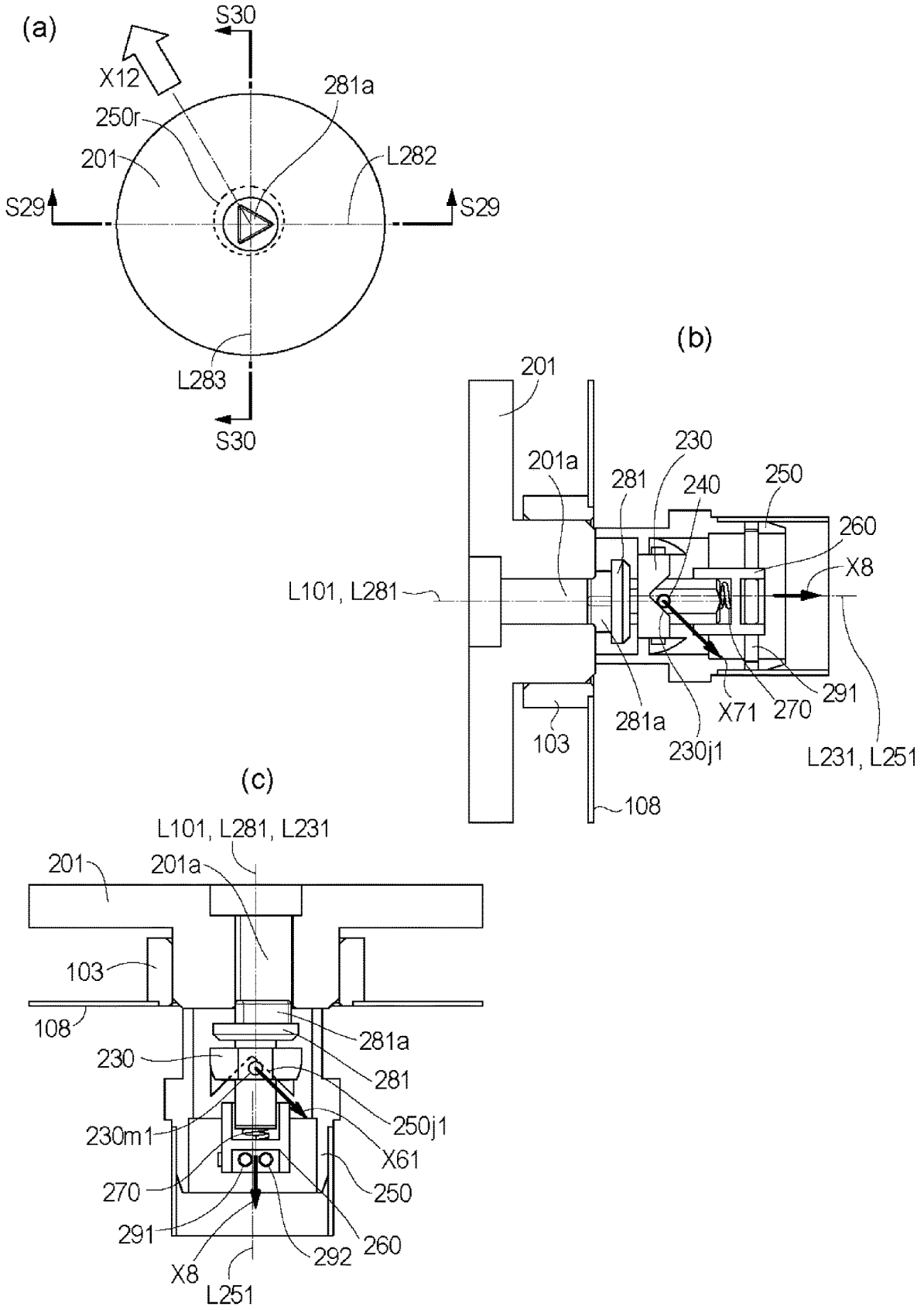
FIG. 54 is an illustration of the operation state of the time when the coupling member is disengaged from the main assembly side engaging portion according to the second embodiment of the present invention.

In this embodiment, similarly to Embodiment 1, the coupling member 280 has two projected portions, but the cross-sectional configurations of the projected portions can be designed freely. Referring to FIG. 52-FIG. 54, the description will be made as to the case in which the cross-sectional configurations of the projected portions are triangular, for example. FIG. 52 is a schematic perspective view of the coupling member 281 and the main assembly side engaging portion 201. FIG. 53 illustrate the state in which a driving side flange unit U221 including the coupling member 281 is in engagement with the main assembly side engaging portion 201. Part (a) of FIG. 53 is a view as seen in the direction of an axis L101, and part (b) of FIG. 53 and part (c) of FIG. 53 are sectional views taken along S29 and S30 of part (a) of FIG. 53, respectively. FIG. 54 illustrates the dismounting operation of the driving side flange unit U221 including the coupling member 281 from the main assembly side engaging portion 201. Part (a) of FIG. 54 is a view as seen in the direction of an axis L101, and part (b) of FIG. 54 and part (c) of FIG. 54 are sectional views taken along S29 and S30 of part (a) of FIG. 54, respectively. In part (a) of FIG. 53 and part (a) of FIG. 54, the coupling unit U231 is not sectioned, and the cylindrical inner wall portion 250*r* of the driving side flange 250 is depicted by broker lines. In part (c) of FIG. 53 and part (c) of FIG. 54, the coupling unit U23 is not sectioned, and the first guide portion 250*j*1 and the first guide portion 250*j*2 of the driving side flange 250 are depicted by broken lines.

As shown in FIG. 52, a projected portion 281*a* of the coupling member 281 is in the form of a triangular prism protruding from the round body 280*c* toward the driving side. On the other hand, a rotational force applying portion 201*a* of the main assembly side engaging portion 201 is in the form of a recessed triangular prism having a substantially complimentary shape with the projection 281*a*.

In this case, as shown in part (a) of FIG. 54, for example, when the cartridge B is moved in the direction of the dismounting direction X12, the coupling member 281 does not move in the direction of the dismounting direction X12 while keeping the engagement with the main assembly side engaging portion 201. On the other hand, the driving side flange 250 moves in the direction of the dismounting direction X12, and therefore, the coupling member 281 moves relative to the driving side flange 250 in the direction opposite to the dismounting direction X12. By this, as shown in part (b) of FIG. 54 and part (c) of FIG. 54, the coupling member 281 move in the direction of the arrow X8 along the first guide portion 230*j*1—first guide portion 230*j*4 and along the second guide portion 250*j*1—second guide portion 250*j*4. That is, the coupling member 281 does not move in the dismounting direction X12, but move in the direction of the arrow X8 at this place, and therefore, the projected portion 281*a* can be disengaged from the rotational force applying portion 201*a*.

As described above, in this embodiment, the coupling member 280 is movable in any direction perpendicular to the axis L281 in addition to the operation in Embodiment 1. That is, the same advantageous effects as with Embodiment 1 are provided, and the design latitude for the configuration of the rotational force receiving portion are enhanced.

Embodiment 3

Referring to FIG. 58-FIG. 86, a third embodiment according to the present invention will be described.

In the description of this embodiment, the same reference numerals as in the foregoing Embodiments are assigned to the elements having the corresponding functions in this embodiment, and the detailed description thereof is omitted for simplicity, and the structure and operation which are different from Embodiment 1 will be described. Also, similar parts names will be assigned.

Similarly to the description of Embodiment 1, rotational axes of a driving side flange 350, of a coupling member 380 and of a main assembly side engaging portion 300 will be called axes.

The mounting direction of the cartridge B to the main assembly A of the apparatus and the dismounting direction of the cartridge B from the main assembly A of the apparatus in this embodiment are similar to those of Embodiment 1, and this applies to the other embodiments, too.

Figure 58:
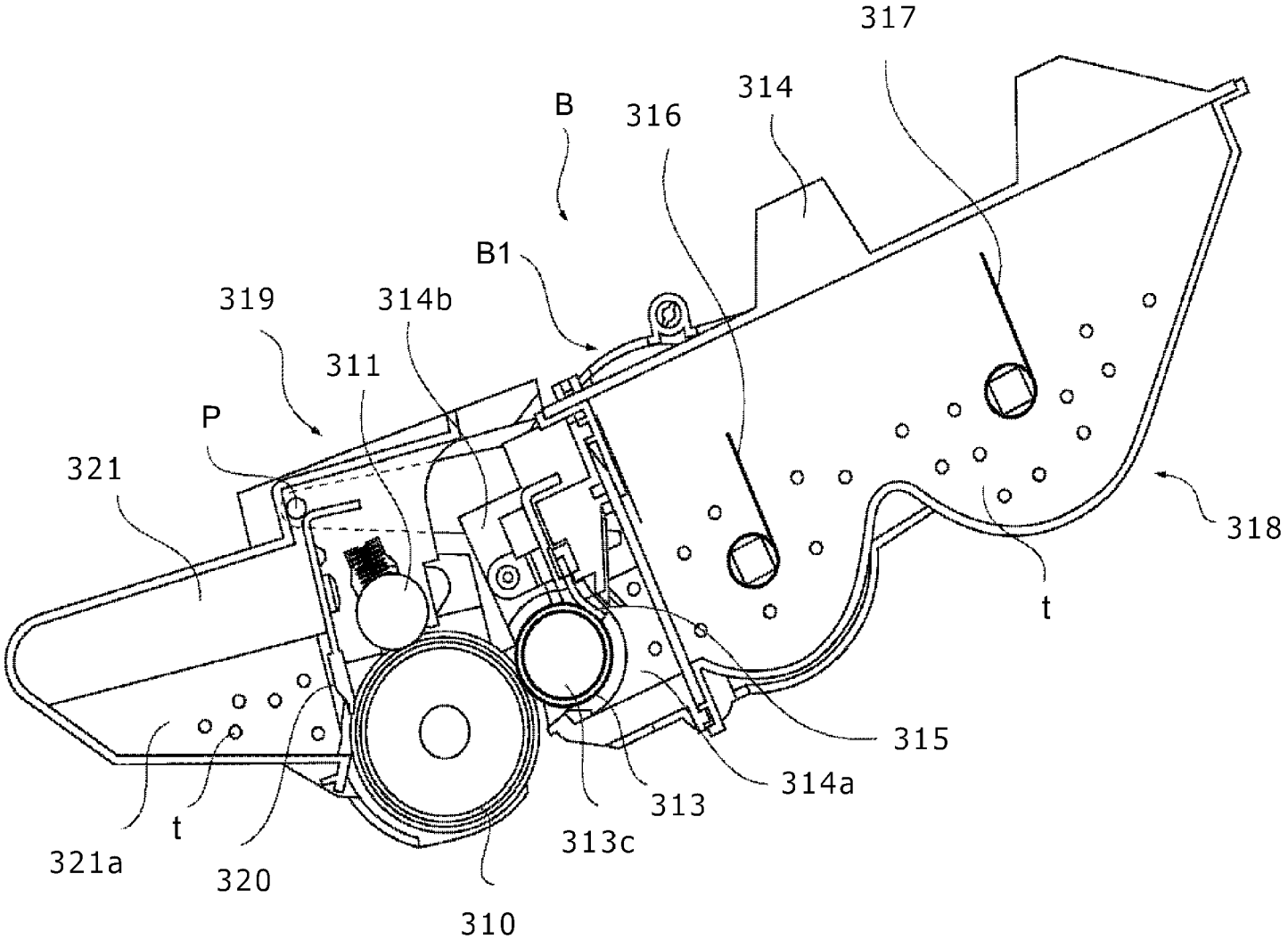
FIG. 58 is a sectional side view of a cartridge according to a third embodiment of the present invention.
Figure 59:
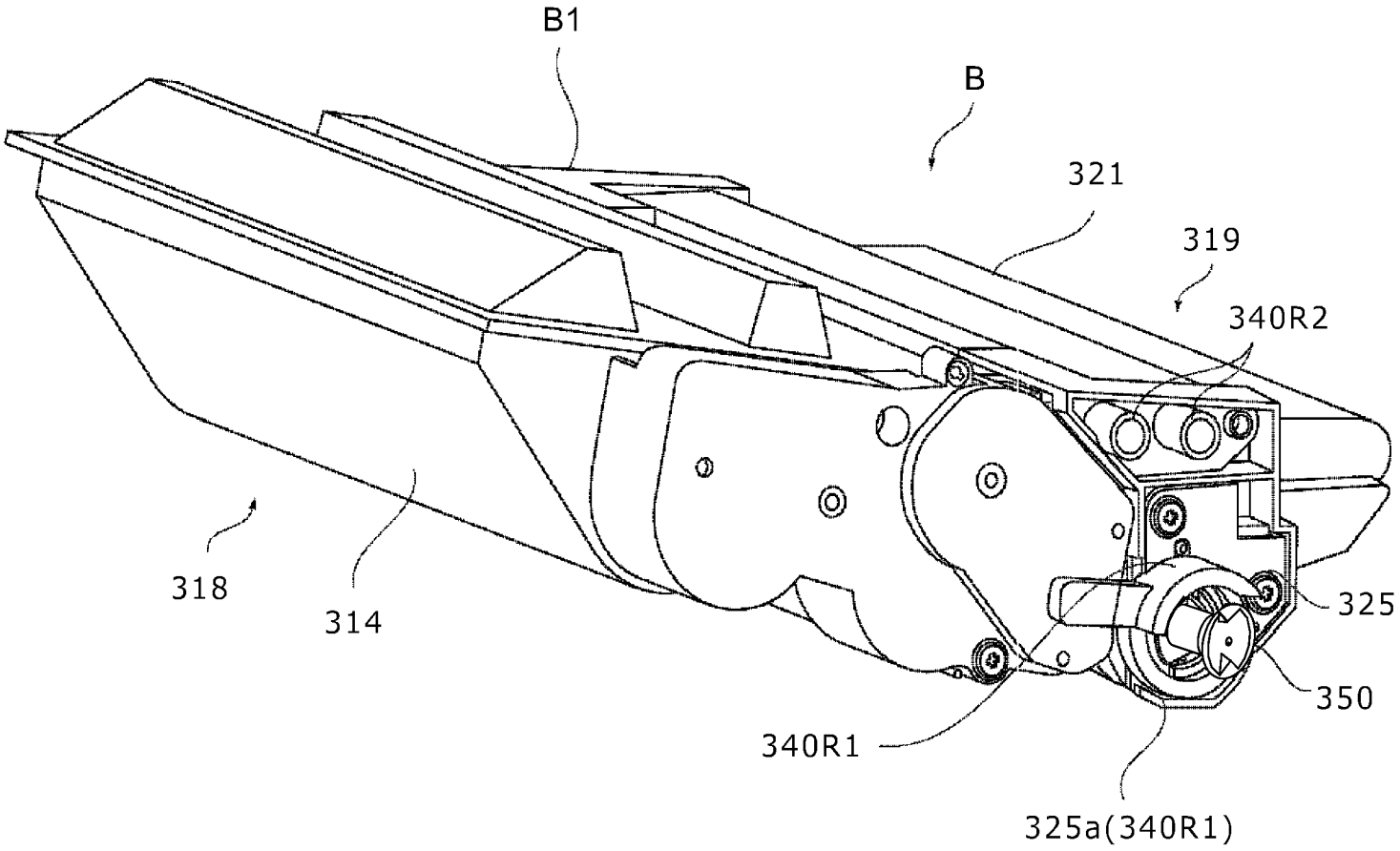
FIG. 59 is a schematic perspective view of the cartridge of the third embodiment, as seen from the driving side.
Figure 60:
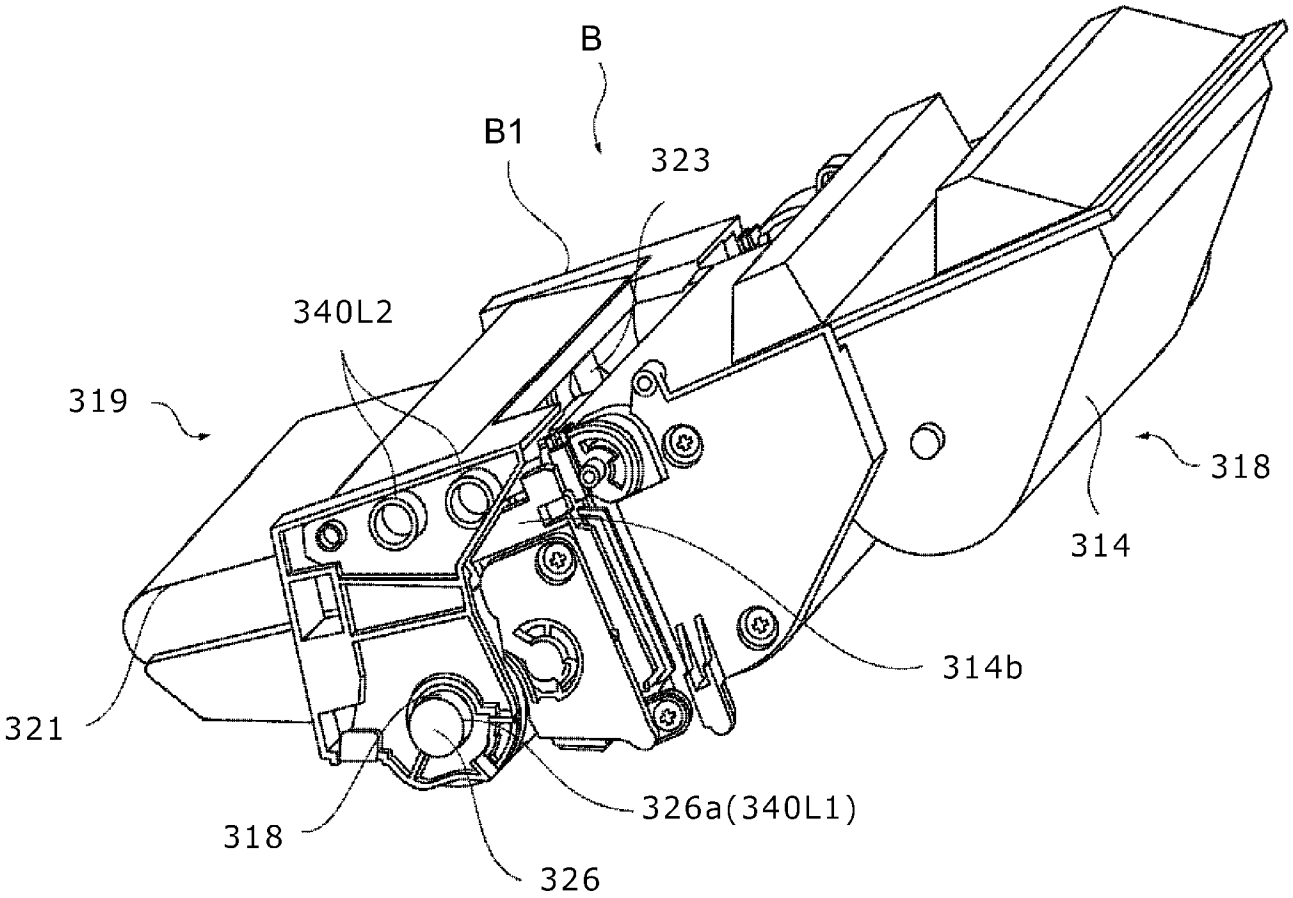
FIG. 60 is a schematic perspective view of the cartridge according to the third embodiment of the present invention, as seen from the non-driving side.

(1) Brief Description of Process Cartridge:

FIG. 58 is a sectional view taken along a line of the according to the present invention, and FIGS. 59 and 60 are perspective views of the cartridge B.

As shown in FIG. 58-FIG. 60, the cartridge B comprises a photosensitive drum 310. When the cartridge B is mounted to the main assembly A of the apparatus, the photosensitive drum is rotated by a rotational force received from the main assembly A of the apparatus by a coupling mechanism which will be described hereinafter. The cartridge B can be mounted to and dismounted from the main assembly A of the apparatus by the user.

To an outer peripheral surface of the photosensitive drum 310, a charging roller 311 as charging means is opposed. The charging roller 311 charges the photosensitive drum 310 by being supplied with voltage application from the main assembly A of the apparatus. The charging roller 311 is contacted to the photosensitive drum 310 to be driven by the photosensitive drum 310.

The cartridge B comprises a developing roller 313 as developing means. The developing roller 313 is a rotatable member capable of carrying a developer t to supply the developer to a developing area on the photosensitive drum 310. The developing roller 313 develops an electrostatic latent image formed on the photosensitive drum 310 with the developer t. The developing roller 313 contains the magnet roller (fixed magnet) 313*c*.

A developing blade 315 is contacted to a peripheral surface of the developing roller 313. The developing blade 315 regulates an amount of the developer t deposited on the peripheral surface of the developing roller 313. In addition, it applies triboelectric charge to the developer t.

Rotatable stirring members 316 and 317 are provided to feed the developer t from a developer accommodating container 314 into a developing chamber 314*a*. And, the developing roller 313 supplied with a voltage is rotated. By this, a developer layer triboelectrically charged by the developing blade 315 is formed on the surface of the developing roller 313. The developer t is transited onto the photosensitive drum 310 in accordance with the latent image pattern. Thus, the latent image is developed. That is, the photosensitive drum 310 as a photosensitive member (rotatable member) is capable of carrying a developer image (developer t).

The developer image formed on the photosensitive drum 310 is transferred onto a recording material 2 (FIG. 1) by a transfer roller 4 (FIG. 1). The recording material is a sheet of paper, a label, an OHP sheet, for example.

An elastic cleaning blade 320 as cleaning means is provided opposed to the outer peripheral surface of the photosensitive drum 310. A free end of the blade 320 is contacted to the photosensitive drum 310. The blade 320 removes the developer t remaining on the photosensitive drum 310 after transfer of the developer image onto the recording material 2. The developer t removed from the surface of the photosensitive drum 310 by the blade 320 is accommodated in the removed developer container 321*a*.

The cartridge B is constituted by a developing unit 318 and a drum unit 319 into a unified structure.

The developing unit 318 comprises a developing device frame 314*b* which is apart of a cartridge frame B1. The developing unit 318 comprises the developing roller 313, the developing blade 315, the developing chamber 314*a*, the developer accommodating container 314 and the stirring members 316 and 317.

The drum unit 319 comprises a drum frame 321 which is a part of the cartridge frame B1. The drum unit 319 further comprises the photosensitive drum 310, the cleaning blade 320, the removed developer container 321*a* and the charging roller 311.

The developing unit 318 and the drum unit 319 are rotatably connected with each other by a pin P. The developing roller 313 is urged to photosensitive drum 310 by an elastic member 323 shown in FIG. 60 and provided between the units 318 and 319.

The cartridge B is mounted in a cartridge accommodating portion 330*a* (FIG. 62 which will be described hereinafter) of the main assembly A of the apparatus. At this time, as will be described hereinafter, a coupling as a rotational force transmitting part of the cartridge B is coupled with a driving shaft main assembly A of the apparatus, in interrelation with the mounting operation of the cartridge B. The photosensitive drum 310 and soon are rotated by a driving force provided by the main assembly A of the apparatus.

As shown in FIG. 59, a drum bearing 325 is provided in the driving side of the cartridge B to rotatably support a photosensitive drum unit U31 as a photosensitive member unit as will be described hereinafter. An outer periphery 325*a* of an outer end portion of the drum bearing 325 functions as a cartridge guide 340R1. The cartridge guide 340R1 is outwardly projected in the longitudinal direction (direction of the rotational axis L1) of the photosensitive drum 310. When the cartridge guide 340R1 as the projected portion and a coupling member 350 (in a first position state which will be described hereinafter) are projected onto the rotational axis L1, the coupling member 350 and the cartridge guide 340R1 are overlapped with each other. The cartridge guide 340R1 has a function of protecting the coupling member 350.

As shown in FIG. 60, a drum shaft 326 is provided in the non-driving side of the cartridge B to rotatably support the photosensitive drum unit U31. The outer periphery 326*a* of the outer end portion of the drum shaft 326 functions as a cartridge guide 340L1.

At a one longitudinal end (driving side) of the drum unit 319, a cartridge guide 340R2 is provided substantially above the cartridge guide 340R1. At the other longitudinal end (non-driving side), a cartridge guide 340L2 is provided above the cartridge guide 340L1.

In this embodiment, the cartridge guides 340R1, 340R2 are formed integrally with the drum frame 321. However, the cartridge guides 340R1, 340R2 may not be integral.

Figure 61:
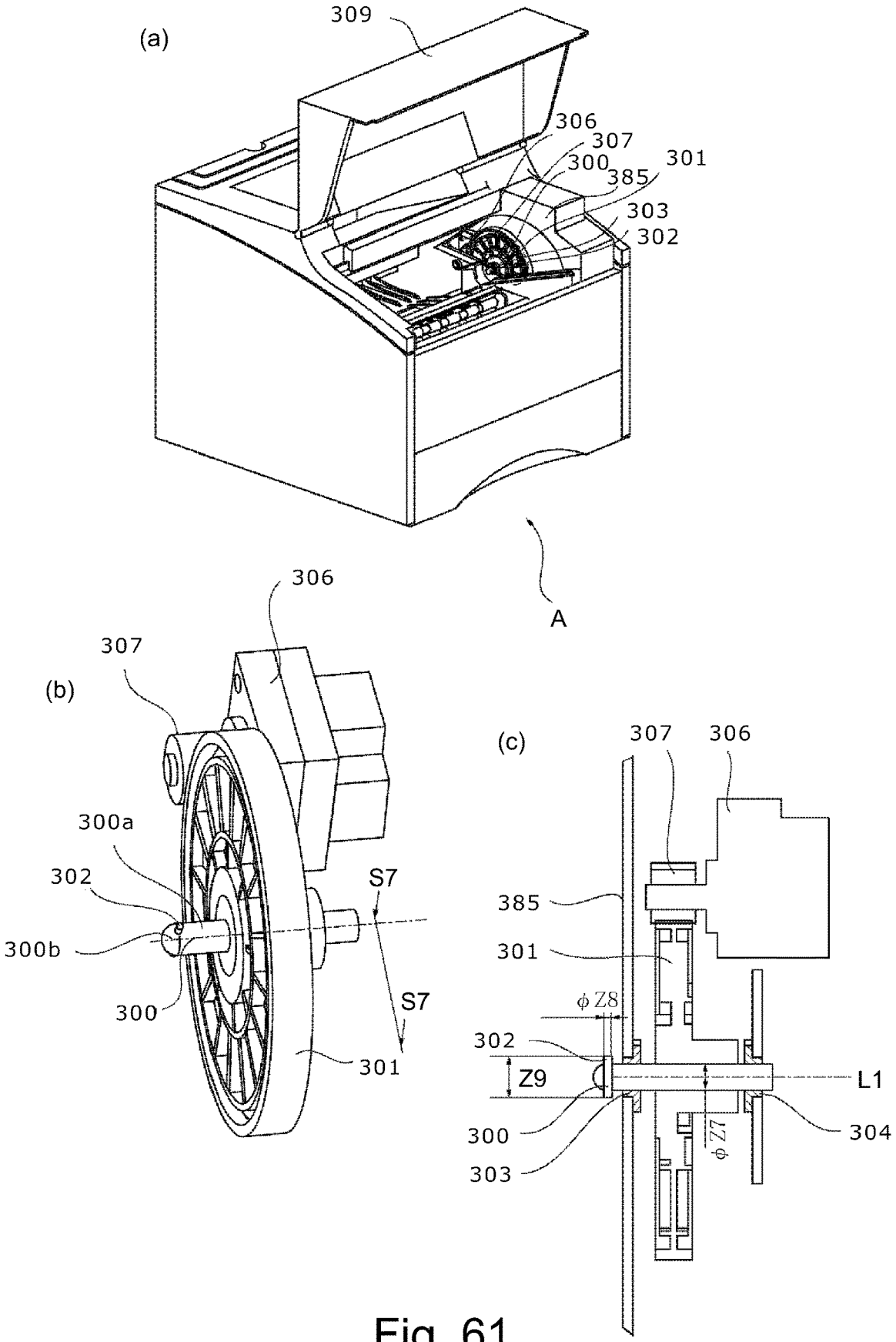
FIG. 61 is a perspective view and a longitudinal sectional view illustrating a driving structure of the main assembly in the third embodiment of the present invention.

(2) Driving Structure of the Main Assembly and Cartridge Mounting Portion:

Referring to FIG. 61, a photosensitive drum driving structure of the electrophotographic image forming apparatus C using the process cartridge according to this embodiment will be described. Part (a) of FIG. 61 is a perspective view of the main assembly A of the apparatus without the cartridge B mounted, in which a side plate of the driving side is partly cut-away. Part (b) of FIG. 61 is a perspective view showing only the drum driving structure. Part (c) of FIG. 61 is a sectional view taken along a line S7-S7 of part (b) of FIG. 61.

The main assembly driving shaft 300 has a spherical free end portion 300*b* and is provided with a drive transmission pin 302 as the main assembly side rotation driving force transmitting portion penetrating substantially at the central portion of the cylindrical main part 300*a*, and the driving force is transmitted to the cartridge B by the drive transmission pin 302.

The main assembly driving shaft 300 is provided with a drum driving gear 301 coaxial with the free end portion 300*b*, at the opposite end portion with respect to the longitudinal direction. The drum driving gear 301 is unrotatably fixed on the main assembly driving shaft 300, and therefore, the main assembly driving shaft 300 rotates when the drum driving gear 301 rotates.

The drum driving gear 301 is disposed at a position for engagement with a pinion gear 307 which receives the driving force from the motor 306. Therefore, when the motor 306 rotates, the main assembly driving shaft 300 rotates.

The drum driving gear 301 is rotatably supported on the main assembly A of the apparatus by the bearing members 303 and 304. Here, the driving gear 301 does not move in the direction of the axial direction L1, and therefore, the driving gear 301 and the bearing members 303, 304 can be placed close to each other.

In the foregoing, the driving gear 301 is directly driven by the motor pinion 307, but this is not limiting to the present invention, and a plurality of gears may be provided therebetween, or a belt or the like may be used for the drive transmission for the conveniences of the position of the motor relative to the main assembly A.

Figure 62:
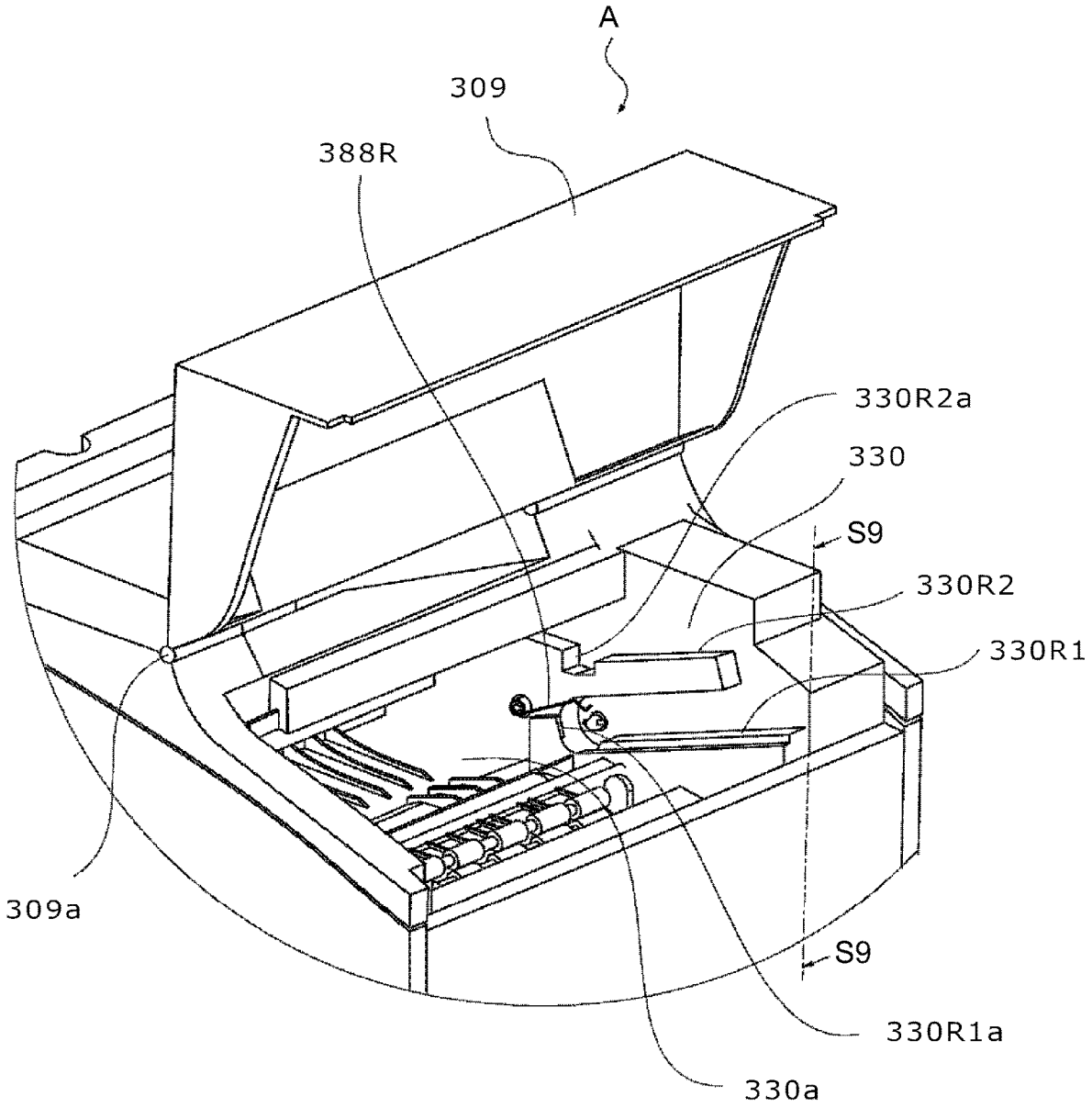
FIG. 62 is a perspective view of a cartridge mounting portion of the main assembly according to the embodiment of the present invention, as seen from the non-driving side.
Figure 63:
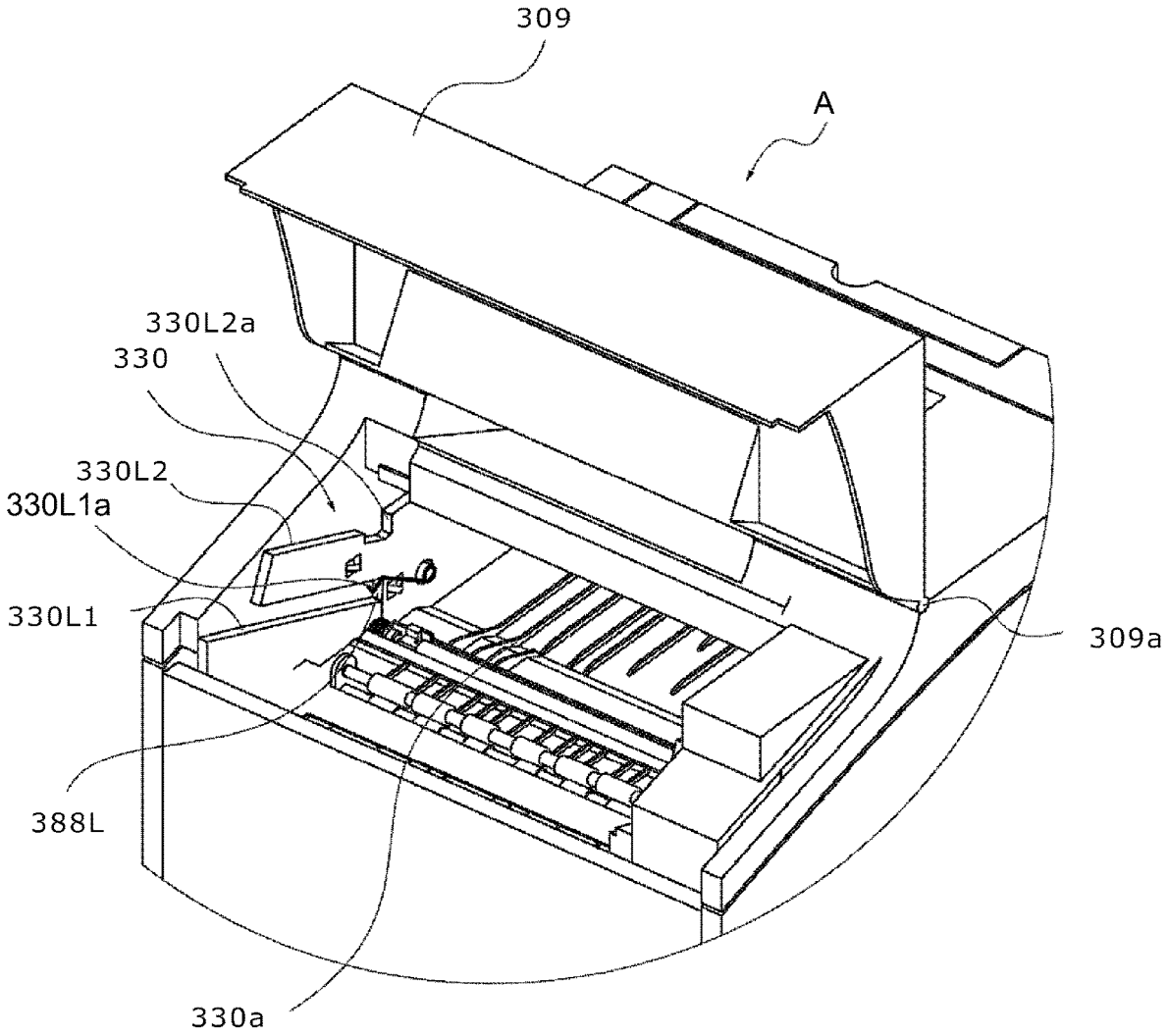
FIG. 63 is a perspective view of the cartridge mounting portion of the main assembly according to the third embodiment of the present invention, as seen from the driving side.

Referring to FIG. 62-FIG. 63, a mounting guide provided in the main assembly A of the apparatus to guide the mounting of the cartridge B will be described. FIG. 62 is a perspective view of the cartridge mounting portion mounted at the driving side. FIG. 63 is a perspective view of the cartridge mounting portion provided on a non-driving-side side surface.

As shown in FIGS. 62 and 63, a cartridge mounting means 330 of this embodiment comprises main assembly guides 330R1, 330R2, 330L1, 330L2 provided in the main assembly A of the apparatus.

They are provided on the left and right surfaces of the cartridge mounting space (cartridge accommodating portion 330*a*) provided in the main assembly A of the apparatus so as to opposite the cartridge mounting means 330 (FIG. 62 shows the driving-side side surface, and FIG. 63 shows the non-driving side surface). The left and right mounting means 330 are provided with guide portions 330R1, 330L1 and 330R2, 330L2 which function as guides and for the mounting of the cartridge B. By the guide portions 330R1, 330R2, 330L1, 330L2, bosses, which will be described hereinafter, provided projected at respective sides of the cartridge frame are guided. When the cartridge B is to be mounted to the main assembly A of the apparatus, a cartridge door 309 as an opening and closing door capable of opening and closing relative to the main assembly A of the apparatus about a shaft 309*a* is opened. By closing the cartridge door 309, the mounting of the cartridge B to the main assembly A of the apparatus is completed. When the cartridge B is to betaken out of the main assembly A of the apparatus, a dismounting operation is carried out with the cartridge door 309 opened. The dismounting and/or mounting of the cartridge B relative to the main assembly may be assisted by interrelation with the opening operation of the door 30.

Figure 64:
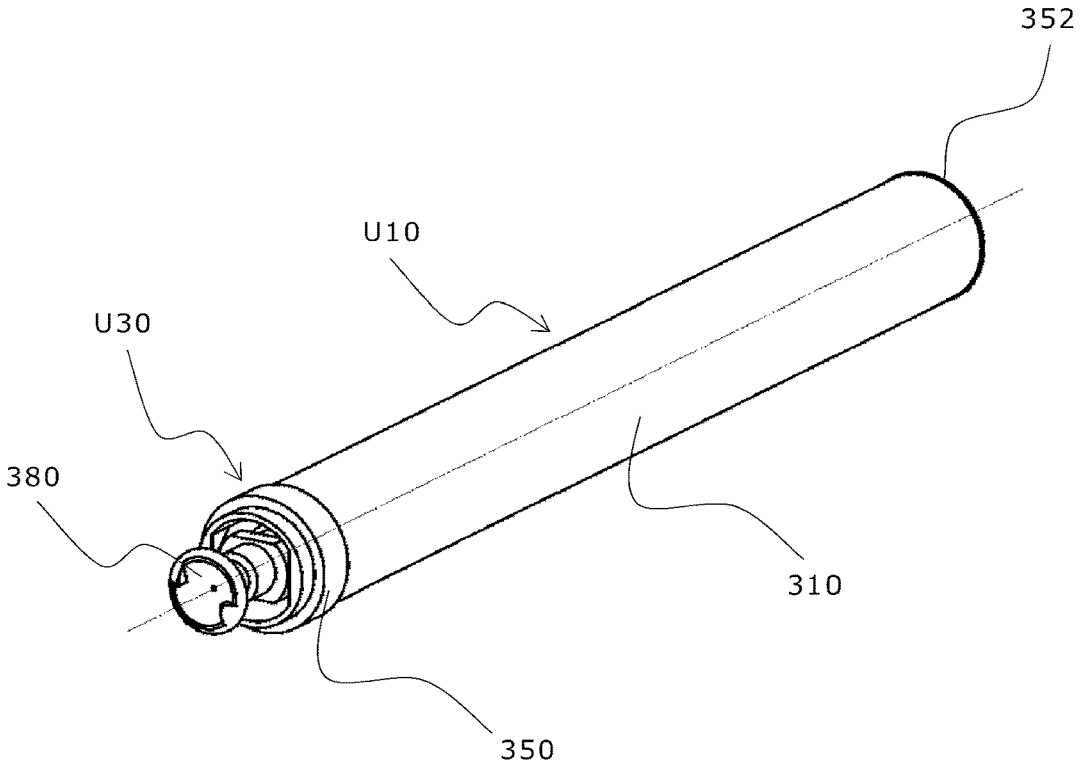
FIG. 64 is a schematic perspective view of a photosensitive member unit according to the third embodiment of the present invention.
Figure 64:
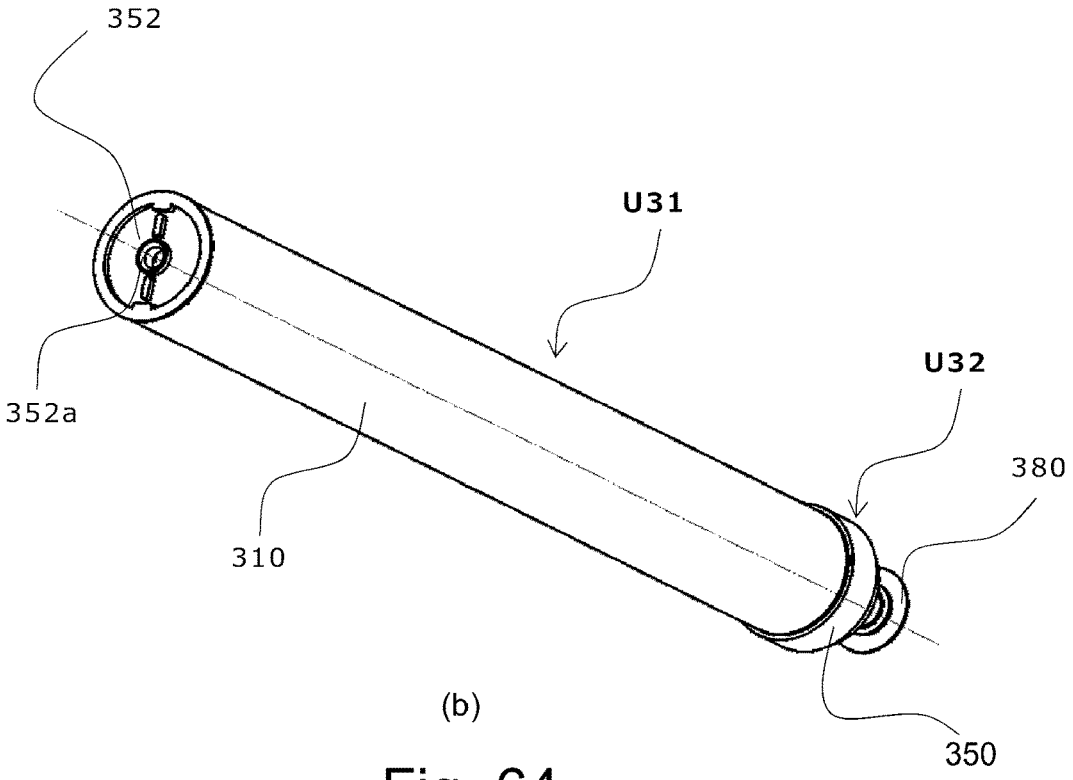
Figure 65:
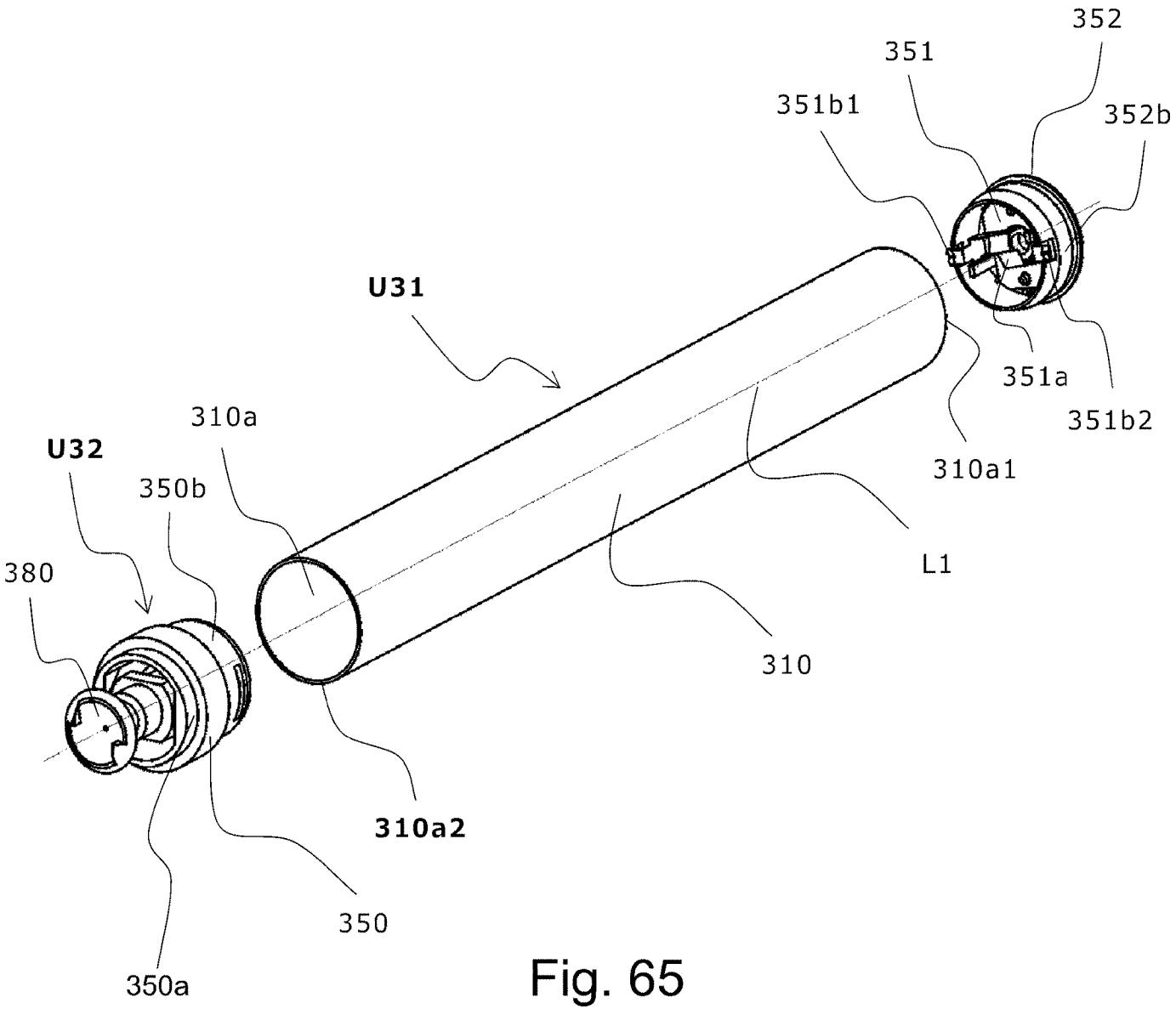
FIG. 65 is an exploded view of a photosensitive member unit according to the third embodiment of the present invention.

(3) Structure of the Photosensitive Member Unit (Photosensitive Drum Unit):

Referring to FIG. 64-FIG. 65, the structure of the photosensitive drum unit U31 as the photosensitive member unit will be described. Part (a) of FIG. 64 is a schematic perspective view of the photosensitive drum unit U31 as seen from the driving side, and part (b) of FIG. 64 is a schematic perspective view thereof as seen from the non-driving side. FIG. 65 is an exploded schematic perspective view of the photosensitive drum unit U31.

As shown in FIGS. 64, 65, the photosensitive drum unit U31 comprises the photosensitive drum 310, a driving side flange unit U32 and a non-driving side flange 352. The photosensitive drum 310 comprises an electroconductive cylinder 310*a* of aluminum or the like and a photosensitive layer coating it. The opposite end portions thereof are provided with openings 310*a*1, 310*a*2 substantially coaxial with the surface of the drum to engage with drum flanges.

The driving side flange unit U32 includes the driving side flange 350. The driving side flange 350 is produced by injection molding of resin material such as polyacetal, polycarbonate or the like. The driving side flange 350 is provided with engageable supporting portion 350*b* and supporting portion 350*a* substantially coaxially. The driving side flange unit U32 will be described in detail hereinafter.

The non-driving side flange 352 is produced by injection molding of resin material similarly to driving side, and engageable supporting portion 352*b* and supporting portion 352*a* are coaxially provided. The non-driving side flange 352 is provided with a drum grounding plate 351. The drum grounding plate 351 is an electroconductive (mainly metal) thin-plate-like member and includes contact portions 351*b*1, 351*b*2 contacted to an inner surface of the electroconductive cylinder 310*a* and a contact portion 351*a* contacted to the drum shaft 326 (FIG. 60). The grounding plate 351 is electrically connected with the main assembly A to electrically ground the photosensitive drum 310.

The driving side flange 350 and the non-driving side flange 352 are engaged with the openings 310*a*1, 310*a*2 of the cylinder 310*a* by the supporting portions 350*b*, 352*b*, and thereafter, they are fixed to the cylinder 310*a* by bonding, clamping or the like. The grounding plate 351 is provided on the non-driving side flange 352, but this is not limiting to the present invention. For example, the grounding plate 351 may be provided on the driving side flange 350, or on another part connectable with the ground.

Figure 66:
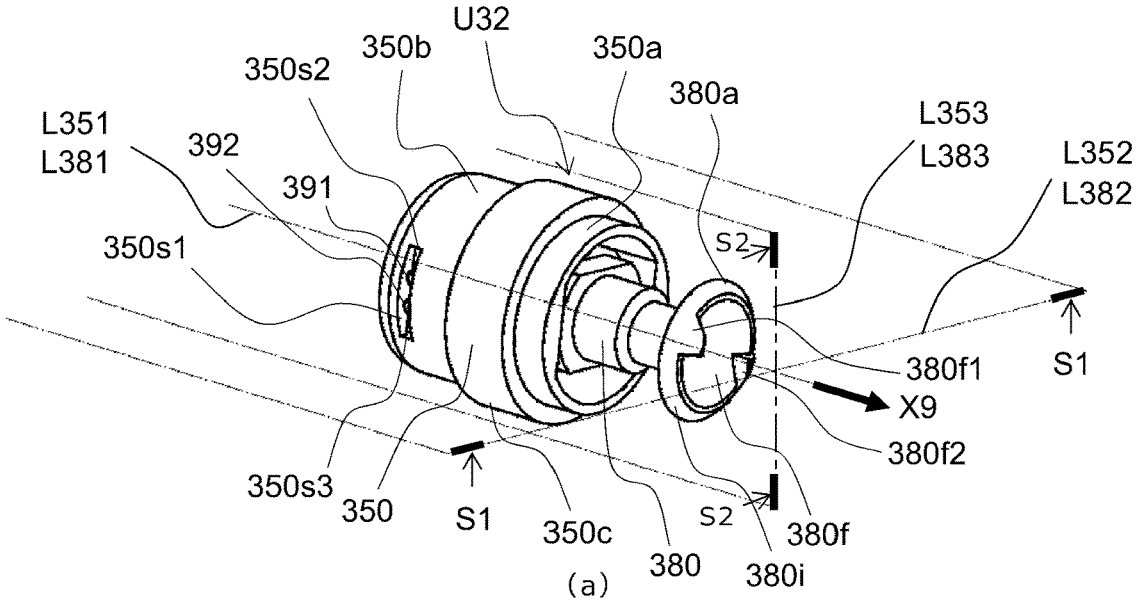
FIG. 66 is an illustration of a driving side flange unit in the third embodiment of the present invention.
Figure 66:
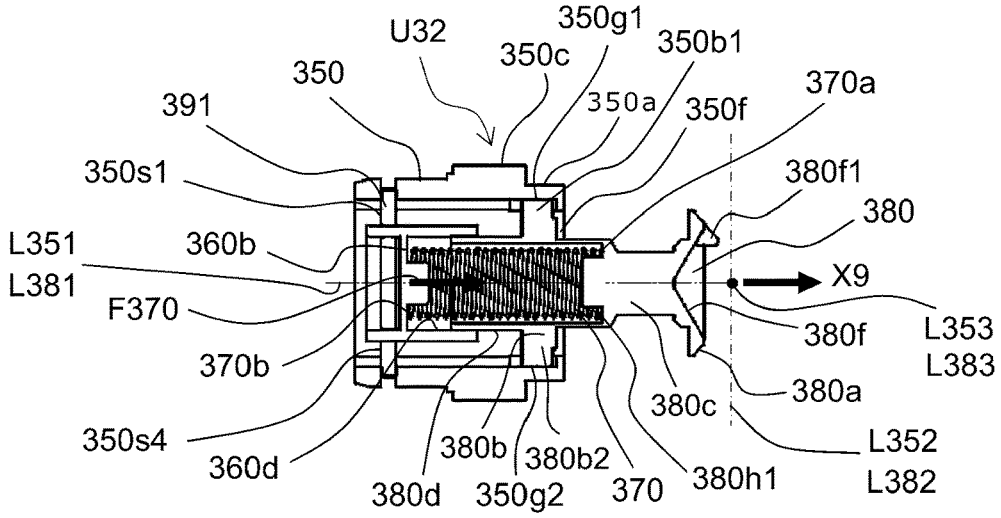
Figure 66:
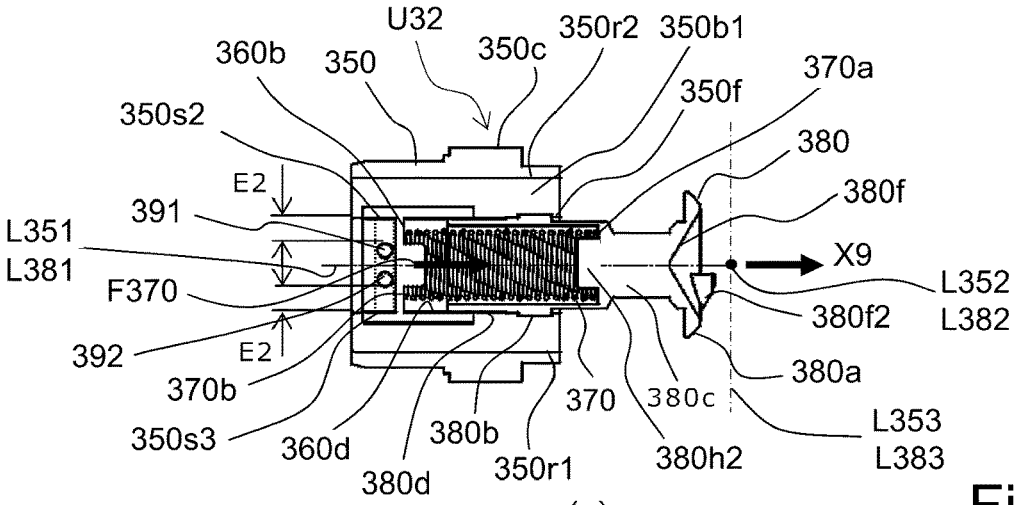
Figure 67:
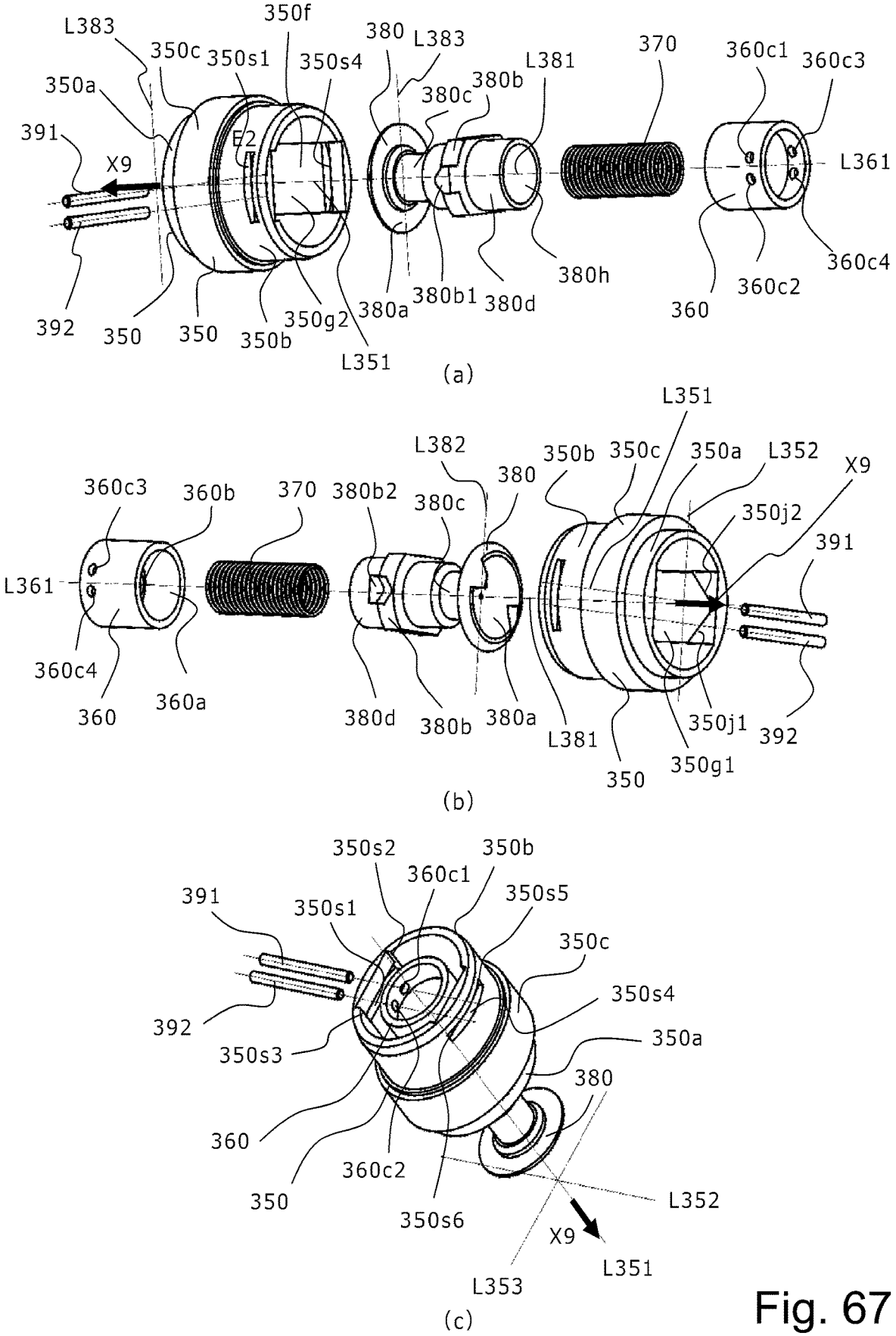
FIG. 67 is an exploded view of the driving side flange unit in the third embodiment of the present invention.
Figure 68:
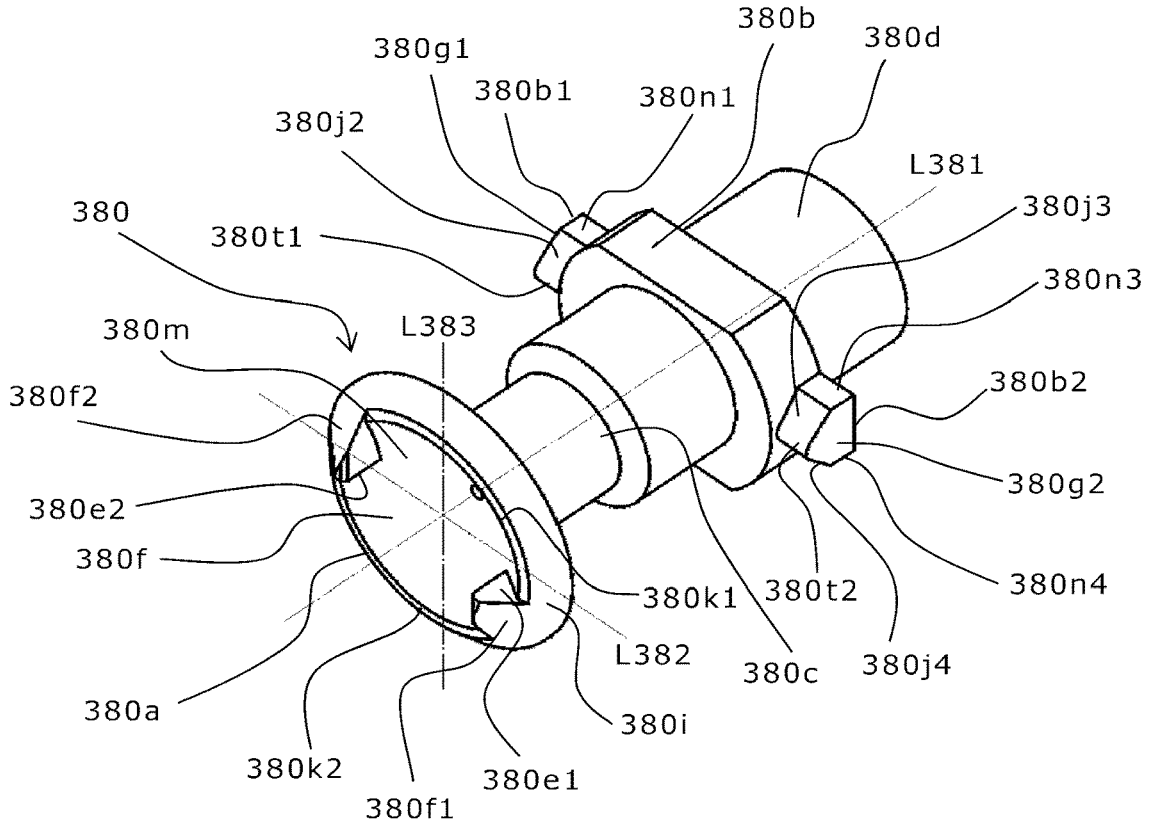
FIG. 68 is a perspective view of the coupling member according to the third embodiment of the present invention.
Figure 68:
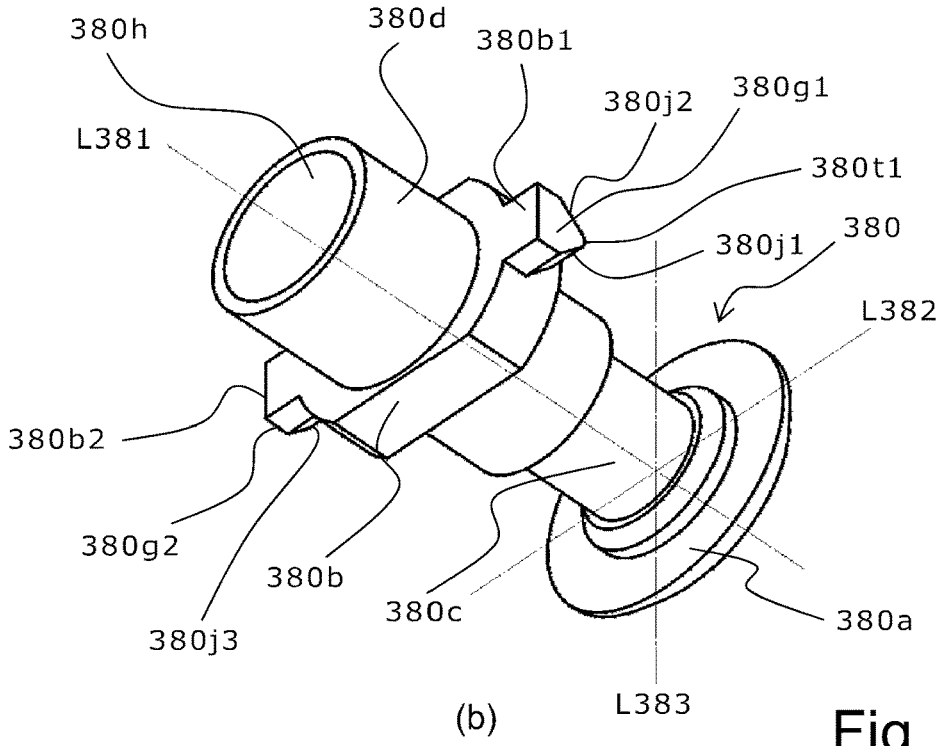
Figure 69:
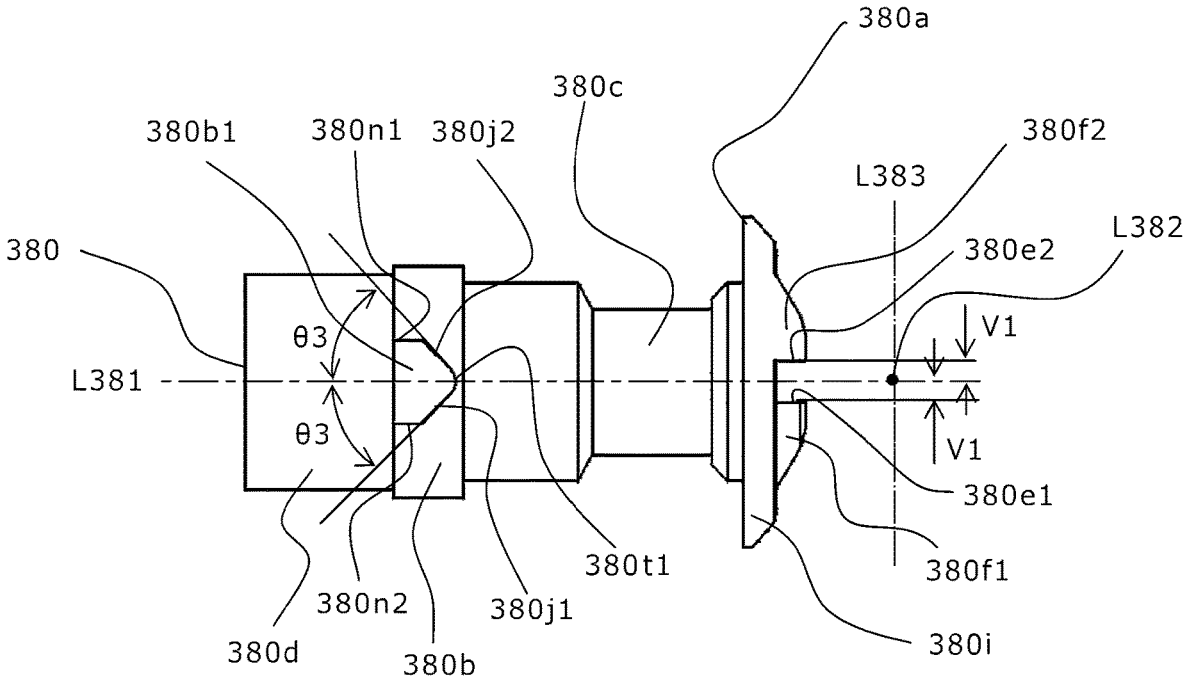
FIG. 69 is an illustration of the coupling member according to the third embodiment of the present invention.
Figure 69:
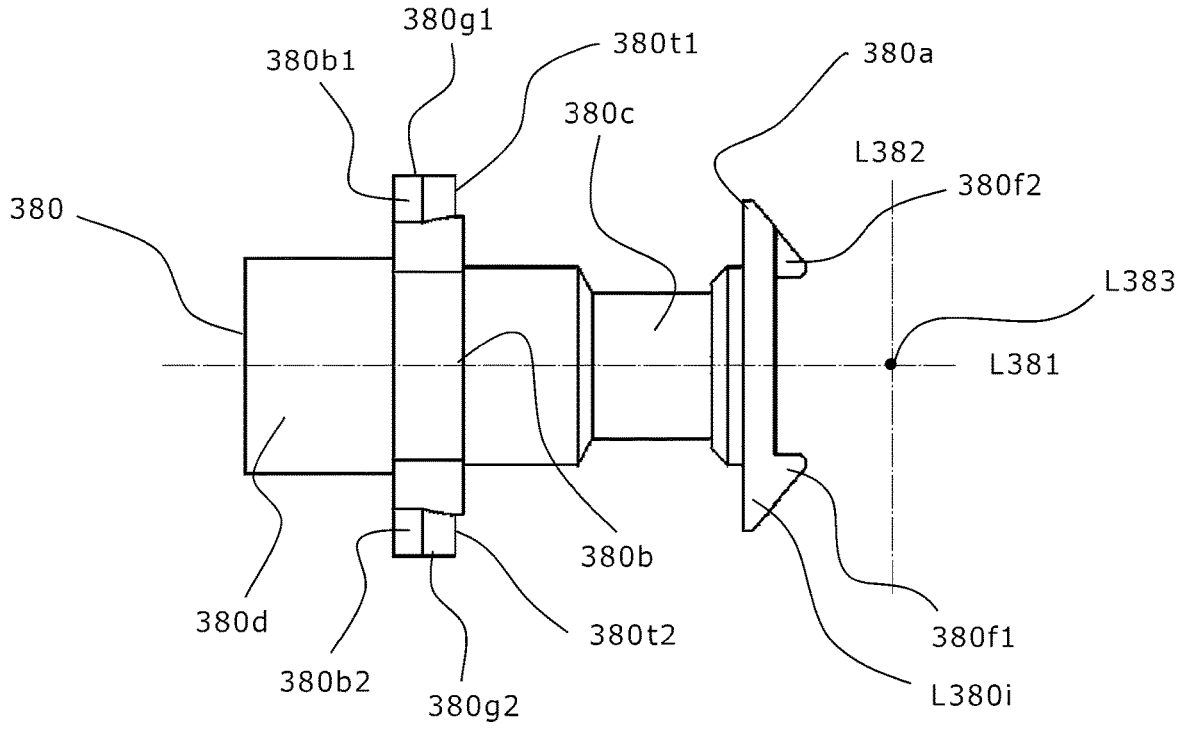
Figure 70:
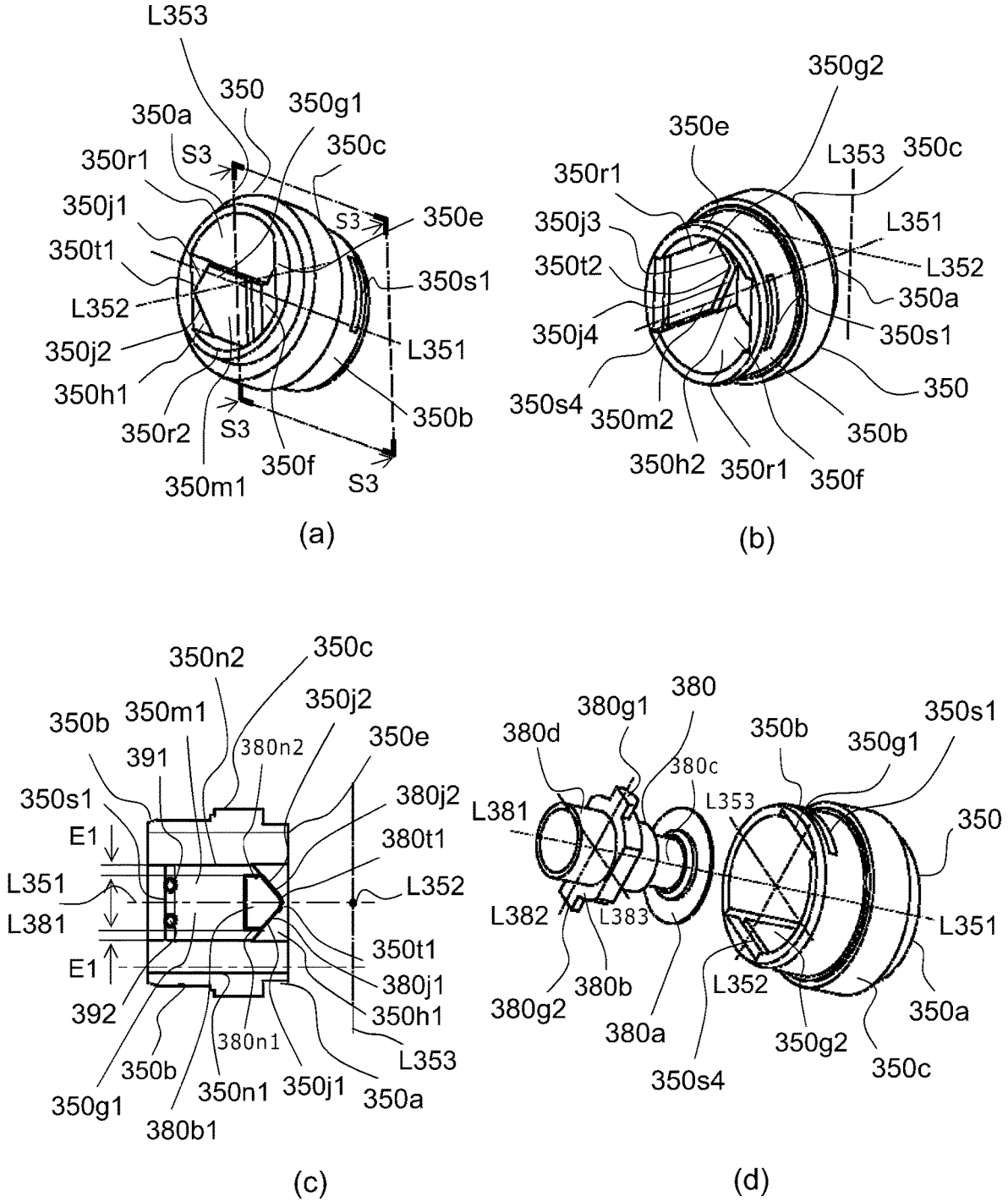
FIG. 70 is an illustration of the driving side flange in the third embodiment of the present invention.
Figure 71:
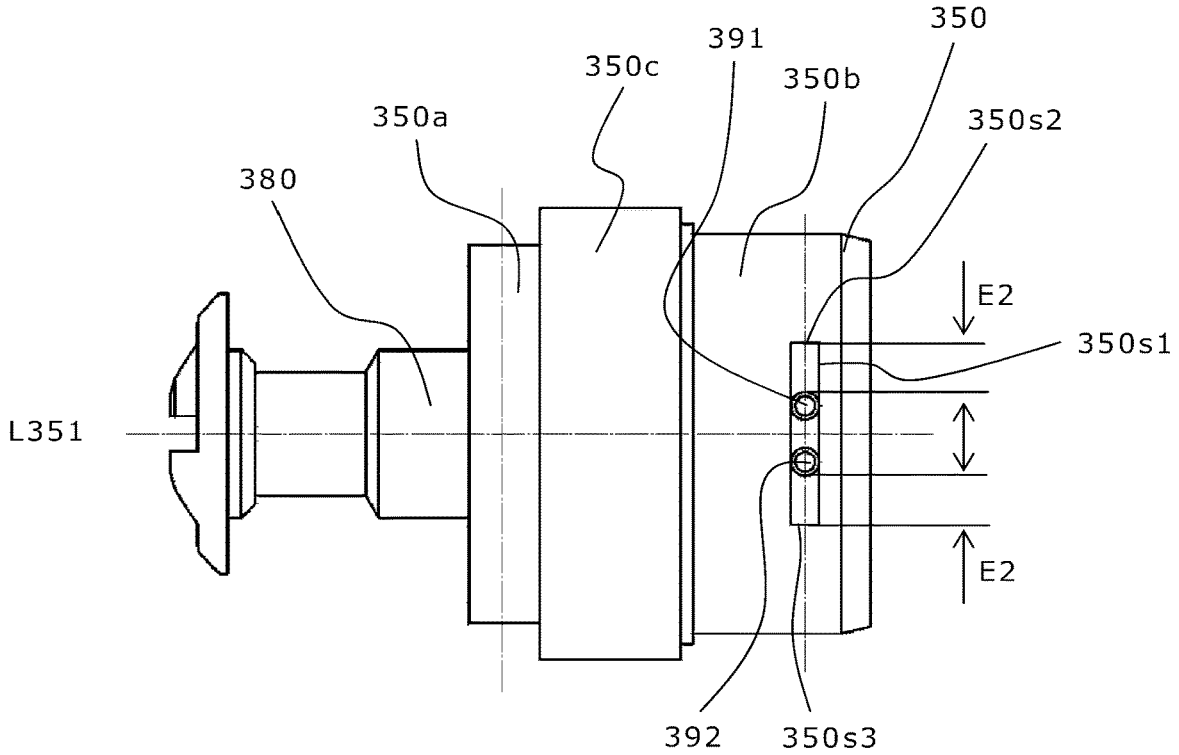
FIG. 71 is an illustration of the driving side flange, a slider and a retention pin in the third embodiment of the present invention.
Figure 71:
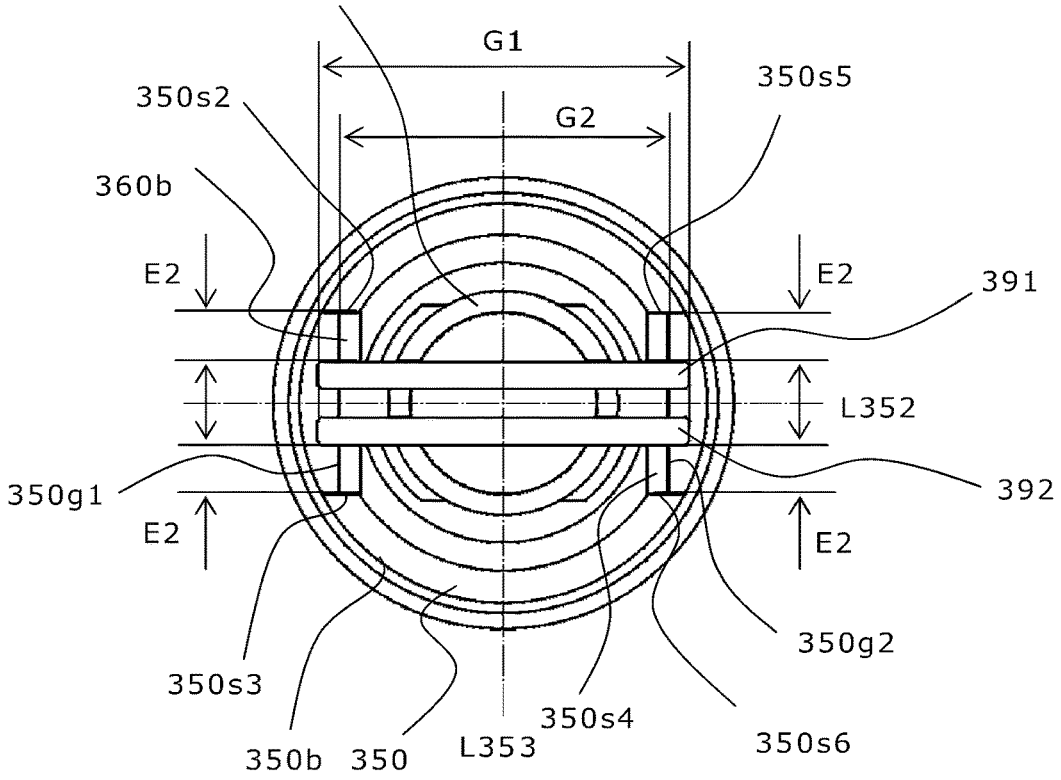

(4) Driving Side Flange Unit:

Referring to FIG. 66 through FIG. 71, the structure of the driving side flange unit U32 will be described. Part (a) of FIG. 66 is a schematic perspective view of the state in which the driving side flange unit U32 is mounted to the photosensitive drum 310, as seen from the driving side. In the part (a) of FIG. 66, the photosensitive drum 310 and the parts therein are depicted by broken lines. Part (b) of FIG. 66 is a schematic sectional view taken along a line S1 in part (a) of FIG. 66, and part (c) of FIG. 66 is a schematic sectional view taken along a line S2 in part (a) of FIG. 66. In part (c) of FIG. 66, a slide groove 350*s*1 of the driving side flange 350 is depicted by broken lines for the convenience of illustration. FIG. 67 is an exploded schematic perspective view of the driving side flange unit U32. FIG. 68 is a schematic perspective view of the coupling member 380. FIG. 69 is an illustration of the coupling member 380. Part (a) of FIG. 70 and part (b) of FIG. 70 are schematic perspective views of the driving side flange 350. Part (c) of FIG. 70 is a schematic sectional view taken along a line S3 in part (a) of FIG. 70, in which a projection 380*b*1 of the coupling member 130, a retention pin 391 and a retention pin 392 are shown for illustration. Part (d) of FIG. 70 is a schematic perspective view of the coupling member 380 and the driving side flange 350. Part (a) of FIG. 71 is an illustration of the driving side flange 350, a slider 360, the retention pin 391 and the retention pin 392, and part (b) of FIG. 71 is a sectional view taken along a line SL353 of part (a) of FIG. 71. In FIG. 71, the photosensitive drum 310 is depicted by chain lines with double dots.

As shown in FIGS. 66 and 67, the driving side flange unit U32 comprises the driving side flange 350, the coupling member 380, an urging member 370, the slider 360, the retention pin 391 and the retention pin 392, as the rotational force transmission member.

Here, in FIG. 66, "L351" is the rotational axis when the driving side flange 350 is rotated, and in the following description, the rotational axis L351 is simply called axis L351. Similarly, "L381" is the rotational axis when the coupling member 380 is rotated, and in the following description, the rotational axis L381 is simply called axis L381.

The coupling member 380 is provided inside the driving side flange 350 together with the urging member 370 and the slider 360. By the structure which will be described hereinafter, the slider 360 does not move in the direction of the axis L351 relative to the driving side flange 350, the retention pin 391 and retention pin 392.

In this embodiment, the urging member 370 is a spring (compression coil spring) as an elastic member. As shown in part (b) of FIG. 66 and part (c) of FIG. 66, one end portion of the 370*a* of the urging member 370 contacts a spring contact portion 380*h*1 of the coupling member 380, and the other end portion 370*b* contacts a spring contact portion 360*b* of the slider 360. The urging member 370 is compressed between the coupling member 380 and the slider 360 to urge the coupling member 380 toward the driving side (arrow X9) by the urging force F370 thereof. The urging member may be a leaf spring, a torsion spring, rubber, sponge or the like or another that can produce an elastic force. However, as will be described hereinafter, the coupling member 380 is movable in the direction parallel with the axis L351 of the driving side flange 350, and therefore, a kind of the urging member 370 has a certain degree of stroke. Therefore, the coil spring or the like capable of having a stroke is preferable.

Referring to FIGS. 68 and 69, the configuration of the coupling member 380 will be described.

As shown in FIGS. 68 and 69, the coupling member 380 mainly comprises four portions. A first portion is a driven portion 380*a* as an end portion (free end portion) engageable with the main assembly driving shaft 300 which will be described hereinafter to receive the rotational force from the drive transmission pin 302 which will be described hereinafter and which is a rotational force transmitting portion (main assembly side rotational force transmitting portion) provided on the main assembly driving shaft 300. A second portion is a driving portion 380*b* engaged with the driving side flange 350 to transmit the rotational driving force to the driving side flange 350. A third portion is an interconnecting portion 380*c* connecting the driven portion 380*a* and the driving portion 380*b* with each other. A fourth portion is an engaging portion 380*d* as the other end portion supported by the slider 360 such that the coupling member 380 is movable in the direction of the rotational axis L381. In this embodiment, the other end portion of the coupling member 380 is an engaging portion 380*d*, but it may be driving portion 380*b*.

A direction perpendicular to axis L381 is an axis L382, and a direction perpendicular to the axis L381 and to the axis L382 is an axis L383.

As shown in FIG. 68, the driven portion 380*a* is provided with a driving shaft insertion opening 380*m* as a recess expanding relative to the rotational axis L381 of the coupling member 380. The opening 380*m* is provided by a conical driving bearing surface 380*f* expanding as approaching toward the main assembly driving shaft 300.

On the circumference of the end surface thereof is provided with transmission projections 380*f*1 and 380*f*2 projecting from the driving bearing surface 380*f* The outer peripheral surface of the driven portion 380*a* including two transmission projections 380*f*1 and 380*f*2 is provided with a substantially spherical main assembly contact portion 380*i*. When the coupling member 380 is engaged with the main assembly driving shaft 300, and when the coupling member 380 is disengaged from the main assembly driving shaft 300, the main assembly contact portion 380*i* contacts the free end portion 300*b* and the drive transmission pin 302 of the main assembly driving shaft 300.

Between the transmission projections 380*f*1 and 380*f*2, there are provided drive receiving stand-by portion 380*k*1 and 380*k*2. A clearance between the two drive receiving projections 380*f*1 and 380*f*2 are larger than an outer diameter of the drive transmission pin so that the drive transmission pin 302 of the main assembly driving shaft 300 of the main assembly A of the apparatus which will be described hereinafter can be received by the clearance portion. The clearance portions are designated by 380*k*1 and 380*k*2.

In the positions downstream of the transmission projection 380*f*1 and 380*f*2 with respect to the clockwise direction, there are provided driving force receiving surfaces (rotational force receiving portions) 380*e*1 and 380*e*2, to which transmission pin 302 as the rotational force transmitting portion provided on the main assembly driving shaft 300 abuts to transmit the rotational force. That is, driving force receiving surfaces 380e1 and 380e2 cross with the rotational moving direction of the coupling member 380 so that they are rotated about the axis L381 by being pushed by the side surfaces of the drive transmission pin 302 of the main assembly driving shaft 300.

In order to stabilize the transmitting torque transmitted to the coupling member 380, it is preferable that the driving force receiving surface 380e1 and 380e2 are disposed on the same circumference extending about the axis L381. By doing so, a drive transmission radius is constant, and therefore, the transmitted torque is stabilized. It is preferable that the position of the coupling member 380 is stabilized as much as possible by the balance of the forces received by the transmission projections 380f1 and 380f2. For this purpose, they are disposed diametrically opposite from each other in this embodiment. Then, the forces received by the coupling member 380 form a couple of forces. Therefore, the coupling member 380 can continue the rotational motion by receiving only the couple of forces without controlling the position of the rotational axis of the coupling.

When the interconnecting portion 380c is sectioned by a plane perpendicular to the axis L381, at least one cross-sections of the interconnecting portion 380c has a maximum rotational radius which is smaller than a distance between the rotational axis L381 of the coupling member 380 and the transmission projections 380f1 and 380f2 (driving force receiving surfaces 3890e1 and 380e2). In other words, a predetermined section of the interconnecting portion 380c perpendicular to the rotational axis L2 of the coupling member 380 has a maximum rotational radius which is smaller than the distance between the transmission projections 380f1 and 380f2 (driving force receiving surfaces 3890e1 and 380e2) and the rotational axis L2. Further in other words, the interconnecting portion 380c has a diameter which is smaller than the distance between the transmission projection 380f1 (driving force receiving surface 380e1) and the transmission projection 380f2 (driving force receiving surface 380e2).

As shown in FIG. 69, the projections 380b1 and 380b2 project along the axis L382 from the driving portion 380b and a provided diametrically opposite from each other with respect to the axis L381. The projections 380b1 and 380b2 have the same configurations, and therefore, the configuration of the projection 380b1 will be described.

As shown in part (a) of FIG. 69, the projection 380b1 has a symmetrical configuration with respect to the axis L381 as seen in the direction of the axis L382, more particularly has a pentagonal configuration. The portion of the projection 380b1 having two surfaces inclined by an angle θ3 relative to the axis L381 as seen in the direction of the axis L382 is called a portion-to-be-guided 380j1 and a portion-to-be-guided 380j2 as an inclined portion or contact portion.

The portion connecting the portion-to-be-guided 380j1 and the portion-to-be-guided 380j2 with each other is called round configuration portion 380t1. In addition, the surfaces of the projection 380b1 perpendicular to the axis L383 are called a projection end portion 380n1 and a projection end portion 380n2. The surface of the projection 380b1 perpendicular to the axis L182 is called a rotational force transmitting portion 380g1.

As shown in part (b) of FIG. 69, portions constituting the projection 380b2 are called portion-to-be-guided 380j3, portion-to-be-guided 380j4, a round configuration portion 380t2, projection end portion 380n3, projection end portion 380n4 and rotational force transmitting portion 380g2, respectively.

The engaging portion 380d has a cylindrical having a central axis aligned with the axis L381 and is fitted in a cylindrical portion 360a of the slider 360 (part (b) of FIG. 66 and part (c) of FIG. 66) with almost no gap and is supported thereby (the detailed live be described hereinafter). As shown in FIG. 68, the spring mounting portion 380h is provided on a non-driving side end portion of the engaging portion 380d. The spring mounting portion 380h is provided with a spring contact portion 380h1 contacting one end portion 370a of the urging member 370, and the spring contact portion 380h1 is substantially perpendicular to the axis L381 of the coupling member 380.

Referring to FIG. 70, the configuration of the driving side flange 350 will be described.

As shown in FIG. 70, the driving side flange 350 is provided with the engagement supporting portion 350b engaging with the inner surface 310b of the photosensitive drum 10, a gear portion 350c, a supporting portion 350a rotatably supported by the drum bearing 330 and so on.

A direction perpendicular to axis L351 is an axis L352, and a direction perpendicular to the axis L351 and to the axis L352 is an axis L353.

The inside of the driving side flange 350 is hollow, and is called hollow portion 350f. The hollow portion 350f includes a flat surface inner wall portion 350h1, a flat surface inner wall portion 350h2, a cylindrical inner wall portion 350r1, a cylindrical inner wall portion 350r2, a recess 350m1 and a recess 350m2.

The flat surface inner wall portion 350h1 and the flat surface inner wall portion 350h2 have surfaces perpendicular to the axis L352 and are diametrically opposite from each other axis L351. The cylindrical inner wall portion 350r1 and the cylindrical inner wall portion 350r2 have cylindrical configurations having a central axis which is common with the axis L351, and a disposed at positions diametrically opposite from each other with respect to the axis L351. The recess 350m1 and the recess 350m2 are formed with the flat surface inner wall portion 350h1 and the flat surface inner wall portion 350h2, respectively, and are farther from the axis L351 along the axis L352. The recess 350m1 and the recess 350m2 have the same configuration and are provided at the positions diametrically opposite with respect to the axis L351, and therefore, the following description will be made with respect to the recess 350m1 only.

The recess 350m1 has a symmetrical configuration with respect to the axis L351 as seen in the direction of the axis L352. As shown in part (c) of FIG. 70, the portion having the surfaces inclined by the angle θ3 relative to the axis L351 as seen in the direction of the axis L352 is a guide portion 350j1 and a guide portion 350j2, similarly to the portion-to-be-guided 380j1—the portion-to-be-guided 380j4. The portion connecting the guide portion 350j1 and the guide portion 350j2 is a round configuration portion 350t1. Surfaces of the recess 350m1 perpendicular to the axis L353 are a recess end portion 350n1 and a recess end portion 350n2. A rotational force receiving portion 350g1 having a flat surface perpendicular to the axis L352 is provided, with a step relative to the flat surface inner wall portion 350h1. In addition, the rotational force receiving portion 350g1 is provided with the slide groove 350s1. As will be described hereinafter, the slide groove 350s1 includes a through hole supporting the retention pin 391 and the retention pin 392, and has a rectangular-shape with the long side thereof being along the axis L353, as seen in the direction of the axis L352.

The parts constituting the recess 350m2 include a rotational force receiving portion 350g2, a guide portion 350j3, a guide portion 350j4, R, a guide portion 350j4, a round configuration portion 350*t*2, a slide groove 350*s*4, a recess end portion 350*n*3 and a recess end portion 350*n*4.

A driving side end portion of the hollow portion 350*f* is an opening 350*e*.

As shown in FIGS. 66 and 67 and part (d) of FIG. 70, the coupling member 380 is provided in the hollow portion 350*f* of the driving side flange 350 such that the axis L382 is parallel with the axis L352. The rotational force transmitting portions 380*g*1 and 380*g*2 and rotational force receiving portions 350*g*1 and 350*g*2 are engaged with each other, respectively with almost no gap in the direction of the axis L382. By this, the movement of the coupling member 380 relative to the driving side flange 350 in the direction of the axis L382 is limited (part (b) of FIG. 66, part (d) of FIG. 70). As shown in part (c) of FIG. 66, when the coupling member 380 is placed in the hollow portion 350*f* so that the axis L381 and the axis L351 are substantially co-axial with each other, a gap D is provided between the driving portion 380*b* and cylindrical inner wall portions 350*r*1 and 350*r*2. In addition, as shown in part (c) of FIG. 70, gaps E1 are provided between the projection end portion 380*n*1 and the recess end portion 350*n*1 and between the projection end portion 380*n*2 and the recess end portion 350*n*1, respectively, in the direction of the axis L353. By this, coupling member 380 is movable in the direction of the axis L383 relative to the driving side flange 350. Here, the projection 380*b*1 and the recess 350*m*1 are so shaped that the gap E1 is larger than the gap D.

Referring to FIGS. 66 and 67 and 71, the description will be made as to the configurations of the slider 360 as the holding member (movable member), the retention pin 391 and the retention pin 392.

As shown in FIGS. 66 and 67, the slider 360 is provided with the cylindrical portion 360*a*, a contact portion 360*b* contacted by the other end portion 370*b* of the urging member 370, a through hole 360*c*1—a through hole 360*c*4. The central axis of the cylindrical portion 360*a* is an axis L361.

The cylindrical portion 360*a* is engaged with the engaging portion 38*d* of the coupling member 380 with almost no gap to support it. By this, the coupling member 380 is movable in the direction of the axis L381 while keeping the substantial coaxiality between the axis L381 and the axis L361.

On the other hand, as shown in part (b) of FIG. 66, part (c) of FIG. 67 and part (c) of FIG. 70, the cylindrical retention pin 391 and the retention pin 392 are inserted into the through hole 360*c*1—the through hole 360*c*4 of the slider 360 such that the central axes are parallel with the axis L352. The retention pin 391 and the retention pin 392 are supported by the slide groove 350*s*1 and the slide groove 350*s*4 of the driving side flange 350, so that the slider 360 and the driving side flange 350 are connected with each other.

As shown in part (c) of FIG. 66 and part (a) of FIG. 71, the retention pin 391 and the retention pin 392 are juxtaposed along the axis L353. The diameters of the retention pin 391 and the retention pin 392 are slightly smaller than the width of the slide groove 350*s*1 and the slide groove 350*s*4 measured in the direction of the axis L351. By this, the slider 360 keeps the parallelism between the axis L361 and the axis L351. In addition, the slider 360 is prevented from the movement relative to the driving side flange 350 in the direction of the axis L351. In other words, the slider 360 is movable in the direction substantially perpendicular to the axis L351.

As shown in part (b) of FIG. 66 and part (b) of FIG. 71, the engagement supporting portion 350*b* of the driving side flange 350 (part (a) of FIG. 71) is engaged in and fixed with an opening 310*a*2 of the photosensitive drum 310. By this, the retention pin 391 and the retention pin 392 are prevented from disengaging in the direction of the axis L352. In addition, a length G1 of the retention pin 391 and the retention pin 392 is selected to be sufficiently larger than a distance G2 between the rotational force transmitting portion 350*g*1 and the rotational force transmitting portion 350*g*2. By doing so, the retention pin 391 and the retention pin 392 are prevented from disengaging from the slide groove 350*s*1 and the slide groove 350*s*4.

Furthermore, between the retention pin 391 and the one end portion 350*s*2 of the slide groove 350*s*1 and between the retention pin 392 and the other end portion 350*s*3 of the slide groove 350*s*1, a gap E2 larger than the gap D is provided (part (c) of FIG. 66 and part (a) of FIG. 71). Similar gaps E2 are provided between the retention pin 391 and one end portion 350*s*5 of the slide groove 350*s*4 and between the retention pin 392 and in the other end portion 350*s*6 of the slide groove 350*s*4 (part (a) of FIG. 71). In addition, lubricant (unshown) is applied to the through hole 360*c*1—the through hole 360*c*4, the slide groove 350*s*1 and the slide groove 350*s*4. By this, the slider 360 is smoothly movable relative to the driving side flange 350 in the direction of the axis L353.

As shown in part (c) of FIG. 70, the guide portion 350*j*1 and the guide portion 350*j*2 as the inclined portion or contact portion and the portion-to-be-guided 380*j*1 and the portion-to-be-guided 380*j*2 as the inclined portion or contact portion are contactable to each other. It will suffice if at least one of the guide portion 350*j*1 or the portion-to-be-guided 380*j*1 is inclined, and the other one may be inclined correspondingly. By the contact therebetween, the coupling member 380 is prevented from disengaging from the opening 350*e* of the driving side flange 350. By the urging member 370, the coupling member 380 is urged toward the driving side such that the portion-to-be-guided 380*j*1 and the portion-to-be-guided 380*j*2 contact the guide portion 350*j*1 and the guide portion 350*j*2. The same applies to the relationship between the guide portion 350*j*3, the guide portion 350*j*4 and the portion-to-be-guided 380*j*3, the portion-to-be-guided 380*j*4.

As described hereinbefore, the projections 380*b*1 and 380*b*2 have symmetrical configurations with respect to the axis L381 as seen in the direction of the axis L382. The recess 350*m*1 and the recess 350*m*2 have symmetrical configurations with respect to the axis L351 as seen in the direction of the axis L352. Therefore, the coupling member 380 is urged toward the driving side by the urging member 370, so that the portion-to-be-guided 380*j*1—the portion-to-be-guided 380*j*4 contact the guide portion 350*j*1 and the guide portion 350*j*4, and therefore, the axis L381 and the axis L351 are substantially coaxial with each other.

With the above-described structures, the coupling member 380 keeps the state relative to the driving side flange 350 through the slider 360 such that the axis L381 and the axis L351 are parallel with each other. The coupling member 380 is movable relative to the driving side flange 350 in the directions of the axis L381 and the axis L383. The coupling member 380 is prevented from moving relative to the driving side flange 350 in the direction of the axis L382. The coupling member 380 is urged toward the driving side (arrow X9 direction in FIG. 66) relative to the driving side flange 350 by the urging force F370 of the urging member 370 such that the axis L381 and the axis L351 are substantially coaxial with each other.

In this embodiment, the driving side flange 350, the coupling member 380 and the slider 360 are made of resin material such as polyacetal, polycarbonate or the like. The retention pins 391, 392 are made of metal such as carbon steel, stainless steel or the like. However, depending on the load torque for rotating the photosensitive drum 310, the materials of the parts may be made of metal or resin material.

In this embodiment, the gear portion 350*c* functions to transmit the rotational force received by the coupling member 380 from the main assembly side engaging portion 300 to the developing roller 313, and it is a helical gear or spur gear integrally molded with the driving side flange 350. The developing roller 313 may be rotated not through the driving side flange 350. In such a case, the gear portion 350*c* may be omitted.

Referring to FIG. 67 and part (d) FIG. 70, an assembling process of the driving side flange unit U32 will be described. As shown in part (d) of FIG. 70, the coupling member 380 is inserted into the space portion 350*f* of the driving side flange 350. At this time, as described hereinbefore, the phases of the coupling member 380 and the driving side flange 350 are adjusted such that the axis L382 and the axis L352 are parallel with each other. Next, as shown in FIG. 67, the urging member 370 is mounted. The urging member 370 is limited in the position in the radial direction by a shaft portion 380*h*2 of the coupling member 380 and a shaft portion 360*d* of the slider 360. The urging member 370 may be mounted beforehand to any one of or both of the shaft portion 380*h*2 and the shaft portion 360*d*. At this time, the urging member 370 is press-fitted relative to the shaft portion 380*h*2 (or shaft portion 360*d*) such that the urging member 370 does not dislodge, by which the assembling operativity is improved. Thereafter, the slider 360 is inserted into the space portion 350*f* so that the engaging portion 380*d* is fitted into the cylindrical portion 360*a*. As shown in part (c) of FIG. 67 and part (d) of FIG. 67, the retention pin 391 and the retention pin 392 are inserted from the slide groove 350*s*1 through the through hole 360*c*1—through hole 360*c*4 into the slide groove 350*s*4.

Figure 72:
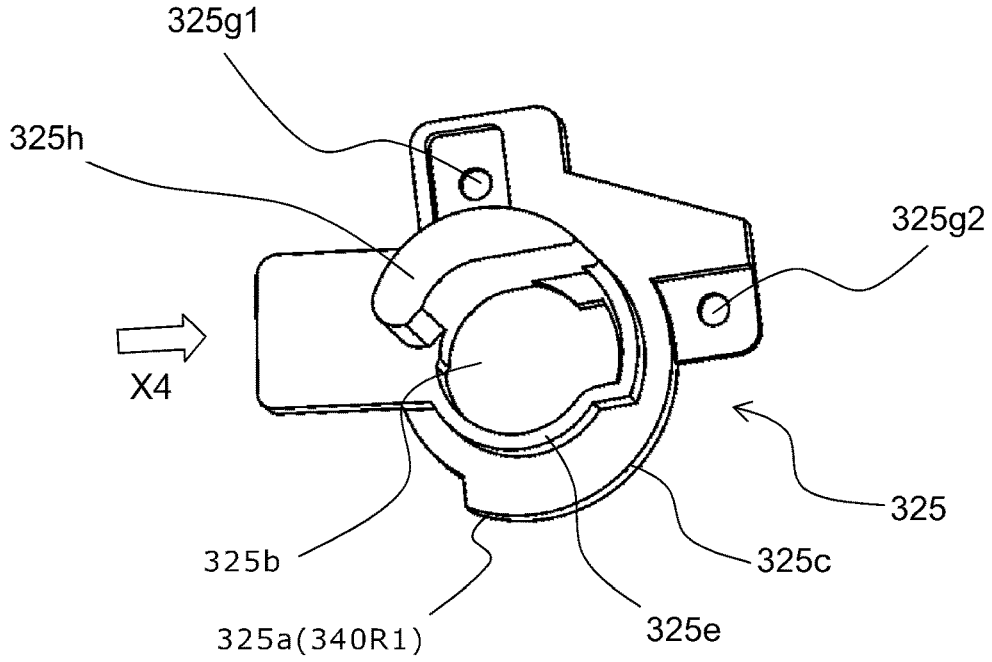
FIG. 72 is an illustration of a drum bearing in the third embodiment of the present invention.
Figure 72:
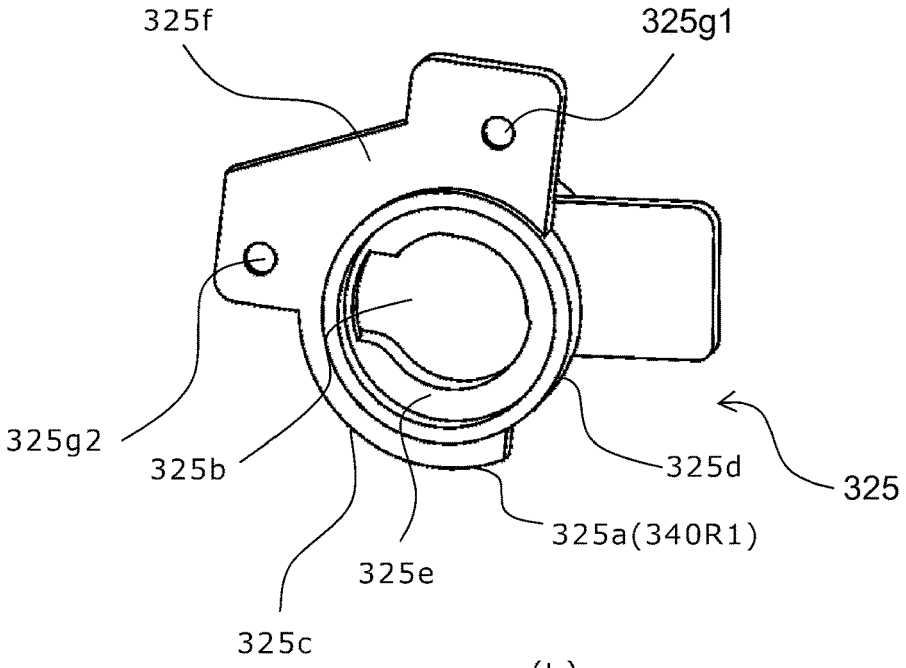

(5) Drum Bearing:

Referring to FIG. 72, the drum bearing 325 will be described. Part (a) of FIG. 72 is a perspective view as seen from the driving shaft, and part (b) of FIG. 72 is a perspective view as seen from the photosensitive drum side.

The drum bearing 325 functions to position the photosensitive drum 310 in place in the drum frame 321 and to position the drum unit U10 relative to the main assembly A of the apparatus. In addition, it also functions to retain the coupling member 380 in the position capable of transmitting the driving force to the photosensitive drum 310.

Detailed description will be made. As the name FIG. 72, an engaging portion 325*d* for positioning the photosensitive drum 310 and for being positioned relative to the drum frame 321 is substantially coaxial with the outer periphery portion 325*c* positioned relative to the main assembly A of the apparatus. The engaging portion 325*d* and the outer periphery portion 325*c* are annular, and the coupling member 380 described above is placed in a space portion 325*b* thereof.

Adjacent a center portion of the engaging portion 325*d*/outer periphery portion 325*c* of the space portion 325*b* with respect to the axial direction, an abutment surface 325*e* for positioning the photosensitive drum unit U31 in the axial direction is provided. In addition, the drum bearing 325 has a fixed surface 325*f* for fixing relative to the drum frame 321 and holes 325*g*1 and 325*g*2 to be penetrated by fixing screws. As will be described hereinafter, a guide portion 325*a* is integrally provided to guide the mounting and dismounting of the cartridge BB relative to the main assembly A of the apparatus.

(6) Mounting Guide of the Process Cartridge and a Positioning Portion Relative to the Main Assembly:

As shown in FIGS. 59 and 60, the outer periphery 325*a* of the outer end portion of the drum bearing 325 functions as a cartridge guide 340R1, and the outer periphery 326*a* of the outer end portion of the drum shaft 326 functions as a cartridge guide 340L1.

One end portion side of the (driving side) of the photosensitive drum unit U31 with respect to the longitudinal direction is provided with a cartridge guide 340R2 substantially above the cartridge guide 340R1. At the other end portion side thereof (non-driving side) is provided with a cartridge guide 340L2 above the cartridge guide 340L1.

In this embodiment, the cartridge guides 340R1, 340R2 are formed integrally with the drum frame 321. However, the cartridge guides 340R1, 340R2 may not be integral.

Figure 73:
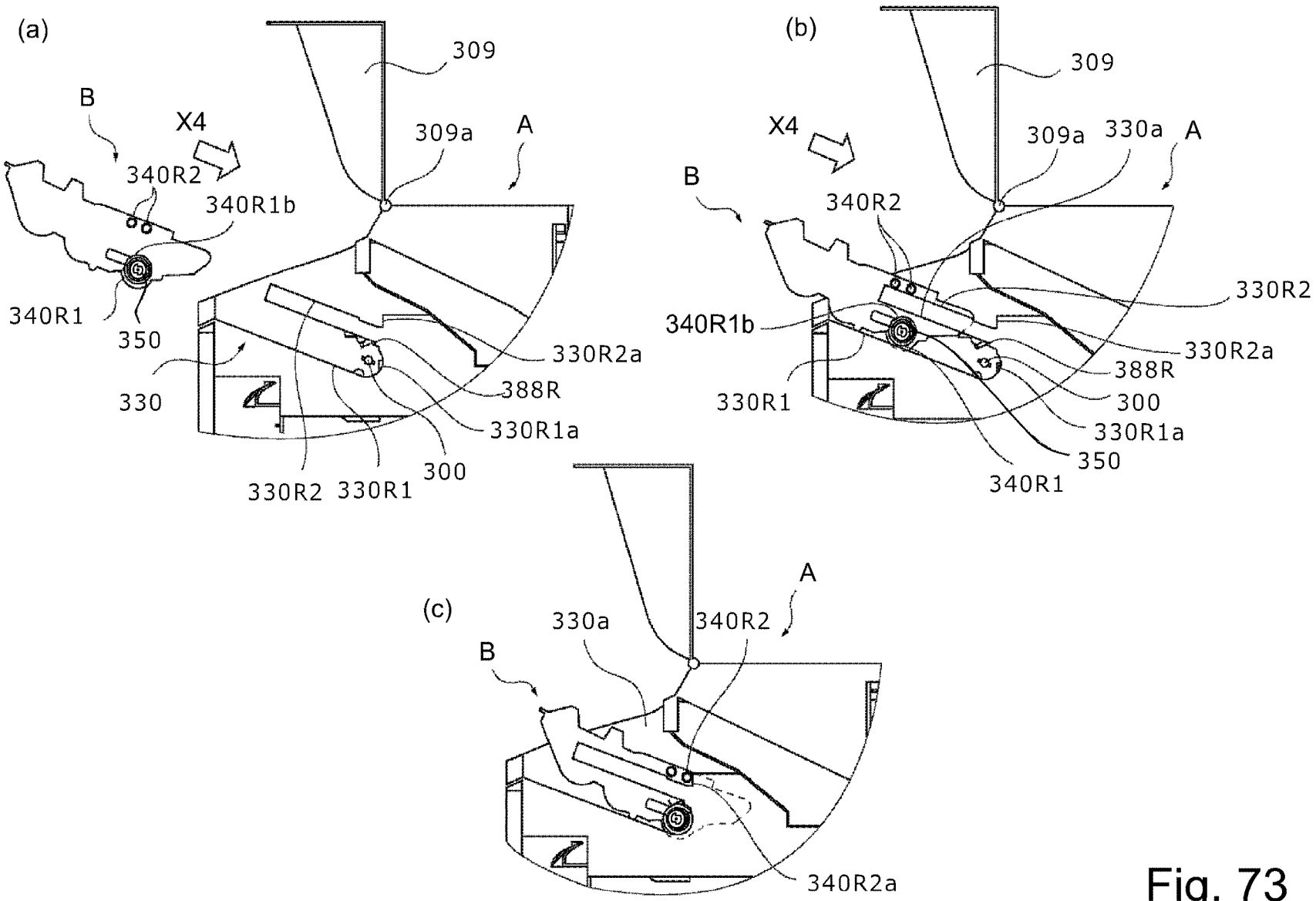
FIG. 73 is an illustration of mounting process of the cartridge in the third embodiment of the present invention.

(7) Mounting Operation of Process Cartridge:

Referring to FIG. 73, the mounting operation of the cartridge B to the main assembly A of the apparatus will be described. FIG. 73 illustrates the mounting process, and is sectional views taken along a line S9-S9 of FIG. 62.

As shown in part (a) of FIG. 73, the user opens the cartridge door 309 provided on the main assembly A of the apparatus. Then, the cartridge B is mounted to the cartridge mounting means 330 of the main assembly A of the apparatus.

When the cartridge B is mounted to the main assembly A of the apparatus, the cartridge guides 340R1, 340R2 are aligned with the main assembly guides 330R1, 330R2 in the driving side, as shown in part (b) of FIG. 73. In addition, in the non-driving side, the cartridge guides 340L1, 340L2 (FIG. 60) are guided by the main assembly guide 330L1, 330L2 (FIG. 63).

Then, the cartridge B is inserted in the direction of the arrow X4, by which the cartridge B is received at a predetermined position by engagement of the coupling 380 of the cartridge B with the main assembly driving shaft 300 of the main assembly A. That is, as shown in part (c) of FIG. 73, the cartridge guide 340R1 contacts the positioning portion 330R1*a* of the main assembly guide 330R1, and the cartridge guide 340R2 contacts the positioning portion 330R2*a* of the main assembly guide 330R2.

Because of the substantially symmetrical configurations, the cartridge guide 340L1 contacts the positioning portion 330L1*a* of the main assembly guide 330L1 (FIG. 63), and the cartridge guide 340L2 contacts the positioning portion 330L2*a* of the main assembly guide 330L2, although not shown in the drawing. In this manner, the cartridge B is dismountably mounted to the cartridge accommodating portion 330*a* by the mounting means 330. By the cartridge B being mounted to the cartridge mounting portion 330*a*, the image forming operation is enabled. The cartridge accommodating portion 330*a* is a chamber to be occupied by the cartridge B mounted to the main assembly A of the apparatus by the mounting means 330, as described hereinbefore.

When the cartridge B is accommodated in the above-described predetermined position, the pressure receiving portion 340R1*b* (FIG. 59) of the cartridge B is pressed by the urging spring 388R shown in FIGS. 62, 63 and 73. In addition, the pressure receiving portion 340L1*b* (FIG. 60) of the process cartridge B is pressed by the urging spring 388L. By this, the cartridge B (photosensitive drum 310) is correctly positioned relative to a transfer roller, optical means and so on of the main assembly A.

Figure 74:
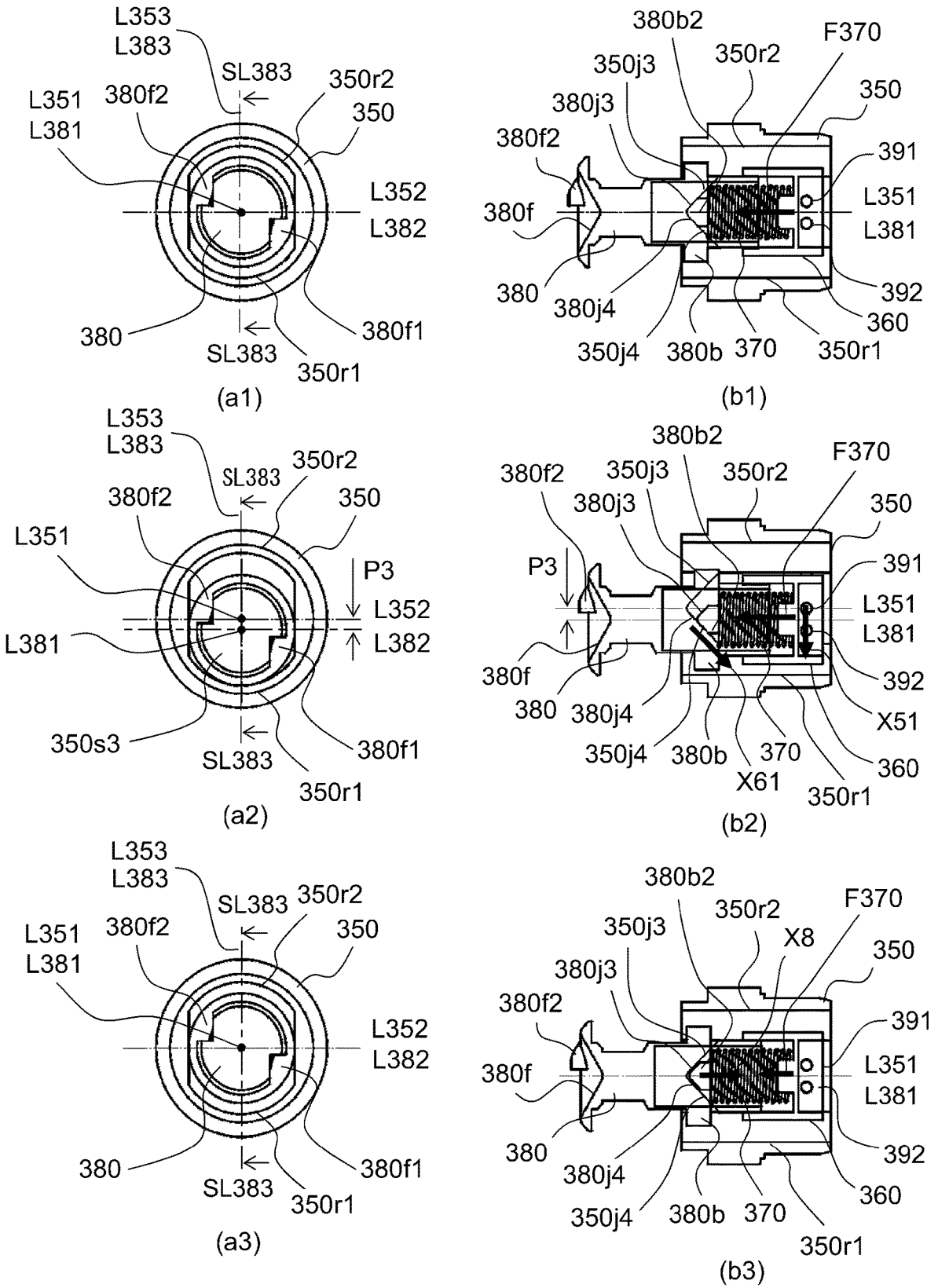
FIG. 74 is an illustration of the operation of the coupling member according to the third embodiment of the present invention.

Referring to FIG. 74, the coupling member 380 will be described. Part (a1) of FIG. 74 is an illustration of the state in which the axis L381 of the coupling member 380 and the axis L351 of the driving side flange 350 are aligned with each other, and the guide portion 350*j*1—the guide portion 350*j*4 contact the portion-to-be-guided 380*j*1 and the portion-to-be-guided 380*j*4, respectively. Part (a2) of FIG. 74 is an illustration of the state in which the coupling member 380 has moved relative to the driving side flange 350 in the direction indicated by an arrow X51, that is, the direction parallel with the axis L383. Part (a3) of FIG. 74 is a illustration of the state in which the coupling member 380 has moved along the axis L351 toward the non-driving side (arrow X8 direction) from the state in which the guide portion 350*j*1 and the guide portion 350*j*4 and the portion-to-be-guided 380*j*1—the portion-to-be-guided 380*j*4 contact to each other, respectively. Part (b1) of FIG. 74 to part (b3) of FIG. 74 are schematic sectional views taken along lines SL383 parallel with the axis L383 in part (a1) of FIG. 74 and part (a3) of FIG. 74. In part (b1) of FIG. 74 to part (b3) of FIG. 74, the coupling member 380 is depicted in the unsectioned state for better illustration, and the guide portion 350*j*3 and the guide portion 350*j*4 of the driving side flange 350 and the slide groove 350*s*4 are depicted by broken lines.

First, as shown in part (b1) of FIG. 74, as for the coupling member 380, the guide portion 350*j*3 and the guide portion 350*j*4 contact the portion-to-be-guided 380*j*3 and the portion-to-be-guided 380*j*4, by the urging force F370 of the urging member 370, so that the axis L381 and the axis L351 are substantially coaxial with each other. At this time, the transmission projections 380*f*1, 380*f*2 of the coupling member 380 are in the most projected state relative to the driving side flange 350.

As shown in part (a2) of FIG. 74, the coupling member 380 is moved relative to the driving side flange 350 in the direction of the arrow X51 parallel with the axis L383 by a distance p3. Then, as shown in part (b2) of FIG. 74, the coupling member 180 moves along the guide portion 350*j*4 (arrow X61) against the urging force F370 of the urging member 370 while keeping the contact between the portion-to-be-guided 380*j*4 and the guide portion 350*j*4 of the driving side flange 350. At this time, the axis L381 of the coupling member 380 maintains the parallelism with the axis L351. Therefore, the coupling member 380 is movable in the direction of the arrow X61 until the driving portion 380*b* abuts to the cylindrical inner wall portion 350*r*1, that is, until the movement distance p3 of the coupling member 380 in the direction of the axis L383 becomes equal to the gap D. On the hand, the slider 360 is movable only in the direction of the axis L383 by the function of the retention pin 391 and the retention pin 392. Therefore, the slider 360 moves in the direction of the arrow X51 integrally with the retention pin 391 and the retention pin 392 in interrelation with the movement of the coupling member 380 in the direction of the arrow X61.

When the coupling member 380 is moved in the direction opposite to that of the arrow X51, the coupling member 380 moves along the guide portion 350*j*3, similarly.

On the other hand, as shown in part (b3) of FIG. 74, when the coupling member 380 is moved in the direction of the arrow X8, the coupling member 380 moves in the direction of the arrow X8 against the urging force F370 of the urging member 370 in the state that the engaging portion 380*d* is supported by the cylindrical portion 360*a* of the slider 360. At this time, the gaps are provided between the portion-to-be-guided 380*j*3 and the portion-to-be-guided 380*j*4 of the coupling member 380 and the guide portion 350*j*3 and the guide portion 350*j*4 of the driving side flange 350, respectively. That is, the coupling member 380 is movable by a predetermined distance from the position in which the coupling member 380 is projected most relative to the driving side flange 350 as shown in part (b1) of FIG. 74 to the position in which the coupling member 380 is retracted as shown in part (b3) of FIG. 74.

As described in the foregoing, the coupling member 380 is movable relative to the driving side flange 350 in the directions of the axis L381 and the axis L383. In addition, by the contact between the guide portion 350*j*1—the portion-to-be-guided 380*j* and the contact between the guide portion 350*j*4 and the portion-to-be-guided 380*j*4, the coupling member 180 is movable relative to the driving side flange 350 in the direction of the axis L381 in interrelation with the movement in the direction of the axis L383.

Figure 75:
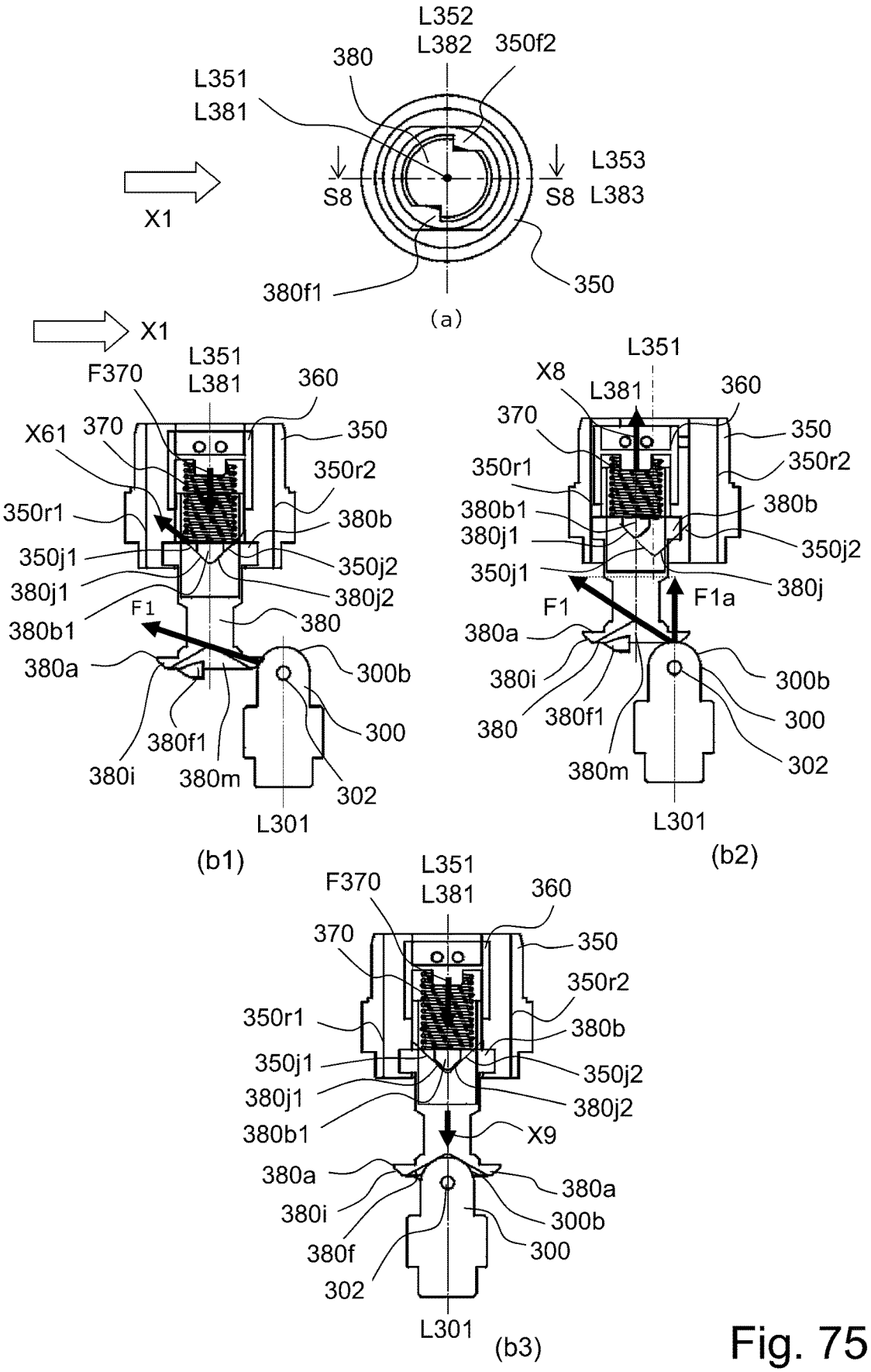
FIG. 75 is an illustration of an engaging operation between the coupling member and the main assembly driving shaft in the third embodiment of the present invention.
Figure 76:
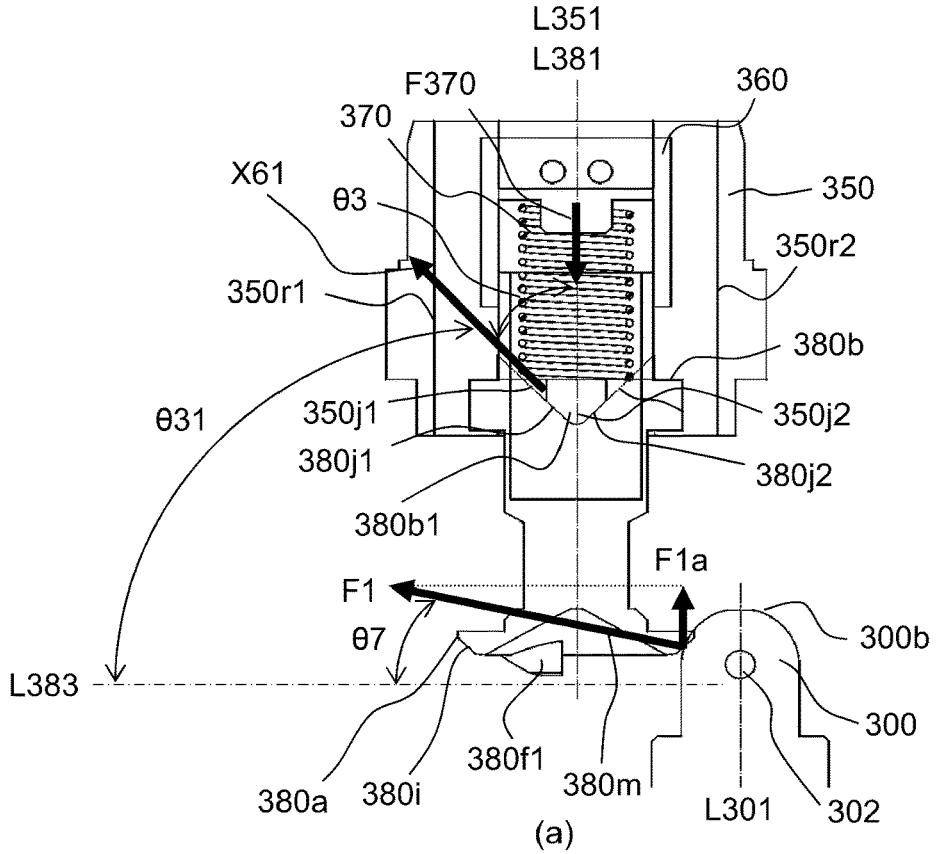
FIG. 76 is a detailed illustration of engaging operation between the coupling member and the main assembly driving shaft in the third embodiment of the present invention.
Figure 76:
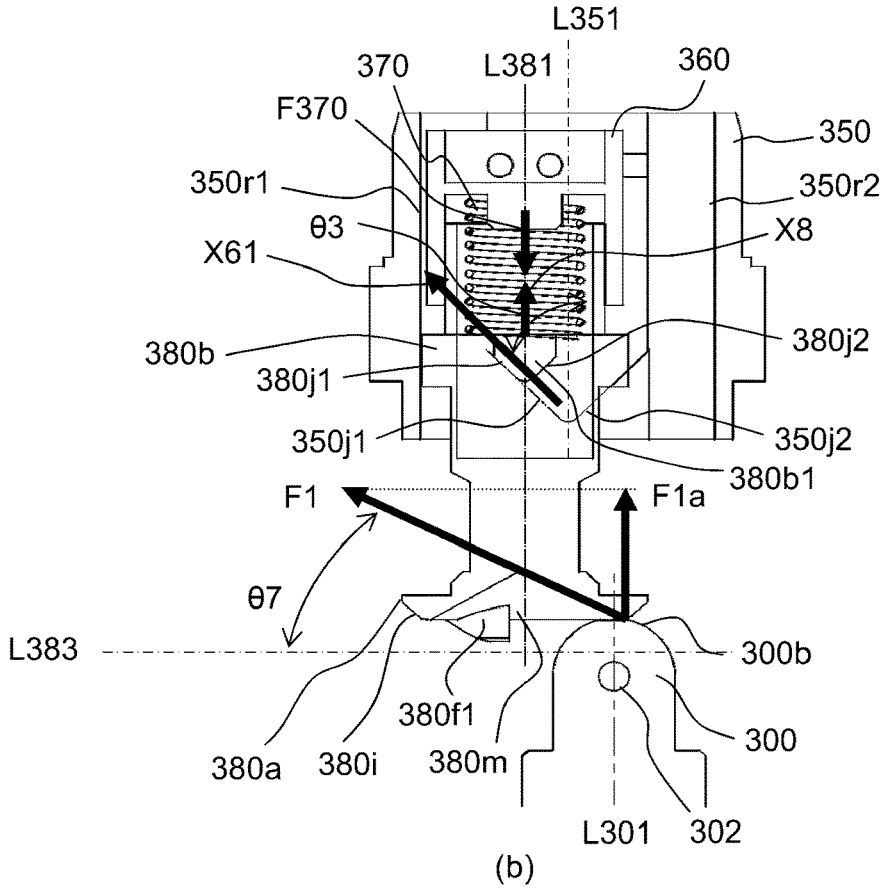
Figure 77:
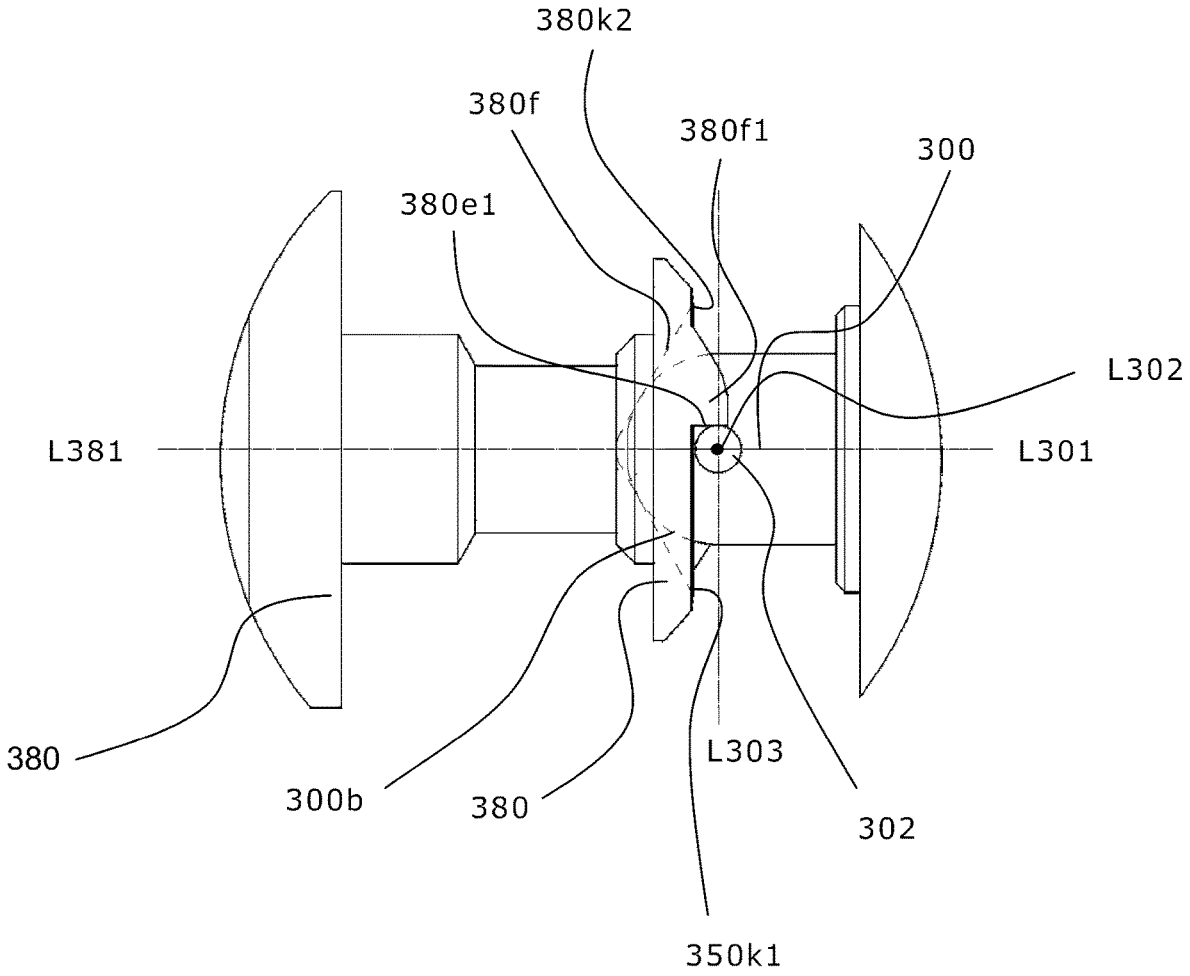
FIG. 77 is an illustration at the time of engagement between the coupling member and the main assembly driving shaft in the third embodiment of the present invention.

(9) Coupling Mounting Operation and Drive Transmission:

As described hereinbefore, the coupling member 380 is engaged with the main assembly driving shaft 300 simultaneously when or immediately before the cartridge B is set in the predetermined position of the main assembly A of the apparatus. Referring to FIG. 75 through FIG. 78, the engaging operation of the coupling member 380 will be described. FIG. 75 is a perspective view of the driving shaft of the main assembly and major parts of the driving side of the cartridge. FIG. 76 is a longitudinal sectional view of the driving shaft of the main assembly, the coupling of the process cartridge, and a drum shaft, as seen from the bottom of the main assembly. FIG. 77 is a longitudinal sectional view showing phase differences relative to the phases shown in FIG. 76 of the driving shaft of the main assembly, the coupling of the process cartridge and drum shaft, as seen from the bottom of the main assembly. In the following description, "engagement" means the state in which the axis L351 and the axis L301 are substantially coaxial with each other, and the drive transmission is possible from the main assembly side engaging portion 300 to the coupling member 380.

As shown in part (a) of FIG. 75, the description will be made as to the case that the axis L383 of the coupling member 380 and the mounting direction of the cartridge B (arrow X1) are parallel with each other.

As shown in FIG. 75, the mounting direction of the cartridge B is substantially perpendicular to the rotational axis L1 of the photosensitive drum 310, and the cartridge B moves along the direction (arrow X1) substantially perpendicular to the axis L351 of the driving side flange 350 to be mounted to the main assembly A of the apparatus. As shown in part (b1) of FIG. 75 and part (a) of FIG. 76, when the cartridge B starts to be mounted to the main assembly A of the apparatus, the transmission projections 380*f*1 and 380*f*2 of the coupling member 380 is projected most toward the driving side flange 350 by the urging force F370 of the urging member 370. This state is the initial state of the mounting. At this time, the position of the coupling member 380 is the first position (projected position). At this time, the rotational axis L381 of the coupling member 380 is substantially parallel with the rotational axis L1 of the photosensitive drum 10. More particularly, the rotational axis L381 and the rotational axis L1 are substantially aligned with each other. The rotational axis L381 of the coupling member 380 is substantially parallel with the axis L351 of the driving side flange 350. More particularly, the rotational axis L381 and the rotational axis L351 are substantially aligned with each other.

When the cartridge B is moved in the direction of the arrow X1 from the initial state of mounting, the main assembly contact portion 380*i* of the coupling member 380 abuts to the free end portion 300*b* of the main assembly driving shaft 300 provided in the main assembly A of the apparatus. As shown in part (b1) of FIG. 75 part (a) of FIG. 76, the main assembly contact portion 380*i* receives the force F1 (retraction force) from the free end portion 300*b*. The force F1 is directed substantially toward the center of the substantially spherical surface constituting the main assembly contact portion 380*i*, and therefore, it is inclined by an angle θ7 which is smaller than a complementary angle θ31 of the angle θ3 relative to the axis L383. Therefore, when the coupling member 380 receives the force F1, moves in the direction of the arrow X61 along the guide portion 350*j*1 against the urging force F370 of the urging member 370 while keeping the contact between the portion-to-be-guided 380*j*1 and the guide portion 350*j*1 of the driving side flange 350.

As shown in part (b2) of FIG. 75 and part (b) of FIG. 76, the cartridge B is further moved in the direction of the arrow X1. Then, the driving portion 380*b* of the coupling member 380 contacts the cylindrical inner wall portion 350*r*1 of the driving side flange 350 so that the movement of the coupling member 380 relative to the driving side flange 350 in the direction of the arrow X61 is limited. At this time, an amount the movement of the coupling member 380 from the initial state of the mounting in the direction of the axis L381 is movement distance N10 (part (b) of FIG. 76). The movement distance N10 is determined by the gap D (part (c) of FIG. 66) and the angle θ3 (FIG. 70) of the guide portion 350*j*1—guide portion 350*j*4 relative to the axis L381.

In the state shown in part (b) of FIG. 76, the coupling member 380 has moved by the movement distance N10 in the direction of the arrow X8 from the initial state of the mounting. Then, the angle θ7 formed between the direction of the force F1 and the axis L383 increases as compared with that in the initial state of the mounting, because the force F1 is substantially directed to the center of the spherical surface constituting the main assembly contact portion 380*i*. With this, a component force F1*a* of the force F1 in the direction of the arrow X8 increases the as compared with that of the initial state of the mounting. By the component force F1*a*, the coupling member 380 moves further in the direction of the arrow X8 against the urging force F370 of the urging member 370. By the movement of the coupling member 380 in the direction of the arrow X8, the coupling member 380 is capable of passing by the free end portion 300*b* of the main assembly driving shaft 300. The position of the coupling member 380 shown in part (b2) of FIG. 76 is a second position (retracted position). At this time, the rotational axis L381 of the coupling member 380 is substantially parallel with the rotational axis L1 of the photosensitive drum 10. More specifically, there is a gap between the rotational axis L381 and the rotational axis L1 (the rotational axis L381 and the rotational axis L1 are substantially out of alignment). The rotational axis L381 of the coupling member 380 is substantially parallel with the axis L351 of the driving side flange 350. More specifically, at this time, there is a gap between the rotational axis L381 and the rotational axis L351 (the rotational axis L381 and the rotational axis L1 are substantially out of alignment). In the second position (retracted position), the coupling member 380 is displaced (moved/retracted) toward the photosensitive drum 10 (the other end portion side of the photosensitive drum 10 in the longitudinal direction), as compared with that in the first position (projected position).

As shown in part (b4) of FIG. 75, when the cartridge B has been moved to the complete mounted position, the axis L301 of the main assembly driving shaft 300 and the axis L351 of the driving side flange 350 are substantially coaxial with each other by the function of the positioning means for positioning the cartridge B to the main assembly A of the apparatus, as will be described hereinafter. At this time, the coupling member 380 is moved in the direction indicated by the arrow X9 by the urging force F370 of the urging member 370. Simultaneously, the coupling member 380 is moved along the guide portion 350*j*1, so that the axis L381 is aligned with the axis L351 of the driving side flange 350.

As shown in FIG. 77, in the state in which the axis L301 of the main assembly driving shaft 300 and the axis L381 of the coupling member 380 are aligned with each other, the driving bearing surface 380*f* constituting the conical shape portion of the coupling member 380 contact to a free end portion 380*b* of the main assembly driving shaft 300. At this time, the transmission projections 380*f*1, 380*f*2 of the coupling member 380 and the drive transmission pin 302 of the main assembly driving shaft 300 are overlapped with each other in the direction of the axis L301. At this time, the drive transmission pin 302 is placed in the drive receiving standby portions 380*k*1, 380*k*2. The rotational force receiving portions 380*e*1, 380*e*2 disposed downstream of the transmission projections 380*f*1, 380*f*2 with respect to the clockwise direction are opposed to the drive transmission pin 302. That is, the coupling member 380 and the main assembly driving shaft 300 are engaged with each other to enabled rotation of the coupling member 380. The position of the coupling member 380 at this time is substantially the same as the above-described first position (projected position).

When the cartridge B is set in the complete mounted position, the transmission projections 380*f*1, 380*f*2 and the drive transmission pin 302 may be overlapped with each other as seen in the direction of the axis L301, depending on the phase of the main assembly driving shaft 300 with respect to the rotational moving direction. In such a case, the free end portion 300*b* of the main assembly driving shaft 300 is unable to contact the driving bearing surface 380*f* of the coupling member 380. In such a case, by the main assembly driving shaft 300 being rotated by a driving source which will be described hereinafter, the transmission projections 380*f*1, 380*f*2 become not overlap with the drive transmission pin 302 as seen in the direction of the axis L301. And, by the urging force F370 of the urging member 370, the free end portion 300*b* of the main assembly driving shaft 300 becomes capable of contacting the driving bearing surface 380*f* of the coupling member 380 (the coupling member 380 reaches the first position (projected position)). Thus, the main assembly driving shaft 300 is capable of engaging with the coupling member 380 while being rotated by the driving source, and therefore, the coupling member 380 starts to rotate.

Figure 78:
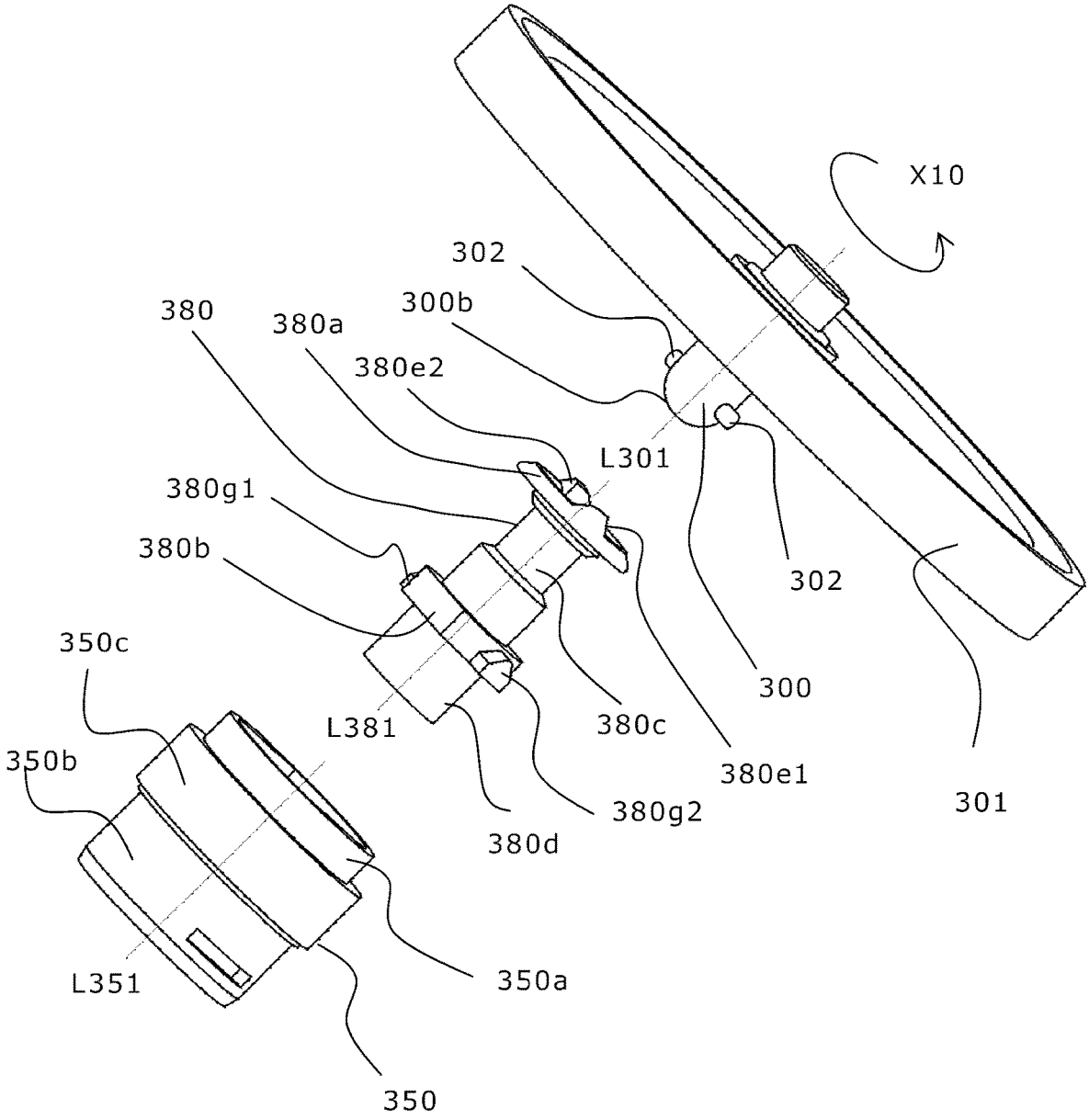
FIG. 78 is an illustration at the time of drive transmission in the third embodiment of the present invention.

Referring to FIG. 78, the drive transmission operation at the time of driving the photosensitive drum 310 will be described. By the rotational force received from the driving source of the main assembly A of the apparatus, the main assembly driving shaft 300 rotates in the direction indicated by X10 in the Figure, together with the drum driving gear 301. The drive transmission pin 302 integral with the main assembly driving shaft 300 contacts to the rotational force receiving portions 380*e*1, 380*e*2 of the coupling member 380 to rotate the coupling member 380. As described hereinbefore, the rotational force transmitting portion 380*g*1, the rotational force transmitting portion 380*g*2 and the rotational force receiving portion 350*g*1 (part (a) of FIG. 70), the rotational force receiving portion 350*g*2 (part (b) of FIG. 70) are engaged almost no gap in the direction of the axis L382

(part (c) of FIG. 70), and therefore, they keep the substantially parallel state. By this, the coupling member 380 can transmit the rotation about the axis L381 the driving side flange 350. Therefore, the rotation of the coupling member 380 is transmitted to the driving side flange 350 through the rotational force transmitting portion 380*g*1, the rotational force transmitting portion 380*g*2 and the rotational force receiving portion 350*g*1, the rotational force receiving portion 350*g*2.

As shown in part (a) of FIG. 79, the description will be made as to the case that the axis L383 of the coupling member 380 is perpendicular to the mounting direction of the cartridge B (arrow X1).

Figure 79:
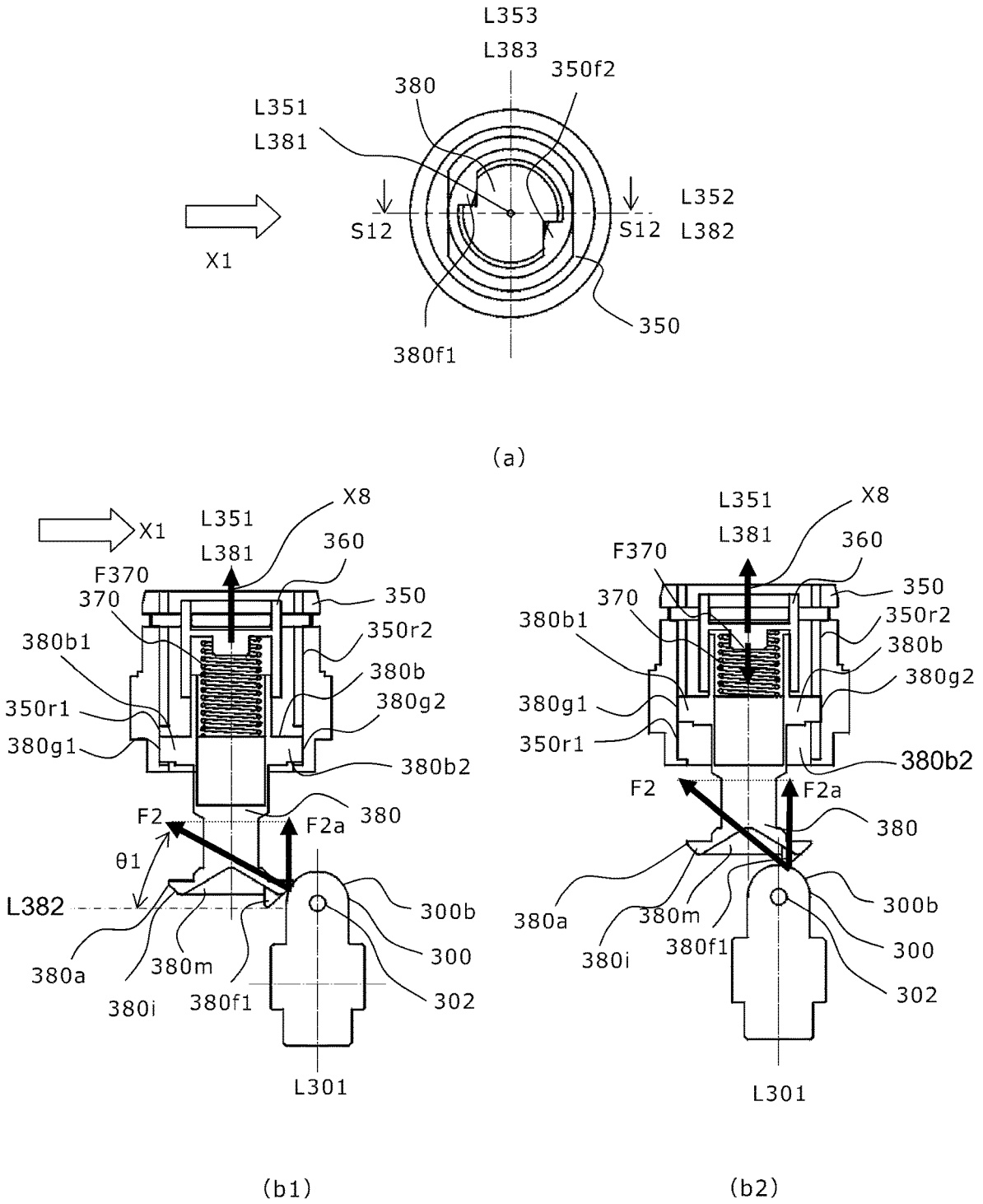
FIG. 79 is an illustration at the time of engagement between the coupling member and the main assembly driving shaft in the third embodiment of the present invention.
Figure 80:
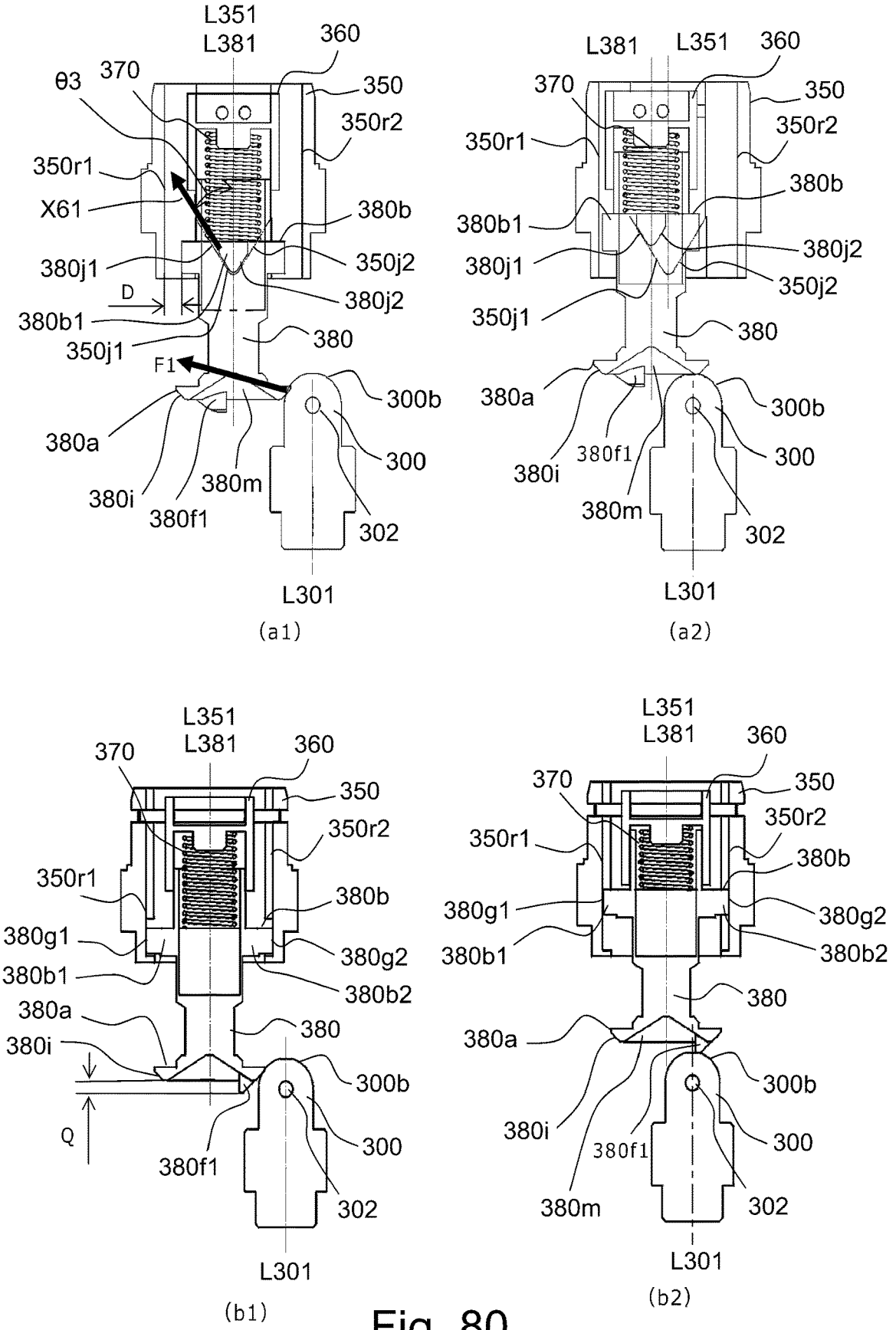
FIG. 80 illustrates a modified example of the driving side flange unit in the third embodiment of the present invention.

As shown in part (b1) of FIG. 79, when the cartridge B is moved in the direction of the arrow X1, the main assembly contact portion 380*i* of the coupling member 380 contact to the free end portion 300*b* of the main assembly driving shaft 300 provided in the main assembly A of the apparatus, similarly to the case that the axis L383 of the coupling member 380 is parallel with the mounting direction of the cartridge B. At this time, the main assembly contact portion 380*i* receives the force F2 from the free end portion 300*b* by the mounting of the cartridge B. The force F2 is directed to the center of the substantially spherical surface constituting the main assembly contact portion 380*i*, and therefore, it is inclined by the angle θ1 relative to axis L382, and a component force F2*a* of the force F2 is produced as a component along the direction of the arrow X8 in the direction of the axis L381. Therefore, when the cartridge B is moved further in the direction of the arrow X1, the coupling member 380 moves in the direction of the arrow X8 against the urging force F370 of the urging member 370, by the component force F2*a*, as shown in part (b2) of FIG. 79. By the movement of the coupling member 380 in the direction of the arrow X8, the coupling member 380 is capable of passing by the free end portion 300*b* of the main assembly driving shaft 300. Here, the angle θ1 formed between the main assembly contact portion 380*i* and the axis L381 is selected such that the coupling member 380 can move in the direction of the arrow X8 by the component force F2*a* against the urging force F370 of the urging member 370. Thereafter, similarly to the case of the part (b3) of FIG. 78 and part (b4) of FIG. 78, the cartridge B can be moved to the complete mounted position while keeping the coupling member 380 in the space portion 350*f* of the driving side flange 350.

The foregoing description has been made with respect to the case in which the mounting direction X1 of the cartridge B is parallel with or perpendicular to the axis L183. However, also when the direction is different from the above-described mounting direction, the coupling member 380 moves in the direction of the arrow X8 so that the coupling member 380 can pass by the free end portion 300*b* of the main assembly driving shaft 300. The coupling member 380 is moved by the force F1 along the guide portion 350*j*1—the guide portion 350*j*4 in the direction indicated by the arrow X8, or by the component force F1*a* or the component force F2*a* of the force F1 or the force F2 in the arrow X8 direction.

With the above-described structure, the cartridge B can be mounted to the main assembly A of the apparatus, irrespective of the phases of the coupling member 380 and the drive transmission pin 302 relative to the rotational moving direction in terms of the mounting direction of the cartridge B to the main assembly A of the apparatus.

As described in the foregoing, with the structure of this embodiment, the coupling member 380 can be engaged with the main assembly driving shaft 300 with a simple structure without using complicated structures of the main assembly A of the apparatus and/or the cartridge B.

As shown in part (b2) of FIG. 75, in this embodiment, the coupling member 380 move in the direction of the arrow X8 after the driving portion 380*b* contacts to the cylindrical inner wall portion 350*r*1. However, the coupling member 380 may passed by the free end portion 300*b* of the main assembly driving shaft 300 when the driving portion 380*b* contacts to the cylindrical inner wall portion 350*r*1. To provide such a structure, as shown in part (a1) of FIG. 18 and part (a2) of FIG. 80, for example, the inclination θ3 is reduced, or the gap D is increased, by which the movement distance N10 is increased. Or, as shown in part (b1) of FIG. 80 and part (b2) of FIG. 80, the amount Q of the projection of the transmission projections 380*f*1, 380*f*2 from the opening 350*e* of the driving side flange 350 toward the driving side may be reduced. With such a structure, only by the movement along the guide portion 350*j*1—guide portion 350*j*4, the transmission projections 380*f*1, 380*f*2 of the coupling member 380 move beyond the free end portion 300*b* in the direction of the arrow X8, so that it can pass by the free end portion 300*b*. Therefore, it is unnecessary to produce the component force F1*a* of the force F1 in the direction of the arrow X8, and the coupling member 380 and the main assembly driving shaft 300 can be engaged with each other with a simpler structure.

Figure 81:
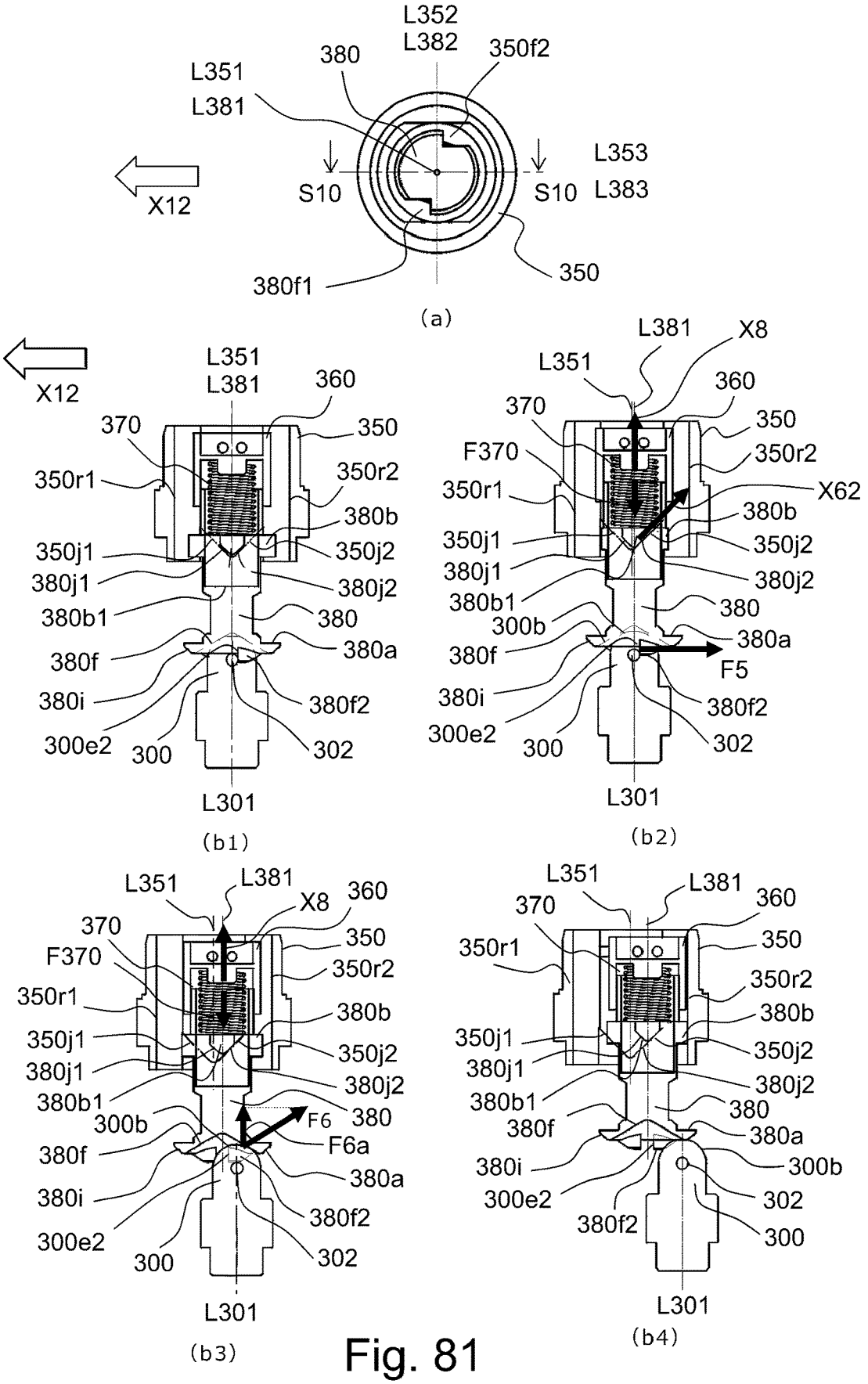
FIG. 81 is an illustration of disengaging operation between the coupling member and the main assembly driving shaft in the third embodiment of the present invention.
Figure 82:
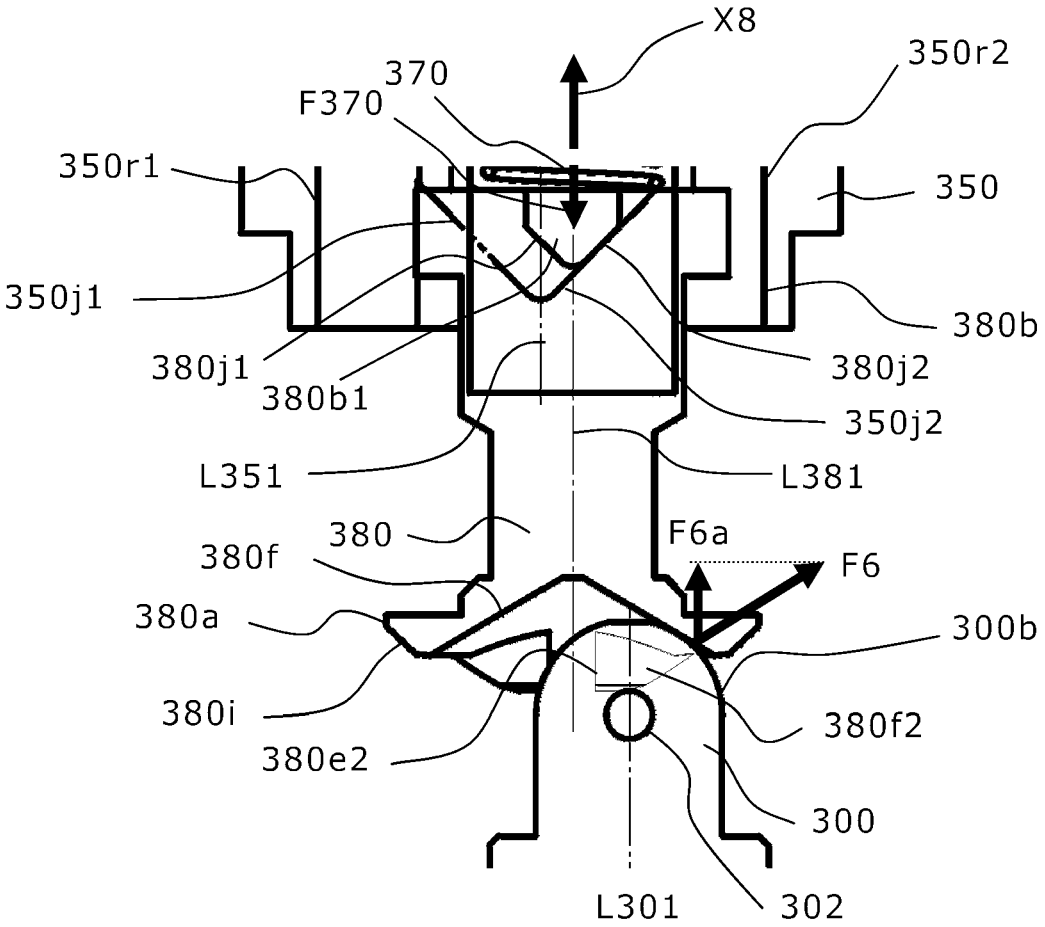
FIG. 82 is a detailed illustration of the disengaging operation between the coupling member and the main assembly driving shaft in the third embodiment of the present invention.
Figure 83:
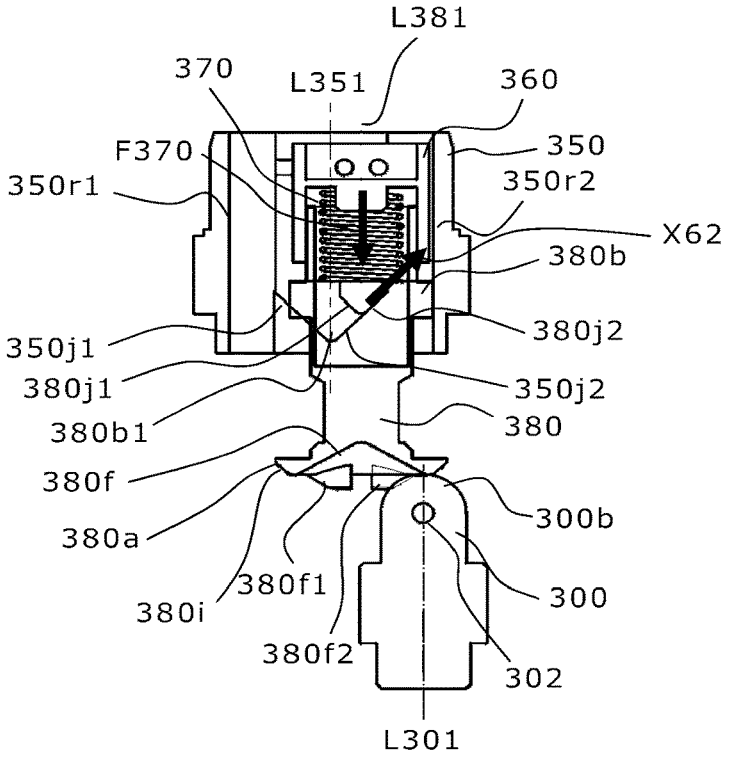
FIG. 83 is a detailed illustration of the disengaging operation between the coupling member and the main assembly driving shaft in the third embodiment of the present invention.
Figure 83:
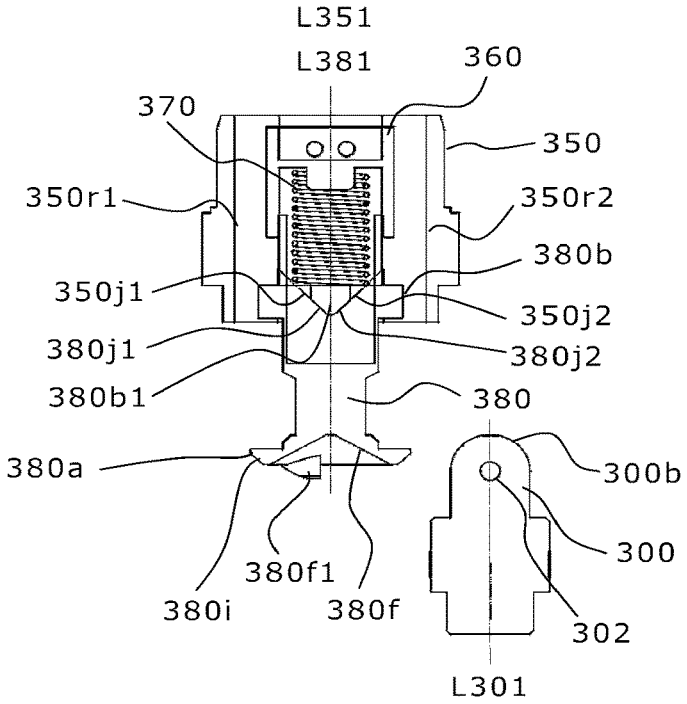
Figure 84:
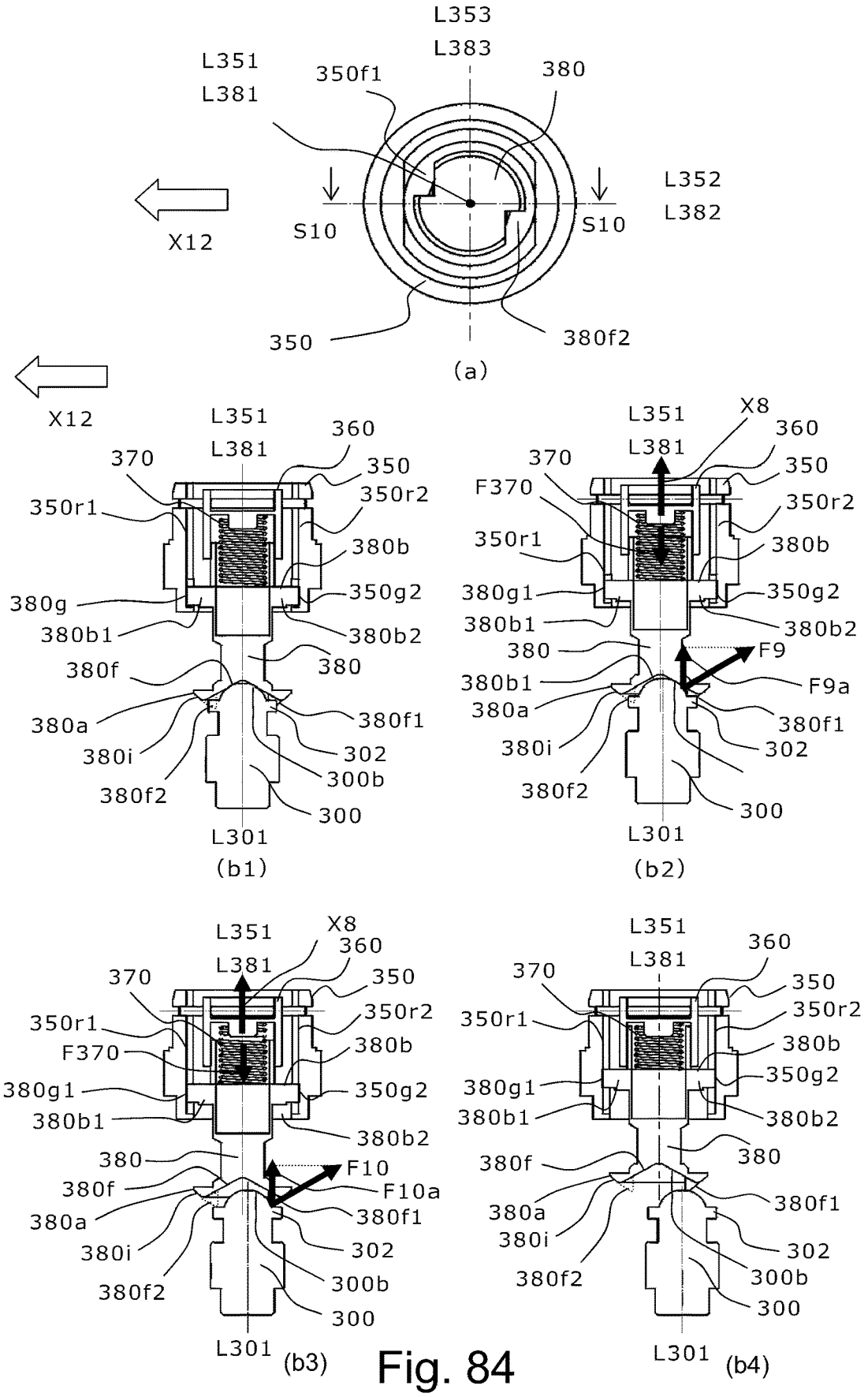
FIG. 84 is a detailed illustration of the disengaging operation between the coupling member and the main assembly driving shaft in the third embodiment of the present invention.

(10) Disengaging Operation of the Coupling and Cartridge Removing Operation:

Referring to FIG. 81 through FIG. 84, the operation of disengagement of the coupling member 380 from the main assembly driving shaft 300 when the cartridge B is removed from the main assembly A of the apparatus will be described. Part (a) of FIG. 81 and part (a) of FIG. 84 show the dismounting direction of the cartridge B and S10 section, and S1 section. Parts (b1)-(b4) of FIG. 81 and parts (a)-(b) FIG. 83 are schematic sectional views illustrating disengagement of the coupling member 380 from the main assembly driving shaft 300 in S sections of part (a) of FIG. 81. Parts (b1)-(b4) of FIG. 84 show sections taken along a line S11 of part (a) of FIG. 84 and illustrates disengagement of the coupling member 380 from the main assembly driving shaft 300. FIG. 82 is an enlarged view of the neighborhood portions of the driving side flange unit U32 and the main assembly driving shaft 300 shown in part (b3) of FIG. 81. In part (b1) of FIG. 81 and part (b2) of FIG. 81, the coupling member 380 is not sectioned. In FIG. 81-FIG. 84, the guide portion 350*j*1 and the guide portion 350*j*2 of the driving side flange 350 are depicted by broken lines. In part (b3) of FIG. 81, part (b4) of FIG. 81, FIG. 82-FIG. 83, the transmission projection 380*f*2 existing in front of the section plane is indicated by broken lines. In the following, the rotational force receiving portion 380*e*2 side will be taken for the explanation.

As shown in part (a) of FIG. 81, the description will be made as to the case in which the dismounting direction of the cartridge B (arrow X12) and the axis L383 of the coupling member 380 are parallel with each other.

As shown in part (b1) of FIG. 81, the cartridge B is moved in the dismounting direction X12 which is substantially perpendicular to the rotational axis L1 of the photosensitive drum 310 and which is substantially perpendicular to the axis L351 of the driving side flange 350 to be dismounted from the main assembly A of the apparatus. In the state that the main assembly driving shaft 300 does not rotate after the completion of the image forming operation, the drive transmission pin 302 contacts the rotational force receiving portions 380*e*1, 380*e*2. The drive transmission pin 302 is located downstream of the rotational force receiving portion 380*e*2 with respect to the dismounting direction X12 of the cartridge B. At this time, the free end portion 300*b* of the main assembly driving shaft 300 contacts the driving bearing surface 380*f* of the coupling member 380. This is the initial state of the dismounting.

The position of the coupling member 380 in the state of part (b1) of FIG. 81 is the first position (enabled-rotational-force-transmission-position). The first position (enabled-rotational-force-transmission-position) is substantially the same as the above-described first position (projected position). At this time, the rotational axis L381 of the coupling member 380 is substantially parallel with the rotational axis L1 of the photosensitive drum 10. More particularly, the rotational axis L381 and the rotational axis L1 are substantially aligned with each other. The rotational axis L381 of the coupling member 380 is substantially parallel with the axis L351 of the driving side flange 350. More particularly, the rotational axis L381 and the rotational axis L351 are substantially aligned with each other.

Then, the cartridge B is moved in the dismounting direction X12. Then, as shown in part (b2) of FIG. 81, the rotational force receiving portion 380*e*2 located in the upstream side of the coupling member 380 with respect to the dismounting direction receives the force F5 produced by the dismounting of the cartridge B, from the drive transmission pin 302. The force F5 is perpendicular to the rotational force receiving portion 380*e*2, and therefore is parallel with the axis L383 which is perpendicular to the rotational force receiving portion 380*e*2. Therefore, when the coupling member 380 receives the force F5, the coupling member 380 moves in the direction of the arrow X62 along the guide portion 350*j*2 against the urging force F370 of the urging member 170 while keeping the contact between the portion-to-be-guided 380*j*2 and the guide portion 350*j*2 of the driving side flange 350. The free end portion 300*b* of the main assembly driving shaft 300 becomes spaced from the driving bearing surface 380*f* of the coupling member 380.

Here, the rotational force receiving portion 380*e*2 (and rotational force receiving portion 380*e*) is set such that the coupling member 380 can move in the direction of the axis L183 by the force F5. In this embodiment, the rotational force receiving portion 380*e*2 (and rotational force receiving portion 380*e*1) is the flat surface perpendicular to the axis L383, and therefore, the direction of the force F5 is parallel with the axis L383. Therefore, the user can move the cartridge B in the dismounting direction X12 with a small force, while moving the coupling member 380 in the axis L383 (and axis L381) relative to the driving side flange 350. By the movement of the coupling member 380 in the direction of the arrow X8 by the force F5, the transmission projection 380*f*2 is capable of passing by the drive transmission pin 302.

When the transmission projection 380*f*2 passes by the drive transmission pin 302, the free end portion 300*b* of the main assembly driving shaft 300 is brought into contact to the driving bearing surface 380*f* of the coupling member 380, again. When the cartridge B is moved to farther from this position in the direction of the dismounting direction X12, the coupling member 380 receives the force F6 from the free end portion 300*b* of the main assembly driving shaft 300, as shown in part (b3) of FIG. 81 and FIG. 82. The force F6 directed toward the center of the conical shape portion of the driving bearing surface 380*f*, and therefore, a component force F6*b* of the force F6 is produced in the direction of the axis L383. Therefore, the coupling member 380 moves in the direction of the arrow X62 while keeping contact between the portion-to-be-guided 380*j*2 and the guide portion 350*j*2 of the driving side flange 350 by the component force F6*b*, and the driving portion 380*b* contacts the cylindrical inner wall portion 350*r*2. By this, the movement of the coupling member 380 relative to the driving side flange 350 in the direction of the axis L383 is limited.

At this time, the component force F6*a* is produced along the arrow X8 in the direction of the axis L381. Therefore, when the cartridge B is moved further in the dismounting direction X12, the coupling member 380 is moved in the direction of the arrow X8 against the urging force F370 of the urging member 370 by the component force F6*a*. By this, as shown in part (b4) of FIG. 81, the free end portion 300*b* of the main assembly driving shaft 300 is disengaged from the opening 380*m* of the coupling member 380.

The position of the coupling member 380 shown in part (b4) of FIG. 81 is the second position (disengagement enabled position). The second position (disengageable position) is substantially the same as the above-described second position (retracted position). At this time, the rotational axis L381 of the coupling member 380 is substantially parallel with the rotational axis L1 of the photosensitive drum 10. More specifically, there is a gap between the rotational axis L381 and the rotational axis L1 (the rotational axis L381 and the rotational axis L1 are substantially out of alignment). The rotational axis L381 of the coupling member 380 is substantially parallel with the axis L351 of the driving side flange 350. More specifically, at this time, there is a gap between the rotational axis L381 and the rotational axis L351 (the rotational axis L381 and the rotational axis L1 are substantially out of alignment). In this second position, the coupling member 180 is displaced (moved/retracted) toward the photosensitive drum 10 (toward the other end portion side of the photosensitive drum 10 in the longitudinal direction) from the position in the first position.

As shown in part (a) of FIG. 83, the coupling member 380 spaced from the main assembly driving shaft 300 is moved in the direction opposite to the direction indicated by the arrow X62 while keeping the contact between the portion-to-be-guided 380*j*2 and the guide portion 350*j*2 of the driving side flange 350 by the urging force F370 of the urging member 370. As shown in part (b) of FIG. 83, the cartridge B returns to the initial state of the mounting at which the mounting to the main assembly A of the apparatus starts, that is, the transmission projections 380*f*1, 380*f*2 of the coupling member 380 returns to the state in which the projected most relative to the driving side flange 350 (first position (projected position)).

In summary, with the dismounting of the cartridge B from the main assembly A of the apparatus, the coupling member 380 is disengaged from the main assembly side engaging portion 300. In other words, with the removal of the cartridge B from the main assembly A of the apparatus, the coupling member 180 receives the force from the main assembly side engaging portion 300, so that the coupling member 380 moves from the first position to the second position, and thereafter, to the first position. Further in other words, with the dismounting of the cartridge B from the main assembly A of the apparatus, the coupling member 380 receives the forces from the main assembly side engaging portion 300 and the driving side flange 350 to displace (move) the first position (enabled-rotational-force-transmission-position) to the second position (disengagement enabled position).

Referring to part (a) of FIG. 84, the description will be made as to the case that the axis L383 of the coupling member 380 is perpendicular to the dismounting direction X12 of the cartridge B.

As shown in part (b1) of FIG. 84, in the state that the rotation of the main assembly driving shaft 300 has stopped after the completion of the image forming operation, the drive transmission pin 302 contacts the rotational force receiving portions 380*e*1 and 380*e*2. At this time, the free end portion 300*b* of the main assembly driving shaft 300 contacts the driving bearing surface 380*f* of the coupling member 380. This is the initial state of the dismounting.

Then, the cartridge B is moved in the dismounting direction X12. By this, the coupling member 380 move together with the driving side flange 350 in the dismounting direction X12 since the movement of the coupling member 380 relative to the driving side flange 350 in the direction of the axis L382 is limited. As shown in part (b2) of FIG. 84, the driving bearing surface 380*f* of the coupling member 380 as a retracting force receiving portion is urged by the force F9 (retraction force) from the free end portion 300*b* of the main assembly driving shaft 300 by the dismounting movement of the cartridge B. The force F9 is directed to the center of the conical shape of the driving shaft bearing 380*f*, and therefore, a component force F9*a* along the arrow X8 is produced in the direction of the axis L381. By the component force F9*a*, the coupling member 880 is moved in the direction of the arrow X8 against the urging force F170 of the urging member 170.

When the cartridge B is moved further in the dismounting direction X12, an inner surface 380*f*4 of the transmission projection 380*f*2 contacts the free end portion 300*b* of the main assembly driving shaft 300, and the coupling member 380 receives the force F10 from the free end portion 300*b* by the dismounting of the cartridge B, as shown in part (b3) of FIG. 84. The force F10 is directed toward the center of the spherical surface of the free end portion 300*b*, and therefore, a component force F10*a* is produced along the arrow X8 in the direction of the axis L381. When the cartridge B is moved further in the dismounting direction X12, the coupling member 380 further moves in the direction of the arrow X8 by the component force F10*a* against the urging force F370 of the urging member 370. As shown in part (b4) of FIG. 84, by the movement of the coupling member 380 in the direction of the arrow X8 by the component force F10*a*, the transmission projection 380*f*2 becomes capable of passing by the drive transmission pin 302. Thus, the free end portion 300*b* of the main assembly driving shaft 300 disengages from the opening 380*m* of the coupling member 380.

The coupling member 380 now spaced from the main assembly driving shaft 300 returns to the initial state of the mounting at which the cartridge B start to be mounted to the main assembly A of the apparatus, that is, the transmission projections 380*f*1, 380*f*2 of the coupling member 380 are most projected (part (b) of FIG. 83) relative to the driving side flange 350, similarly to the case that the dismounting direction (arrow X12) of the cartridge B is parallel with the axis L383 of the coupling member 380.

In the foregoing description, the dismounting direction X12 of the cartridge B is parallel with or perpendicular to the axis L183 of the coupling member 180. However, the coupling member 380 can be similarly removed from the main assembly side engaging portion 100 even when the dismounting direction is different from those described in the foregoing. In such a case, in the dismounting of the cartridge B, one of the transmission projections 380*f*1 and 380*f*2 contacts the drive transmission pin 302. Or, the free end portion 300*b* of the main assembly driving shaft 300 contacts the driving bearing surface 380*f* of the coupling member 380. In addition, one of the inner surface 380*f*3 (unshown) of the transmission projection 380*f*1 and the inner surface 380*f*4 of the transmission projection 380*f*2 contacts the free end portion 300*b* of the main assembly driving shaft 300. Then, the coupling member 380 receives one of the force F5, F6 and force F9, F10 by the dismounting movement to move in the direction of the arrow X8 relative to driving side flange 350, thus becoming capable of disengaging from the main assembly driving shaft 300.

In the dismounting of the cartridge B from the main assembly A of the apparatus, the cartridge B can be dismounted from the main assembly A of the apparatus, irrespective of the rotational phases of the coupling member 380 and the drive transmission pin 302 relative to the dismounting direction of the cartridge B from the main assembly A of the apparatus.

As described in the foregoing, in response to the dismounting operation of the cartridge B, the coupling member 380 can be disengaged in the state that the free end portion 300*b* of the main assembly driving shaft 300 is in the opening 380*m* of the coupling member 380. Therefore, the cartridge B can be dismounted in the direction substantially perpendicular to the rotational axis of the photosensitive drum 310.

According to the embodiment of the present invention, the coupling member 380 is movable relative to the driving side flange 350 in the direction of the axis L381 and in the direction of the axis L383. In addition, the coupling member 380 is movable relative to the driving side flange 350 in the direction of the axis L381 in interrelation with the movement in the axis L383 direction. By this, when the cartridge B is mounted to the main assembly A of the apparatus by moving the cartridge B in the direction substantially perpendicular to the rotational axis L1 of the photosensitive drum 310, the coupling member 380 move in the direction of the axis L381 to engage with the main assembly driving shaft 300. In addition, when the cartridge B is dismounted, from the main assembly A of the apparatus by moving the cartridge B in the direction substantially perpendicular to the rotational axis L1 of the photosensitive drum 310, the coupling member 380 move in the direction of the axis L381 to disengage from the main assembly driving shaft 300. Furthermore, when the cartridge B is dismounted from the main assembly A of the apparatus, it is unnecessary to rotate any of the photosensitive drum 310 and the main assembly driving shaft 300. Therefore, the dismounting load of the cartridge B is reduced, and the usability performance at the time of dismounting the cartridge B from the main assembly A of the apparatus is improved.

Figure 85:
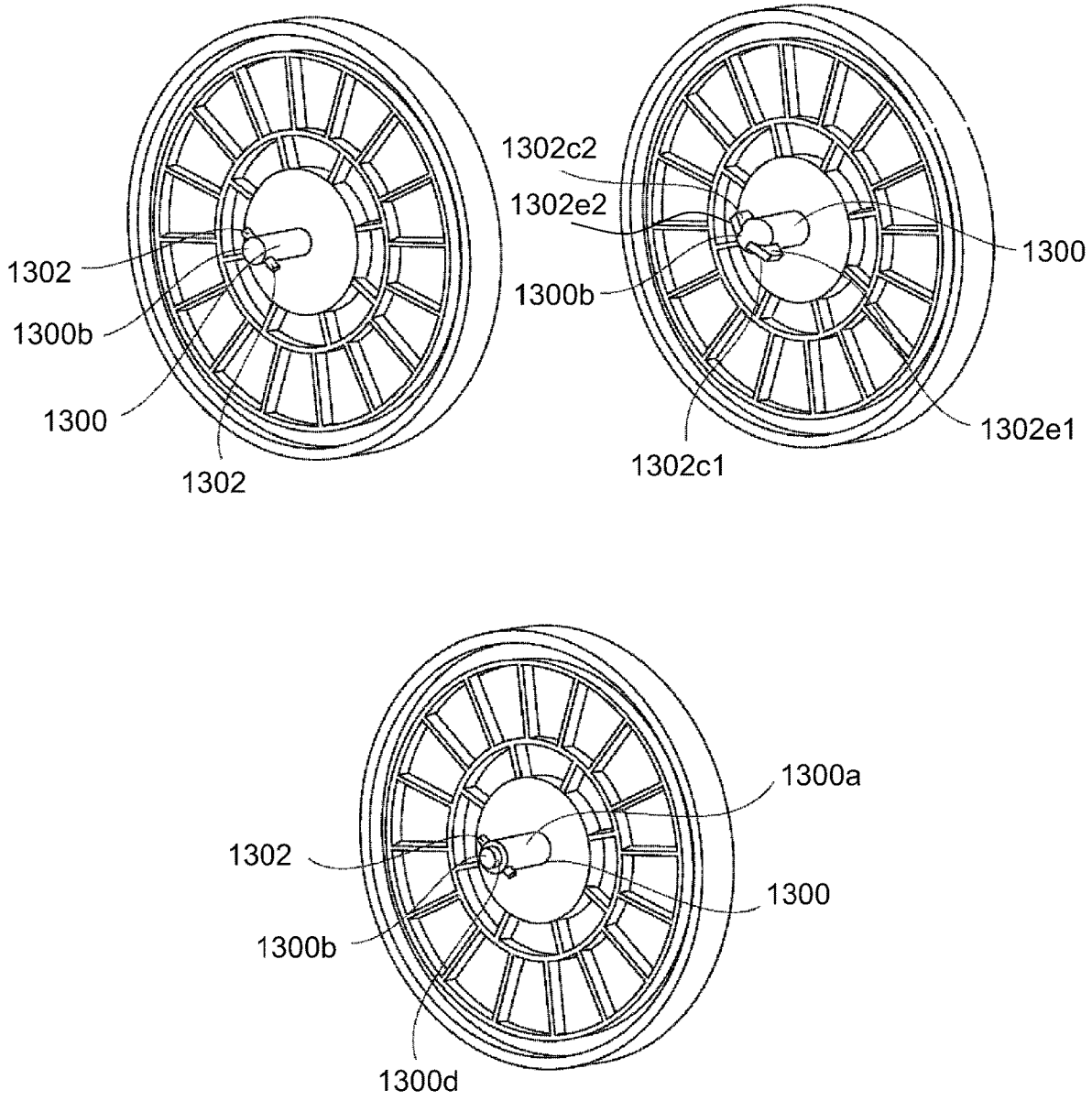
FIG. 85 is a perspective view of the main assembly driving shaft and a drum driving gear in the third embodiment of the present invention.

The configuration of the main assembly driving shaft is not limited to that described in the foregoing. Referring to FIG. 85, a modified example of the main assembly driving shaft will be described. FIG. 85 is a perspective view of the main assembly driving shaft and the drum driving gear.

As shown in part (a) of FIG. 85, a free end portion of a main assembly driving shaft 1300 may be a flat surface 1300*b*. By this, the configuration of the shaft is simple with the result that the manufacturing cost can be reduced, thus accomplishing cost reduction. In such a case, the main assembly driving shaft 1300 contacts the coupling member 380 at the flat surface 1300*b*, but the driving bearing surface 380*f* (FIG. 68) contacted by the flat surface 1300*b* has a conical shape. Therefore, by the movement of the cartridge B in the mounting and dismounting, the coupling member 380 receives a component force in the direction of the axis L381 from the main assembly driving shaft 1300, and therefore, the coupling member 380 can pass by the main assembly driving shaft 1300.

As shown in part (b) of FIG. 85, drive transmitting portions 1302*c*1 and 1302*c*2 for transmitting the driving force to the cartridge B may be formed into early with the main assembly driving shaft 1300, in which the drive transmission surfaces 1302*e*1 and 1302*e*2 are formed on the drive transmitting portions 1302*c*1 and 1302*c*2, respectively. By manufacturing the driving shaft from resin material, the drive transmitting portion can be molded integrally to accomplish the cost reduction.

As shown in part (c) of FIG. 85, in order to narrow the range of the free end portion 1300*b* of the main assembly driving shaft 1300, a shaft free end 1300*d* having a diameter smaller than the main part 1300*a* may be provided. As described hereinbefore, a certain degree of precision is required for the free end portion 1300*b* in order to determine the position of the coupling member 380. Therefore, in order to limit a precision required range to the contact portion of the coupling member 380 (driving bearing surface 380*f*, part (a) of FIG. 66), only the costly precision required surface may be made smaller, thus reducing the manufacturing cost.

Figure 86:
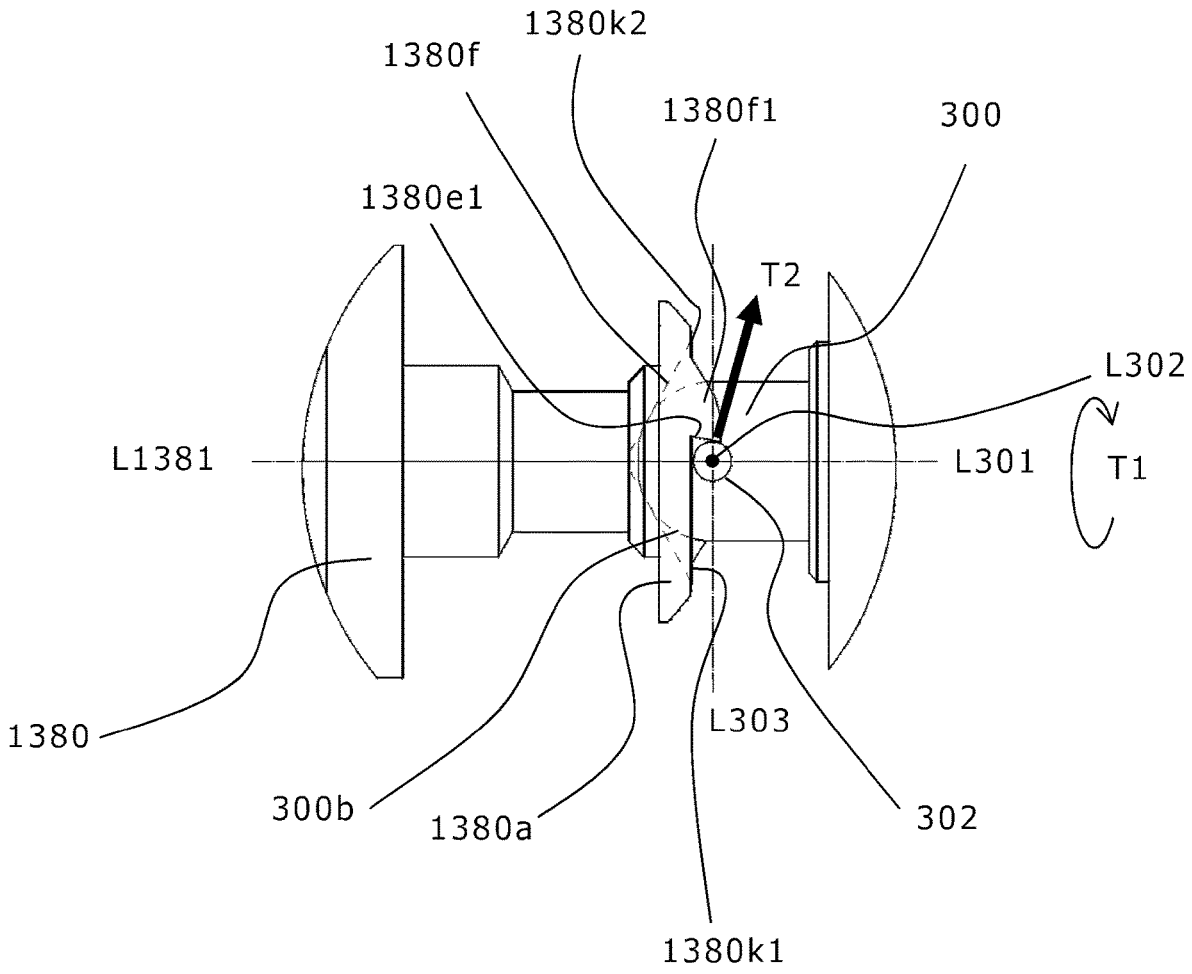
FIG. 86 is a modified example of the coupling member of the third embodiment of the present invention.

In this embodiment, the rotational force receiving portion of the coupling member is a flat surface perpendicular to the axis L383, but the present invention is not limited to such an example. Referring to FIG. 86, a modified example of the rotational force receiving portion will be described. FIG. 86 is a perspective view and a top plan view of the coupling member.

As shown in FIG. 86, rotational force receiving portions 1380*e*1 and 1380*e*2 of the transmission projections 1380*f*1 and 1380*f*2 of the coupling member 1380 is inclined by an angle α5 relative to rotational axis L1 of the photosensitive drum 310. That is, they are surfaces inclined relative to the axis L383. When the main assembly driving shaft 300 rotates in the direction indicated by an arrow T1, the rotational force receiving portions 1380*e*1, 1380*e*2 of the coupling member 1380 contact the drive transmission pin 302. Then, the coupling member 1380 receives a component force in the direction of the arrow T2. When the cartridge B is mounted to the main assembly A of the apparatus, a driving bearing surface 1380*f* of the coupling member 1380 contacts the free end portion 300*b* of the main assembly driving shaft 300 by the urging force F370 of the urging member 370 (part (b4) of FIG. 75). Therefore, by the coupling member 1380 receiving the force in the direction of the arrow T2, the contact between the driving bearing surface 1380*f* and the free end portion 300*b* is made stronger during the driving operation, and therefore, the engagement between the coupling member 1380 and the main assembly driving shaft 300 can be further stabilized.

Embodiment 4

Referring to FIG. 87 through FIG. 99, a fourth embodiment of the present invention will be described.

In the description of this embodiment, the same reference numerals as in Embodiment 1 are assigned to the elements having the corresponding functions in this embodiment, and the detailed description thereof is omitted for simplicity, and the structure and operation which are different from Embodiment 1 will be described. Also, similar parts names will be assigned. This applies to the other embodiments, too.

Similarly to the description of Embodiment 1, rotational axes of a driving side flange 450, of a coupling member 480 and of a main assembly side engaging portion 100 will be called axes. This applies to the other embodiments, too.

The mounting direction of the cartridge B to the main assembly A of the apparatus and the dismounting direction of the cartridge B from the main assembly A of the apparatus in this embodiment are similar to those of Embodiment 1, and this applies to the other embodiments, too.

Figure 87:
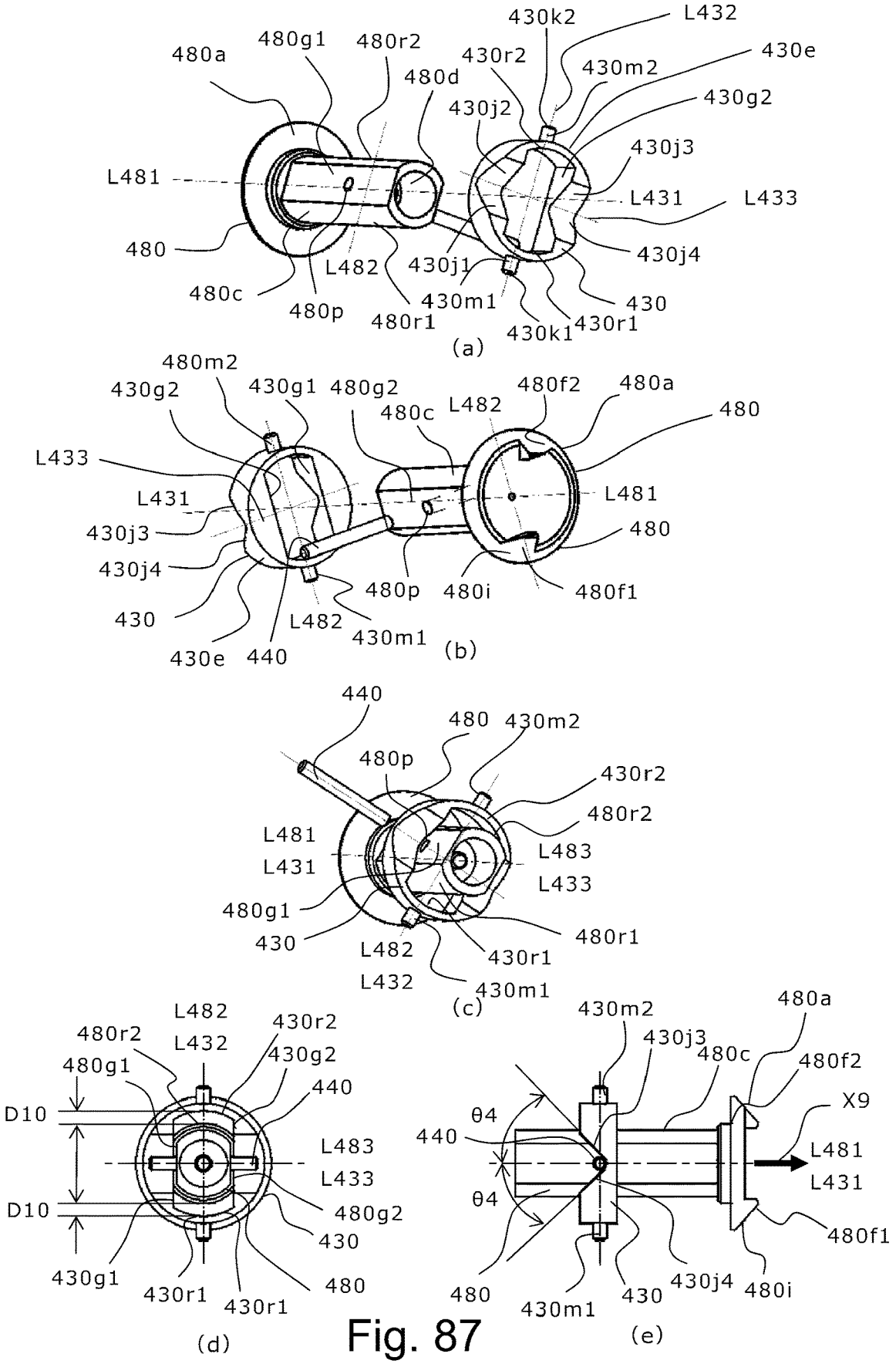
FIG. 87 is an exploded illustration of a coupling unit according to the fourth embodiment of the present invention.

Referring first to FIG. 87, the structure of a coupling unit U40 used in this embodiment will be described. As shown in FIG. 87, the coupling unit U40 comprises the coupling member 480, an intermediate slider 430 as an intermediate transmission member, and a guided pin (pin to be guided) 440.

The coupling member 480 will be described in detail. The rotational axis of the coupling member 480 is an axis L481, a direction perpendicular to the axis L481 is an axis L482, and a direction perpendicular to both of the axis L481 and the axis L442 is an axis L483.

Part (a)-part (c) of FIG. 87 are exploded perspective views of the coupling unit U40. Part (d)-part (e) of FIG. 87 illustrate the coupling unit U40, and part (d) of FIG. 87 is a view as seen in the direction of the axis L881, and part (e) of FIG. 87 is a view as seen in the direction of the axis L483. In part (e) of FIG. 87, a cylindrical inner wall portion 430*r*1 and a cylindrical inner wall portion 430*r*2 (which will be described hereinafter) of the slider 430 are detected by broken lines.

As shown in FIG. 87, the coupling member 480 mainly comprises three portions. A first portion is a driven portion 480*a* as an end portion (free end portion) engageable with the main assembly driving shaft 400 which will be described hereinafter to receive the rotational force from the drive transmission pin 302 which will be described hereinafter and which is a rotational force transmitting portion (main assembly side rotational force transmitting portion) provided on the main assembly driving shaft 300. A second portion is a driving portion 480*b* as the other end portion (supported portion) which functions to transmit a rotational driving force to the driving side flange 450 which will be described hereinafter through the intermediate slider 430 and which is supported by a slider 460 such that the coupling member 480 can move in the direction of the rotational axis L481. An interconnecting portion 480*c* connects the driving portion 480*b* and the driven portion 480*a* with each other. As shown in part (b) of FIG. 87, a driven portion 380*a* includes a driving shaft insertion opening 480*m* as the recess expanding from the rotational axis L481 of the coupling member 480. The opening 480*m* is provided by a conical driving bearing surface 480*f* expanding as approaching toward the main assembly driving shaft 300.

On the circumference of the end surface thereof, there is provided with transmission projections 480*f*1 and 480*f*2 projecting from the driving bearing surface 480*f* The outer peripheral surface of the driven portion 380*a* including the two transmission projections 480*f*1 and 480*f*2 is provided with a substantially spherical main assembly contact portion 480*i*. When the coupling member 480 is engaged with the main assembly driving shaft 300, and when the coupling member 480 is disengaged from the main assembly driving shaft 300, the main assembly contact portion 480*i* contacts the free end portion 300*b* and the drive transmission pin 302 of the main assembly driving shaft 300.

Between the transmission projections 480*f*1 and 480*f*2, there are provided drive receiving stand-by portion 480*k*1 and 480*k*2. A clearance between the two drive receiving projections 480*f*1 and 480*f*2 are larger than an outer diameter of the drive transmission pin so that the drive transmission pin 302 of the main assembly driving shaft 300 of the main assembly A of the apparatus which will be described hereinafter can be received by the clearance portion. The clearance portions are designated by 480*k*1 and 480*k*2.

In the positions downstream of the transmission projection 480*f*1 and 480*f*2 with respect to the clockwise direction, there are provided driving force receiving surfaces (rotational force receiving portions) 480*e*1 and 480*e*2, to which transmission pin 302 as the rotational force transmitting portion provided on the main assembly driving shaft 300 abuts to transmit the rotational force. That is, the driving force receiving surfaces 480*e*1 and 480*e*2 cross with the rotational moving direction of the coupling member 480 so that they are rotated about the axis L481 by being pushed by the side surfaces of the drive transmission pin 302 of the main assembly driving shaft 300.

When the interconnecting portion 480*c* is sectioned by a plane perpendicular to the axis L481, at least one cross-sections of the interconnecting portion 480*c* has a maximum rotational radius which is smaller than a distance between the rotational axis L481 of the coupling member 480 and the transmission projections 480*f*1 and 48012 (driving force receiving surfaces 480*e*1 and 480*e*2). In other words, a predetermined section of the interconnecting portion 480*c* perpendicular to the rotational axis L2 of the coupling member 4380 has a maximum rotational radius which is smaller than the distance between the transmission projections 480*f*1 and 480*f*2 (driving force receiving surfaces 480*e*1 and 480*e*2) and the rotational axis L2. Further in other words, the interconnecting portion 480*c* has a diameter which is smaller than the distance between the transmission projection 480*f*1 (driving force receiving surface 480*e*1) and the transmission projection 480*f*2 (driving force receiving surface 480*e*2).

As shown in FIG. 87, the round body (interconnecting portion 480*c* and driving portion 480*b*) comprises a cylindrical portion 480*r*1, a cylindrical portion 480*r*2, a first rotational force transmitting portion 480*g*1, a first rotational force transmitting portion 280*g*2 and a through hole 480*p*.

the through holes 480*p* are cylindrical and are provided in the first rotational force transmitting portion 480*g*1 and the first rotational force transmitting portion 480*g*2, and the central axes of the through holes 480*p* are parallel with the axis L483.

The first rotational force transmitting portion 480*g*1 and the first rotational force transmitting portion 480*g*2 are flat surfaces perpendicular to the axis L483, and the disposed at positions diametrically opposite from each other with respect to the axis L481, as seen in the direction of the axis L481. The cylindrical portion 480*r*1 and the cylindrical portion 480*r*2 are cylindrical, and the central axis thereof is the axis L481, and they are disposed at positions diametrically opposite from each other with respect to the axis L481, as seen in the direction of the axis L481.

An intermediate slider 430 as an intermediate transmission member will be described in detail. As shown in part (a) of FIG. 87, a rotational axis of the intermediate slider 430 is an axis L431, a direction perpendicular to the axis L431 is an axis L432, and a direction perpendicular to the axis L431 and the axis L432 is an axis L433.

The intermediate slider 430 mainly comprises a hollow portion 430*f*, an outer periphery portion 430*e* and first guide portions 430*j*1-430*j*4.

The outer periphery portion 430*e* is provided with a cylindrical projection 430*m*1 and a cylindrical projection 430*m*2 which extend in the direction of the axis L432 and which are provided with second rotational force transmitting portions 430*k*1 and 430*k*2 which will be described hereinafter.

The second rotational force transmitting portions 430*k*1, 430*k*2 are flat surfaces perpendicular to the axis L432 and are diametrically opposite from each other with respect to the axis L431. In addition, a round body 430*c*1 and a round body 430*c*2 have cylindrical shapes having the central axes aligned with the axis L431 and a disposed at positions diametrically opposite from each other with respect to the axis L431.

The hollow portion 430*f* is provided with a first rotational force receiving portion 430*g*1 and a first rotational force receiving portion 430*g*2 having flat surfaces perpendicular to the axis L433, and the cylindrical inner wall portion 430*r*1 and the cylindrical inner wall portion 430*r*2 having the cylindrical shape with the central axis thereof aligned with the axis L431. The cylindrical inner wall portion 430*r*1 and the cylindrical inner wall portion 430*r*2 are disposed at positions diametrically opposite from each other with respect to the axis L431, as seen in the direction of the axis L431.

As shown in part (e) of FIG. 87, the first guide portion 430*j*3 and the first guide portion 430*j*4 are inclined by an angle θ4 relative to the axis L431 as seen in the direction of the axis L433. The first guide portion 430*j*3 and the first guide portion 430*j*4 have symmetrical configurations with respect to the axis L431 as seen in the direction of the axis L433. As shown in part (a) of FIG. 87, the first guide portion 430*j*1 and the first guide portion 430*j*2 are disposed at positions diametrically opposite from the first guide portion 430*j*3 and the first guide portion 430*j*4 with respect to the axis L431, respectively.

As shown in part (c) of FIG. 87, cylindrical portions 480*r*1 and 480*r*2 and first rotational force transmitting portions 480*g*1 and 480*g*2 is disposed in the hollow portion 430*f* such that axis L483 of the coupling member 480 is parallel with the axis L433 of the intermediate slider 430. As shown in part (d) of FIG. 87, the first rotational force transmitting portions 480*g*1, 480*g*2 and the first rotational force receiving portions 430*g*1, 430*g*2 are engaged with each other with almost no gap in the axis L483. By this, the coupling member 480 is prevented from moving relative to the intermediate slider 430 in the direction of the axis L483. The intermediate slider 430 is prevented from rotating relative to the coupling member 480 in the direction of the axis L431. That is, a rotational force is transmitted from the coupling member 280 to the intermediate slider 230 through the engagement between the first rotational force transmitting portion 480*g*1 and the first rotational force transmitting portion 480*g*2 and the first rotational force receiving portion 430*g*1 and the first rotational force receiving portion 430*g*2.

The cylindrical portion 480*r*1, the cylindrical portion 480*r*2, the cylindrical inner wall portion 430*r*1 and the cylindrical inner wall portion 430*r*2 are provided such that when the axis L481 of the coupling member 480 is substantially coaxial with the axis L431 in the hollow portion 430*f*, gaps D10 are provided between the cylindrical portion 480*r*1 and the cylindrical inner wall portion 430*r*1 and between the cylindrical portion 480*r*2 and the cylindrical inner wall portion 430*r*2, respectively. By this, the coupling member 480 is movable relative to the intermediate slider 430 in the direction of the axis L482.

As shown in part (c) of FIG. 87 and part (e) of FIG. 87, the cylindrical guided pin 440 is inserted into a through hole 430*p* of the coupling member 430. As will be described hereinafter, when the coupling member 480 is urged by an urging member 470 toward the driving side (arrow X9), first guide portions 430*j*1-430*j*4 contact the guided pin 440. By this, the coupling member 480 is prevented from disengaging from the intermediate slider 430 toward the driving side, and the axis L481 substantially coaxial with the axis L431.

Figure 88:
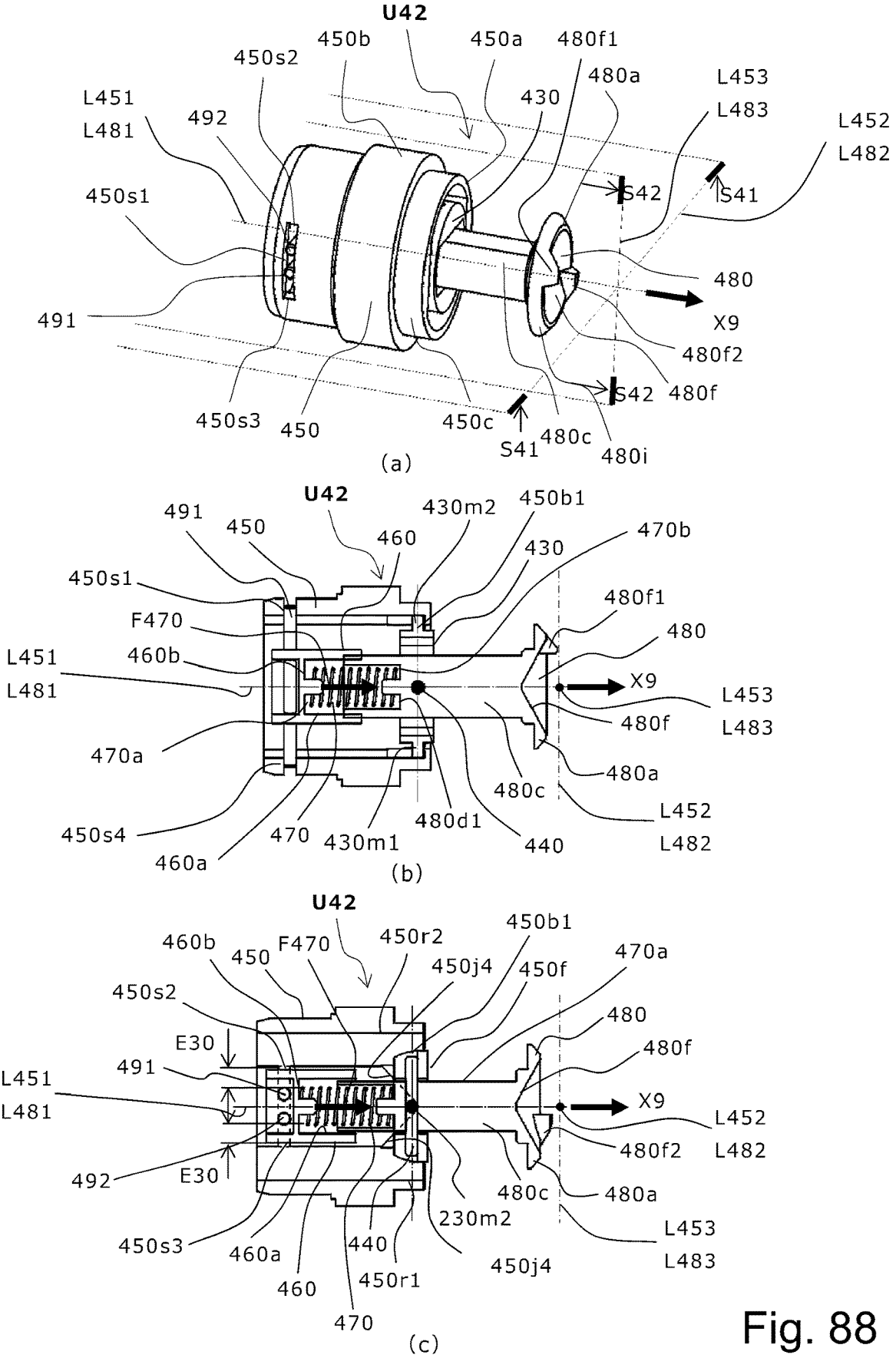
FIG. 88 is a schematic perspective view and a schematic sectional view of a photosensitive member unit according to the fourth embodiment of the present invention.
Figure 89:
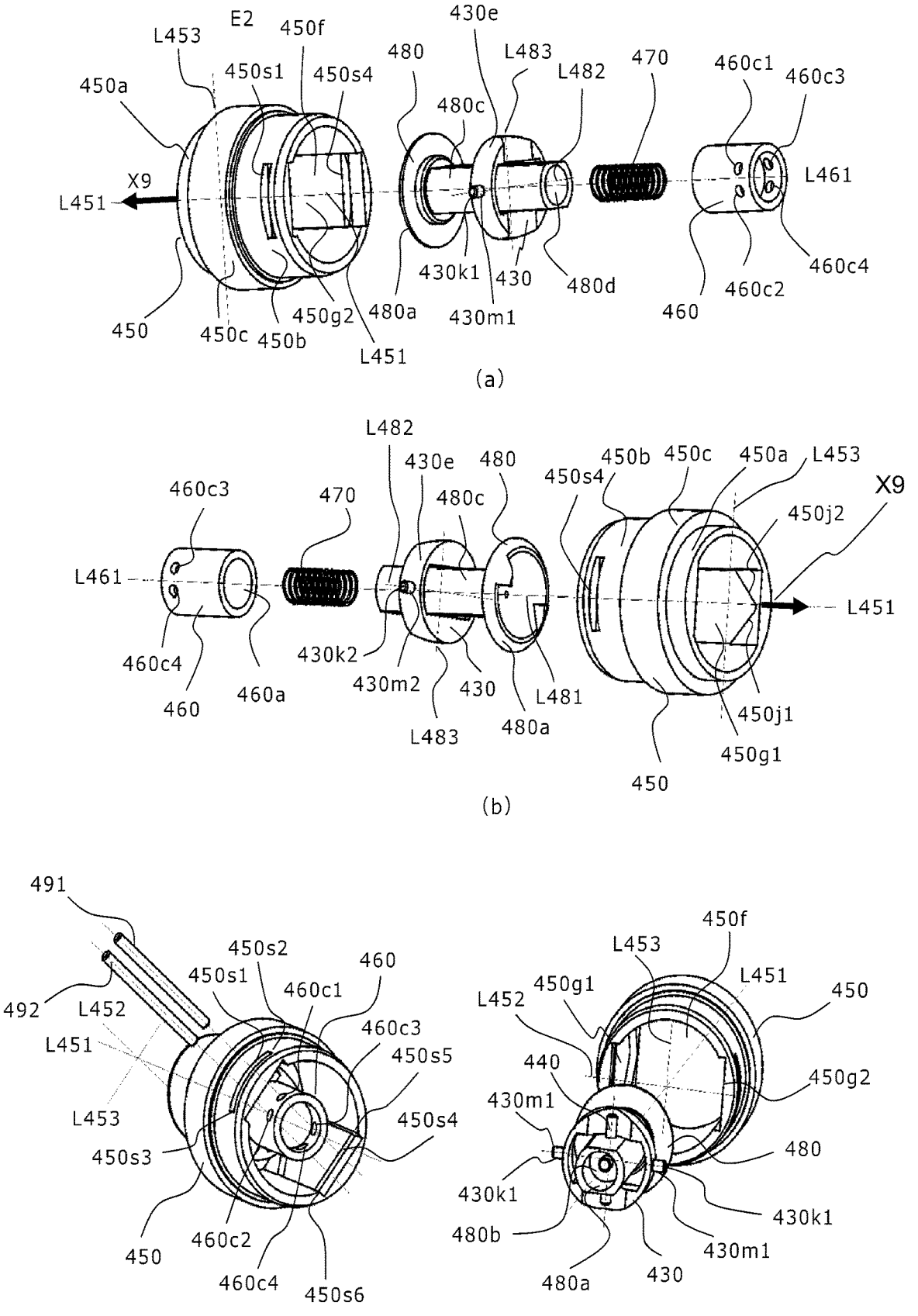
FIG. 89 is an exploded schematic perspective view of a driving side flange unit in the fourth embodiment of the present invention.

FIGS. 88 and 89, the structure of a driving side flange unit U42 used in this embodiment will be described. Part (a) of FIG. 88 is a schematic perspective view of a photosensitive drum unit U41 as a photosensitive member unit to which the driving side flange unit U42 is mounted, as seen from the driving side. Part (b) of FIG. 88 is a schematic sectional view taken along a line S41 in part (a) of FIG. 88, and part (c) of FIG. 88 is a schematic sectional view taken along a line S42 in part (a) of FIG. 88. FIG. 89 is an exploded perspective view of the driving side flange unit U42. In part (c) of FIG. 88, second guide portions 450*j*1, 450*j*2 and a slide groove 450*s*1 are depicted by broken lines for better illustration.

As shown in FIG. 88, the driving side flange unit U42 comprises the driving side flange 450, the coupling unit U40, a retention pins 491 492, the urging member 470 and a slider 460.

Referring first to FIG. 89, the driving side flange 450 will be described in detail. The rotational axis of the driving side flange is an axis L451, a direction perpendicular to the axis L451 is axis L452, and a direction perpendicular to both of the axis L451 and the axis L452 is axis L453.

The driving side flange 450 is provided with an engagement supporting portion 450*b*, a gear portion 450*c* and a supporting portion 450*d* and so on. The inside of the driving side flange 450 is hollow and will be called a hollow portion 450*f*.

The hollow portion 450*f* is provided with second rotational force receiving portions 450*g*1 and 450*g*2 having flat surfaces perpendicular to the axes L452, a cylindrical inner wall portion 450*r* having a cylindrical shape with a central axis aligned with the L451, and second guide portions 450*j*1-450*j*4.

As shown in part (c) of FIG. 88, the second guide portions 450*j*1, 450*j*2 are inclined relative to an axis L251 by an angle θ5 as seen in the direction of the axis L452. The second guide portions 450*j*1, 450*j*2 have symmetrical configurations with respect to the axis L451 as seen in the direction of the axis L452. The second guide portions 450*j*3, 450*j*4 are provided diametrically opposite from the second guide portions 450*j*1, 450*j*2 with respect to the axis L451, respectively.

The cylindrical inner wall portion 450*r* is provided with the slide groove 450*s*1 and the slide groove 450*s*4. As will be described hereinafter, the slide groove 450*s*1 and the slide groove 450*s*4 are through holes for supporting the retention pins 491, 492 and have rectangular-shapes with long sides along the axis L453, as seen in the direction of the axis L452.

As shown in FIGS. 88 and 89, the coupling unit U40 is disposed in the hollow portion 450*f* of the driving side flange 450 such that the axis L482 is parallel with the axis L452. The second rotational force transmitting portions 430*k*1, 430*k*2 of the intermediate slider 430 and the second rotational force receiving portions 450*g*1, 450*g*2 are engaged with each other with almost no gap in the direction of the axis L482. By this, the coupling unit U40 is prevented from moving relative to the driving side flange 450 in the direction of the axis L482 (part (d) of FIG. 89). The intermediate slider 430 is prevented from rotating relative to the driving side flange 450 about the axis L451. That is, the rotational force is transmitted from the intermediate slider 430 to the flange 450 through engagement between the second rotational force transmitting portion 430*k*1 and the second rotational force receiving portion 450*g*1 and between the second rotational force transmitting portion 430*k*2 and the second rotational force receiving portion 450*g*2.

As shown in part (c) of FIG. 88, the round body 430*c*1, the round body 430*c*2 and the cylindrical inner wall portion 450*r* are provided such that when the axis L481 of the coupling unit U40 is substantially coaxial with the axis L451 in the hollow portion 450*f*, gaps D20 are provided between the round body 430*c*1 and the cylindrical inner wall portion 450*r* and between the round body 430*c*2 and the cylindrical inner wall portion 450*r*. By this, the coupling unit U40 is movable relative to the driving side flange 450 in the direction of the axis L483. As will be described hereinafter, when the intermediate slider 430 is urged toward the driving side (arrow X9) by the urging member 470 through the coupling member 480, the cylindrical projection 430*m*1 and the cylindrical projection 430*m*2 contact the second guide portion 450*j*1—the second guide portion 450*j*4. By this, the intermediate slider 430 is prevented from disengaging from the driving side flange 450 toward the driving side, and the axis L431 is substantially coaxial with the axis L451.

As shown in FIG. 88, the slider 460 as the holding member (movable member) is provided with a cylindrical portion 460*a* engaged with the cylindrical portions 480*r*1, 480*r*2 of the coupling member 480, a contact portion 460*b* contacted by one end portion 470*a* of the urging member 470, and through holes 460*c*1-460*c*4 penetrated by retention pins 491, 492. The central axis of the cylindrical portion 460*a* is an axis L461.

The cylindrical portion 460*a* engages with the cylindrical portion 480*r*1 and the cylindrical portion 480*r*2 of the coupling member 480 with almost no gap to support them. By this, the coupling member 480 is movable in the direction of the axis L481 while keeping the axis L481 and the axis L461 coaxial with each other.

As shown in part (c) of FIG. 89, the cylindrical retention pins 491, 492 are inserted into the through holes 460*c*1-460*c*4 with almost no gap in the diametrical direction such that the central axes are parallel with the axis L452 of the driving side flange 450. By the retention pins 491, 492 supported by the slide grooves 450*s*1, 450*s*4 of the driving side flange 450, the slider 460 and the driving side flange 450 are connected with each other.

As shown in part (c) of FIG. 88, the retention pins 491, 492 are juxtaposed in the direction of the axis L453. In addition, the diameters of the retention pins 491, 492 are slightly smaller than a width of the slide groove 450*s*1, 450*s*4 measured in the direction of the axis L451. By this, the slider 460 keeps the parallelism between the axis L461 and the axis L451. In addition, the slider 460 is prevented from the movement relative to the driving side flange 450 in the direction of the axis L451. In other words, the slider 260 is movable in the direction substantially perpendicular to the axis L451.

As shown in part (b) of FIG. 88, the retention pins 491, 492 are prevented from disengaging in the direction of the axis L452 by the opening 310*a*2 (FIG. 65) of the photosensitive drum 310. In addition, a length G4 of the retention pins 491, 492 is larger than a diameter cpG5 of the cylindrical inner wall portion 450*r*. By this, the retention pins 491, 492 are prevented from dislodging from the slide grooves 4250*s*1, 450*s*4.

In addition, between the retention pin 491 and one end portion of 450*s*2 of the slide groove 450*s*1 and between the retention pin 492 and the other end portion of 450*s*3 of the slide groove 450*s*1, gaps E30 larger than the gap D20 is provided (part (c) of FIG. 88). Between the retention pin 491 and the one end portion 450*s*5 of the slide groove 450*s*4 and between the retention pin 492 and the other end portion 450*s*6 of the slide groove 450*s*4, the gaps similar to the gap E30 are provided. Additionally, lubricant (unshown) is applied to the through holes 460*c*1-460*c*4 and the slide grooves 450*s*1, 450*s*4. By this, the slider 460 is smoothly movable relative to the driving side flange 450 in the direction of the axis L453.

Therefore, the slider 460 is movable relative to the driving side flange 450 in the directions of the axis L452 and the axis L453 and in a direction provided by sum of vectors of these directions (that is, any direction perpendicular to the axis L451), while keeping the parallelism between the axis L461 and the axis L451. In other words, the slider 460 is movable substantially in the direction perpendicular to the axis L451. In addition, the slider 460 is prevented from moving relative to the driving side flange 450 in the direction of the axis L451.

As shown in part (b) of FIG. 88, the one end portion 2470*a* of the urging member 470 contacts a spring contact portion 460*b* of the slider 460, and a other end portion 470*b* contacts a spring contact portion 480*d*1 of the coupling member 480. The urging member 470 is compressed between the coupling member 480 and the slider 460 to urge the coupling member 480 toward the driving side (arrow X9). As shown in part (e) of FIG. 87, the urging member 470 also urges the intermediate slider 430 toward the driving side (arrow X9), through the contact between the guided pin 440 mounted on the coupling member 480 and the first guide portion 430*j*1—first guide portion 430*j*4.

With the above-described structures, the coupling member 480 keeps the state relative to the driving side flange 450 through the slider 460 such that the axis L481 and the axis L451 are parallel with each other. The intermediate slider 430 does not rotated relative to the coupling member 480 about the axis L432, and does not rotate relative to the driving side flange 450 about the axis L433. Therefore, the intermediate slider 430 keeps relative to the coupling member 480 and the driving side flange 450 such that the axis L431 is parallel with the axis L481 and the axis L451.

Additionally, the coupling member 480 is movable relative to the intermediate slider 430 in the direction of the axis L482. In addition, the intermediate slider 430 is movable relative to the driving side flange 450 in the direction of the axis L433. In other words, as seen in the direction of the axis L451, the moving direction of the coupling member 480 relative to the intermediate slider 430 and the moving direction of the intermediate slider 430 relative to the driving side flange 450 are substantially crossing with each other (more particularly, substantially perpendicular to each other). Therefore, the coupling member 480 is movable relative to the driving side flange 450 in the direction of the axis L482, the direction of the axis L433 and in a direction provided by sum of vectors of these directions (that is, any direction perpendicular to the axis L481).

Furthermore, by the urging of the urging member 470, the axis L481 of the coupling member 480 becomes substantially coaxial with the axis L431 of the intermediate slider 430, and the axis L431 becomes substantially coaxial with the axis L451 of the driving side flange 450. Therefore, the coupling member 480 is urged by the urging member 470 relative to the driving side flange 450 such that the axis L481 and the axis L451 are substantially coaxial with each other.

Figure 90:
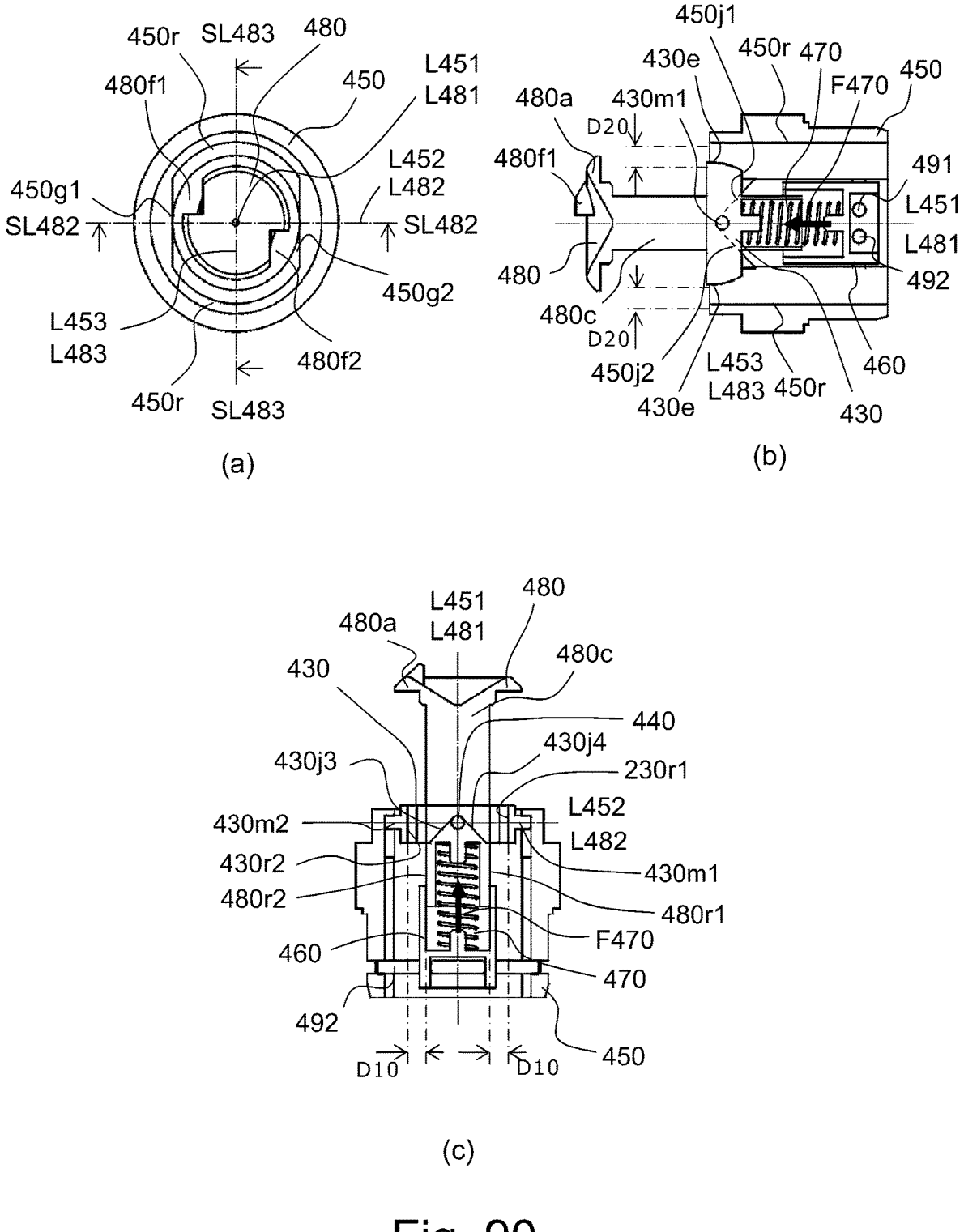
FIG. 90 is an illustration of operations of the coupling member and the coupling unit in the fourth embodiment of the present invention.
Figure 91:
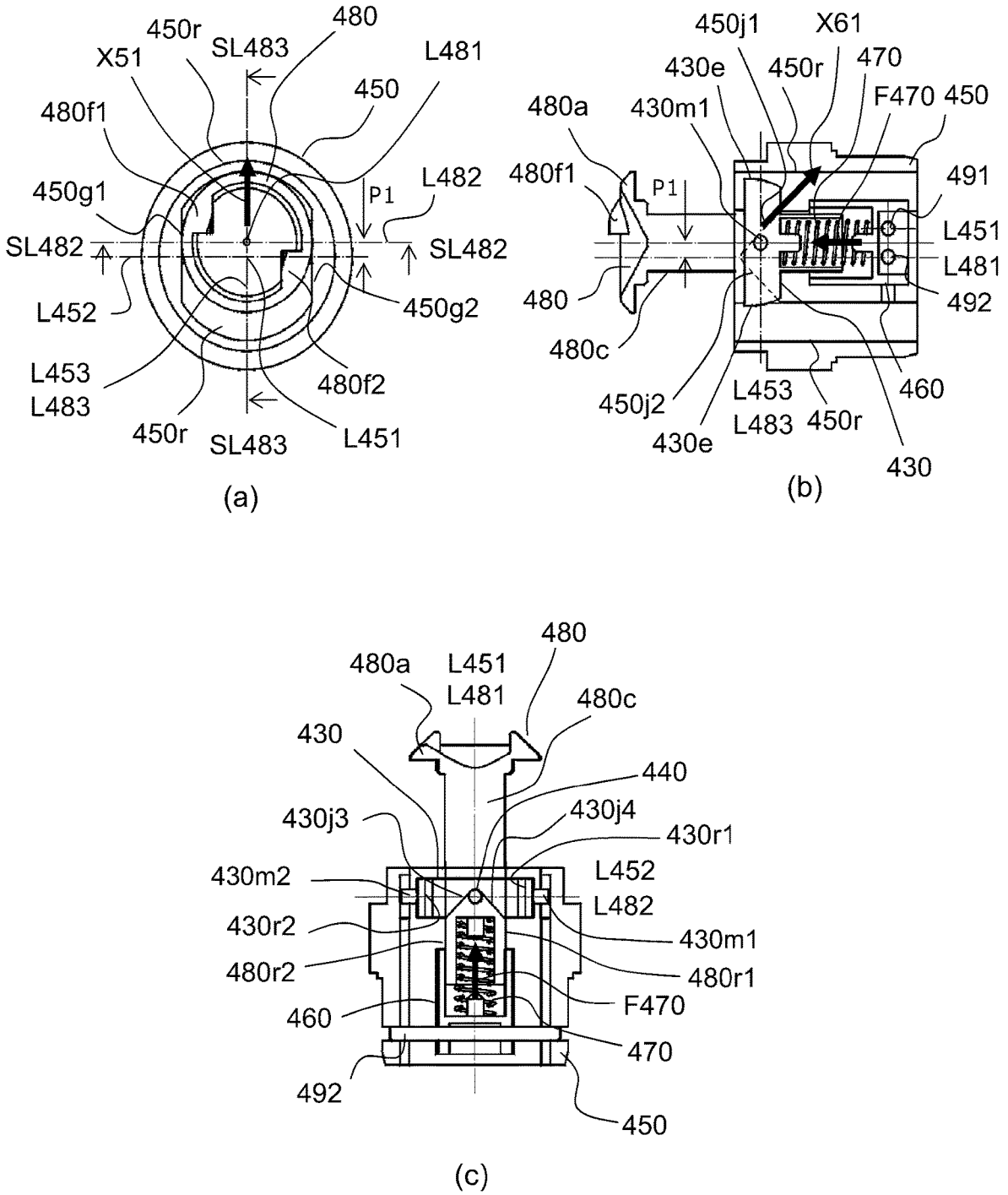
FIG. 91 is an illustration of operations of the coupling member and the coupling unit in the fourth embodiment of the present invention.
Figure 92:
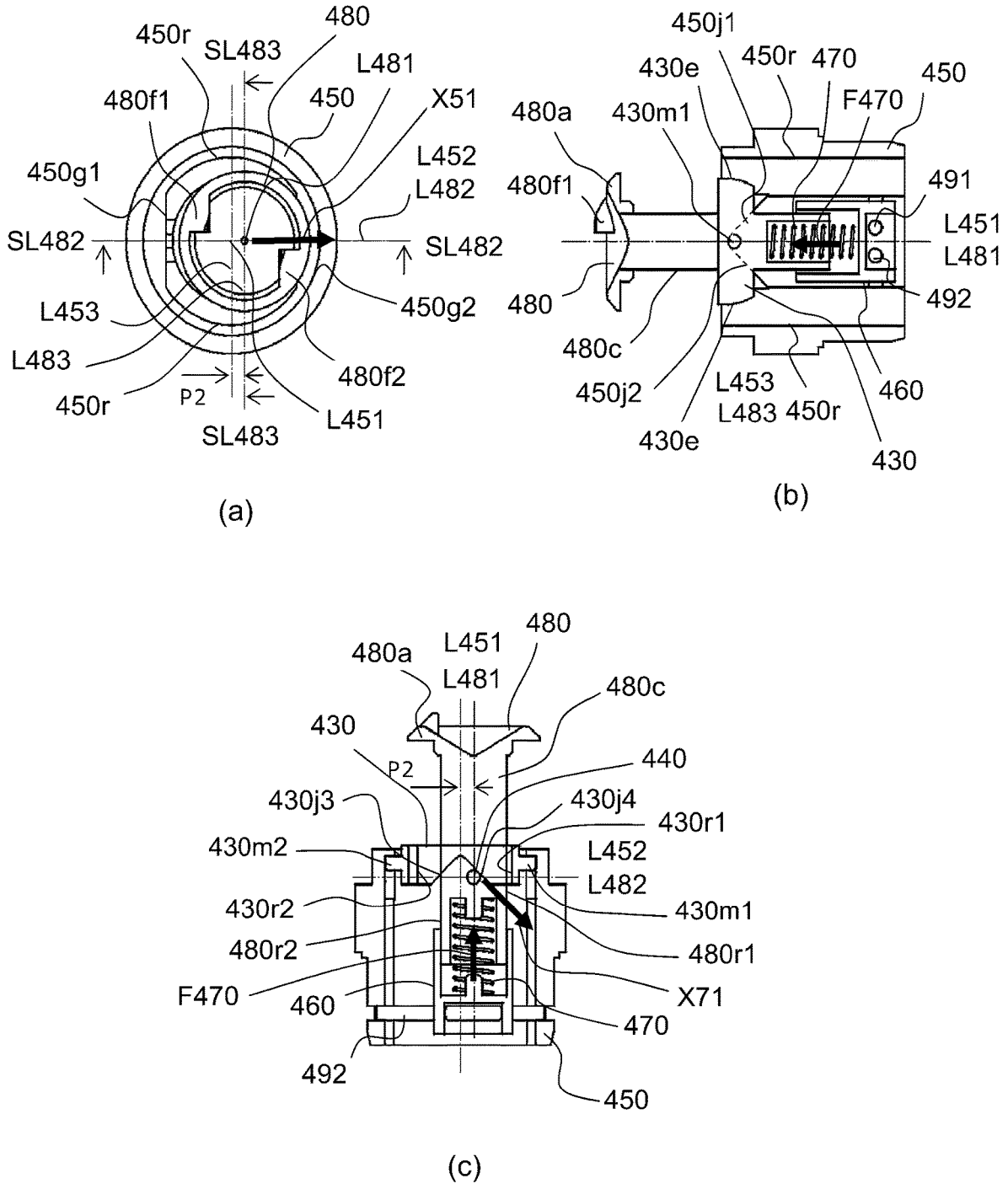
FIG. 92 is an illustration of operations of the coupling member and the coupling unit in the fourth embodiment of the present invention.

Referring to FIG. 90 through FIG. 93, the operation of the coupling member 480 will be described. FIG. 90 shows the state in which the axis L481 of the coupling member 480 is coaxial with the axis L451 of the driving side flange 450. Part (a) of FIG. 90 is a view as seen from the driving side, part (b) of FIG. 90 and part (c) of FIG. 90 are sectional views taken along a line SL483 parallel with the axis L483 and a line SL482 parallel with the axis L482 of part (a) of FIG. 90, respectively. The lines along which the sectional views are taken apply to FIG. 91 through FIG. 93. FIG. 91 shows the state in which the coupling member 480 has been moved relative to the driving side flange 450 in the direction of an arrow X51 parallel with the axis L483. FIG. 92 shows the state in which the coupling member 480 has been moved relative to the driving side flange 450 in the direction of an arrow X41 parallel with the axis L482. FIG. 94 is a view in which the coupling member 480 has been moved by a distance p in a direction of an arrow X45 which is in the direction provided by a sum of the vectors of the arrow X41 and the arrow X51.

First, as shown in FIG. 90, by the urging force F470 of the urging member 470, the first guide portions 430*j*3, 430*j*4 contact the guided pin 440, and the second guide portions 450*j*1, 450*j*2 contact the cylindrical projection 430*m*1. Here, as shown in part (c) of FIG. 90, by the contact between the first guide portions 430*j*3, 430*j*4 and the guided pin 440, the axis L481 and the axis L431 become substantially coaxial with each other, and saying in the direction of the axis L482. On the other hand, as shown in part (b) of FIG. 90, by the contact between the second guide portions 450*j*1, 450*j*2 and the cylindrical projection 430*m*1, the axis L431 and the axis L451 become substantially coaxial with each other, as seen in the direction of the axis L483. Therefore, by the urging force F470 of the urging member 470 to the coupling member 480, the axis L481 and the axis L451 become substantially coaxial with each other.

Then, as shown in part (a) of FIG. 91, the coupling member 480 is moved relative to the driving side flange 450 in the direction of the arrow X51 parallel with the axis L483. Then, as shown in part (b) of FIG. 91, the coupling unit U40 is moved in the direction on the second guide portion 450*j*1 (arrow X61) by the contact between the cylindrical projection 430*m*1 as an inclined portion or contact portion of the intermediate slider 430 and the second guide portion 450*j*1 as an inclined portion or contact portion of the driving side flange 450. At this time, the coupling unit U40 keeps the state in which the axis L481 is parallel with the axis L451. Therefore, the coupling unit U40 is movable in the direction of the arrow X61 until the round body 430*c*1 of the intermediate slider 430 abuts to the cylindrical inner wall portion 450*r*, that is, until the movement distance p1 thereof in the direction of the axis L483 becomes equal to the gap D20. On the other hand, the slider 460 is prevented from moving in the direction of the axis L451, by the retention pin 491 and 292. Therefore, in interrelation with the movement of the coupling unit U40 in the direction of the arrow X61, the slider 460 moves together with the retention pins 491, 492 along the slide groove 450*s*1 and the slide groove 450*s*4, in the direction of the arrow X51.

When the coupling member 480 is moved in the direction opposite from the arrow X51, the coupling member 480 move along the second guide portion 450*j*2, similarly.

On the hand, as shown in part (a) of FIG. 92, the coupling member 480 is moved relative to the driving side flange 450 in the direction of the arrow X41 parallel with the axis L482. Then, as shown in part (c) of FIG. 92, the coupling member 480 is moved in the direction along the first guide portion 430*j*4 (arrow X71) by the contact between the guided pin 440 as the inclined portion or contact portion and the first guide portion 430*j*4 as the inclined portion or contact portion of the intermediate slider 430. At this time, the coupling member 480 is such that the parallelism between the axis L481 and the axis L431. Therefore, the coupling member 480 is movable in the direction of the arrow X71 until the cylindrical portion 480*r*1 abuts to the cylindrical inner wall portion 430*r*1 of the intermediate slider 230, that is, the movement distance p2 of the coupling portion 480 in the direction of the axis L482 becomes equal to the gap D10. On the other hand, the slider 460 is prevented from moving in the direction of the axis L451, by the retention pin 491 and the retention pin 492. Therefore, in interrelation with the movement of the coupling member 480 in the direction of the arrow X71, the slider 460 moves in the direction of the arrow X41 along the central axis of the retention pin 491 and the retention pin 492.

When the coupling member 480 is moved in the direction opposite to that of the arrow X41, the coupling member 480 move along the first guide portion 430*j*3, similarly.

Figure 93:
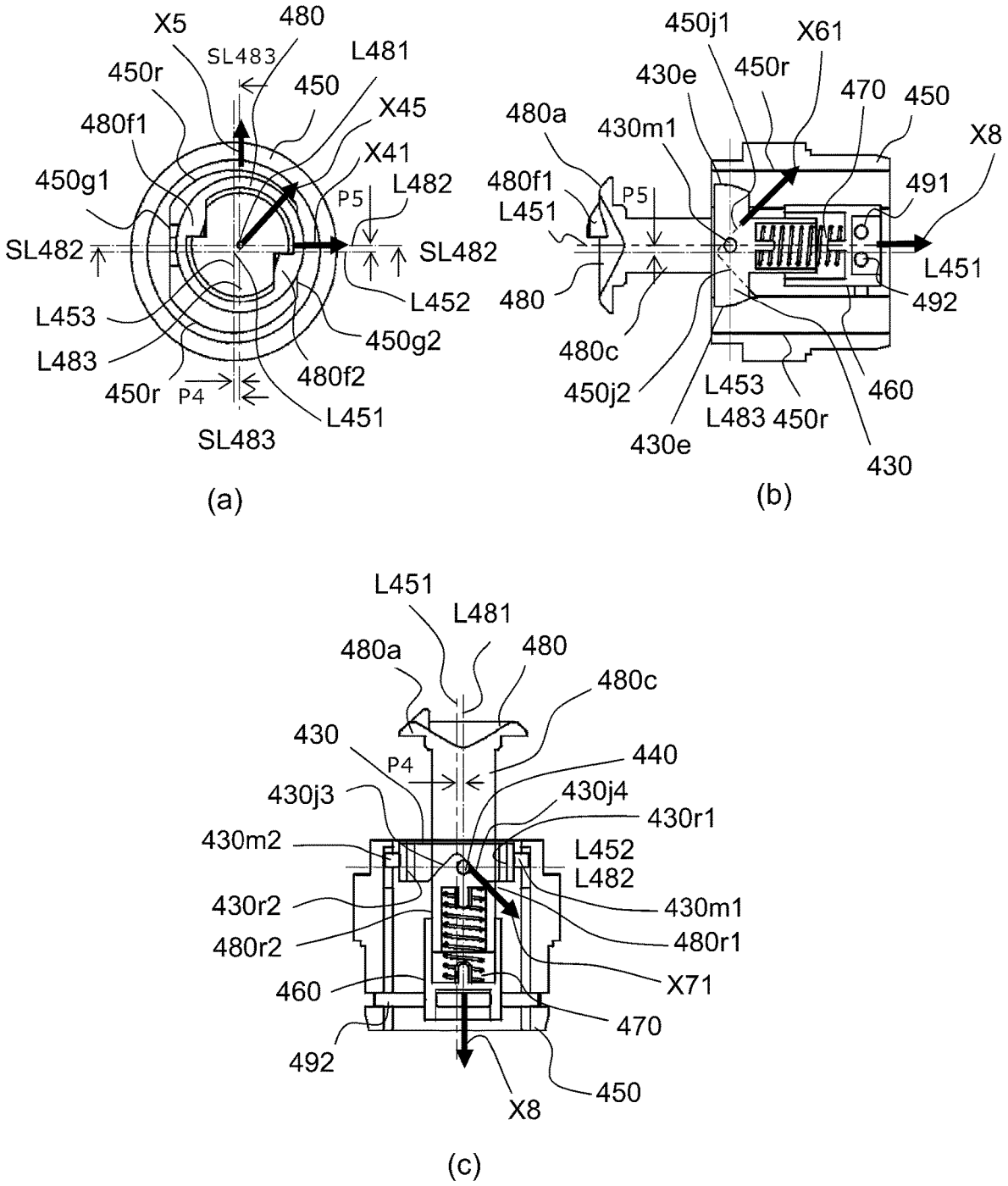
FIG. 93 is an illustration of operations of the coupling member and the coupling unit in the fourth embodiment of the present invention.
Figure 94:
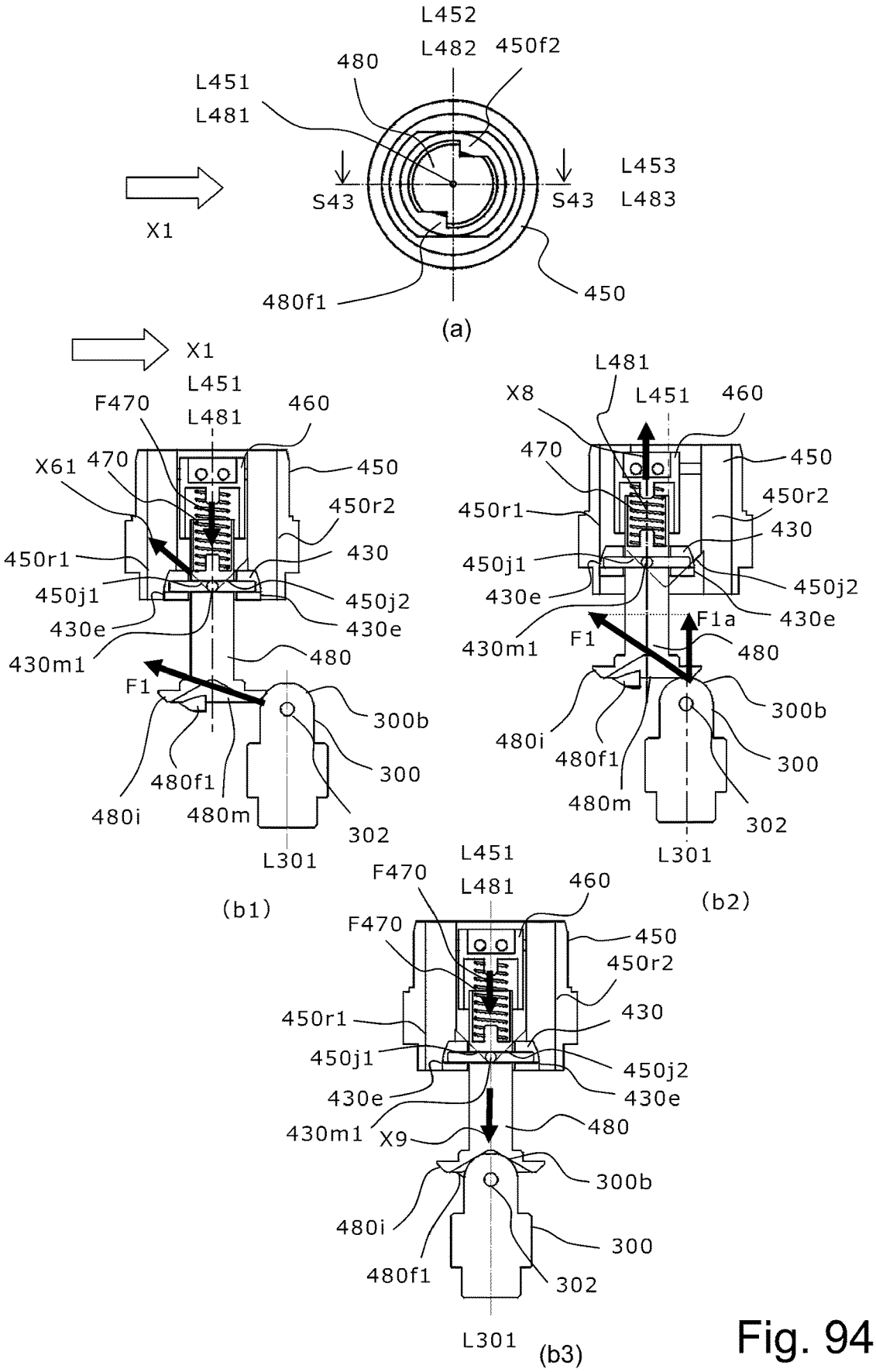
FIG. 94 is an illustration of an operation state at the time of engagement between the coupling member and the main assembly side engaging portion in the fourth embodiment of the present invention.

Furthermore, as shown in part (a) of FIG. 93, the coupling member 480 is moved relative to the driving side flange 450 in the direction of the arrow X45 by the distance p. A component of the distance p in the direction of the axis L482 is p4, and the component thereof in the direction of the axis L483 is p5. Then, the coupling member 480 moves relative to the intermediate slider 430 in the direction of the axis L482 by the distance p4. Simultaneously, the coupling member 480 and the intermediate slider 430 move relative to the driving side flange in the direction of the axis L483 by the distance p5. With the movement of the coupling member 480 relative to the intermediate slider 430, the coupling member 480 moves along the first guide portion 430*j*4 by the distance p41, and moves relative to the intermediate slider 430 in the direction of the arrow X8 (part (c) of FIG. 93). Simultaneously, with the movement of the intermediate slider 430 relative to the driving side flange 450, the intermediate slider 430 and the coupling member 480 move along the second guide portion 450*j*1 by the distance p51, and moves relative to the driving side flange 450 in the direction of the arrow X8 (part (b) of FIG. 93). Therefore, with movement of the coupling member 480 in the direction of the arrow X45 by the distance p, it moves in the direction of the arrow X8 by the distance p41+p51.

The structure for the movement of the coupling member 480 in the direction of the arrow X8 is similar to that of Embodiment 3, and therefore, the description is omitted.

As described in the foregoing, the coupling member 480 is movable relative to the driving side flange 450 in the direction of the axis L481, the direction of the axis L483 and the direction of the axis L482. In addition, the coupling member 480 is movable relative to the driving side flange 450 in the direction of the axis L481 in interrelation with the movement in the direction of the axis L483, the direction of the axis L482 and the direction provided by sum of the vectors of these directions, that is, any direction perpendicular to the axis L481.

Figure 95:
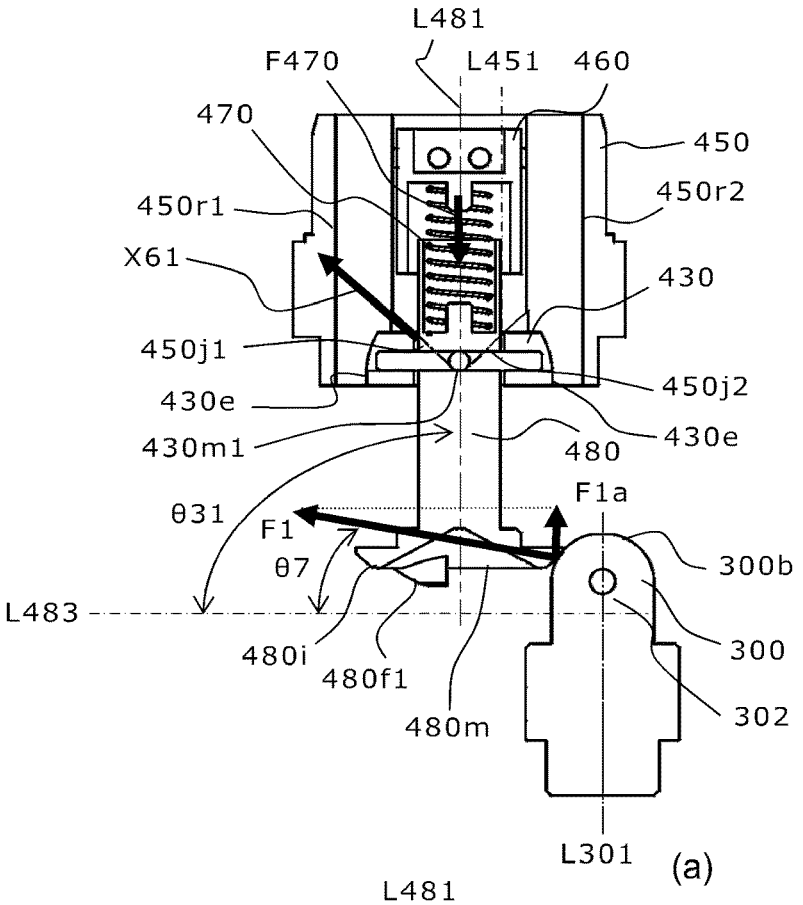
FIG. 95 is an enlarged illustration of an operation state at the time when the coupling member is engaged with the main assembly side engaging portion in the fourth embodiment of the present invention.
Figure 95:
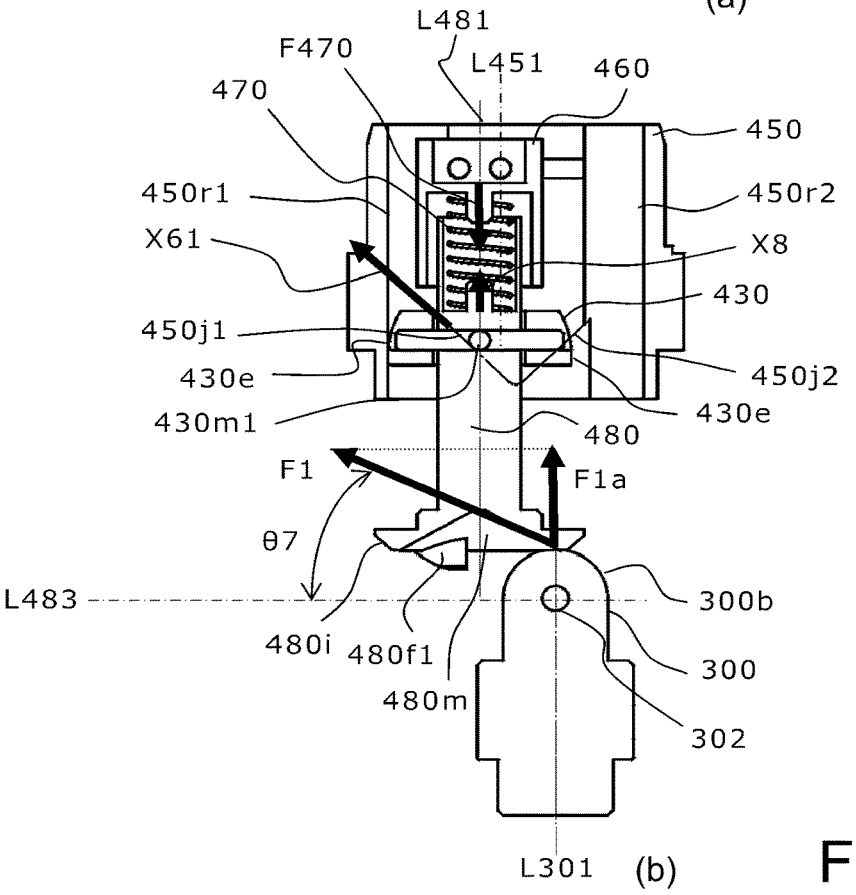
Figure 96:
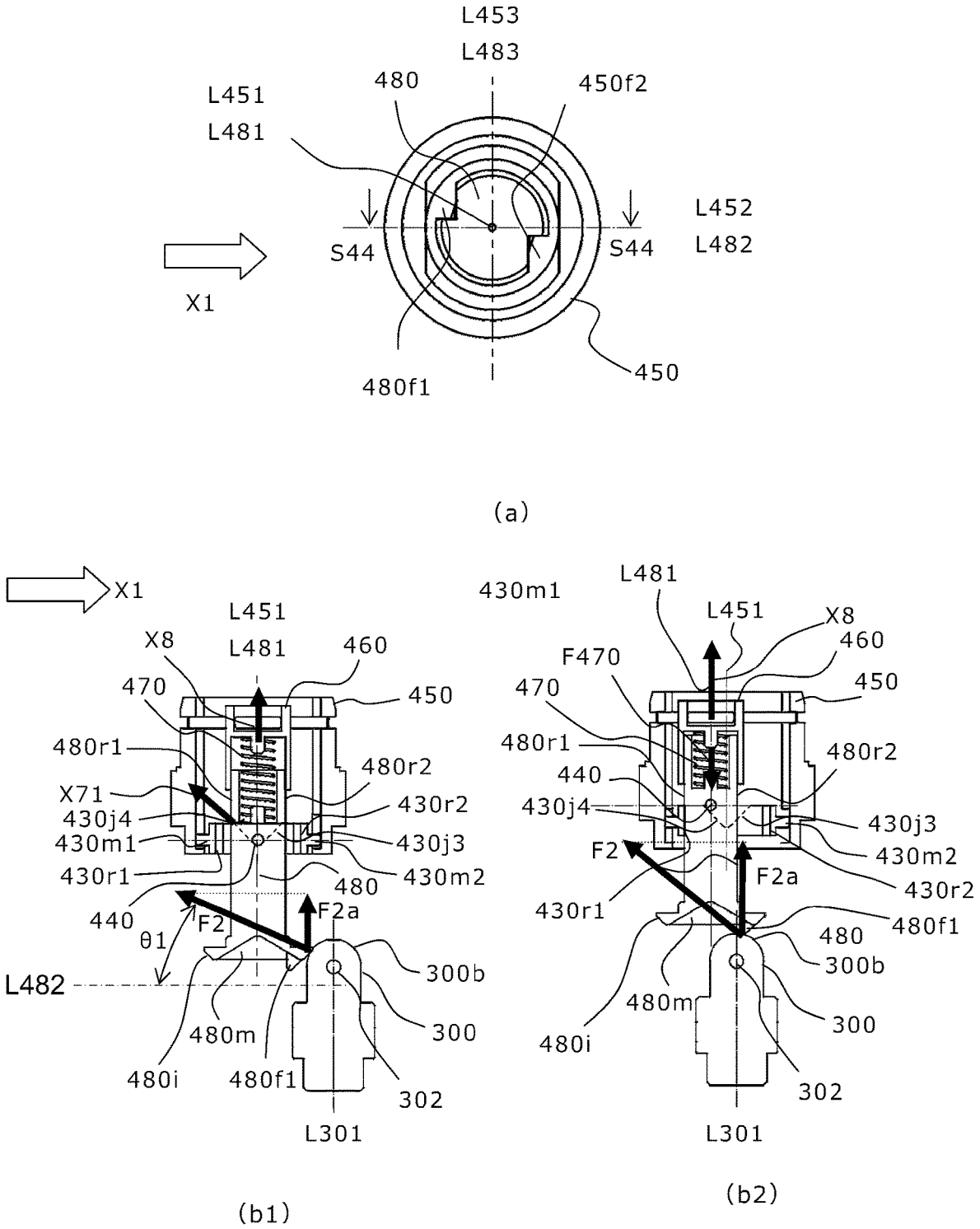
FIG. 96 is an illustration of an operation state at the time of engagement between the coupling member and the main assembly side engaging portion in the fourth embodiment of the present invention.

Referring to FIG. 94 to FIG. 96, the engaging operation of the coupling member 480 will be described. FIGS. 94 and 96 is a schematic sectional view showing the state in which the coupling member 480 engages with the main assembly side engaging portion 300. Part (a) of FIG. 94 and part (a) of FIG. 96 show the mounting direction and the lines along which a S43 sectional view and S44 sectional view are taken. Part (b1) of FIG. 94 through part (b4) of FIG. 94 are schematic sectional views taken along a line S43-S43 of part (a) of FIG. 94, in which the coupling member 480 moves to engage with the main assembly side engaging portion 300. Part (b1) of FIG. 96 and part (b2) of FIG. 96 are schematic sectional views taken along a line S44 of part (a) of FIG. 96, in which the coupling member 480 moves to engage with the main assembly side engaging portion 300. Part (a) of FIG. 95 and part (b) of FIG. 95 are enlarged views of the neighborhood of the driving side flange unit U42 shown in part (b1) of FIG. 94 and part (b2) of FIG. 94. In part (b) of FIG. 95 and part (b2) of FIG. 96, the transmission projection 480*f*2 in the initial state (which will be described hereinafter) of the mounting is depicted by broken lines. In the following, the description will be made as to the completion of the engagement between the main assembly side engaging portion 300 and the coupling member 480.

As shown in part (a) of FIG. 94, the description will be made as to the case that the axis L483 of the coupling member 480 and the mounting direction of the cartridge B (arrow X1) are parallel with each other.

As shown in part (b1) of FIG. 94 and part (a) of FIG. 95, at the time when the cartridge B starts to be mounted to the main assembly A of the apparatus, the transmission projections 480*f*1 and 480*f*2 of the coupling member 480 is most a projected relative to the driving side flange 450 by the urging force F470 of the urging member 470. This state is the initial state of the mounting. The position of the coupling member 480 in the state shown in part (b1) of FIG. 94 this is a first position (projected position). At this time, the rotational axis L481 of the coupling member 480 is substantially parallel with the rotational axis L1 of the photosensitive drum 10. More particularly, the rotational axis L481 and the rotational axis L1 are substantially aligned with each other. The rotational axis L481 of the coupling member 480 is substantially parallel with the axis L451 of the driving side flange 450. More particularly, the rotational axis L481 and the rotational axis L451 are substantially aligned with each other.

When the cartridge B is moved from the initial position of the mounting in the direction of the arrow X1, the main assembly contact portion 480*i* of the coupling member 480 contacts to the free end portion 300*b* of the main assembly driving shaft 300 provided in the main assembly A. Then, the main assembly contact portion 480*i* receives the force F1 from the free end portion 300*b* by the mounting movement. The force F1 is directed substantially toward the center of the substantially spherical surface constituting the main assembly contact portion 480*i*, and therefore, it is inclined by an angle θ7 which is smaller than a complementary angle θ31 of the angle θ3 relative to the axis L483. By the force F1, the cylindrical projection 430*m*1 of the intermediate slider 430 contacts to the second guide portion 450*j*1 of the driving side flange 450. The coupling unit U40 moves relative to the driving side flange 450 along the second guide portion 450*j*1 in the direction of the arrow X61.

As shown in part (b2) of FIG. 94 and part (b) of FIG. 95, the round body 430*c*1 of the intermediate slider 430 contacts a cylindrical inner wall portion 450*r*1 of the driving side flange 450 to limit the movement of the coupling unit U40 in the direction of the X61. At this time, in the direction of the axis L481, a movement distance of the coupling unit U40 from the initial state of the mounting is N20. The movement distance N20 is determined by the angle θ5 of the second guide portion 450*j*1—the second guide portion 450*j*4 relative to the axis L451 and the gap D20 (part (c) of FIG. 88).

In the state shown in part (b) of FIG. 95, the coupling unit U40 is distance from the position in the initial state of the mounting shown in part (b1) of FIG. 94 and part (a) of FIG. 95 in the direction of the arrow X8 by a movement distance N20. Then, the angle θ7 formed between the direction of the force F1 and the axis L483 increases as compared with that in the initial state of the mounting, because the force F1 is substantially directed to the center of the spherical surface constituting the main assembly contact portion 480*i*. With this, a component force F1*a* of the force F1 in the direction of the arrow X8 increases the as compared with that of the initial state of the mounting. By the component force F1*a*, the coupling member 480 moves further in the direction of the arrow X8 against the urging force F470 of the urging member 470. By the movement of the coupling member 480 in the direction of the arrow X8, the coupling member 480 is capable of passing by the free end portion 300*b* of the main assembly driving shaft 300. The position of the coupling member 480 shown in part (b2) of FIG. 94 is a second position (retracted position). At this time, the rotational axis L481 of the coupling member 480 is substantially parallel with the rotational axis L1 of the photosensitive drum 10. More specifically, there is a gap between the rotational axis L481 and the rotational axis L1 (the rotational axis L481 and the rotational axis L are substantially out of alignment). The rotational axis L481 of the coupling member 480 is substantially parallel with the axis L451 of the driving side flange 450. More specifically, at this time, there is a gap between the rotational axis L481 and the rotational axis L451 (the rotational axis L481 and the rotational axis L1 are substantially out of alignment). In this second position, the coupling member 480 is displaced (moved/retracted) toward the photosensitive drum 10 (toward the other end portion side of the photosensitive drum 10 in the longitudinal direction) from the position in the first position.

And, as shown in part (b3) of FIG. 94, when the cartridge B is moved to the complete mounted position, the axis L481 of the coupling member 480 and the axis L451 of the driving side flange 450 are aligned with each other, similarly to Embodiment 3. That is, the coupling member 480 and the main assembly driving shaft 300 are engaged with each other to enabled rotation of the coupling member 480. That is, at this time, the position of the coupling member 480 is substantially the same as the first position (projected position).

In summary, with the mounting of the cartridge B to the main assembly A of the apparatus, the rotational axis L481 of the coupling member 480 is aligned with the rotational axis L3 of the main assembly side engaging portion 300. In other words, with the mounting of the cartridge B to the main assembly A of the apparatus, the coupling member 480 receives the force from the main assembly side engaging portion 300, by which the coupling member 480 moves from the first position to the second position, and thereafter, it returns to the first position by the urging force F470 of the urging member 470. Father on the other words, with the mounting of the cartridge B to the main assembly A of the apparatus, the coupling member 480 receives the force from the main assembly side engaging portion 300 and the driving side flange 450, by which moves from the first position to the second position, and thereafter returns to the first position by the urging force F470 of the urging member 470.

Referring to FIG. 96, the description will be made as to the case that the axis L483 of the coupling member 480 is perpendicular to the mounting direction of the cartridge B (arrow X1).

When the cartridge B is moved in the direction of the arrow X1, the main assembly contact portion 480*i* of the coupling member 480 contacts to the free end portion 300*b* of the main assembly driving shaft 300 provided in the main assembly A of the apparatus, similarly to the above-described parallel case. This state is the initial state of the mounting. The position of the coupling member 480 in the state shown in part (b1) of FIG. 96 is a first position (projected position). At this time, the rotational axis L481 of the coupling member 480 is substantially parallel with the rotational axis L1 of the photosensitive drum 10. More particularly, the rotational axis L481 and the rotational axis L1 are substantially aligned with each other. The rotational axis L481 of the coupling member 480 is substantially parallel with the axis L451 of the driving side flange 450. More particularly, the rotational axis L481 and the rotational axis L451 are substantially aligned with each other. At this time, the main assembly contact portion 480*i* receives the force F2 from the free end portion 300*b* by the mounting of the cartridge B. Because the force F2 is directed to the center of the substantial spherical surface constituting the main assembly contact portion 480*i*, it is inclined relative to the axis L482 by an angle θ1. By the force F2, the first guide portion 430*j*4 of the intermediate slider 430 contacts to the guided pin 440. Then, the coupling member 480 moves relative to the intermediate slider 430 along the first guide portion 430*j*4 in the direction of the arrow X71.

As shown in part (b2) of FIG. 96, the cylindrical portion 480*r*1 of the coupling member 980 contacts the cylindrical inner wall portion 430*r*1 of the intermediate slider 430, so that the movement of the coupling member 480 in the direction of the X71 is prevented. At this time, in the direction of the axis L481, the movement distance of the coupling member 480 from the initial state is N30 (part (b2) of FIG. 96). The movement distance N30 is determined by the angle θ4 of the first guide portion 430*j*1—first guide portion 430*j*4 relative to the axis L431 and the gap D10 (part (c) of FIG. 87).

In the state shown in part (b2) of FIG. 96, the coupling member 480 is distant from the position in the initial state of the mounting in the direction of the arrow X8 by the movement distance N30. At this time, along the axis L381, a component force F2*a* of the force F2 is produced in the direction of the arrow X8. With the movement of the cartridge B in the direction of the mounting direction X1, the coupling member 480 further moves in the direction of the arrow X8 by the component force F2*a* against the urging force F470 of the urging member 470, so that the coupling member 480 can pass by the free end portion 300*b* of the main assembly driving shaft 300. The position of the coupling member 480 shown in part (b2) of FIG. 96 is a second position (retracted position). At this time, the rotational axis L481 of the coupling member 480 is substantially parallel with the rotational axis L1 of the photosensitive drum 10. More specifically, there is a gap between the rotational axis L481 and the rotational axis L1 (the rotational axis L481 and the rotational axis L1 are substantially out of alignment). The rotational axis L481 of the coupling member 480 is substantially parallel with the axis L451 of the driving side flange 450. More specifically, at this time, there is a gap between the rotational axis L481 and the rotational axis L451 (the rotational axis L481 and the rotational axis L1 are substantially out of alignment). In this second position, the coupling member 480 is displaced (moved/retracted) toward the photosensitive drum 10 (toward the other end portion side of the photosensitive drum 10 in the longitudinal direction) from the position in the first position.

Thereafter, through the steps similar to those shown in part (b3) of FIG. 94, the cartridge B can be moved to the complete mounted position.

As to the rotational force transmitting operation to the photosensitive drum in this embodiment, the description of the Embodiment 2 applies. That is, the coupling member 480 having received the rotational force transmits the rotational force to the intermediate slider 430 from the first rotational force transmitting portions 480*g*1, 480*g*2 through the first rotational force receiving portions 430*g*1, 430*g*2. The intermediate slider 430 transmits the rotational force to the driving side flange 450 from the second rotational force transmitting portions 430*k*1, 430*k*2 to the second rotational force receiving portions 450*g*1, 450*g*2. And, the rotational force is transmitted from the driving side flange 450 to the photosensitive drum unit U41.

Figure 97:
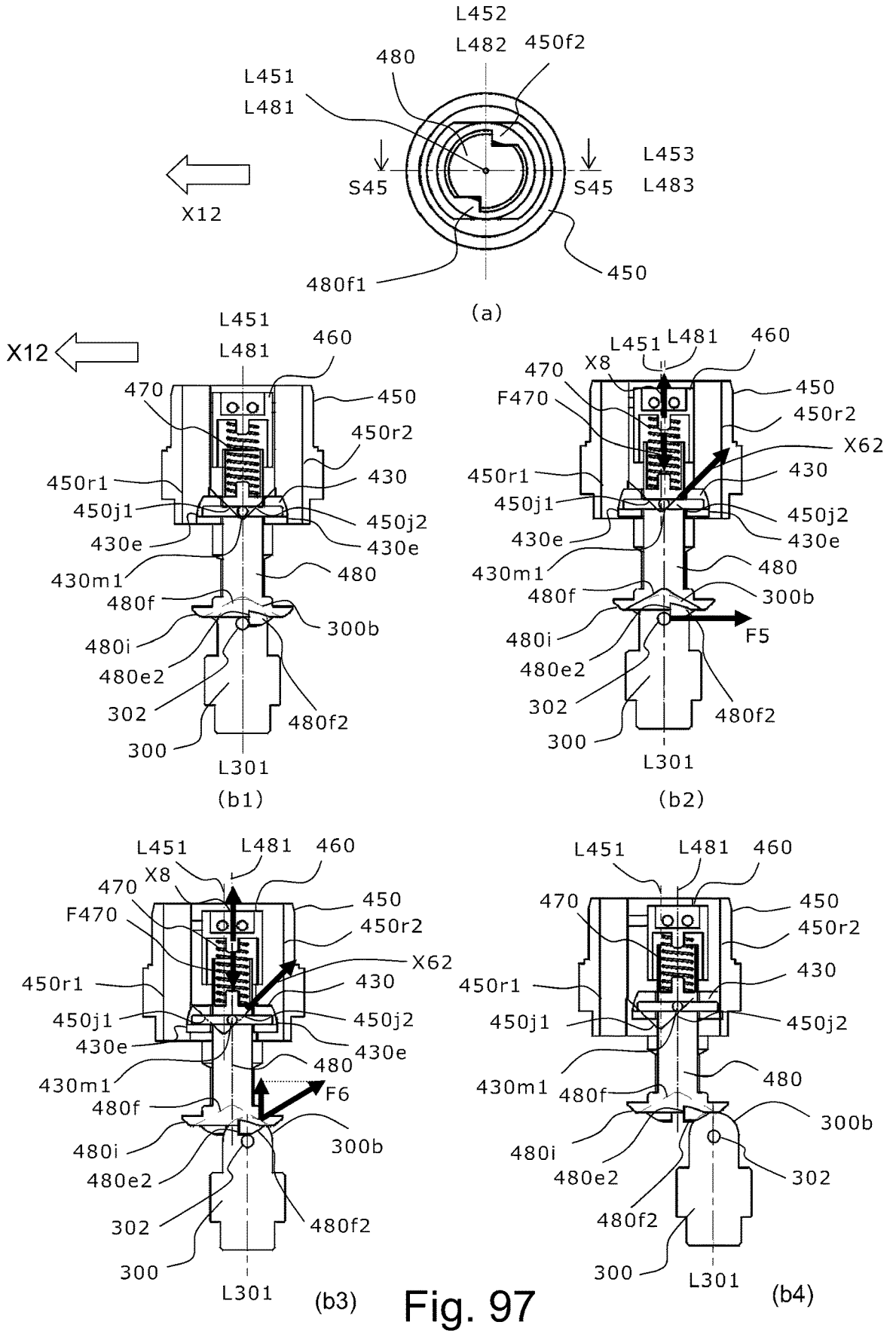
FIG. 97 is an illustration of an operation state at the time of disengagement between the coupling member and the main assembly side engaging portion in the fourth embodiment of the present invention.
Figure 98:
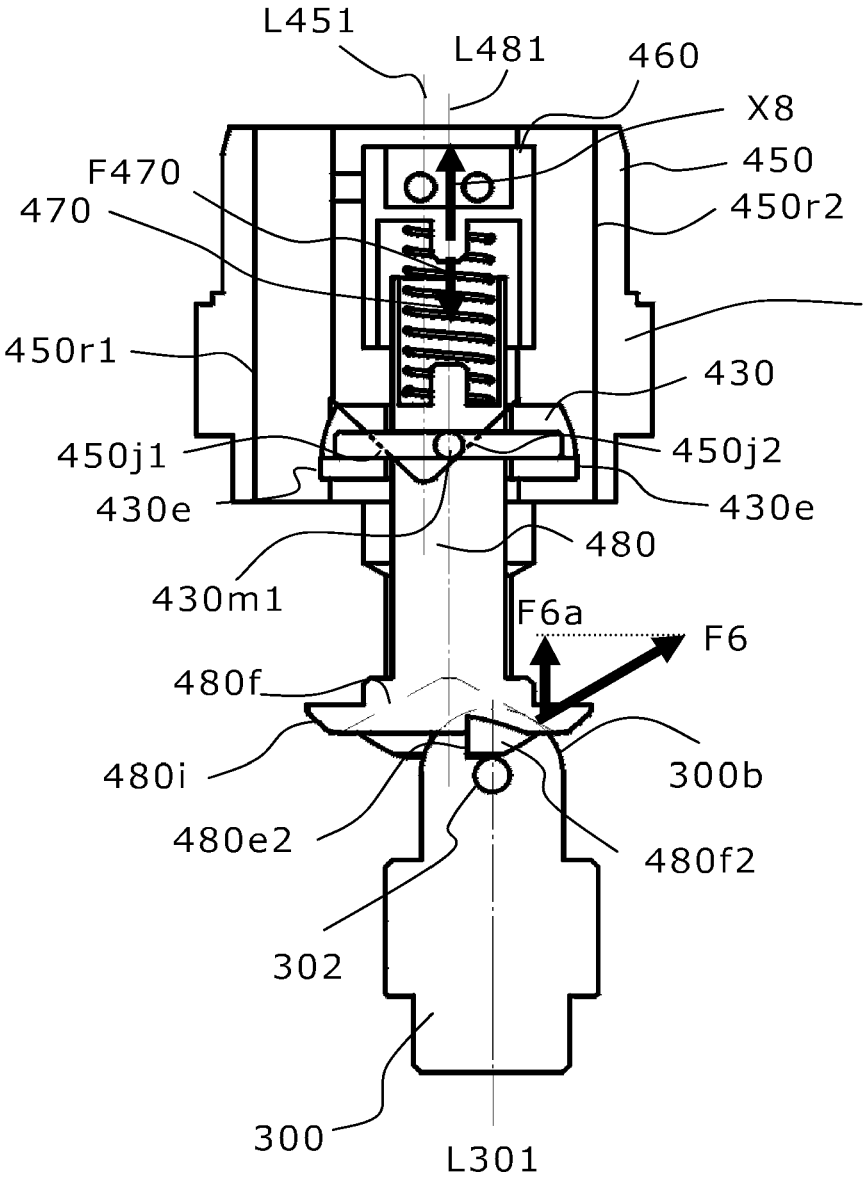
FIG. 98 is an illustration of an operation state at the time of disengagement between the coupling member and the main assembly side engaging portion in the fourth embodiment of the present invention.
Figure 99:
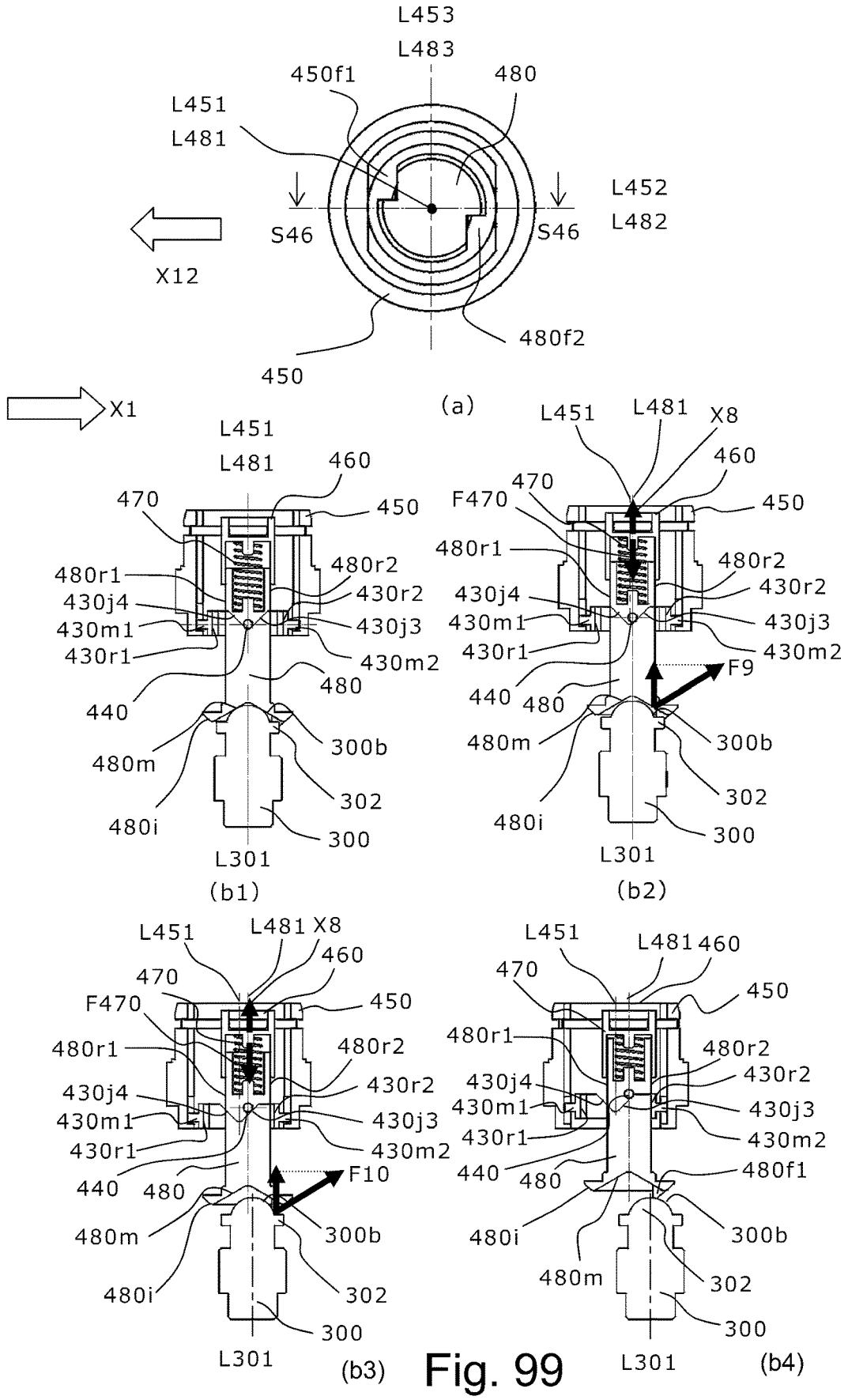
FIG. 99 is an illustration of an operation state at the time of disengagement between the coupling member and the main assembly side engaging portion in the fourth embodiment of the present invention.

Referring to FIG. 97 through FIG. 99, the description will be made as to the operation of disengaging the coupling member 480 from the main assembly side engaging portion 300 when the cartridge B is dismounted from the main assembly A of the apparatus.

Part (a) of FIG. 97 and part (a) of FIG. 99 shows the dismounting direction of the cartridge B and the lines along which the S45 sectional view and the S46 sectional view are shown. Parts (b1)-(b4) of FIG. 97 is a S45 section of part (a) of FIG. 97, and is a schematic sectional view illustrating the state of the coupling member 480 disengaging from the main assembly side engaging portion 300. Parts (b1)-(b4) of FIG. 99 is a S46 section of part (a) of FIG. 99, and is a schematic sectional view illustrating the state of the coupling member 480 disengaging from the main assembly side engaging portion 300. FIG. 98 is an enlarged view of the neighborhood of the driving side flange unit U42 of the part (b3) of FIG. 97. In the sectional view of FIG. 97-FIG. 99, the coupling unit U40 is not sectioned, for better illustration. In parts (b1)-(b4) of FIG. 97 and FIG. 98, the second guide portions 450*j*1 and 450*j*2 of the driving side flange 450 are depicted by broken lines. In parts (b1)-(b3) of FIG. 99, cylindrical inner wall portions 430*r*1 and 430*r*2 of the intermediate slider 430 are depicted by broken lines. The description will be made referring to the Figures showing the rotational force receiving portion 480*e*2 side.

First, as shown in FIG. 97, the description will be made as to the case that the dismounting direction of the cartridge B (arrow X12) and the axis L483 of the coupling member 480 are parallel with each other.

The position of the coupling member 480 in the state shown in part (b1) of FIG. 97 is the first position (enabled-rotational-force-transmission-position). The first position (enabled-rotational-force-transmission-position) is substantially the same as the first position (projected position). At this time, the rotational axis L481 of the coupling member 480 is substantially parallel with the rotational axis L1 of the photosensitive drum 10. More particularly, the rotational axis L481 and the rotational axis L1 are substantially aligned with each other. The rotational axis L481 of the coupling member 480 is substantially parallel with the axis L451 of the driving side flange 450. More particularly, the rotational axis L481 and the rotational axis L451 are substantially aligned with each other.

As shown in part (b1) of FIG. 97, the cartridge B is moved in the dismounting direction X12 which is substantially perpendicular to the rotational axis L1 of the photosensitive drum 410 and which is substantially perpendicular to the axis L451 of the driving side flange 450 to be dismounted from the main assembly A of the apparatus. In the state that the main assembly driving shaft 300 does not rotate after the completion of the image forming operation, the drive transmission pin 302 contacts the rotational force receiving portions 480*e*1, 480*e*2. The drive transmission pin 302 is located downstream of the rotational force receiving portion 480*e*2 with respect to the dismounting direction X12 of the cartridge B. At this time, the free end portion 300*b* of the main assembly driving shaft 300 contacts the driving bearing surface 480*f* of the coupling member 480. This is the initial state of the dismounting.

Then, when the cartridge B is moved in the direction of the dismounting direction X12, a rotational force receiving portion 480*e*2 in the upstream side with respect to the dismounting direction of the coupling member 480 receives the force F5 from the drive transmission pin 302 by the dismounting operation of the cartridge B, as shown in part (b2) of FIG. 97 The force F5 is perpendicular to the rotational force receiving portion 480*e*2, and therefore is parallel with the axis L483 which is perpendicular to the rotational force receiving portion 480*e*2. By the force F5, the cylindrical projection 430*m*1 of the intermediate slider 430 contact the second guide portion 450*j*2 of the driving side flange 450. The coupling unit U40 moves relative to the driving side flange 450 in the direction of the arrow X62 along the second guide portion 450*j*2.

At this time, the free end portion 300*b* of the main assembly driving shaft 300 is spaced from the driving bearing surface 480*f* of the coupling member 480.

Here, the rotational force receiving portion 480*e*2 (and rotational force receiving portion 480*e*1) is set such that the coupling member 480 can move in the direction of the axis L483 by the force F5. In this embodiment, the rotational force receiving portion 380*e*2 (and rotational force receiving portion 380*e*1) is the flat surface perpendicular to the axis L483, and therefore, the direction of the force F5 is parallel with the axis L483. Therefore, the user can move the cartridge B in the dismounting direction X12 with a small force, while moving the coupling member 480 in the axis L483 (and axis L481) relative to the driving side flange 450. By the movement of the coupling member 480 in the direction of the arrow X8 by the force F5, the transmission projection 480*f*2 is capable of passing by the drive transmission pin 302.

When the transmission projection 480*f*2 passes by the drive transmission pin 302, the free end portion 300*b* of the main assembly driving shaft 300 is brought into contact to the driving bearing surface 480*f* of the coupling member 480, again. When the cartridge B is moved to farther from this position in the direction of the dismounting direction X12, the coupling member 480 receives the force F6 from the free end portion 300*b* of the main assembly driving shaft 300, as shown in part (b3) of FIG. 97 and FIG. 98. The force F6 directed toward the center of the conical shape portion of the driving bearing surface 480*f*, and therefore, a component force F6*b* of the force F6 is produced in the direction of the axis L483. Therefore, the coupling member 480 moves in the direction of the arrow X62 while keeping contact between the portion-to-be-guided 480*j*2 and the guide portion 450*j*2 of the driving side flange 450 by the component force F6*b*, and the driving portion 480*b* contacts the cylindrical inner wall portion 450*r*2. By this, the movement of the coupling member 480 relative to the driving side flange 450 in the direction of the axis L483 is limited.

At this time, the component force F6*a* is produced along the arrow X8 in the direction of the axis L481. Therefore, when the cartridge B is moved further in the dismounting direction X12, the coupling member 480 is moved in the direction of the arrow X8 against the urging force F470 of the urging member 470 by the component force F6*a*. By this, as shown in part (b4) of FIG. 97, the free end portion 300*b* of the main assembly driving shaft 300 is disengaged from the opening 480*m* of the coupling member 480.

The position of the coupling member 480 in part (b4) of FIG. 97 is the second position (disengageable position). The second position (disengagement enabled position) is substantially the same as the above-described first position (retracted position). At this time, the rotational axis L481 of the coupling member 480 is substantially parallel with the rotational axis L1 of the photosensitive drum 10. More specifically, there is a gap between the rotational axis L481 and the rotational axis L1 (the rotational axis L481 and the rotational axis L1 are substantially out of alignment). The rotational axis L481 of the coupling member 480 is substantially parallel with the axis L451 of the driving side flange 450. More specifically, at this time, there is a gap between the rotational axis L481 and the rotational axis L451 (the rotational axis L481 and the rotational axis L1 are substantially out of alignment). In this second position, the coupling member 480 is displaced (moved/retracted) toward the photosensitive drum 10 (toward the other end portion side of the photosensitive drum 10 in the longitudinal direction) from the position in the first position.

In summary, with the dismounting of the cartridge B from the main assembly A of the apparatus, the coupling member 480 is disengaged from the main assembly side engaging portion 300. In other words, with the dismounting of the cartridge B from the main assembly A of the apparatus, the coupling member 480 receives the force from the main assembly side engaging portion 300, so that the coupling member 480 moves from the first position to the second position. Further in other words, with the dismounting of the cartridge B from the main assembly A of the apparatus, the coupling member 280 receives the force from the main assembly side engaging portion 300 and the driving side flange 450 to move from the first position (enabled-rotational-force-transmission-position) to the second position (disengagement enabled position).

Referring to part (a) of FIG. 99, the description will be made as to the case that the axis L483 of the coupling member 480 is perpendicular to the dismounting direction X12 of the cartridge B.

As shown in part (b1) of FIG. 99, in the state that the rotation of the main assembly driving shaft 300 has stopped after the completion of the image forming operation, the drive transmission pin 302 contacts the rotational force receiving portions 480*e*1 and 480*e*2. At this time, the free end portion 300*b* of the main assembly driving shaft 300 contacts the driving bearing surface 480*f* of the coupling member 480. This is the initial state of the dismounting. The position of the coupling member 480 shown in part (b1) of FIG. 99 is also the first position (enabled-rotational-force-transmission-position). At this time, the rotational axis L481 of the coupling member 480 is substantially parallel with the rotational axis L1 of the photosensitive drum 10. More particularly, the rotational axis L481 and the rotational axis L1 are substantially aligned with each other. The rotational axis L481 of the coupling member 480 is substantially parallel with the axis L451 of the driving side flange 450. More particularly, the rotational axis L481 and the rotational axis L451 are substantially aligned with each other.

The position of the intermediate slider 430 in part (b1) of FIG. 99 is a first middle position. At this time, a rotational axis L431 of the intermediate slider 430 is substantially parallel with the rotational axis L1 of the photosensitive drum 10. More particularly, the rotational axis L431 and the rotational axis L1 are substantially aligned with each other. In addition, the rotational axis L431 of the intermediate slider 430 is substantially parallel with the axis L451 of the driving side flange 450. More particularly, the rotational axis L431 and the rotational axis L451 are substantially aligned with each other.

When the cartridge B is moved in the direction of the dismounting direction X12, coupling member 480 moves in the direction of the dismounting direction X12 together with the driving side flange 450 and the intermediate slider 430. As shown in part (b2) of FIG. 99, the coupling member 480 receives the force F9 from the free end portion 300*b* of the main assembly driving shaft 300 by the dismounting operation of the cartridge B. By the force F9, the coupling member 480 moves relative to the intermediate slider 430 and the driving side flange 450 in the direction of the arrow X72 along the first guide portion 430*j*2 while the guided pin 440 keeps contact with the first guide portion 430*j*1 of the intermediate slider 430.

When the cartridge B is moved farther in the dismounting direction X12, the cylindrical portion 480*r*2 of the coupling member 480 is brought into contact to the cylindrical inner wall portion 430*r*2 of the intermediate slider 430, as shown in part (b3) of FIG. 99. By this, the movement of the coupling member 480 relative to the driving side flange 450 and the intermediate slider 430 in the direction of the arrow X72 is regulated. At this time, the coupling member 480 receives the force F10 from the free end portion 300*b* by the dismounting operation of the cartridge B. The force F10 is directed toward the center of the spherical surface of the free end portion 300*b*, and therefore, a component force F10*a* is produced along the arrow X8 in the direction of the axis L481. When the cartridge B is moved further in the dismounting direction X12, the coupling member 480 is further moved in the direction of the arrow X8 by the component force F10*a* against the urging force F470 of the urging member 470. As shown in part (b4) of FIG. 99, by the movement of the coupling member 480 in the direction of the arrow X8 by the component force F10*a*, the transmission projection 480*f*2 becomes capable of passing by the drive transmission pin 302. Thus, the free end portion 300*b* of the main assembly driving shaft 300 disengages from the opening 480*m* of the coupling member 480.

The position of the coupling member 480 shown in part (b4) of FIG. 99 is also the second position (disengagement enabled position). At this time, the rotational axis L481 of the coupling member 480 is substantially parallel with the rotational axis L1 of the photosensitive drum 10. More specifically, there is a gap between the rotational axis L481 and the rotational axis L1 (the rotational axis L481 and the rotational axis L1 are substantially out of alignment). The rotational axis L481 of the coupling member 480 is substantially parallel with the axis L451 of the driving side flange 450. More specifically, at this time, there is a gap between the rotational axis L481 and the rotational axis L451 (the rotational axis L481 and the rotational axis L1 are substantially out of alignment). In this second position, the coupling member 480 is displaced (moved/retracted) toward the photosensitive drum 10 (toward the other end portion side of the photosensitive drum 10 in the longitudinal direction) from the position in the first position.

The position of the intermediate slider 430 shown in part (b4) of FIG. 99 is a second middle position. At this time, a rotational axis L431 of the intermediate slider 430 is substantially parallel with the rotational axis L1 of the photosensitive drum 10. More specifically, there is a gap between the rotational axis L431 and the rotational axis L1 (the rotational axis L431 and the rotational axis L1 are substantially out of alignment). In addition, the rotational axis L431 of the intermediate slider 430 is substantially parallel with the axis L451 of the driving side flange 450. More specifically, at this time, there is a gap between the rotational axis L431 and the rotational axis L451 (the rotational axis L431 and the rotational axis L1 are substantially out of alignment). In the second position, the intermediate slider 430 is displaced (moved/retracted) toward the photosensitive drum 10 (toward the other end portion side of the photosensitive drum 10 with respect to the longitudinal direction), as compared with the first position.

In summary, with the dismounting of the cartridge B from the main assembly A of the apparatus, the coupling member 480 is disengaged from the main assembly side engaging portion 300. In other words, with the dismounting of the cartridge B from the main assembly A of the apparatus, the coupling member 480 receives the force from the main assembly side engaging portion 300, so that the coupling member 480 moves from the first position to the second position. Further in other words, with the dismounting of the cartridge B from the main assembly A of the apparatus, the coupling member 480 receives the force from the main assembly side engaging portion 300 and the driving side flange 450 to move from the first position (enabled-rotational-force-transmission-position) to the second position (disengagement enabled position).

In the foregoing, the description has been made as to the case in which the dismounting direction 12 of the cartridge B is parallel with the axis L483 of the coupling member 480, as an example. However, the coupling member 480 can be similarly removed from the main assembly side engaging portion 300 even when the dismounting direction is different from those described in the foregoing. In such a case, in the dismounting of the cartridge B, one of the transmission projections **480*f*1 and 480*f*2 contacts the drive transmission pin 302. Or, the free end portion 300*b* of the main assembly driving shaft 300 contacts the driving bearing surface 480*f* of the coupling member 480. In addition, one of the inner surface of the transmission projection 480*f*1 and the inner surface 480*f*4 of the transmission projection 480*f*2 contacts the free end portion 300*b* of the main assembly driving shaft 300. Then, the coupling member 280 receive any of force F5, F6 and force F9, F10 to move relative to the driving side flange 450 in the direction of the arrow X8, so that it can disengaged from the main assembly driving shaft 300**.

That is, the cartridge B can be dismounted from the main assembly A of the apparatus irrespective of the rotation of phases of the coupling member 480 and the main assembly side engaging portion 400 relative to the dismounting direction of the cartridge B from the main assembly A of the apparatus.

As described above, in this embodiment, the coupling member 480 is movable in any direction perpendicular to the axis L481 in addition to the operation in Embodiment 3. That is, the same advantageous effects as with Embodiment 3 are provided, and the design latitude for the configuration of the rotational force receiving portion are enhanced.

Other Embodiments

Figure 55:
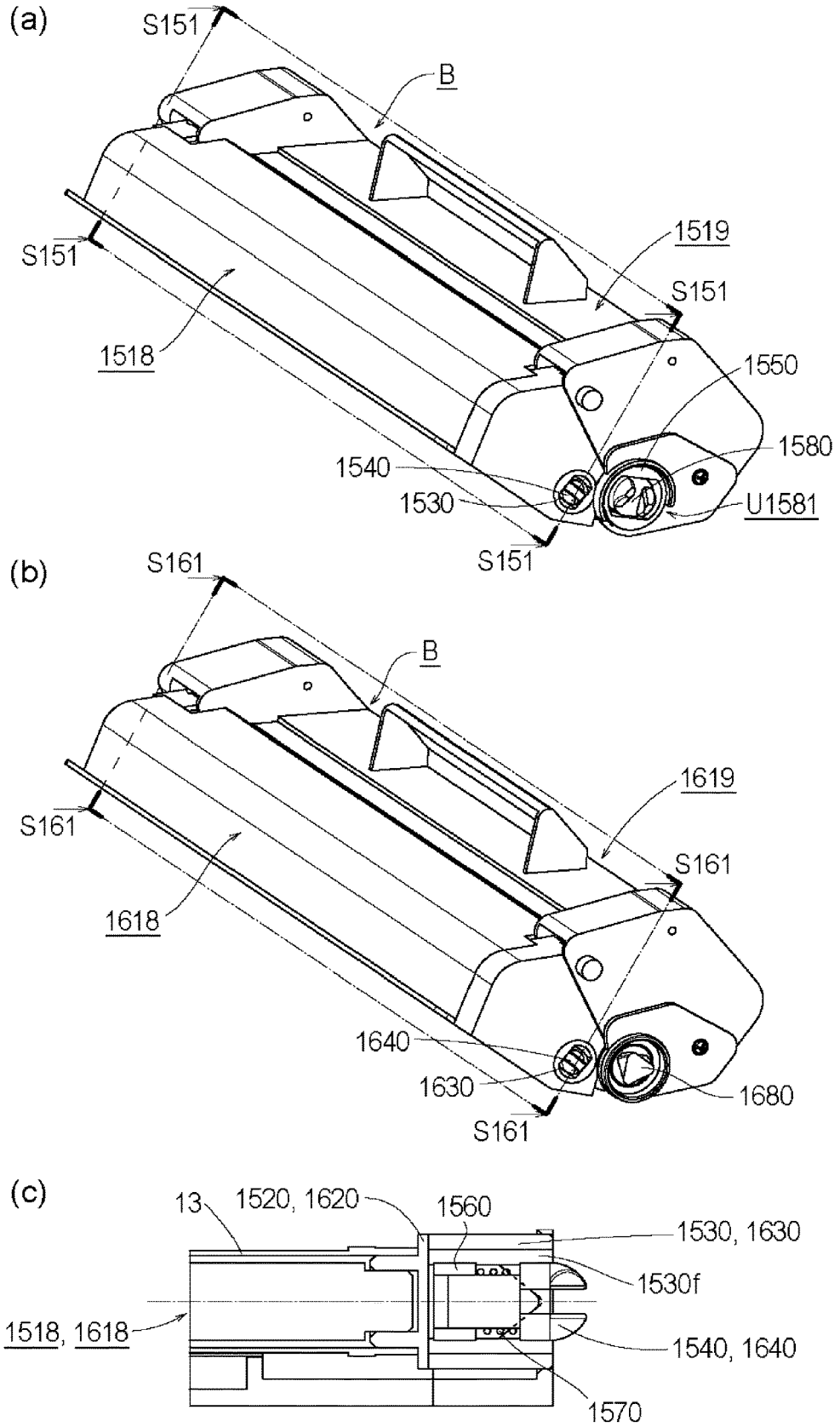
FIG. 55 is a schematic perspective view and a schematic sectional view of the process cartridge according to a further embodiment of the present invention.
Figure 56:
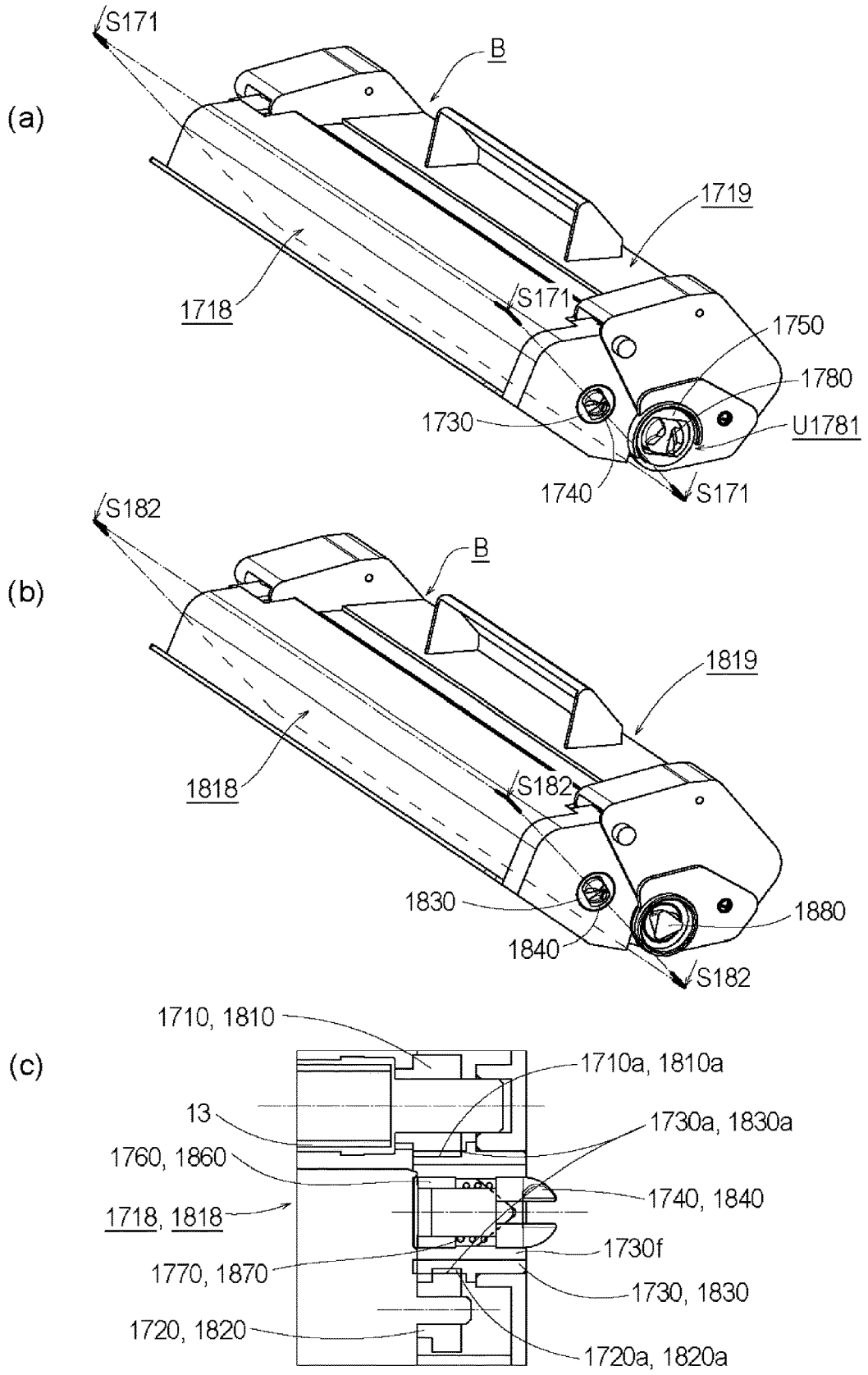
FIG. 56 is a schematic perspective view and a schematic sectional view of the process cartridge according to another embodiment of the present invention.

In the foregoing embodiments, the coupling member 180 is for transmitting the rotational force from the main assembly side engaging portion 100 to the photosensitive drum 10. However, the present invention is not limited to such a case. For example, referring to FIGS. 55 and 56, for the cartridge B including the photosensitive drum 10, the rotational force is transmitted from the main assembly A of the apparatus to a rotatable member other than the photosensitive drum 10. Part (a) of FIG. 55 and part (b) of FIG. 55 are schematic perspective view of the cartridge B including the first frame unit 1518 and the first frame unit 1618. Part (c) of FIG. 55 is a sectional view of the first frame unit 1518 and the first frame unit 1618 taken along a line S151 of part (a) of FIG. 55 and along a line S161 of part (b) of FIG. 55, respectively. Part (a) of FIG. 56 and part (b) of FIG. 56 are schematic perspective view of the cartridge B including the first frame unit 1718 and the first frame unit 1818. Part (c) of FIG. 56 is a schematic sectional view of the first frame unit 1718 and the first frame unit 1818 taken along a line S171 of part (a) of FIG. 56 and along aline S182 of part (b) of FIG. 56, respectively.

As shown in FIGS. 55, 56, a second frame unit 1519, a second frame unit 1619, a second frame unit 1719 and a second frame unit 1819 of the cartridge B include mechanisms for transmitting the driving force to the photosensitive drum (unshown). The mechanisms may be one of the driving side flange units U1581(U1781) similar to the first embodiment as shown in part (a) of FIG. 55 or as shown in part (a) of FIG. 56 and another drive transmitting portion 1680 (1880) different from the present invention, as shown in part (b) of FIG. 55 and part (b) of FIG. 56. The first frame unit 1518 and the second frame unit 1618 have the similar structures, and therefore, the description will be made only as to the first frame unit 1518. In addition, the first frame unit 1718 and the first frame unit 1818 have the similar structures, and therefore, the description will be made only as to the first frame unit 1718.

As shown in part (c) of FIG. 55, a driving side flange 1530 as a rotational force transmission member is provided coaxially with the rotational axis of the developing roller 13, as the structure for transmitting the rotational force to a minimum provided in the first frame unit 1518. The driving side flange 1530 is provided with a hollow portion **1530*f* similar to the above-described embodiments (Embodiments 1-4). In the hollow portion 1530*f*, there are provided a coupling member 1540, a slider 1560, an urging member 1570 and so on similarly to the first and second embodiments. The driving side flange 1530 transmits the rotational force to the developing roller 13 through the development flange 1520 integrally fixed on the developing roller 13**.

Here, the driving side flange 1530 may transmit the rotational force from the driving side flange 1530 to the development flange 1520 by engagement with the development flange 1520. Alternatively, the rotational force may be transmitted from the driving side flange 1530 to the development flange 1520 by connecting the driving side flange 1530 and the development flange 1520 using bonding, welding or the like. In such structures, the present invention can be suitably applied.

As shown in FIG. 56, a driving side flange 1730 as the rotational force transmission member may be provided at a position not coaxial with the rotational axis of the developing roller 13, and a coupling member 1740 or the like may be provided in the hollow portion **1730*f* of the driving side flange 1730. In such a case, a developing roller gear 1710 as another rotational force transmission member integrally rotatable with the developing roller 13 is provided coaxially with the rotational axis of the developing roller 13. By the engagement between a gear portion 1730*a* of the driving side flange 1730 and the gear portion 1710*a* of the developing roller gear 1710, the rotational force is transmitted to the developing roller 13. In addition, a rotatable member 1720 other than the developing roller 13 may be provided in the first frame unit 1718, and the rotational force may be transmitted to the rotatable member 1720 from the gear portion 1730*a* through a gear portion 1720*a* of the rotatable member 1720**. In such structures, the present invention can be suitably applied.

The cartridge B of the foregoing embodiments includes the photosensitive drum 10 and the plurality of process means. However, the present invention is not limited to such a case. The present invention is applicable to another type of cartridge B, that is, a process cartridge including the photosensitive drum 10 and at least one of process means, for example. Therefore, in addition to the above-described embodiments of the process cartridge, the present invention is applicable to a process cartridge including the photosensitive drum 10 and charging means as the process means which are unified into a cartridge. In another example, the process cartridge may include the photosensitive drum 10 and the charging means and cleaning means as the process means which are unified into a cartridge. In a further example, the process cartridge may include the photosensitive drum 10, developing means, charging means and cleaning means as the process means which are unified into a cartridge.

Figure 57:
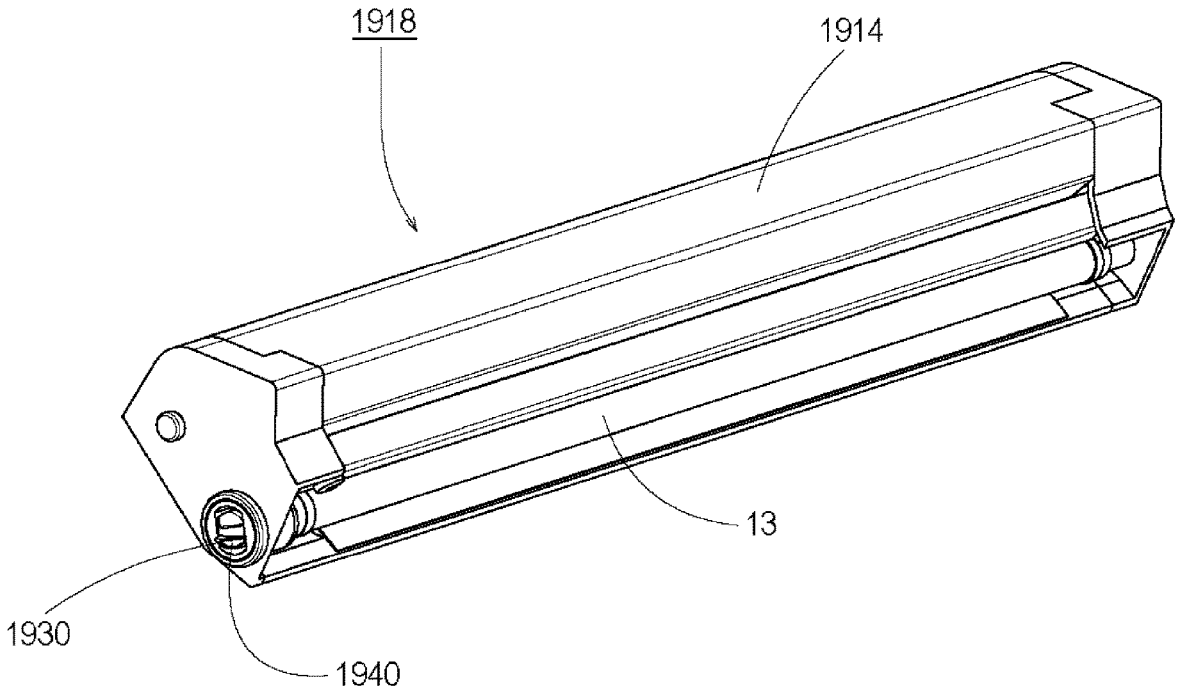
FIG. 57 is a schematic perspective view of the cartridge according to a further embodiment of the present invention.
Figure 57:
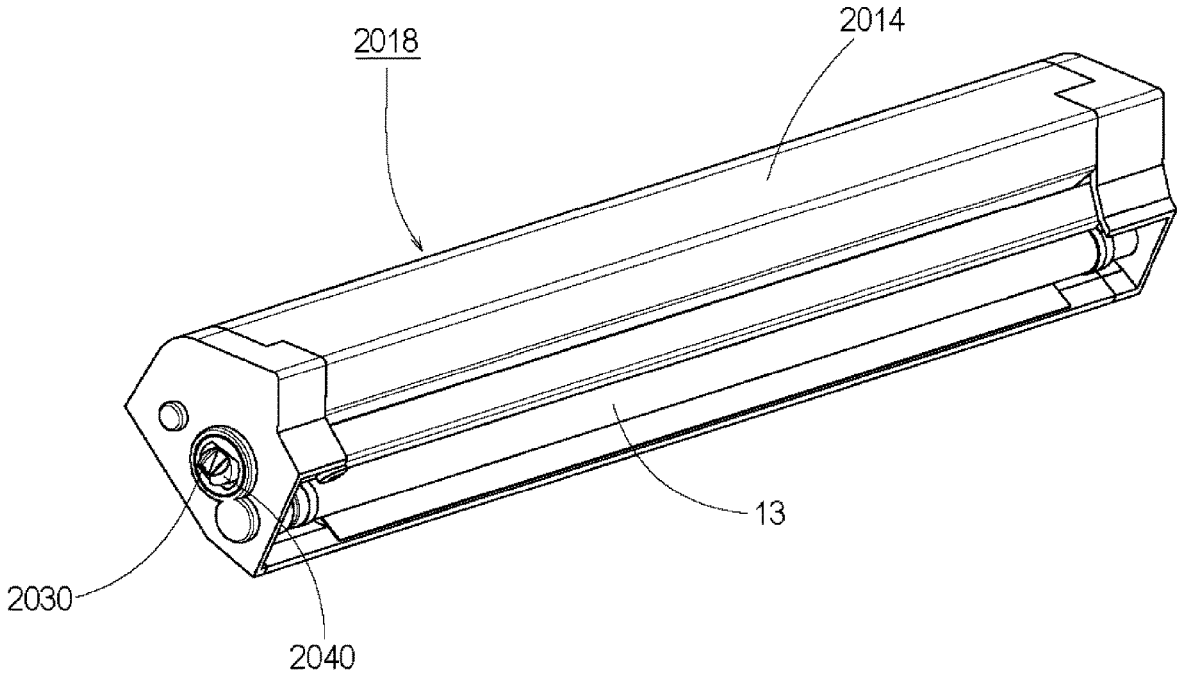

In the foregoing embodiments (Embodiments 1-4), the cartridge B includes the photosensitive drum 10. However, the present invention is not limited to such a case. In a further type of the cartridge B, as shown in FIG. 57, for example, the cartridge may not include the photosensitive drum but include the developing roller 13, to which the present invention is suitably applicable. In such a case, the proper selection will be made from the structure (part (a) of FIG. 57) in which the driving side flange 1930, the driving side flange 2030 and to the coupling member 1940, the coupling member 2040 are provided coaxially with the rotational axis of the developing roller 13 and the structure (part (b) of FIG. 57) in which they are not coaxial with the rotational axis of the developing roller 13.

The cartridge B in the foregoing embodiments is to form a monochromatic image. However, the present invention is not limited to such a case. The present invention is suitably applicable to a cartridge or cartridges including plural developing means to form multiple color image (for example, two-color image, three-color image or full-color or the like).

The mounting-and-dismounting path of the cartridge B relative to the main assembly A of the apparatus may be one line, a combination of lines, our curved line, to which case the present invention is suitably applicable.

As described in the foregoing, according to the present invention, the process cartridge can be mounted to the main assembly in a direction substantially perpendicular to the rotational axis of the photosensitive drum, the main assembly being not provided with a mechanism for moving the main assembly side engaging portion provided in the main assembly of the electrophotographic image forming apparatus to transmit the rotational force to the photosensitive drum, in the direction of the rotational axis of the photosensitive drum in interrelation with opening and closing operation of the main assembly cover of the main assembly.

In addition, according to the present invention, the process cartridge can be mounted to or dismounted from the main assembly in a direction substantially perpendicular to the rotational axis of the photosensitive drum, with reduced load necessitated by the rotations of the photosensitive drum and the main assembly side engaging portion, the main assembly being not provided with a mechanism for moving the main assembly side engaging portion provided in the main assembly of the electrophotographic image forming apparatus to transmit the rotational force to the photosensitive drum, in the direction of the rotational axis of the photosensitive drum in interrelation with opening and closing operation of the main assembly cover of the main assembly The present invention is applicable to a process cartridge, a photosensitive drum unit, a developing unit and an electrophotographic image forming apparatus.

INDUSTRIAL APPLICABILITY

According to the present invention, there are provided a cartridge and a photosensitive member unit which can be dismountable from (or mountable to) a main assembly of the image forming apparatus including a rotatable member such as an image bearing member, in a predetermined direction which is substantially perpendicular to the rotational axis of the rotatable member.

REFERENCE NUMERALS

A: main assembly (main assembly of the image forming apparatus)
B: cartridge (process cartridge)
10: photosensitive drum
100, 101, 201: main assembly side engaging portion
108: side plate
150, 250: driving side flange
160, 260: slider
170, 270: urging member
180, 181, 280, 281: coupling member
191, 192, 291, 292: retention pin
230: intermediate slider
240: guided pin
U1: photosensitive drum unit
U2, U22: driving side flange unit
U23: coupling unit

The invention claimed is:

1. A cartridge detachably mountable to a main assembly of an electrophotographic image forming apparatus, the cartridge comprising:

i) a rotatable member capable of carrying developer, the rotatable member being rotatable about a rotational axis thereof; and ii) a coupling member provided at one end portion of the cartridge with respect to a rotational axis direction of the rotatable member, the coupling member including at least one projection and being configured to transmit a rotational force to the rotatable member;

iii) a rotational force transmission member for transmitting the rotational force from the coupling member toward the rotatable member, the rotational force transmission member including a hollow portion;

iv) a holding member holding the coupling member; and v) two pins supporting the holding member, each of the two pins including a shaft portion elongated in a direction substantially perpendicular to the rotational axis of the rotatable member and the two pins being disposed substantially parallel to each other, wherein the coupling member is movable between a first position in which a rotational axis of the coupling member is substantially parallel to the rotational axis of the rotatable member, and a second position in which a tip of the projection of the coupling member is displaced from the first position at least in the direction of the rotational axis of the rotatable member toward the other end portion of the cartridge.

2. A cartridge according to claim 1, wherein the holding member includes holes in which the shaft portions of the two pins are inserted.

3. A cartridge according to claim 2, wherein the two pins support the holding member such that the coupling member is movable at least in a direction substantially perpendicular to the elongated direction of the shaft portions of the two pins relative to the rotational force transmission member.

4. A cartridge according to claim 3, wherein the two pins support the holding member such that the holding member is movable at least in a direction substantially perpendicular to the elongated direction relative to the rotational force transmission member.

5. A cartridge according to claim 1, wherein with movement of the coupling member from the first position to the second position, the coupling member moves toward the other end portion of the cartridge in the direction of the rotational axis of the rotatable member.

6. A cartridge according to claim 1, wherein the rotational force transmission member is provided at the one end portion of the cartridge with respect to the direction of the rotational axis of the rotatable member.

7. A cartridge according to according to claim 1, wherein the holding member holds the coupling member so as to be movable integrally with the holding member in the direction substantially perpendicular to the elongated direction.

8. A cartridge according to claim 7, wherein the coupling member is movable relative to the holding member substantially in the direction of the rotational axis of the rotational force transmission member.

9. A cartridge according to claim 1, further comprising an urging member urging the coupling member in the direction of the rotational axis of the rotatable member.

10. A cartridge according to claim 9, wherein the urging member includes an elastic member.

11. A cartridge according to claim 10, wherein the elastic member is a spring.

12. A cartridge according to claim 1, wherein the rotatable member is a photosensitive member capable of forming a latent image thereon.

13. A cartridge according to claim 12, wherein the rotational force transmission member is a flange mounted to the photosensitive member.

14. A cartridge according to claim 13, further comprising a developing roller for developing the latent image, wherein the flange is provided with a gear for transmitting the rotational force to the developing roller.

15. A cartridge according to claim 1, wherein the rotatable member is a developing roller.

16. A cartridge according to claim 15, wherein the rotational force transmission member is provided with a gear for transmitting the rotational force to the developing roller.

17. A cartridge according to claim 16, further comprising an additional rotational force transmission member mounted to the developing roller, wherein the rotational force is transmitted to the developing roller from the rotational force transmission member and the additional rotational force transmission member.

18. A cartridge according to according to claim 1, wherein the coupling member includes one end portion provided with the at least one projection, an opposite end portion, and a connecting portion connecting the one end portion and the opposite end portion to each other.

19. A cartridge according to according to claim 18, wherein a rotational force receiving portion for receiving the rotational force is provided on the at least one projection.

20. A cartridge according to claim 19, wherein a predetermined section of the connecting portion taken along a plane perpendicular to the rotational axis of the coupling member has a maximum radius that is less than a distance between the rotational force receiving portion and the rotational axis of the coupling member.

21. A cartridge according to claim 1, wherein the two pins are rotatable integrally with the coupling member.

22. A cartridge according to claim 1, wherein the rotational force transmission member includes a hollow portion in which a part of the coupling member is inserted, and wherein the coupling member moves between the first position and the second position with the part of the coupling member in the hollow portion.

23. A cartridge according to claim 1, wherein each of the two pins extend straight.

24. A cartridge detachably mountable to a main assembly of an electrophotographic image forming apparatus, the cartridge comprising:

i) a rotatable member capable of carrying developer, the rotatable member being rotatable about a rotational axis thereof; and ii) a coupling member provided at one end portion of the cartridge with respect to a rotational axis direction of the rotatable member, the coupling member including at least one projection and being configured to transmit a rotational force to the rotatable member;

iii) a rotational force transmission member for transmitting the rotational force from the coupling member toward the rotatable member, the rotational force transmission member including a hollow portion, iv) a holding member holding the coupling member; and v) two pins supporting the holding member, each of the two pins including a shaft portion elongated in a direction substantially perpendicular to the rotational axis of the rotatable member and the two pins being disposed substantially parallel to each other, wherein the coupling member is movable between a first position in which a rotational axis of the coupling member is substantially parallel to the rotational axis of the rotatable member, and a second position in which the coupling member is displaced from the first position in the direction of the rotational axis of the rotatable member toward an other end portion of the cartridge, and wherein, in the second position the rotational axis of the coupling member is substantially parallel to the rotational axis of the rotatable member and the coupling member is displaced from the first position in the direction substantially perpendicular to the rotational axis of the rotatable member.

25. A cartridge according to claim 24, wherein the holding member includes holes in which the shaft portions of the two pins are inserted.

26. A cartridge according to claim 25, wherein the two pins support the holding member such that the coupling member is movable at least in a direction substantially perpendicular to the elongated direction of the shaft portions of the two pins relative to the rotational force transmission member.

27. A cartridge according to claim 26, wherein the two pins support the holding member such that the holding member is movable at least in a direction substantially perpendicular to the elongated direction relative to the rotational force transmission member.

28. A cartridge according to claim 24, wherein the rotational force transmission member is provided at the one end portion of the cartridge with respect to the direction of the rotational axis of the rotatable member.

29. A cartridge according to according to claim 24, wherein the holding member holds the coupling member so as to be movable integrally with the holding member in the direction substantially perpendicular to the elongated direction.

30. A cartridge according to claim 29, wherein the coupling member is movable relative to the holding member substantially in the direction of the rotational axis of the rotational force transmission member.

31. A cartridge according to claim 29, further comprising an urging member urging the coupling member in the direction of the rotational axis of the rotatable member.

32. A cartridge according to claim 31, wherein the urging member includes an elastic member.

33. A cartridge according to claim 32, wherein the elastic member is a spring.

34. A cartridge according to claim 24, wherein the rotatable member is a photosensitive member capable of forming a latent image thereon.

35. A cartridge according to claim 34, wherein the rotational force transmission member is a flange mounted to the photosensitive member.

36. A cartridge according to claim 35, further comprising a developing roller for developing the latent image, wherein the flange is provided with a gear for transmitting the rotational force to the developing roller.

37. A cartridge according to claim 24, wherein the rotatable member is a developing roller.

38. A cartridge according to claim 37, wherein the rotational force transmission member is provided with a gear for transmitting the rotational force to the developing roller.

39. A cartridge according to claim 38, further comprising an additional rotational force transmission member mounted to the developing roller, wherein the rotational force is transmitted to the developing roller from the rotational force transmission member and the additional rotational force transmission member.

40. A cartridge according to according to claim 24, wherein the coupling member includes one end portion provided with the at least one projection, an opposite end portion, and a connecting portion connecting the one end portion and the opposite end portion to each other.

41. A cartridge according to according to claim 40, wherein a rotational force receiving portion for receiving the rotational force is provided on the at least one projection.

42. A cartridge according to claim 40, wherein a predetermined section of the connecting portion taken along a plane perpendicular to the rotational axis of the coupling member has a maximum radius that is less than a distance between the rotational force receiving portion and the rotational axis of the coupling member.

43. A cartridge according to claim 24, wherein the two pins are rotatable integrally with the coupling member.

44. A cartridge according to claim 24, wherein the rotational force transmission member includes a hollow portion in which a part of the coupling member is inserted, and wherein the coupling member moves between the first position and the second position with the part of the coupling member in the hollow portion.

45. A cartridge according to claim 24, wherein each of the two pins extend straight.

46. A cartridge detachably mountable to a main assembly of an electrophotographic image forming apparatus, the cartridge comprising:

i) a roller capable of carrying developer, the roller being rotatable about a rotational axis thereof; and ii) a coupling member provided at one end portion of the cartridge with respect to a rotational axis direction of the roller, the coupling member including at least one projection and being configured to transmit a rotational force to the roller;

iii) a gear for transmitting the rotational force from the coupling member toward the roller, the gear including a hollow portion;

iv) a holder holding the coupling member; and v) two pins supporting the holder, each of the two pins including a shaft portion elongated in a direction substantially perpendicular to the rotational axis of the roller and the two pins being disposed substantially parallel to each other, wherein the coupling member is movable between a first position in which a rotational axis of the coupling member is substantially parallel to the rotational axis of the roller, and a second position in which a tip of the projection of the coupling member is displaced from the first position at least in the direction of the rotational axis of the roller toward the other end portion of the cartridge.

47. A cartridge according to claim 46, wherein the holder includes holes in which the shaft portions of the two pins are inserted.

48. A cartridge according to claim 47, wherein the two pins support the holder such that the coupling member is movable at least in a direction substantially perpendicular to an elongated direction of the shaft portions of the two pins relative to the gear.

49. A cartridge according to claim 48, wherein the two pins support the holder such that the holder is movable at least in a direction substantially perpendicular to the elongated direction relative to the gear.

50. A cartridge according to claim 46, wherein with movement of the coupling member from the first position to the second position, the coupling member moves toward the other end portion of the cartridge in the direction of the rotational axis of the roller.

51. A cartridge according to claim 46, wherein the gear is provided at the one end portion of the cartridge with respect to the direction of the rotational axis of the roller.

52. A cartridge according to according to claim 46, wherein the holder holds the coupling member movable integrally with the holder in the direction substantially perpendicular to the elongated direction.

53. A cartridge according to claim 52, wherein the coupling member is movable relative to the holder substantially in the direction of the rotational axis of the gear.

54. A cartridge according to claim 46, further comprising an urging member urging the coupling member in the direction of the rotational axis of the roller.

55. A cartridge according to claim 54, wherein the urging member includes an elastic member.

56. A cartridge according to claim 55, wherein the elastic member is a spring.

57. A cartridge according to claim 46, wherein the roller is a photosensitive member capable of forming a latent image thereon.

58. A cartridge according to claim 57, wherein the gear is a flange mounted to the photosensitive member.

59. A cartridge according to claim 58, further comprising a developing roller for developing the latent image, wherein the gear transmits the rotational force to the developing roller.

60. A cartridge according to claim 46, wherein the roller is a developing roller.

61. A cartridge according to claim 60, further comprising an additional gear mounted to the developing roller, wherein the rotational force is transmitted to the developing roller from the gear to the additional gear.

62. A cartridge according to according to claim 46, wherein the coupling member includes one end portion provided with the at least one projection, an opposite end portion, and a connecting portion connecting the one end portion and the opposite end portion to each other.

63. A cartridge according to according to claim 62, wherein a rotational force receiving portion for receiving the rotational force is provided on the at least one projection.

64. A cartridge according to claim 62, wherein a predetermined section of the connecting portion taken along a plane perpendicular to the rotational axis of the coupling member has a maximum radius that is less than a distance between the rotational force receiving portion and the rotational axis of the coupling member.

65. A cartridge according to claim 46, wherein the two pins are rotatable integrally with the coupling member.

66. A cartridge according to claim 46, wherein the gear includes a hollow portion in which a part of the coupling member is inserted, and wherein the coupling member moves between the first position and the second position with the part of the coupling member in the hollow portion.

67. A cartridge according to claim 46, wherein each of the two pins extend straight.

68. A cartridge detachably mountable to a main assembly of an electrophotographic image forming apparatus, the cartridge comprising:

i) a roller capable of carrying developer, the roller being rotatable about a rotational axis thereof;

ii) a coupling member provided at one end portion of the cartridge with respect to a rotational axis direction of the roller, the coupling member including at least one projection and being configured to transmit a rotational force to the roller;

iii) a gear for transmitting the rotational force from the coupling member toward the roller, the gear including a hollow portion, iv) a holder holding the coupling member; and v) two pins supporting the holder, each of the two pins including a shaft portion elongated in a direction substantially perpendicular to the rotational axis of the roller and the two pins being disposed substantially parallel to each other, wherein the coupling member is movable between a first position in which a rotational axis of the coupling member is substantially parallel to the rotational axis of the roller, and a second position in which the coupling member is displaced from the first position in the direction of the rotational axis of the roller toward an other end portion of the cartridge, and wherein, in the second position, the rotational axis of the coupling member is substantially parallel to the rotational axis of the roller and the coupling member is displaced from the first position in the direction substantially perpendicular to the rotational axis of the roller.

69. A cartridge according to claim 68, wherein the holder includes holes in which the shaft portions of the two pins are inserted.

70. A cartridge according to claim 69, wherein the two pins support the holder such that the coupling member is movable at least in a direction substantially perpendicular to an elongated direction of the shaft portions of the two pins relative to the gear.

71. A cartridge according to claim 70, wherein the two pins support the holder such that the holder is movable at least in a direction substantially perpendicular to the elongated direction relative to the gear.

72. A cartridge according to claim 68, wherein the gear is provided at the one end portion of the cartridge with respect to the direction of the rotational axis of the roller.

73. A cartridge according to according to claim 68, wherein the holder holds the coupling member movable integrally with the holder in the direction substantially perpendicular to the elongated direction.

74. A cartridge according to claim 73, wherein the coupling member is movable relative to the holder substantially in the direction of the rotational axis of the gear.

75. A cartridge according to claim 68, further comprising an urging member urging the coupling member in the direction of the rotational axis of the roller.

76. A cartridge according to claim 75, wherein the urging member includes an elastic member.

77. A cartridge according to claim 76, wherein the elastic member is a spring.

78. A cartridge according to claim 68, wherein the roller is a photosensitive member capable of forming a latent image thereon.

79. A cartridge according to claim 78, wherein the gear is a flange mounted to the photosensitive member.

80. A cartridge according to claim 79, further comprising a developing roller for developing the latent image, wherein the gear transmits the rotational force to the developing roller.

81. A cartridge according to claim 68, wherein the roller is a developing roller.

82. A cartridge according to claim 81, further comprising an additional gear mounted to the developing roller, wherein the rotational force is transmitted to the developing roller from the gear and the additional gear.

83. A cartridge according to according to claim 68, wherein the coupling member includes one end portion provided with the at least one projection, an opposite end portion, and a connecting portion connecting the one end portion and the opposite end portion t each other.

84. A cartridge according to according to claim 83, wherein a rotational force receiving portion for receiving the rotational force is provided on the at least one projection.

85. A cartridge according to claim 83, wherein a predetermined section of the connecting portion taken along a plane perpendicular to the rotational axis of the coupling member has a maximum radius that is less than a distance between the rotational force receiving portion and the rotational axis of the coupling member.

86. A cartridge according to claim 68, wherein the two pins are rotatable integrally with the coupling member.

87. A cartridge according to claim 68, wherein the gear includes a hollow portion in which a part of the coupling member is inserted, and wherein the coupling member moves between the first position and the second position with the part of the coupling member in the hollow portion.

88. A cartridge according to claim 68, wherein each of the two pins extend straight.

* * * * *